US008914296B2

(12) United States Patent
Fuchs et al.

(10) Patent No.: US 8,914,296 B2
(45) Date of Patent: Dec. 16, 2014

(54) AUDIO ENCODER, AUDIO DECODER, METHOD FOR ENCODING AND AUDIO INFORMATION, METHOD FOR DECODING AN AUDIO INFORMATION AND COMPUTER PROGRAM USING AN OPTIMIZED HASH TABLE

(71) Applicant: Fraunhofer-Gesellschaft zur Foerderung der angewandten Forschung e.V., Munich (DE)

(72) Inventors: Guillaume Fuchs, Erlangen (DE); Vignesh Subbaraman, Germering (DE); Markus Multrus, Nuremberg (DE); Nikolaus Rettelbach, Nuremberg (DE); Matthias Hildenbrand, Erlangen (DE); Oliver Weiss, Nuremberg (DE); Arthur Tritthart, Erlangen (DE); Patrick Warmbold, Emskirchen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 13/744,772

(22) Filed: Jan. 18, 2013

(65) Prior Publication Data

US 2013/0226594 A1 Aug. 29, 2013

Related U.S. Application Data

(63) Continuation of application No. PCT/EP2011/062478, filed on Jul. 20, 2011.

(60) Provisional application No. 61/365,936, filed on Jul. 20, 2010.

(51) Int. Cl.

| | |
|---|---|
| ***G10L 19/00*** | (2013.01) |
| ***G10L 21/04*** | (2013.01) |
| ***G10L 19/008*** | (2013.01) |
| *G10L 19/02* | (2013.01) |

(52) U.S. Cl.

CPC ..... *G10L 19/008* (2013.01); *G10L 19/02* (2013.01); *G10L 19/0017* (2013.01)

USPC ..... 704/500; 704/503

(58) Field of Classification Search

CPC ... G10L 19/0017; G10L 19/02; G10L 19/022; G10L 19/0204; G10L 19/028; H03M 7/40; H03M 7/4006; H03M 7/42

USPC ..... 704/500–504

See application file for complete search history.

(56) References Cited

U.S. PATENT DOCUMENTS

| | | | | |
|---|---|---|---|---|
| 7,088,269 | B2 * | 8/2006 | Kadono et al. | 341/67 |
| 2010/0324912 | A1 * | 12/2010 | Choo et al. | 704/500 |

(Continued)

FOREIGN PATENT DOCUMENTS

| | | |
|---|---|---|
| JP | 2011-527443 | 10/2011 |
| JP | 2012-505423 | 3/2012 |

OTHER PUBLICATIONS

"ISO 14496 Part 3 Subpart 4", ISO/IEC., 2005, 334 Pages.

Meine, et al., "Improved Quantization and Lossless Coding for Subband Audio Coding", 118th AES Convention, vol. 1-4, XP040507276, May 2005, pp. 1-9., May 31, 2005, 1-9.

Neuendorf, M et al., "A Novel Scheme for Low Bitrate Unified Speech and Audio Coding—MPEG RM0", Presented at the 126th AES Convention. Munich, Germany. May 7-10, 2009, 1-14.

(Continued)

*Primary Examiner* — Samuel G Neway

(74) *Attorney, Agent, or Firm* — Michael A. Glenn; Perkins Coie LLP

(57) ABSTRACT

An audio decoder includes an arithmetic decoder for providing decoded spectral values on the basis of an arithmetically encoded representation thereof, and a frequency-domain-to-time-domain converter for providing a time-domain audio representation. The arithmetic decoder selects a mapping rule describing a mapping of a code value onto a symbol code representing a spectral value, or a most significant bit-plane thereof, in a decoded form, in dependence on a context state described by a numeric current context value. The arithmetic decoder determines the numeric current context value in dependence on a plurality of previously decoded spectral values. It evaluates a hash table, entries of which define both significant state values amongst the numeric context values and boundaries of intervals of numeric context values, in order to select the mapping rule, wherein the hash table ari_hash_m is defined as given in FIGS. 22(1), 22(2), 22(3) and 22(4).

20 Claims, 85 Drawing Sheets

AUDIO DECODER

(56) References Cited

U.S. PATENT DOCUMENTS

| | | | | |
|---|---|---|---|---|
| 2011/0173007 | A1* | 7/2011 | Multrus et al. | 704/500 |
| 2011/0238426 | A1* | 9/2011 | Fuchs et al. | 704/500 |
| 2012/0265540 | A1* | 10/2012 | Fuchs et al. | 704/500 |
| 2013/0096930 | A1 | 4/2013 | Neuendorf et al. | |

OTHER PUBLICATIONS

"MPEG Unified Speech and Audio Coding Enabling Efficient Coding of both Speech and Music", NTT DOCOMO Technical Journal, Oct. 2011, vol. 19; No. 3; pp. 18-23.

* cited by examiner

AUDIO ENCODER

AUDIO ENCODER

AUDIO DECODER

AUDIO DECODER

```
values_decode()
{
310 ──► c = arith_map_context(N, arith_reset_flag);

    for (i=0; i<lg/2; i++) {
        /* MSB decoding */
312a    c = arith_get_context (c,i,N);
        for (lev=esc_nb=0;;) {
            pki = arith_get_pk(c+esc_nb<<17)

            cum_freq = table_start_position (pki);
            cfl = table_lengh (pki);
            m = arith_decode ();                    use between
                                                    1 and 20 bits
                                                    of bits acod_m
            if ( m != ARITH_ESCAPE)
                break;
            lev += 1;
            if ( (esc_nb=lev)>7 )
                esc_nb=7;
        }
312bb   b = m>>2
        a = m-(b<<2)

312c    /* ARITH_STOP symbol detection */
        if (m==0 && lev>0)
            break;

        /* LSB decoding */
        for (l=lev; l>0; l--) {
            cum_freq = arith_cf_r;
            cfl = 4i
            r = arith_decode ();
            a=(a<<1)|(r&1);
            b=(b<<1)|((r>>1)&1);
        }
        x_ac_dec[2*i] = a;
        x_ac_dec[2*i+1] = b;
        arith_update_context(i,a,b);
    }
315 ──► arith_finish (x_ac_dec,i,N);

    /* Signs decoding */
    for (i=0; i<lg; i++) {
        if (x_ac_dec[i] != 0) {
            s = read_bitstream;
            if (s==1) {x_ac_dec[i] *= -1; }
        }
    }
}
```

312 = 312a, 312b, 312c, 312d, 312e, 313, 314

312b = 312ba, 312bb

312d = 312da

FIG 3

CONTEXT FOR THE STATE CALCULATION

```
/*Input variables*/
N /*Length of the current window*/
arith_reset_flag /*Arithmetic coder reset flag*/

/*Global variables*/
previous_N /*Length of the previous window */

c = arith_map_context(N,arith_reset_flag)
{
    if (arith_reset_flag) {
500a    for (j=0; j<N/4; j++) {
            q[0][j]=0;
        }
    } else {
500b    ratio = ((float)previous_N) / ((float)N);
        for (j=0; j<N/4; j++) {
            k = (int) ((float) j * ratio);
            q[0][j] = q[1][k];
        }
    }

    previous_N=N;

    return(q[0][0]<<12);
}
```

FIG 5A

```
/*Input variables*/
lg /*Number of sepctral coefficients to decode in the frame*/
arith_reset_flag /*Arithmetic coder reset flag*/
/*Global variables*/
previous_lg /*Previous number of spectral lines of the previous frame*/

c=arith_map_context (lg,arith_reset_flag)
{
    v=w=0

    if(arith_reset_flag){
        for(j=0; j<lg/2; j++){
            q[0][v++]=0;
        }
    else{
        ratio= ((float)previous_lg)/((float)lg);
        for(j=0; j<lg/2; j++){
            k = (int) ((float)) ((j)*ratio);
            q[0][v++] = qs[w+k];
        }
    }

    previous_lg=lg;

    return(q[0][0]<<12);
}
```

FIG 5B

504

```
/*Input variables*/
c /*old state context*/
i /*Index of the 2-tuple to decode in the vector*/
N /*Window Length*/

/*Output value*/
c /*updated state context*/

c = arith_get_context(c,i,N)
{
504a    c = c>>4;
        if(i<N/4-1)
504b        c = c + (q[0][i+1]<<12);
504c    c = (c&0xFFF0);

        if(i>0)
504d        c = c + (q[1][i-1]);

        if (i > 3) {
            if ((q[1][i-3] + q[1][i-2] + q[1][i-1]) < 5)
504e            return(c+0x10000);
        }

504f    return (c);
}
```

FIG 5C

```
/*Input variables*/
c /*old state context*/
i /*Index of the 2-tuple to decode in the vector*/
/*Output value*/
c /*updated state context*/


c=arith_get_context(c,i)
{
    c=c>>4;
    c=(c)+(q[0][i+1]<<12);
    c=(c&0xFFF0)+(q[1][i-1]);

    if(i > 3) {
        if((q[1][i-3] + q[1][i-2] + q[1][i-1]) < 5)
            return(c+0x10000);
    }

    return(c);
}
```

FIG 5D

```
/*Input variable*/
c /*State of the context*/

/*Output value*/
pki /*Index of the probability model */

pki = arith_get_pk(c)
{
    i_min = -1;
    i = i_min;
    i_max = (sizeof(ari_lookup_m) /sizeof(ari_lookup_m[0]))-1;
    while ((i_max-i_min)>1) {
        i = i_min+((i_max-i_min) /2);
        j = ari_hash_m[i];
        if (c<(j>>8))
            i_max = i;
        else if (c>(j>>8))
            i_min=i;
        else
            return(j&0xFF);
    }
    return ari_lookup_m[i_max];
}
```

506a

506b

506ba

506c

FIG 5E

```
/*Input variable*/
c /*State of the context*/
/*Output value*/
pki /*Index of the probability model */
/*constants*/
i_diff[]={ 299, 149, 74, 37, 18, 9, 4, 2, 1};

pki=arith_get_pk(c) {
    i_min=0;
508a    s=c<<8;
    for(k=0;k<9;k++) {
        i=i_min+i_diff[k];
        j=ari_hash_m[i];
508b 508ba  if(s>j) {
            i_min=i+1;
        }
    }

    j=ari_hash_m[i_min];
    if(s>j)
        return(ari_lookup_m[i_min+1]);
508c    else if(c<(j>>8))
        return(ari_lookup_m[i_min]);
    else
        return(j&0xFF);
}
```

FIG 5F

```
/*helper functions*/
bool arith_first_symbol(void);
    /* Return TRUE if it is the first symbol of the sequence,
        FALSE otherwise */
Ushort arith_get_next_bit(void);
    /* Get the next bit of the bitstream */

/* global variables */
low
high
value

/* input variables */
cum_freq[]; /* cumulative frequencies table */
cfl; /* length of cum_freq[] */

symbol = arith_decode(cum_freq, cfl)
{
    if (arith_first_symbol()) {
        value = 0;
        for (i=1; i<=16; i++) {
            value = (value<<1) | arith_get_next_bit();
        }
        low  = 0;
        high  = 65535;
    }

    range = high-low+1;
    cum =((((int) (value-low+1))<<14)-((int) 1))/range;
    p = cum_freq-1;
```

570a

570b

FIG 5G(1)

| FIG 5G(1) | FIG 5G |
|---|---|
| FIG 5G(2) | |

```
570c  do {
          q = p + (cfl>>1);
          if ( *q > cum ) {p=q; cfl++; }
          cfl>>=1;
      }
      while ( cfl>1 );

570d  symbol = p-cum_freq+1;
      if (symbol)
570e      high = low + (range*cum_freq[symbol-1])>>14 - 1;

          low += (range * cum_freq[symbol])>>14;

570f  for (;;) {
570fa     if (high<32768) {}
          else if (low>=32768) {
              value -= 32768;
              low  -= 32768;
              high  -= 32768;
          }
          else if (low>=16384 && high<49152) {
              value -= 16384;
              low  -= 16384;
              high  -= 16384;
          }
          else break;

570fb     low += low;
          high += high+1;
          value = (value<<1) | arith_get_next_bit();
      }
      return symbol;
  }
```

FIG 5G(2)

| FIG 5G(1) | FIG 5G |
|---|---|
| FIG 5G(2) | |

```
/*helper functions*/
bool arith_first_symbol(void);
    /* Return TRUE if it is the first symbol of the sequence,
    FALSE otherwise */
Ushort arith_get_next_bit(void);
    /* Get the next bit of the bitstream */

/* global variables */
low
high
value

/* input variables */
cum_freq[]; /* cumulative frequencies table */
cfl; /* length of cum_freq[] */

symbol = arith_decode(cum_freq, cfl)
{
    if (arith_first_symbol()) {
        value = 0;
        for (i=1; i<=16; i++) {
            value = (val<<1) | arith_get_next_bit();
        }
        low  = 0;
        high  = 65535;
    }

    range = high-low+1;
    cum =((((int) (value-low+1))<<14)-((int) 1));
    p = cum_freq-1;

    do {
        q = p + (cfl>>1);
        if ( *q *range > cum ) {p=q; cfl++; }
        cfl>>=1;
    }
```

<CONTINUED IN FIG 5I>

FIG 5H

<CONTINUATION FROM FIG 5H>

```
    while ( cfl>1 );

    symbol = p-cum_freq+1;
    if (symbol)
        high = low + (range*cum_freq[symbol-1])>>14 - 1;

    low += (range * cum_freq[symbol])>>14;

    for (;;) {
        if (high<32768) {}
        else if (low>=32768) {
            value -= 32768;
            low   -= 32768;
            high  -= 32768;
        }
        else if (low>=16384 && high<49152) {
            value -= 16384;
            low   -= 16384;
            high  -= 16384;
        }
        else break;

        low += low;
        high += high+1;
        value = (value<<1) | arith_get_next_bit();
    }
    return symbol;
}
```

FIG 5I

```
b = m>>2;
a = m-(b<<2);
for (j=0;j<lev;j++) {
    r = arith_decode(arith_cf_r,4);
    a = (a<<1) | (r&1);
    b = (b<<1) | ((r>>1)&1);
}
```

FIG 5J

```
x_ac_dec[2*i]   = a
x_ac_dec[2*i+1] = b;
```

FIG 5K

```
/*input variables*/
a,b /* Decoded unsigned quantized spectralcoefficients of the 2-tuple */
i /* Index of the quantized spectral coefficient to decode */

arith_update_context(i, a, b)
{
    q[1][i] = a+b+1;
    if (q[1][i]>0xF)
        q[1][i] = 0xF;
}
```

FIG 5L

FIG 5M

```
/*input variables*/
offset /*number of decoded 2-tuple */
N /*Window length */
x_ac_dec  /*vector of decoded spectal coefficients*/

arith_finish(x_ac_dec,offset,N)
{
    for(i=offset ;i<N/4;i++) {
        x_ac_dec[2*i] = 0;
        x_ac_dec[2*i+1] = 0;
        q[1][i] = 1;
    }
}
```

FIG 5N

```
b= m>>2
a = m&0x03;
for(j=0;j<lev;j++){
    r = arith_decode(arith_cf_r,4);
    a = (a<<1) | (r&1);
    b = (b<<1) |((r>>1)&1);

}
```

FIG 5O

```
/*input variables*/
a,b /*Decoded unsigned quantized spectralcoefficients of the 2-tuple*/
i /*Index of the quantized spectral coefficient to decode*/

arith_update_context (){
    qdec[2*i]=a
    qdec[2*i+1]=b;
    q[1][i]=a+b+1;

    if(q[1][i]>0xF)
        q[1][i]=0xF;
}
```

```
/*input variables*/
i /*Index of the quantized spectral coefficient to decode*/
lg /*number of coefficients in the frame*/

arith_save_context(i,lg){

    for(;i<N/4;i++){
        qdec[2*i]=0;
        qdec[2*i+1]=0;
        q[1][i]=1;
    }

    if(core_mode==1){
        ratio= ((float) lg)/((float)1024);
        for(j=0; j<512; j++){
            k = (int) ((float) j*ratio);
            qs[j] = q[1][k];
        }
        previous_lg = 512;
    }
    else{
        for(j=0; j<512; j++){
            qs[j] = q[1][j];
        }
        previous_lg = MIN(1024,lg);
    }
}
```

FIG 5P

Definitions

| | |
|---|---|
| a,b | 2-tuple to decode (2-tuple quantized coefficient to decode) |
| m | The most significant 2-bits wise plane of the quantized spectral coefficient to decode. |
| r | The least significant bit planes of the quantized spectral coefficient to decode. |
| lev | Level of the remaining bit-planes. It corresponds to the number of less significant bit planes. |
| arith_hash_m[] | Hash table mapping context states to a cumulative frequencies table index pki. |
| arith_lookup_m[] | Look-up table mapping group of context states to a cumulative frequencies table index pki. |
| arith_cf_m[pki][17] | Models of the cumulative frequencies for the most significant 2-bits wise plane m and the ARITH_ESCAPE symbol. |
| arith_cf_r [] | Cumulative frequencies for the least significant bit-planes symbol r. |
| arith_cf_r [] | Cumulative frequencies for the least significant bit-planes symbol r |
| q[2][] | 2-tuple context elements of the previous and current frame. |
| x_ac_dec[] | The decoded quantized spectral coefficients. |
| arith_reset_flag | Flag which indicates if the spectral noiseless context must be reset. |
| ARITH_STOP | Stop symbol consisting of the succession of ARITH_ESCAPE symbol and m=0. When it occurs, the rest of the frame is decoded with zero values. |
| N | Window length. For FD mode it is deduced from the window_sequence and for TCX N=2*lg. |
| previous_N | Length of the previous window. |

FIG 5Q

Definitions

| | |
|---|---|
| a,b | The 2-tuple quantized coefficient to decode |
| m | The most significant 2-bits wise plane of the quantized spectral coefficient to decode. |
| r | The most significant 2-bits wise plane of the quantized spectral coefficient to decode. |
| lev | Level of the remaining bit-planes. It corresponds to number the bit planes less significant than the most significant 2 bits-wise plane. |
| arith_hash_m[] | Hash table mapping context states to a cumulative frequencies table index pki. |
| arith_lookup_m[] | Look-up table mapping group of context states to a cumulative frequencies table index pki. |
| arith_cf_m[pki][17] | Models of the cumulative frequencies for the most significant 2-bits wise plane m and the ARITH_ESCAPE symbol. |
| arith_cf_r [] | Cumulative frequencies for the least significant bit-planes symbol r |
| previous_lg | number of transmitted spectral coefficients previously decoded by the arithmetic decoder |
| q[2][] | The current context of 2-tuples uses for decoding the current frame. |
| qs[] | The past context stored for the next frame. |
| qdec[] | The decoded quantized spectral coefficients. |
| arith_reset_flag | Flag which indicates if the spectral noiseless context must be reset. |
| ARITH_STOP | Stop symbol consisting of the succession of ARITH_ESCAPE symbol and m=0. When it occurs, the rest of the frame is decoded with zero values. |
| N | Window length. For AAC it is deduced from the window_sequence (see section 6.8.3.1) and for TCX N=2.lg. |

FIG 5R

```
usac_raw_data_block ()
{
    single_channel_element (); and/or
    channel_pair_element ();
}
```

FIG 6A

Syntax of single_channel_element()

| Syntax | No. of bits | Mnemonic |
|---|---|---|
| single_channel_element() | | |
| { | | |
| **core_mode** | **1** | **uimsbf** |
| if ( core_mode == 1 ) { | | |
| lpd_channel_stream(); | | |
| } | | |
| else { | | |
| fd_channel_stream(); | | |
| } | | |
| } | | |

FIG 6B

Syntax of channel_pair_element()

| Syntax | No. of bits | Mnemonic |
|---|---|---|
| channel_pair_element() | | |
| { | | |
| **core_mode0** | **1** | **uimsbf** |
| **core_mode1** | **1** | **uimsbf** |
| ics_info(); | optional: common ics_info for two channels | |
| if ( core_mode0 == 1 ) { | | |
| lpd_channel_stream(); | | |
| } | | |
| else { | | |
| fd_channel_stream(); | | |
| } | | |
| if ( core_mode1 == 1 ) { | | |
| lpd_channel_stream(); | | |
| } | | |
| else { | | |
| fd_channel_stream(); | | |
| } | | |
| } | | |

FIG 6C

Syntax of ics_info()

| Syntax | No. of bits | Mnemonic |
|---|---|---|
| ics_info() | | |
| { | | |
| **window_length;** | 1 | uimsbf |
| if(window_length !=0) { | | |
| **transform_length;** | 1 | uimsbf |
| } | | |
| else { | | |
| transform_length=0; | | |
| } | | |
| **window_shape;** | 1 | uimsbf |
| if (window_length !=0 && transform_length !=0){ | | |
| **max_sfb;** | 4 | uimsbf |
| **scale_factor_grouping;** | 7 | uimsbf |
| } | | |
| else { | | |
| **max_sfb;** | 6 | uimsbf |
| } | | |
| } | | |

optional

FIG 6D

Syntax of fd_channel_stream()

| Syntax | | No. of bits | Mnemonic |
|---|---|---|---|
| fd_channel_stream() | | | |
| { | | | |
| **global_gain;** | | **8** | **uimsbf** |
| ics_info(); | (unless included in channel pair element) | | |
| scale_factor_data (); | | | |
| ac_spectral_data (); | | | |
| } | | | |

FIG 6E

Syntax of ac_spectral_data()

| Syntax | No. of bits | Mnemonic |
|---|---|---|
| ac_spectral_data() | | |
| { | | |
| **arith_reset_flag** | **1** | **uimsbf** |
| for (win=0; win<num_windows; win++){ | | |
| arith_data(num_bands, arith_reset_flag) | | |
| } | | |
| } | | |

FIG 6F

FIG 6G

Syntax of arith_data()

| Syntax | No. of bits | Mnemonic |
|---|---|---|
| arith_data(lg, arith_reset_flag) | | |
| { | | |
| c = arith_map_context(N, arith_reset_flag); | | |
| for (i=0; i<lg/2; i++) { | | |
| /* MSB decoding */ | | |
| c = arith_get_context (c,i,N); | | |
| for (lev=esc_nb=0;;) { | | |
| 662 pki = arith_get_pk(c+esc_nb<<17) | | |
| 663 **acod_m**[pki][m] | 1..20 | vlclbf |
| 664 if ( m != ARITH_ESCAPE) | | |
| break; | | |
| lev += 1; | | |
| if ( (esc_nb=lev)>7 ) | | |
| esc_nb=7; | | |
| } | | |
| b = m>>2; | | |
| a = m – (b<<2); | | |
| /* ARITH_STOP symbol detection */ | | |
| if (m==0 && lev>0) | | |
| break; | | |
| /* LSB decoding */ | | |
| for (l=lev; l>0; l--) { | | |
| **acod_r**[r] | 1..20 | vlclbf |
| a=(a<<1) \| (r&1); | | |
| b=(b<<1) \| ((r>>1)&1); | | |
| } | | |
| x_ac_dec[2*i] = a; | | |
| x_ac_dec[2*i+1] = b; | | |
| 668 arith_update_context(i,a,b); | | |
| } | | |
| arith_finish (x_ac_dec,lg,N); | | |
| /* Signs decoding */ | | |
| for (i=0; i<lg; i++) { | | |
| if (x_ac_dec[i] != 0) { | | |
| **s;** | 1 | uimsbf |
| if (s==0) {x_ac_dec[i] *= -1; } | | |
| } | | |
| } | | |
| } | | |

Table

Syntax of arith_data()

| Syntax | No. of bits | Mnemonic |
|---|---|---|
| Arith_data(lg, arith_reset_flag){ | | |
| c=arith_map_context(lg, arith_reset_flag); | | |
| for (i=0; i<lg/2; i++) { | | |
| /*MSBs decoding*/ | | |
| c = arith_get_context (c,i); | | |
| for (lev=esc_nb=0;;) { | | |
| pki = arith_get_pk(c+esc_nb<<17) | | |
| **acod_m**[pki][m] | 1..20 | vlclbf |
| if ( m != ARITH_ESCAPE) | | |
| break; | | |
| lev += 1; | | |
| if((esc_nb=lev)>7) | | |
| esc_nb=7; | | |
| } | | |
| b=m>>2; | | |
| a=m-(b<<2); | | |
| /*ARITH_STOP symbol detection*/ | | |
| if(m==0 && lev>0) | | |
| break; | | |
| /*LSBs decoding*/ | | |
| for (l=lev; l>0; l--) { | | |
| **acod_r**[r] | 1..20 | vlclbf |
| a=(a<<1)\|(r&1); | | |
| b=(b<<1)\|((r>>1)&1); | | |
| } | | |
| arith_update_context(a,b,i); | | |
| } | | |
| arith_save_arith (l,lg); | | |
| /*Signs decoding*/ | | |
| for (i=0; i<lg/2; i++) { | | |
| if(a!=0){ | | |
| s; | 1 | uimsbf |
| If(s) a=-a; | | |
| } | | |
| if(b!=0){ | | |
| s; | 1 | uimsbf |
| if(s) b=-b; | | |
| } | | |
| } | | |
| } | | |

FIG 6H

Definitions

| | |
|---|---|
| arith_data() | Data element to decode the spectral noiseless coder data |
| **arith_reset_flag** | Flag which indicates if the spectral noiseless context must be reset. |
| **acod _m[pki][m]** | Arithmetic codeword necessary for decoding of the most significant 2-bits wise plane m of the quantized spectral coefficients of a 2-tuple. |
| **acod_r[lsbidx][]** | Arithmetic codeword necessary for decoding of the residual bit-planes r of the quantized spectral coefficient of a 2-tuple. |
| **s** | The coded sign of the non-null spectral quantized coefficient. |

Help elements

| | |
|---|---|
| a,b | 2-tuple corresponding to quantized spectral coefficients |
| m | The most significant 2-bits wise plane of the 2-tuple to decode. |
| r | The least significant bit planes of the 2-tuple to decode. |
| lg | Number of quantized coefficients to decode. |
| N | Window length. For FD mode it is deduced from the window_sequence and for TCX N=2*lg. |
| i | Index of 2-tuples to decode within the frame. |
| pki | Index of the cumulative frequencies table used by the arithmetic decoder for decoding m. |
| arith_get_pk () | Function that returns the index pki of cumulative frequencies table necessary to decode the codeword **acod_m[pki][m]**. |
| c | State of context |
| lsbidx | Index to the cumulative frequencies tables used by the arithmetic coder for decoding r. |
| lev | Level of bit-planes to decode beyond the most significant 2-bits wise plane. |
| ARITH_ESCAPE | Escape symbol that indicates additional bit-planes to decode beyond the two most significant bit planes. |
| esc_nb | Number of ARITH_ESCAPE symbol already decoded for the present 2-tuple. The value is bounded to 7. |
| x_ac_dec[] | Element holding the decoded spectral coefficients |
| arith_map_context() | Initializes the contexts needed for decoding the present frame. |
| arith_get_context() | Computes the context state for decoding the present 2-tuple m symbols. |
| arith_update_context() | Updates the context for the next 2-tuple. |
| arith_finish () | Finish the noiseless decoding. |

FIG 6I

Definitions

| | |
|---|---|
| arith_data() | Data element to decode the spectral noiseless coder data |
| **arith_reset_flag** | Flag which indicates if the spectral noiseless context must be reset. |
| **acod _m[pki][m]** | Arithmetic codeword necessary for decoding of the most significant 2-bits wise plane m of the quantized spectral coefficients of a 2-tuple. |
| **arith_r[]** | Arithmetic codeword necessary for decoding of the residual bit-planes r of the quantized spectral coefficient of a 2-tuple. |
| **s** | The coded sign of the non-null spectral quantized coefficient. |

Help elements

| | |
|---|---|
| a,b | The 2-tuple quantized coefficients to decode |
| m | The most significant 2-bits wise plane of the 2-tuple to decode. |
| r | The least significant bit wise plane of the 2-tuple to decode. |
| lg | Number of quantized coefficients to decode. |
| i | Index of 2-tuple to decode within the frame. |
| pki | Index of the cumulative frequencies table used by the arithmetic decoder for decoding m. |
| arith_get_pk () | Function that returns the index pki of cumulative frequencies table necessary to decode the codeword acod_m[pki][m]. |
| c | State of context |
| lev | Level of bit-planes to decode beyond the most significant 2-bits wise plane. |
| ARITH_ESCAPE | Escape symbol that indicates additional bit-planes to decode beyond the two most significant bit planes. |
| esc_nb | Number of ARITH_ESCAPE symbol already decoded for the present 2-tuple. The value is bounded to 7. |
| arith_map_context() | Initializes the contexts needed for decoding the present frame. |
| arith_get_context() | Computes the context state for decoding the present 2-tuple m symbols. |
| arith_update_context() | Updates the context for the next 2-tuple. |
| arith_save_context() | Save the context for the next frame to decode. |

FIG 6J

Table 15 - Syntax of UsacSingleChannelElement()

| Syntax | No. of bits | Mnemonic |
|---|---|---|
| UsacSingleChannelElement(indepFlag) | | |
| { | | |
| UsacCoreCoderData(1, indepFlag); | | |
| if (sbrRatioIndex > 0) { | | optional |
| UsacSbrData(1, indepFlag); | | optional |
| } | | optional |
| } | | |

FIG 6K

Table 16 – Syntax of UsacChannelPairElement()

| Syntax | No. of bits | Mnemonic |
|---|---|---|
| UsacChannelPairElement(indepFlag) | | |
| { | | |
| if (stereoConfigIndex == 1) { | | |
| nrCoreCoderChannels = 1; | | |
| } else { | | |
| nrCoreCoderChannels = 2; | | |
| } | | |
| UsacCoreCoderData(nrCoreCoderChannels, indepFlag); | | |
| if (sbrRatioIndex > 0) { | | optional |
| if (stereoConfigIndex == 0 \|\| stereoConfigIndex == 3) { | | optional |
| nrSbrChannels = 2; | | optional |
| } else { | | optional |
| nrSbrChannels = 1; | | optional |
| } | | optional |
| UsacSbrData(nrSbrChannels, indepFlag); | | optional |
| } | | optional |
| if (stereoConfigIndex > 0) { | | optional |
| Mps212Data(indepFlag); | | optional |
| } | | |
| } | | |

FIG 6L

Table 19 – Syntax of ics_info()

| Syntax | No. of bits | Mnemonic |
|---|---|---|
| ics_info() | | |
| { | | |
| window_sequence; | 2 | uimsbf |
| window_shape; | 1 | uimsbf |
| if (window_sequence == EIGHT_SHORT_SEQUENCE) { | | |
| max_sfb; | 4 | uimsbf |
| scale_factor_grouping; | 7 | uimsbf |
| } | | |
| else { | | |
| max_sfb; | 6 | uimsbf |
| } | | |
| } | | |

FIG 6M

FIG 6N

Table 20 – Syntax of UsacCoreCoderData()

| Syntax | No. of bits | Mnemonic |
|---|---|---|
| UsacCoreCoderData(nrChannels, indepFlag) | | |
| { | | |
| for (ch=0; ch < nrChannels; ch++) { | | |
| **core_mode[ch];** | **1** | **uimsbf** |
| } | | |
| if (nrChannels == 2) { } optional | | |
| StereoCoreToolInfo(core_mode); | | |
| } | | |
| for (ch=0; ch<nrChannels; ch++) { | | |
| if (core_mode[ch] == 1) { | | |
| lpd_channel_stream(indepFlag); | | |
| } | | |
| else { | | |
| if ( (nrChannels == 1) \|\| (core_mode[0] != core_mode[1]) ) { } optional | | |
| **tns_data_present[ch];** | **1** | **uimsbf** |
| } | | |
| fd_channel_stream(common_window, common_tw, | | |
| tns_data_present[ch], noiseFilling, indepFlag); | | |
| } | | |
| } | | |
| } | | |

FIG 60

Table 22 – Syntax of fd_channel_stream()

| Syntax | No. of bits | Mnemonic |
|---|---|---|
| fd_channel_stream(common_window, common_tw, tns_data_present, noiseFilling, indepFlag) | | |
| { | | |
| **global_gain;** | 8 | uimsbf |
| if (noiseFilling) { | | |
| **noise_level;** | 3 | uimsbf |
| **noise_offset;** | 5 | uimsbf |
| } | | |
| else { | | |
| noise_level = 0; | | |
| } | | |
| if (!common_window) { | | |
| ics_info(); | | |
| } | | |
| if (tw_mdct) { | | |
| if (!common_tw) { | | |
| tw_data(); | | |
| } | | |
| } | | |
| scale_factor_data (); | | |
| if (tns_data_present) { | | |
| tns_data (); | | |
| } | | |
| ac_spectral_data( indepFlag); | | |
| **fac_data_present;** | 1 | uimsbf |
| if (fac_data_present) { | | |
| fac_length = (window_sequence==EIGHT_SHORT_SEQUENCE) ? ccfl/16 : ccfl/8; | | |
| fac_data(1, fac_length); | | |
| } | | |
| } | | |

optional optional optional optional

Table 27 – Syntax of ac_spectral_data()

| Syntax | No. of bits | Mnemonic |
|---|---|---|
| ac_spectral_data(indepFlag) | | |
| { | | |
| if (indepFlag) { (optional) | | |
| arith_reset_flag = 1; (optional) | | |
| } else { (optional) | | |
| **arith_reset_flag;** (optional) | **1** | **uimsbf** |
| } | | |
| for (win = 0; win < num_windows; win++) { | | Note 1 |
| arith_data(lg, arith_reset_flag && (win==0)); | | |
| } | | |
| } | | |

Note 1: num_windows indicates the number of windows in the current window_sequence. In case window_sequence is EIGHT_SHORT_SEQUENCE num_windows equals 8. In all other cases num_windows equals 1

FIG 6P

TABLES AS USED IN USAC WD4 ARITHMETIC CODING SCHEME

| table name | description | unit of data | memory (words of 32 Bit) |
|---|---|---|---|
| arith_cf_ng_hash[128] | Hash table mapping context to a probability model index. | word | 128 |
| arith_cf_ng[32][545] | Cumulative frequencies of groups for each probability distribution mode ,l | 1/2 word | 8720 |
| egroups[8][8][8][8] | Group index of 4 tuple. | 1/2 word | 2048 |
| dgvectors[4*4096] | Map group index and element index to 4-tuple. | 1/4 word | 4096 |
| dgroups[544] | Map group index to cardinal of the group and offset in dgvectors | word | 544 |
| arith_cf_ne[2701] | Cumulative frequencies of the element index symbol | 1/2 word | 1350.5 |
| arith_cf_r[16] | Cumulative frequencies of least significant bit planes | 1/2 word | 8 |
| **total** | | | **16894.5** |

FIG 14B

TABLES AS USED IN A COMAPRISON EXAMPLE

| table name | description | unit of data | memory (words of 32 Bit) |
|---|---|---|---|
| arith_hash[600] | Hash table mapping states of the context to a group of states | 1 word | 600 |
| arith_lookup[600] | Look-up table mapping | 1/4 word | 150 |
| arith_cf_msb[96][16] | groups of states to a cumulative frequencies table<br>Models of the cumulative frequencies for the most significant 2-bits wise plane m and the ARITH_ESCAPE symbol | 1/2 word | 768 |
| **total** | | | **1518** |

FIG 15B table: average bitrates produced by the WD3 arithemtic coder and the comaprison example. Net bitrates do not include bits for byte alignment or fill bits

| operating mode | WD3 (kbit/s) | comaprison example (kbit/s) | difference after transcoding (kbit/s) | difference after transcoding (% of total bitrate) |
|---|---|---|---|---|
| Test 1, 64s | 64.00 | 62.78 | -1.22 | -1.90 |
| Test 2, 32s | 32.00 | 31.47 | -0.53 | -1.66 |
| Test 3, 24s | 24.00 | 23.61 | -0.39 | -1.64 |
| Test 4, 20s | 20.00 | 19.65 | -0.35 | -1.74 |
| Test 5, 16s | 16.00 | 15.72 | -0.28 | -1.75 |
| Test 6, 24m | 24.00 | 23.56 | -0.44 | -1.83 |
| Test 7, 20m | 20.00 | 19.61 | -0.39 | -1.95 |
| Test 8, 16m | 16.00 | 15.70 | -0.30 | -1.87 |
| Test 9, 12m | 12.00 | 11.77 | -0.23 | -1.92 |

FIG 18 table: minimum and maximum bitreservoir levels for WD3 arithemtic coder and comaprison example

| operating mode | bitreservoir control | | | | | |
|---|---|---|---|---|---|---|
| | comaprison example | | | WD3 | | |
| | min | max | avg | min | max | avg |
| Test 1, 64kbps stereo | 3739 | 9557 | 8874 | 2314 | 9557 | 7018 |
| Test 2, 32kbps stereo | 2335 | 4505 | 4293 | 582 | 4505 | 3529 |
| Test 3, 24kbps stereo | 2184 | 4704 | 4472 | 957 | 4704 | 3871 |
| Test 4, 20kbps stereo | 2688 | 4864 | 4660 | 712 | 4864 | 3854 |
| Test 5, 16kbps stereo | 2965 | 5006 | 4859 | 724 | 5006 | 4234 |
| Test 6, 24kbps mono | 2185 | 4704 | 4457 | 1002 | 4704 | 3927 |
| Test 7, 20kbps mono | 2782 | 4864 | 4690 | 1192 | 4864 | 3935 |
| Test 8, 16kbps mono | 2916 | 5006 | 4905 | 1434 | 5006 | 4450 |
| Test 9, 12kbps mono | 3645 | 5184 | 5107 | 2256 | 5184 | 4787 |

FIG 19 table: average complexity numbers for decoding the 32 kbit/s WD3 bitstream for the different version of the arithmetic coder.

| | WD3 | base version |
|---|---|---|
| PCU (MHz) | 0.953 | 0.823 |

FIG 20

FIG 21 ari_lookup_m[742]

```
static unsigned short ari_lookup_m[742] = {
0x01,0x34,0x0D,0x13,0x12,0x25,0x00,0x3A,0x05,0x00,0x21,0x13,0x1F,0x1A,0x1D,0x36,
0x24,0x2B,0x1B,0x33,0x37,0x29,0x1D,0x33,0x37,0x33,0x37,0x33,0x37,0x33,0x2C,0x00,
0x21,0x13,0x25,0x2A,0x00,0x21,0x24,0x12,0x2C,0x1E,0x37,0x24,0x1F,0x35,0x37,0x24,
0x35,0x37,0x35,0x37,0x38,0x2D,0x21,0x29,0x1E,0x21,0x13,0x2D,0x36,0x38,0x29,0x36,
0x37,0x24,0x36,0x38,0x37,0x38,0x00,0x20,0x23,0x20,0x23,0x36,0x38,0x24,0x3B,0x24,
0x26,0x29,0x1F,0x30,0x2D,0x0D,0x12,0x3F,0x2D,0x21,0x1C,0x2A,0x00,0x21,0x12,0x1E,
0x36,0x38,0x36,0x37,0x3F,0x1E,0x0D,0x1F,0x2A,0x1E,0x21,0x24,0x12,0x2A,0x3C,0x21,
0x24,0x1F,0x3C,0x21,0x29,0x36,0x38,0x36,0x37,0x38,0x21,0x1E,0x00,0x3B,0x25,0x1E,
0x20,0x10,0x1F,0x3C,0x20,0x23,0x29,0x08,0x23,0x12,0x08,0x23,0x21,0x38,0x00,0x20,
0x13,0x20,0x3B,0x1C,0x20,0x3B,0x29,0x20,0x23,0x24,0x21,0x24,0x21,0x24,0x3B,0x13,
0x23,0x26,0x23,0x13,0x21,0x24,0x26,0x29,0x12,0x22,0x2B,0x02,0x1E,0x0D,0x1F,0x2D,
0x00,0x0D,0x12,0x00,0x3C,0x21,0x29,0x3C,0x21,0x2A,0x3C,0x3B,0x22,0x1E,0x20,0x10,
0x1F,0x3C,0x0D,0x29,0x3C,0x21,0x24,0x08,0x23,0x20,0x38,0x39,0x3C,0x20,0x13,0x3C,
0x00,0x0D,0x13,0x1F,0x3C,0x09,0x26,0x1F,0x08,0x09,0x26,0x12,0x08,0x23,0x29,0x20,
0x23,0x21,0x24,0x20,0x13,0x20,0x3B,0x16,0x20,0x3B,0x29,0x20,0x3B,0x29,0x20,0x3B,
0x13,0x21,0x24,0x29,0x0B,0x13,0x09,0x3B,0x13,0x09,0x3B,0x13,0x21,0x3B,0x13,0x0D,
0x26,0x29,0x26,0x29,0x3D,0x12,0x22,0x28,0x2E,0x04,0x08,0x13,0x3C,0x3B,0x3C,0x20,
0x10,0x3C,0x21,0x07,0x08,0x10,0x00,0x08,0x0D,0x29,0x08,0x0D,0x29,0x08,0x09,0x13,
0x20,0x23,0x39,0x08,0x09,0x13,0x08,0x09,0x16,0x08,0x09,0x10,0x12,0x20,0x3B,0x3D,
0x09,0x26,0x20,0x3B,0x24,0x39,0x09,0x26,0x20,0x0D,0x13,0x00,0x09,0x13,0x20,0x0D,
0x26,0x12,0x20,0x3B,0x13,0x21,0x26,0x0B,0x12,0x09,0x3B,0x16,0x09,0x3B,0x3D,0x09,
0x26,0x0D,0x13,0x26,0x3D,0x1C,0x12,0x1F,0x28,0x2E,0x07,0x0B,0x08,0x09,0x00,0x39,
0x0B,0x08,0x26,0x08,0x09,0x13,0x20,0x0B,0x39,0x10,0x39,0x0D,0x13,0x20,0x10,0x12,
0x09,0x13,0x20,0x3B,0x13,0x09,0x26,0x0B,0x09,0x3B,0x1C,0x09,0x3B,0x13,0x20,0x3B,
0x13,0x09,0x26,0x0B,0x16,0x0D,0x13,0x09,0x13,0x09,0x13,0x26,0x3D,0x1C,0x1F,0x28,
0x2E,0x07,0x10,0x39,0x0B,0x39,0x39,0x13,0x39,0x0B,0x39,0x0B,0x39,0x26,0x39,0x10,
0x20,0x3B,0x16,0x20,0x10,0x09,0x26,0x0B,0x13,0x09,0x13,0x26,0x1C,0x0B,0x3D,0x1C,
0x1F,0x28,0x2B,0x07,0x0C,0x39,0x0B,0x39,0x0B,0x0C,0x0B,0x26,0x0B,0x26,0x3D,0x0D,
0x1C,0x14,0x28,0x2B,0x39,0x0B,0x0C,0x0E,0x3D,0x1C,0x0D,0x12,0x22,0x2B,0x07,0x0C,
0x0E,0x3D,0x1C,0x10,0x1F,0x2B,0x0C,0x0E,0x19,0x14,0x10,0x1F,0x28,0x0C,0x0E,0x19,
0x14,0x26,0x22,0x2B,0x0C,0x0E,0x19,0x14,0x26,0x28,0x0E,0x19,0x14,0x26,0x28,0x0E,
0x19,0x14,0x28,0x0E,0x19,0x14,0x22,0x28,0x2B,0x0E,0x14,0x2B,0x31,0x00,0x3A,0x3A,
0x05,0x05,0x1B,0x1D,0x33,0x06,0x35,0x35,0x20,0x21,0x37,0x21,0x24,0x05,0x1B,0x2C,
0x2C,0x2C,0x06,0x34,0x1E,0x34,0x00,0x08,0x36,0x09,0x21,0x26,0x1C,0x2C,0x00,0x02,
0x02,0x02,0x3F,0x04,0x04,0x04,0x34,0x39,0x20,0x0A,0x0C,0x39,0x0B,0x0F,0x07,0x07,
0x07,0x07,0x34,0x39,0x39,0x0A,0x0C,0x39,0x0C,0x0F,0x07,0x07,0x07,0x00,0x39,0x39,
0x0C,0x0F,0x07,0x07,0x39,0x0C,0x0F,0x07,0x39,0x0C,0x0F,0x39,0x39,0x0C,0x0F,0x39,
0x0C,0x39,0x0C,0x0F,0x00,0x11,0x27,0x17,0x2F,0x27,0x00,0x27,0x17,0x00,0x11,0x17,
0x00,0x11,0x17,0x11,0x00,0x27,0x15,0x11,0x17,0x01,0x15,0x11,0x15,0x11,0x15,0x15,
0x17,0x00,0x27,0x01,0x27,0x27,0x15,0x00,0x27,0x11,0x27,0x15,0x15,0x15,0x27,0x15,
0x15,0x15,0x15,0x17,0x2F,0x11,0x17,0x27,0x27,0x27,0x11,0x27,0x15,0x27,0x27,0x15,
0x15,0x27,0x17,0x2F,0x27,0x17,0x2F,0x27,0x17,0x2F,0x27,0x17,0x2F,0x27,0x17,0x2F,
0x27,0x17,0x2F,0x27,0x17,0x2F,0x27,0x17,0x2F,0x27,0x17,0x2F,0x27,0x17,0x2F,0x27,
0x17,0x2F,0x27,0x17,0x2F,0x27,0x17,0x2F,0x17,0x2F,0x2B,0x00,0x27,0x00,0x00,0x11,
0x15,0x00,0x11,0x11,0x27,0x27,0x15,0x17,0x15,0x17,0x15,0x17,0x27,0x17,0x27,0x17,
0x27,0x17,0x27,0x17,0x27,0x17,0x27,0x17,0x27,0x17,0x27,0x17,0x27,0x17,0x27,0x17,
0x27,0x15,0x27,0x27,0x15,0x27};
```

FIG 22(1)

ari_hash_m[742]

```
static unsigned long ari_hash_m[742] = {
0x00000104UL, 0x0000030AUL, 0x00000510UL, 0x00000716UL,
0x00000A1FUL, 0x00000F2EUL, 0x00011100UL, 0x00111103UL,
0x00111306UL, 0x00111436UL, 0x00111623UL, 0x00111929UL,
0x00111F2EUL, 0x0011221BUL, 0x00112435UL, 0x00112621UL,
0x00112D12UL, 0x00113130UL, 0x0011331DUL, 0x00113535UL,
0x00113938UL, 0x0011411BUL, 0x00114433UL, 0x00114635UL,
0x00114F29UL, 0x00116635UL, 0x00116F24UL, 0x00117433UL,
0x0011FF0FUL, 0x00121102UL, 0x0012132DUL, 0x00121436UL,
0x00121623UL, 0x00121912UL, 0x0012213FUL, 0x0012232DUL,
0x00122436UL, 0x00122638UL, 0x00122A29UL, 0x00122F2BUL,
0x0012322DUL, 0x00123436UL, 0x00123738UL, 0x00123B29UL,
0x0012411DUL, 0x00124536UL, 0x00124938UL, 0x00124F12UL,
0x00125535UL, 0x00125F29UL, 0x00126535UL, 0x0012B837UL,
0x0013112AUL, 0x0013131EUL, 0x0013163BUL, 0x0013212DUL,
0x0013233CUL, 0x00132623UL, 0x00132F2EUL, 0x0013321EUL,
0x00133521UL, 0x00133824UL, 0x0013411EUL, 0x00134336UL,
0x00134838UL, 0x00135135UL, 0x00135537UL, 0x00135F12UL,
0x00137637UL, 0x0013FF29UL, 0x00140024UL, 0x00142321UL,
0x00143136UL, 0x00143321UL, 0x00143F25UL, 0x00144321UL,
0x00148638UL, 0x0014FF29UL, 0x00154323UL, 0x0015FF12UL,
0x0016F20CUL, 0x0018A529UL, 0x00210031UL, 0x0021122CUL,
0x00211408UL, 0x00211713UL, 0x00211F2EUL, 0x0021222AUL,
0x00212408UL, 0x00212710UL, 0x00212F2EUL, 0x0021331EUL,
0x00213436UL, 0x00213824UL, 0x0021412DUL, 0x0021431EUL,
0x00214536UL, 0x00214F1FUL, 0x00216637UL, 0x00220004UL,
0x0022122AUL, 0x00221420UL, 0x00221829UL, 0x00221F2EUL,
0x0022222DUL, 0x00222408UL, 0x00222623UL, 0x00222929UL,
0x00222F2BUL, 0x0022321EUL, 0x00223408UL, 0x00223724UL,
0x00223A29UL, 0x0022411EUL, 0x00224436UL, 0x00224823UL,
0x00225134UL, 0x00225621UL, 0x00225F12UL, 0x00226336UL,
0x00227637UL, 0x0022FF29UL, 0x0023112DUL, 0x0023133CUL,
0x00231420UL, 0x00231916UL, 0x0023212DUL, 0x0023233CUL,
0x00232509UL, 0x00232929UL, 0x0023312DUL, 0x00233308UL,
0x00233509UL, 0x00233724UL, 0x0023413CUL, 0x00234421UL,
0x00234A13UL, 0x0023513CUL, 0x00235421UL, 0x00235F1FUL,
0x00236421UL, 0x0023FF29UL, 0x00240024UL, 0x0024153BUL,
0x00242108UL, 0x00242409UL, 0x00242726UL, 0x00243108UL,
0x00243409UL, 0x00243610UL, 0x00244136UL, 0x00244321UL,
0x00244523UL, 0x00244F1FUL, 0x00245423UL, 0x0024610AUL,
0x00246423UL, 0x0024FF29UL, 0x00252510UL, 0x00253121UL,
0x0025343BUL, 0x00254121UL, 0x00254510UL, 0x00254F25UL,
0x00255221UL, 0x0025FF12UL, 0x00266513UL, 0x0027F529UL,
0x0029F101UL, 0x002CF224UL, 0x00310030UL, 0x0031122AUL,
0x00311420UL, 0x00311816UL, 0x0031212CUL, 0x0031231EUL,
0x00312408UL, 0x00312710UL, 0x0031312AUL, 0x0031321EUL,
```

FIG 22(2)

0x00313408UL, 0x00313623UL, 0x0031411EUL, 0x0031433CUL,
0x00320007UL, 0x0032122DUL, 0x00321420UL, 0x00321816UL,
0x0032212DUL, 0x0032233CUL, 0x00322509UL, 0x00322916UL,
0x0032312DUL, 0x00323420UL, 0x00323710UL, 0x00323F2BUL,
0x00324308UL, 0x00324623UL, 0x00324F25UL, 0x00325421UL,
0x00325F1FUL, 0x00326421UL, 0x0032FF29UL, 0x00331107UL,
0x00331308UL, 0x0033150DUL, 0x0033211EUL, 0x00332308UL,
0x00332420UL, 0x00332610UL, 0x00332929UL, 0x0033311EUL,
0x00333308UL, 0x0033363BUL, 0x00333A29UL, 0x0033413CUL,
0x00334320UL, 0x0033463BUL, 0x00334A29UL, 0x0033510AUL,
0x00335320UL, 0x00335824UL, 0x0033610AUL, 0x00336321UL,
0x00336F12UL, 0x00337623UL, 0x00341139UL, 0x0034153BUL,
0x00342108UL, 0x00342409UL, 0x00342610UL, 0x00343108UL,
0x00343409UL, 0x00343610UL, 0x00344108UL, 0x0034440DUL,
0x00344610UL, 0x0034510AUL, 0x00345309UL, 0x0034553BUL,
0x0034610AUL, 0x00346309UL, 0x0034F824UL, 0x00350029UL,
0x00352510UL, 0x00353120UL, 0x0035330DUL, 0x00353510UL,
0x00354120UL, 0x0035430DUL, 0x00354510UL, 0x00354F28UL,
0x0035530DUL, 0x00355510UL, 0x00355F1FUL, 0x00356410UL,
0x00359626UL, 0x0035FF12UL, 0x00366426UL, 0x0036FF12UL,
0x0037F426UL, 0x0039D712UL, 0x003BF612UL, 0x003DF81FUL,
0x00410004UL, 0x00411207UL, 0x0041150DUL, 0x0041212AUL,
0x00412420UL, 0x0041311EUL, 0x00413308UL, 0x00413509UL,
0x00413F2BUL, 0x00414208UL, 0x00420007UL, 0x0042123CUL,
0x00421409UL, 0x00422107UL, 0x0042223CUL, 0x00422409UL,
0x00422610UL, 0x0042313CUL, 0x00423409UL, 0x0042363BUL,
0x0042413CUL, 0x00424320UL, 0x0042463BUL, 0x00425108UL,
0x00425409UL, 0x0042FF29UL, 0x00431107UL, 0x00431320UL,
0x0043153BUL, 0x0043213CUL, 0x00432320UL, 0x00432610UL,
0x0043313CUL, 0x00433320UL, 0x0043353BUL, 0x00433813UL,
0x00434108UL, 0x00434409UL, 0x00434610UL, 0x00435108UL,
0x0043553BUL, 0x00435F25UL, 0x00436309UL, 0x0043753BUL,
0x0043FF29UL, 0x00441239UL, 0x0044143BUL, 0x00442139UL,
0x00442309UL, 0x0044253BUL, 0x00443108UL, 0x00443220UL,
0x0044353BUL, 0x0044410AUL, 0x00444309UL, 0x0044453BUL,
0x00444813UL, 0x0044510AUL, 0x00445309UL, 0x00445510UL,
0x00445F25UL, 0x0044630DUL, 0x00450026UL, 0x00452713UL,
0x00453120UL, 0x0045330DUL, 0x00453510UL, 0x00454120UL,
0x0045430DUL, 0x00454510UL, 0x00455120UL, 0x0045530DUL,
0x00456209UL, 0x00456410UL, 0x0045FF12UL, 0x00466513UL,
0x0047FF22UL, 0x0048FF25UL, 0x0049F43DUL, 0x004BFB25UL,
0x004EF825UL, 0x004FFF18UL, 0x00511339UL, 0x00512107UL,
0x00513409UL, 0x00520007UL, 0x00521107UL, 0x00521320UL,
0x00522107UL, 0x00522409UL, 0x0052313CUL, 0x00523320UL,
0x0052353BUL, 0x00524108UL, 0x00524320UL, 0x00531139UL,
0x00531309UL, 0x00532139UL, 0x00532309UL, 0x0053253BUL,
0x00533108UL, 0x0053340DUL, 0x00533713UL, 0x00534108UL,
0x0053453BUL, 0x00534F2BUL, 0x00535309UL, 0x00535610UL,
0x00535F25UL, 0x0053643BUL, 0x00541139UL, 0x00542139UL,

FIG 22(3)

0x00542309UL, 0x00542613UL, 0x00543139UL, 0x00543309UL,
0x00543510UL, 0x00543F2BUL, 0x00544309UL, 0x00544510UL,
0x00544F28UL, 0x0054530DUL, 0x0054FF12UL, 0x00553613UL,
0x00553F2BUL, 0x00554410UL, 0x0055510AUL, 0x0055543BUL,
0x00555F25UL, 0x0055633BUL, 0x0055FF12UL, 0x00566513UL,
0x00577413UL, 0x0059FF28UL, 0x005CC33DUL, 0x005EFB28UL,
0x005FFF18UL, 0x00611339UL, 0x00612107UL, 0x00613320UL,
0x0061A724UL, 0x00621107UL, 0x0062140BUL, 0x00622107UL,
0x00622320UL, 0x00623139UL, 0x00623320UL, 0x00631139UL,
0x0063130CUL, 0x00632139UL, 0x00632309UL, 0x00633139UL,
0x00633309UL, 0x00633626UL, 0x00633F2BUL, 0x00634309UL,
0x00634F2BUL, 0x0063543BUL, 0x0063FF12UL, 0x0064343BUL,
0x00643F2BUL, 0x0064443BUL, 0x00645209UL, 0x00665513UL,
0x0066610AUL, 0x00666526UL, 0x0067A616UL, 0x0069843DUL,
0x006CF612UL, 0x006EF326UL, 0x006FFF18UL, 0x0071130CUL,
0x00721107UL, 0x00722239UL, 0x0072291CUL, 0x0072340BUL,
0x00731139UL, 0x00732239UL, 0x0073630BUL, 0x0073FF12UL,
0x0074430BUL, 0x00755426UL, 0x00776F28UL, 0x00777410UL,
0x0078843DUL, 0x007CF416UL, 0x007EF326UL, 0x007FFF18UL,
0x00822239UL, 0x00831139UL, 0x0083430BUL, 0x0084530BUL,
0x0087561CUL, 0x00887F25UL, 0x00888426UL, 0x008AF61CUL,
0x008F0018UL, 0x008FFF18UL, 0x00911107UL, 0x0093230BUL,
0x0094530BUL, 0x0097743DUL, 0x00998C25UL, 0x00999616UL,
0x009EF825UL, 0x009FFF18UL, 0x00A3430BUL, 0x00A4530BUL,
0x00A7743DUL, 0x00AA9F2BUL, 0x00AAA616UL, 0x00ABD61FUL,
0x00AFFF18UL, 0x00B3330BUL, 0x00B44426UL, 0x00B7643DUL,
0x00BB971FUL, 0x00BBB53DUL, 0x00BEF512UL, 0x00BFFF18UL,
0x00C22139UL, 0x00C5330EUL, 0x00C7633DUL, 0x00CCAF2EUL,
0x00CCC616UL, 0x00CFFF18UL, 0x00D4440EUL, 0x00D6420EUL,
0x00DDCF2EUL, 0x00DDD516UL, 0x00DFFF18UL, 0x00E4330EUL,
0x00E6841CUL, 0x00EEE61CUL, 0x00EFFF18UL, 0x00F3320EUL,
0x00F55319UL, 0x00F8F41CUL, 0x00FAFF2EUL, 0x00FF002EUL,
0x00FFF10CUL, 0x00FFF33DUL, 0x00FFF722UL, 0x00FFFF18UL,
0x01000232UL, 0x0111113EUL, 0x01112103UL, 0x0111311AUL,
0x0112111AUL, 0x01122130UL, 0x01123130UL, 0x0112411DUL,
0x01131102UL, 0x01132102UL, 0x01133102UL, 0x01141108UL,
0x01142136UL, 0x01143136UL, 0x01144135UL, 0x0115223BUL,
0x01211103UL, 0x0121211AUL, 0x01213130UL, 0x01221130UL,
0x01222130UL, 0x01223102UL, 0x01231104UL, 0x01232104UL,
0x01233104UL, 0x01241139UL, 0x01241220UL, 0x01242220UL,
0x01251109UL, 0x0125223BUL, 0x0125810AUL, 0x01283212UL,
0x0131111AUL, 0x01312130UL, 0x0131222CUL, 0x0131322AUL,
0x0132122AUL, 0x0132222DUL, 0x0132322DUL, 0x01331207UL,
0x01332234UL, 0x01333234UL, 0x01341139UL, 0x01343134UL,
0x01344134UL, 0x01348134UL, 0x0135220BUL, 0x0136110BUL,
0x01365224UL, 0x01411102UL, 0x01412104UL, 0x01431239UL,
0x01432239UL, 0x0143320AUL, 0x01435134UL, 0x01443107UL,
0x01444134UL, 0x01446134UL, 0x0145220EUL, 0x01455134UL,
0x0147110EUL, 0x01511102UL, 0x01521239UL, 0x01531239UL,

FIG 22(4)

```
0x01532239UL, 0x01533107UL, 0x0155220EUL, 0x01555134UL,
0x0157110EUL, 0x01611107UL, 0x01621239UL, 0x01631239UL,
0x01661139UL, 0x01666134UL, 0x01711107UL, 0x01721239UL,
0x01745107UL, 0x0177110CUL, 0x01811107UL, 0x01821107UL,
0x0185110CUL, 0x0188210CUL, 0x01911107UL, 0x01933139UL,
0x01A11107UL, 0x01A31139UL, 0x01F5220EUL, 0x02000001UL,
0x02000127UL, 0x02000427UL, 0x02000727UL, 0x02000E2FUL,
0x02110000UL, 0x02111200UL, 0x02111411UL, 0x02111827UL,
0x02111F2FUL, 0x02112411UL, 0x02112715UL, 0x02113200UL,
0x02113411UL, 0x02113715UL, 0x02114200UL, 0x02121200UL,
0x02121301UL, 0x02121F2FUL, 0x02122200UL, 0x02122615UL,
0x02122F2FUL, 0x02123311UL, 0x02123F2FUL, 0x02124411UL,
0x02131211UL, 0x02132311UL, 0x02133211UL, 0x02184415UL,
0x02211200UL, 0x02211311UL, 0x02211F2FUL, 0x02212311UL,
0x02212F2FUL, 0x02213211UL, 0x02221201UL, 0x02221311UL,
0x02221F2FUL, 0x02222311UL, 0x02222F2FUL, 0x02223211UL,
0x02223F2FUL, 0x02231211UL, 0x02232211UL, 0x02232F2FUL,
0x02233211UL, 0x02233F2FUL, 0x02287515UL, 0x022DAB17UL,
0x02311211UL, 0x02311527UL, 0x02312211UL, 0x02321211UL,
0x02322211UL, 0x02322F2FUL, 0x02323311UL, 0x02323F2FUL,
0x02331211UL, 0x02332211UL, 0x02332F2FUL, 0x02333F2FUL,
0x0237FF17UL, 0x02385615UL, 0x023D9517UL, 0x02410027UL,
0x02487827UL, 0x024E3117UL, 0x024FFF2FUL, 0x02598627UL,
0x025DFF2FUL, 0x025FFF2FUL, 0x02687827UL, 0x026DFA17UL,
0x026FFF2FUL, 0x02796427UL, 0x027E4217UL, 0x027FFF2FUL,
0x02888727UL, 0x028EFF2FUL, 0x028FFF2FUL, 0x02984327UL,
0x029F112FUL, 0x029FFF2FUL, 0x02A76527UL, 0x02AEF717UL,
0x02AFFF2FUL, 0x02B7C827UL, 0x02BEF917UL, 0x02BFFF2FUL,
0x02C66527UL, 0x02CD5517UL, 0x02CFFF2FUL, 0x02D63227UL,
0x02DDD527UL, 0x02DFFF2BUL, 0x02E84717UL, 0x02EEE327UL,
0x02EFFF2FUL, 0x02F54527UL, 0x02FCF817UL, 0x02FFEF2BUL,
0x02FFFA2FUL, 0x02FFFE2FUL, 0x03000127UL, 0x03000201UL,
0x03111200UL, 0x03122115UL, 0x03123200UL, 0x03133211UL,
0x03211200UL, 0x03213127UL, 0x03221200UL, 0x03345215UL,
0x04000F17UL, 0x04122F17UL, 0x043F6515UL, 0x043FFF17UL,
0x044F5527UL, 0x044FFF17UL, 0x045F0017UL, 0x045FFF17UL,
0x046F6517UL, 0x04710027UL, 0x047F4427UL, 0x04810027UL,
0x048EFA15UL, 0x048FFF2FUL, 0x049F4427UL, 0x049FFF2FUL,
0x04AEA727UL, 0x04AFFF2FUL, 0x04BE9C15UL, 0x04BFFF2FUL,
0x04CE5427UL, 0x04CFFF2FUL, 0x04DE3527UL, 0x04DFFF17UL,
0x04EE4627UL, 0x04EFFF17UL, 0x04FEF327UL, 0x04FFFF2FUL,
0x06000F27UL, 0x069FFF17UL, 0x06FFFF17UL, 0x08110017UL,
0x08EFFF15UL, 0xFFFFFF00UL };
```

ari_cf_m[64][17]

2310

2312

```
unsigned short ari_cf_m[64][17] = {
{708,706,579,569,568,567,479,469,297,138,97,91,72,52,38,34,0},
{7619,6917,6519,6412,5514,5003,4683,4563,3907,3297,3125,3060,2904,2718,2631,2590,0},
{7263,4888,4810,4803,1889,415,335,327,195,72,52,49,36,20,15,14,0},
{3626,2197,2188,2187,582,57,47,46,30,12,9,8,6,4,3,2,0},
{7806,5541,5451,5441,2720,834,691,674,487,243,179,167,139,98,77,70,0},
{6684,4101,4058,4055,1748,426,368,364,322,257,235,232,228,222,217,215,0},
{9162,5964,5831,5819,3269,866,658,638,535,348,258,244,234,214,195,186,0},
{10638,8491,8365,8351,4418,2067,1859,1834,1190,601,495,478,356,217,174,164,0},
{13389,10514,10032,9961,7166,3488,2655,2524,2015,1140,760,672,585,426,325,283,0},
{14861,12788,12115,11952,9987,6657,5323,4984,4324,3001,2205,1943,1764,1394,1115,978,0},
{12876,10004,9661,9610,7107,3435,2711,2595,2257,1508,1059,952,893,753,609,538,0},
{15125,13591,13049,12874,11192,8543,7406,7023,6291,4922,4104,3769,3465,2890,2486,2275,0},
{14574,13106,12731,12638,10453,7947,7233,7037,6031,4618,4081,3906,3465,2802,2476,2349,0},
{15070,13179,12517,12351,10742,7657,6200,5825,5264,3998,3014,2662,2510,2153,1799,1564,0},
{15542,14466,14007,13844,12489,10409,9481,9132,8305,6940,6193,5867,5458,4743,4291,4047,0},
{15165,14384,14084,13934,12911,11485,10844,10513,10002,8993,8380,8051,7711,7036,6514,6233,0},
{15642,14279,13625,13393,12348,9971,8405,7858,7335,6119,4918,4376,4185,3719,3231,2860,0},
{13408,13407,11471,11218,11217,11216,9473,9216,6480,3689,2857,2690,2256,1732,1405,1302,0},
{16098,15584,15191,14931,14514,13578,12703,12103,11830,11172,10475,9867,9695,9281,8825,8389,0},
{15844,14873,14277,13996,13230,11535,10205,9543,9107,8086,7085,6419,6214,5713,5195,4731,0},
{16131,15720,15443,15276,14848,13971,13314,12910,12591,11874,11225,10788,10573,10077,9585,9209,0},
{16331,16330,12283,11435,11434,11433,8725,8049,6065,4138,3187,2842,2529,2171,1907,1745,0},
{16011,15292,14782,14528,14008,12767,11556,10921,10591,9759,8813,8043,7855,7383,6863,6282,0},
{16380,16379,15159,14610,14609,14608,12859,12111,11046,9536,8348,7713,7216,6533,5964,5546,0},
{16367,16333,16294,16253,16222,16143,16048,15947,15915,15832,15731,15619,15589,15512,15416,15310,0},
```

FIG 23(1)

FIG 23(2)

{15967,15319,14937,14753,14010,12638,11787,11360,10805,9706,8934,8515,8166,7456,6911,6575,0},
{4906,3005,2985,2984,875,102,83,81,47,17,12,11,8,5,4,3,0},
{7217,4346,4269,4264,1924,428,340,332,280,203,179,175,171,164,159,157,0},
{16010,15415,15032,14805,14228,13043,12168,11634,11265,10419,9645,9110,8892,8378,7850,7437,0},
{8573,5218,5046,5032,2787,771,555,533,443,286,218,205,197,181,168,162,0},
{11474,8095,7822,7796,4632,1443,1046,1004,748,351,218,194,167,121,93,83,0},
{16152,15764,15463,15264,14925,14189,13536,13070,12846,12314,11763,11277,11131,10777,10383,10011,0},
{14187,11654,11043,10919,8498,4885,3778,3552,2947,1835,1283,1134,998,749,585,514,0},
{14162,11527,10759,10557,8601,5417,4105,3753,3286,2353,1708,1473,1370,1148,959,840,0},
{16205,15902,15669,15498,15213,14601,14068,13674,13463,12970,12471,12061,11916,11564,11183,10841,0},
{15043,12972,12092,11792,10265,7446,5934,5379,4883,3825,3036,2647,2507,2185,1901,1699,0},
{15320,13694,12782,12352,11191,8936,7433,6671,6255,5366,4622,4158,4020,3712,3420,3198,0},
{16255,16020,15768,15600,15416,14963,14440,14006,13875,13534,13137,12697,12602,12364,12084,11781,0},
{15627,14503,13906,13622,12557,10527,9269,8661,8117,6933,5994,5474,5222,4664,4166,3841,0},
{16366,16365,14547,14160,14159,14158,11969,11473,8735,6147,4911,4530,3865,3180,2710,2473,0},
{16257,16038,15871,15754,15536,15071,14673,14390,14230,13842,13452,13136,13021,12745,12434,12154,0},
{15855,14971,14338,13939,13239,11782,10585,9805,9444,8623,7846,7254,7079,6673,6262,5923,0},
{9492,6318,6197,6189,3004,652,489,477,333,143,96,90,78,60,50,47,0},
{16313,16191,16063,15968,15851,15590,15303,15082,14968,14704,14427,14177,14095,13899,13674,13457,0},
{8485,5473,5389,5383,2411,494,386,377,278,150,117,112,103,89,81,78,0},
{10497,7154,6959,6943,3788,1004,734,709,517,238,152,138,120,90,72,66,0},
{16317,16226,16127,16040,15955,15762,15547,15345,15277,15111,14922,14723,14671,14546,14396,14239,0},
{16382,16381,15858,15540,15539,15538,14704,14168,13768,13092,12452,11925,11683,11268,10841,10460,0},
{5974,3798,3758,3755,1275,205,166,162,95,35,26,24,18,11,8,7,0},
{3532,2258,2246,2244,731,135,118,115,87,45,36,34,29,21,17,16,0},
{7466,4882,4821,4811,2476,886,788,771,688,531,469,457,437,400,369,361,0},
{9580,5772,5291,5216,3444,1496,1025,928,806,578,433,384,366,331,296,273,0},

```
{10692,7730,7543,7521,4679,1746,1391,1346,1128,692,495,458,424,353,291,268,0},
{11040,7132,6549,6452,4377,1875,1253,1130,958,631,431,370,346,296,253,227,0},
{12687,9332,8701,8585,6266,3093,2182,2004,1683,1072,712,608,559,458,373,323,0},
{13429,9853,8860,8584,6806,4039,2862,2478,2239,1764,1409,1224,1178,1077,979,903,0},
{14685,12163,11061,10668,9101,6345,4871,4263,3908,3200,2668,2368,2285,2106,1942,1819,0},
{13295,11302,10999,10945,7947,5036,4490,4385,3391,2185,1836,1757,1424,998,833,785,0},
{4992,2993,2972,2970,1269,575,552,549,530,505,497,495,493,489,486,485,0},
{15419,13862,13104,12819,11429,8753,7220,6651,6020,4667,3663,3220,2995,2511,2107,1871,0},
{12468,9263,8912,8873,5758,2193,1625,1556,1187,589,371,330,283,200,149,131,0},
{15870,15076,14615,14369,13586,12034,10990,10423,9953,8908,8031,7488,7233,6648,6101,5712,0},
{1693,978,976,975,194,18,16,15,11,7,6,5,4,3,2,1,0},
{7992,5218,5147,5143,2152,366,282,276,173,59,38,35,27,16,11,10,0} };
```

2364

FIG 23(3)

```
unsigned short ari_cf_r[4] = {(3<<14)/4,(2<<14)/4,(1<<14)/4, 0}
```

FIG 24 context for state calculation,
as used in a proposed scheme table: averaged coding performance for transcoding of WD6 reference quality bitstreams (average over all 9 operating points)

| M17558 difference after transcoding (% of total bitrate) | new proposal: difference after transcoding (% of total bitrate) | gain new proposal over M17558 (% of total bitrate) |
|---|---|---|
| -1.74 | -2.45 | 0.71 |

coding performance for transcoding of WD6 reference quality bitstreams per operating point comparison of noiseless coder memory demand for WD6, M17588 and new proposal

| | WD6 (32 bit words) | M17558 (32 bit words) | new proposal (32 bit words) |
|---|---|---|---|
| ROM | 16894.5 | 1519.5 | 1441.0 |
| RAM (per channel) | 592 | 64 | 64 |

tables as used in the Re-trained coding scheme

| table name | description | unit of data | memory (words of 32 Bit) |
|---|---|---|---|
| arith_hash_m[742] | Hash table mapping states of the context to a group of states | 1 word | 742 |
| arith_lookup_m[742] | Look-up table mapping groups of states to a cumulative frequencies table | 1/4 word | 185.5 |
| arith_cf_m[64][16] | Models of the cumulative frequencies for the most significant 2-bits wise plane m and the ARITH_ESCAPE symbol | 1/2 word | 512 |
| arith_cf_r[3] | Models of the cumulative frequencies for the least significant bits | 1/2 word | 1.5 |
| **total** | | | **1441.0** |

FIG 29 average complexity numbers for decoding the 32 kbit/s WD6 reference quality bitstreams for the different arithmetic coder versions

| | WD6 (not optimized) | WD6 (optimized) | new proposal (base) | new proposal (enhanced) |
|---|---|---|---|---|
| PCU (MHz) | 0.826 | 0.594 | 0.600 | 0.601 |

FIG 30 average complexity numbers for decoding the 12 kbit/s WD6 reference quality bitstreams for the different arithmetic coder versions

| | WD6 (not optimized) | WD6 (optimized) | new proposal (base) | new proposal (enhanced) |
|---|---|---|---|---|
| PCU (MHz) | 0.355 | 0.237 | 0.261 | 0.262 |

FIG 31 average bitrates produced by the arithmetic coder in proposal and WD6

| operating mode | average bitrate in kbit/s | | | | | |
|---|---|---|---|---|---|---|
| | new proposal | | | WD6 | | |
| | FD mode | wLPT mode | total | FD mode | wLPT mode | total |
| Test 1, 64kbps stereo | 48.59 | --- | 48.59 | 50.71 | --- | 50.71 |
| Test 2, 32kbps stereo | 24.50 | 24.68 | 24.56 | 25.52 | 25.22 | 25.43 |
| Test 3, 24kbps stereo | 17.82 | 16.93 | 17.59 | 18.54 | 17.34 | 18.23 |
| Test 4, 20kbps stereo | 15.13 | 14.08 | 14.87 | 15.78 | 14.47 | 15.46 |
| Test 5, 16kbps stereo | 12.06 | 11.33 | 11.71 | 12.64 | 11.80 | 12.24 |
| Test 6, 24kbps mono | 19.56 | 17.31 | 18.97 | 20.38 | 17.73 | 19.69 |
| Test 7, 20kbps mono | 15.79 | 14.29 | 15.41 | 16.52 | 14.68 | 16.05 |
| Test 8, 16kbps mono | 12.64 | 11.69 | 12.18 | 13.30 | 12.17 | 12.75 |
| Test 9, 12kbps mono | 9.06 | 8.48 | 8.78 | 9.53 | 8.86 | 9.20 |

FIG 32 minimum, maximum and average bitrates of USAC on a frame basis using the proposed scheme

| operating mode | minimum bitrate (kbit/s) | maximum bitrate (kbit/s) | average bitrate (kbit/s) |
|---|---|---|---|
| Test 1, 64kbps stereo | 41.81 | 100.10 | 61.88 |
| Test 2, 32kbps stereo | 16.95 | 46.64 | 31.29 |
| Test 3, 24kbps stereo | 6.49 | 36.10 | 23.50 |
| Test 4, 20kbps stereo | 2.97 | 30.88 | 19.55 |
| Test 5, 16kbps stereo | 5.39 | 25.47 | 15.62 |
| Test 6, 24kbps mono | 3.44 | 35.85 | 23.45 |
| Test 7, 20kbps mono | 1.50 | 30.11 | 19.52 |
| Test 8, 16kbps mono | 5.92 | 25.52 | 15.59 |
| Test 9, 12kbps mono | 4.11 | 19.32 | 11.70 |

FIG 33 average bitrates produced by USAC coder using WD6 arithmetic coder and new proposal

| operating mode | nominal bitrate (kbit/s) | new proposal (kbit/s) | difference after transcoding (kbit/s) | difference after transcoding (% of nominal bitrate) |
|---|---|---|---|---|
| Test 1, 64kbps stereo | 64.00 | 61.88 | -2.12 | -3.31 |
| Test 2, 32kbps stereo | 32.00 | 31.29 | -0.71 | -2.21 |
| Test 3, 24kbps stereo | 24.00 | 23.50 | -0.50 | -2.07 |
| Test 4, 20kbps stereo | 20.00 | 19.55 | -0.45 | -2.25 |
| Test 5, 16kbps stereo | 16.00 | 15.62 | -0.38 | -2.37 |
| Test 6, 24kbps mono | 24.00 | 23.45 | -0.55 | -2.28 |
| Test 7, 20kbps mono | 20.00 | 19.52 | -0.48 | -2.42 |
| Test 8, 16kbps mono | 16.00 | 15.59 | -0.41 | -2.58 |
| Test 9, 12kbps mono | 12.00 | 11.70 | -0.30 | -2.52 |

FIG 34 best and worst cases on a frame basis

| operating mode | best case | | worst case | |
|---|---|---|---|---|
| | (kbit/s) | (%) | (kbit/s) | (%) |
| Test 1, 64kbps stereo | -17.88 | -26.42 | 5.06 | 7.92 |
| Test 2, 32kbps stereo | -5.90 | -18.33 | 1.80 | 6.32 |
| Test 3, 24kbps stereo | -4.29 | -18.36 | 1.72 | 7.76 |
| Test 4, 20kbps stereo | -4.28 | -18.32 | 0.55 | 3.22 |
| Test 5, 16kbps stereo | -3.25 | -20.63 | 1.25 | 8.90 |
| Test 6, 24kbps mono | -4.97 | -19.61 | 1.72 | 8.53 |
| Test 7, 20kbps mono | -4.17 | -20.60 | 1.98 | 11.67 |
| Test 8, 16kbps mono | -3.18 | -19.89 | 1.15 | 7.22 |
| Test 9, 12kbps mono | -2.32 | -17.52 | 1.30 | 11.50 |

FIG 35 bitreservoir limits

| operating mode | bitreservoir control | | | | | |
|---|---|---|---|---|---|---|
| | new proposal | | | WD6 | | |
| | min | max | avg | min | max | avg |
| Test 1, 64kbps stereo | 4009 | 9557 | 9103 | 1676 | 9557 | 6159 |
| Test 2, 32kbps stereo | 2161 | 4505 | 4203 | 770 | 4505 | 3315 |
| Test 3, 24kbps stereo | 1565 | 4704 | 4121 | 1045 | 4704 | 3253 |
| Test 4, 20kbps stereo | 2013 | 4864 | 4372 | 1328 | 4864 | 3212 |
| Test 5, 16kbps stereo | 2197 | 5006 | 4472 | 1494 | 5006 | 3335 |
| Test 6, 24kbps mono | 1847 | 4704 | 4221 | 738 | 4704 | 3272 |
| Test 7, 20kbps mono | 2253 | 4864 | 4456 | 1272 | 4864 | 3358 |
| Test 8, 16kbps mono | 2596 | 5006 | 4549 | 1505 | 5006 | 3666 |
| Test 9, 12kbps mono | 1974 | 5184 | 4494 | 1256 | 5184 | 3556 |

FIG 36 table 7.1 - syntax of arith_data()

| Syntax | No. of bits | Mnemonic |
|---|---|---|
| Arith_data(lg, arith_reset_flag){ | | |
| c=arith_map_context(lg, arith_reset_flag); (change) | | |
| for (i=0; i<lg/2; i++) { (change) | | |
| /*MSBs decoding*/ | | |
| c = arith_get_context (c,i); (change) | | |
| for (lev=esc_nb=0;;) { (change) | | |
| pki = arith_get_pk(c+esc_nb<<17) (change) | | |
| **acod_m**[pki][m] (change) | 1..20 | vlclbf |
| if ( m != ARITH_ESCAPE) (change) | | |
| break; | | |
| lev += 1; | | |
| if((esc_nb=lev)>7) (change) | | |
| esc_nb=7; | | |
| } | | |
| b=m>>2; | | |
| a=m-(b<<2); | | |
| /*ARITH_STOP symbol detection*/ (change) | | |
| if(m==0 && lev>0) | | |
| break; | | |
| /*LSBs decoding*/ | | |
| for (l=lev; l>0; l--) { | | |
| **acod_r**[r] | 1..20 | vlclbf |
| a=(a<<1)\|(r&1); (change) | | |
| b=(b<<1)\|((r>>1)&1); | | |
| } | | |
| arith_update_context(a,b,i); (change) | | |
| } | | |
| arith_save_arith (l,lg); (change) | | |
| /*Signs decoding*/ | | |
| for (i=0; i<lg/2; i++) { | | |
| if(a!=0){ | | |
| s; (change) | 1 | uimsbf |
| If(s) a=-a; | | |
| } (change) | | |
| if(b!=0){ | | |
| s; (change) | 1 | uimsbf |
| if(s) b=-b; | | |
| } | | |
| } | | |
| } | | |

FIG 37

Definitions

| | | |
|---|---|---|
| arith_data() | Data element to decode the spectral noiseless coder data | |
| **arith_reset_flag** | Flag which indicates if the spectral noiseless context must be reset. | |
| **acod _m[pki][m]** | Arithmetic codeword necessary for decoding of the most significant 2-bits wise plane m of the quantized spectral coefficients of a 2-tuple. | changes |
| **arith_r[]** | Arithmetic codeword necessary for decoding of the residual bit-planes r of the quantized spectral coefficient of a 2-tuple. | changes |
| **s** | The coded sign of the non-null spectral quantized coefficient. | changes |

Help elements

| | | |
|---|---|---|
| a,b | The 2-tuple quantized coefficients to decode | changes |
| m | The most significant 2-bits wise plane of the 2-tuple to decode. | |
| r | The least significant bit wise plane of the 2-tuple to decode. | |
| lg | Number of quantized coefficients to decode. | |
| i | Index of 2-tuple to decode within the frame. | |
| pki | Index of the cumulative frequencies table used by the arithmetic decoder for decoding m. | |
| arith_get_pk () | Function that returns the index pki of cumulative frequencies table necessary to decode the codeword acod_m[pki][m]. | |
| c | State of context | changes |
| lev | Level of bit-planes to decode beyond the most significant 2-bits wise plane. | |
| ARITH_ESCAPE | Escape symbol that indicates additional bit-planes to decode beyond the two most significant bit planes. changes | |
| esc_nb | Number of ARITH_ESCAPE symbol already decoded for the present 2-tuple. The value is bounded to 7. | changes |
| arith_map_context() | Initializes the contexts needed for decoding the present frame. | changes |
| arith_get_context() | Computes the context state for decoding the present 2-tuple m symbols. | changes |
| arith_update_context() | Updates the context for the next 2-tuple. | changes |
| arith_save_context() | Save the context for the next frame to decode. | changes |

FIG 38

Definitions

| | | |
|---|---|---|
| a,b | The 2-tuple quantized coefficient to decode | changes |
| m | The most significant 2-bits wise plane of the quantized spectral coefficient to decode. | |
| r | The most significant 2-bits wise plane of the quantized spectral coefficient to decode. | |
| lev | Level of the remaining bit-planes. It corresponds to number the bit planes less significant than the most significant 2 bits-wise plane. | |
| arith_hash_m[] | Hash table mapping context states to a cumulative frequencies table index pki. | changes |
| arith_lookup_m[] | Look-up table mapping group of context states to a cumulative frequencies table index pki. | changes |
| arith_cf_m[pki][17] | Models of the cumulative frequencies for the most significant 2-bits wise plane m and the ARITH_ESCAPE symbol. | |
| arith_cf_r [] change | Cumulative frequencies for the least significant bit-planes symbol r | |
| previous_lg | number of transmitted spectral coefficients previously decoded by the arithmetic decoder | |
| q[2][] | The current context of 2-tuples uses for decoding the current frame. | |
| qs[] | The past context stored for the next frame. | |
| qdec[] | The decoded quantized spectral coefficients. | |
| arith_reset_flag | Flag which indicates if the spectral noiseless context must be reset. | |
| ARITH_STOP | Stop symbol consisting of the succession of ARITH_ESCAPE symbol and m=0. When it occurs, the rest of the frame is decoded with zero values. | changes |
| N | Window length. For AAC it is deduced from the window_sequence (see section 6.8.3.1) and for TCX N=2.lg. | changes |

FIG 39

```
/*Input variables*/
lg    /*Number of sepctral coefficients to decode in the frame*/
arith_reset_flag   /*Arithmetic coder reset flag*/
/*Global variables*/
previous_lg   /*Previous number of spectral lines of the previous frame*/

c=arith_map_context(lg,arith_reset_flag)
{
    v=w=0

    if(arith_reset_flag){
        for(j=0; j<lg/2; j++){
            q[0][v++]=0;
        }
    else{
        ratio= ((float)previous_lg)/((float)lg);
        for(j=0; j<lg/2; j++){
            k = (int) ((float)) ((j)*ratio);
            q[0][v++] = qs[w+k];
        }
    }

    previous_lg=lg;

    return(q[0][0]<<12);
}
```

FIG 40A

FIG 40B

```
/*Input variables*/
c  /*old state context*/
i  /*Index of the 4-tuple to decode in the vector*/
/*Output value*/
c  /*updated state context*/

c=arith_get_context(c,i)
{
    c=c>>4;
    c=(c)+(q[0][1]<<12);
    c=(c&0xFFF0)+(q[1][-1]);

    if(i > 3) {
        if((q[1][-3] + q[1][-2] + q[1][-1]) < 5)
            return(c+0x10000);
    }

    return(c);
}
```

FIG 40C

```
/*Input variable*/
c   /*State of the context*/
/*Output value*/
pki /*Index of the probability model */

pki=arith_get_pk(c){
    i_min=-1;
    i=i_min;
    i_max=741;

    while((i_max-i_min)>1){
        i=i_min+((i_max-i_min)/2);
        j=ari_hash_m[i];
        if(c<(j>>8))
            i_max=i;
        else if(c>(j>>8))
            i_min=i;
        else
            return(j&0xFF);
    }

    return ari_lookup_m[i_max];
}
```

FIG 40D

```
/*helper funtions*/
bool arith_first_symbol(void);
/* Return TRUE if it is the first symbol of the sequence, FALSE otherwise*/
Ushort arith_get_next_bit(void);
/* Get the next bit of the bitstream*/

/* global variables */
low
high
value

/* Input variables */
cum_freq[];  /* cumulative frequencies table*/
cfl;  /* length of cum_freq[] */

symbol=arith_decode(cum_freq,cfl)
{
    if(arith_first_symbol())
    {
        value = 0;
        for (i=1; i<=20; i++)
        {
        value = (val<<1) | arith_get_next_bit();
        }
        s->low=0;
        s->high= 65535;
        s->vobf= value;

    }

    low = s->low;
    high = s->high;
    value = s->vobf;

    range = high-low+1;
    cum =((((int) (value-low+1))<<stat_bitsnew)-((int) 1));
    p = cum_freq-1;

    do{
        q=p+(cfl>>1);
        if ( *q * range > cum ) { p=q; cfl++; }
        cfl>>=1;
    }
    while ( cfl>1 );

    symbol = p-cum_freq+1;
    if ( symbol ) high = low + ((range*(cum_freq[symbol-1])>>stat_bitsnew) - 1;
```

<continued in FIG 40E>

FIG 40E <continuation of FIG 40D>

```
    low  +=((range*(cum_freq[symbol-1])>>stat_bitsnew);

    for (;;)
    {
        if ( high<32768 )
        {
        }
        else if ( low>=32768 )
        {
            value -= 32768;
            low -= 32768;
            high -= 32768;
        }
        else if ( low>=16384 && high<49152 )
        {
            value -= 16384;
            low -= 16384;
            high -= 16384;
        }
        else break;

        low += low;
        high += high+1;

        value = (value<<1) | arith_get_next_bit();
        bp++;
    }

    s->low = low;
    s->high = high;
    s->vobf = value;

    return(symbol);
}
```

FIG 40F

```
a = m;
for(j=0;j<lev;j++){
    r = arith_decode(arith_cf_r,4);
    a = (a<<1) | (r&1);
    a = (a<<1) |((r>>1)&1);

}
```

FIG 40G

```
/*input variables*/
a,b /*Decoded unsigned quantized spectralcoefficients of the 2-tuple*/
i  /*Index of the quantized spectral coefficient to decode*/

arith_update_context(){
    qdec[2*i]=a
    qdec[2*i+1]=b;
    q[1][i]=a+b+1;
    if(q[1][i]>0xF)
        q[1][i]=0xF;
}
```

FIG 40H

```
/*input variables*/
i  /*Index of the quantized spectral coefficient to decode*/
lg  /*number of coefficients in the frame*/

arith_save_context(i,lg){

    for(;i<N/2;i++){
        qdec[2*i]=0;
        qdec[2*i+1]=0;
        q[1][i]=1;
    }

    if(core_mode==1){
        ratio= ((float) lg)/((float)1024);
        for(j=0; j<512; j++){
            k = (int) ((float) j*ratio);
            qs[k] = q[1][j];
        }
        previous_lg = 512;
    }
    else{
        for(j=0; j<512; j++){
            qs[j] = q[1][j];
        }
        previous_lg = MIN(1024,lg);
    }
}
```

FIG 41(1)

set of Re-trained Tables

```
static unsigned short ari_lookup_m[742] = {
0x01,0x34,0x0D,0x13,0x12,0x25,0x00,0x3A,
0x05,0x00,0x21,0x13,0x1F,0x1A,0x1D,0x36,
0x24,0x2B,0x1B,0x33,0x37,0x29,0x1D,0x33,
0x37,0x33,0x37,0x33,0x37,0x33,0x2C,0x00,
0x21,0x13,0x25,0x2A,0x00,0x21,0x24,0x12,
0x2C,0x1E,0x37,0x24,0x1F,0x35,0x37,0x24,
0x35,0x37,0x35,0x37,0x38,0x2D,0x21,0x29,
0x1E,0x21,0x13,0x2D,0x36,0x38,0x29,0x36,
0x37,0x24,0x36,0x38,0x37,0x38,0x00,0x20,
0x23,0x20,0x23,0x36,0x38,0x24,0x3B,0x24,
0x26,0x29,0x1F,0x30,0x2D,0x0D,0x12,0x3F,
0x2D,0x21,0x1C,0x2A,0x00,0x21,0x12,0x1E,
0x36,0x38,0x36,0x37,0x3F,0x1E,0x0D,0x1F,
0x2A,0x1E,0x21,0x24,0x12,0x2A,0x3C,0x21,
0x24,0x1F,0x3C,0x21,0x29,0x36,0x38,0x36,
0x37,0x38,0x21,0x1E,0x00,0x3B,0x25,0x1E,
0x20,0x10,0x1F,0x3C,0x20,0x23,0x29,0x08,
0x23,0x12,0x08,0x23,0x21,0x38,0x00,0x20,
0x13,0x20,0x3B,0x1C,0x20,0x3B,0x29,0x20,
0x23,0x24,0x21,0x24,0x21,0x24,0x3B,0x13,
0x23,0x26,0x23,0x13,0x21,0x24,0x26,0x29,
0x12,0x22,0x2B,0x02,0x1E,0x0D,0x1F,0x2D,
0x00,0x0D,0x12,0x00,0x3C,0x21,0x29,0x3C,
0x21,0x2A,0x3C,0x3B,0x22,0x1E,0x20,0x10,
0x1F,0x3C,0x0D,0x29,0x3C,0x21,0x24,0x08,
0x23,0x20,0x38,0x39,0x3C,0x20,0x13,0x3C,
0x00,0x0D,0x13,0x1F,0x3C,0x09,0x26,0x1F,
0x08,0x09,0x26,0x12,0x08,0x23,0x29,0x20,
0x23,0x21,0x24,0x20,0x13,0x20,0x3B,0x16,
0x20,0x3B,0x29,0x20,0x3B,0x29,0x20,0x3B,
0x13,0x21,0x24,0x29,0x0B,0x13,0x09,0x3B,
0x13,0x09,0x3B,0x13,0x21,0x3B,0x13,0x0D,
0x26,0x29,0x26,0x29,0x3D,0x12,0x22,0x28,
0x2E,0x04,0x08,0x13,0x3C,0x3B,0x3C,0x20,
0x10,0x3C,0x21,0x07,0x08,0x10,0x00,0x08,
0x0D,0x29,0x08,0x0D,0x29,0x08,0x09,0x13,
0x20,0x23,0x39,0x08,0x09,0x13,0x08,0x09,
0x16,0x08,0x09,0x10,0x12,0x20,0x3B,0x3D,
0x09,0x26,0x20,0x3B,0x24,0x39,0x09,0x26,
0x20,0x0D,0x13,0x00,0x09,0x13,0x20,0x0D,
0x26,0x12,0x20,0x3B,0x13,0x21,0x26,0x0B,
0x12,0x09,0x3B,0x16,0x09,0x3B,0x3D,0x09,
0x26,0x0D,0x13,0x26,0x3D,0x1C,0x12,0x1F,
0x28,0x2E,0x07,0x0B,0x08,0x09,0x00,0x39,
```

FIG 41(2)

```
0x0B,0x08,0x26,0x08,0x09,0x13,0x20,0x0B,
0x39,0x10,0x39,0x0D,0x13,0x20,0x10,0x12,
0x09,0x13,0x20,0x3B,0x13,0x09,0x26,0x0B,
0x09,0x3B,0x1C,0x09,0x3B,0x13,0x20,0x3B,
0x13,0x09,0x26,0x0B,0x16,0x0D,0x13,0x09,
0x13,0x09,0x13,0x26,0x3D,0x1C,0x1F,0x28,
0x2E,0x07,0x10,0x39,0x0B,0x39,0x39,0x13,
0x39,0x0B,0x39,0x0B,0x39,0x26,0x39,0x10,
0x20,0x3B,0x16,0x20,0x10,0x09,0x26,0x0B,
0x13,0x09,0x13,0x26,0x1C,0x0B,0x3D,0x1C,
0x1F,0x28,0x2B,0x07,0x0C,0x39,0x0B,0x39,
0x0B,0x0C,0x0B,0x26,0x0B,0x26,0x3D,0x0D,
0x1C,0x14,0x28,0x2B,0x39,0x0B,0x0C,0x0E,
0x3D,0x1C,0x0D,0x12,0x22,0x2B,0x07,0x0C,
0x0E,0x3D,0x1C,0x10,0x1F,0x2B,0x0C,0x0E,
0x19,0x14,0x10,0x1F,0x28,0x0C,0x0E,0x19,
0x14,0x26,0x22,0x2B,0x0C,0x0E,0x19,0x14,
0x26,0x28,0x0E,0x19,0x14,0x26,0x28,0x0E,
0x19,0x14,0x28,0x0E,0x19,0x14,0x22,0x28,
0x2B,0x0E,0x14,0x2B,0x31,0x00,0x3A,0x3A,
0x05,0x05,0x1B,0x1D,0x33,0x06,0x35,0x35,
0x20,0x21,0x37,0x21,0x24,0x05,0x1B,0x2C,
0x2C,0x2C,0x06,0x34,0x1E,0x34,0x00,0x08,
0x36,0x09,0x21,0x26,0x1C,0x2C,0x00,0x02,
0x02,0x02,0x3F,0x04,0x04,0x04,0x34,0x39,
0x20,0x0A,0x0C,0x39,0x0B,0x0F,0x07,0x07,
0x07,0x07,0x34,0x39,0x39,0x0A,0x0C,0x39,
0x0C,0x0F,0x07,0x07,0x07,0x00,0x39,0x39,
0x0C,0x0F,0x07,0x07,0x39,0x0C,0x0F,0x07,
0x39,0x0C,0x0F,0x39,0x39,0x0C,0x0F,0x39,
0x0C,0x39,0x0C,0x0F,0x00,0x11,0x27,0x17,
0x2F,0x27,0x00,0x27,0x17,0x00,0x11,0x17,
0x00,0x11,0x17,0x11,0x00,0x27,0x15,0x11,
0x17,0x01,0x15,0x11,0x15,0x11,0x15,0x15,
0x17,0x00,0x27,0x01,0x27,0x27,0x15,0x00,
0x27,0x11,0x27,0x15,0x15,0x15,0x27,0x15,
0x15,0x15,0x15,0x17,0x2F,0x11,0x17,0x27,
0x27,0x27,0x11,0x27,0x15,0x27,0x27,0x15,
0x15,0x27,0x17,0x2F,0x27,0x17,0x2F,0x27,
0x17,0x2F,0x27,0x17,0x2F,0x27,0x17,0x2F,
0x27,0x17,0x2F,0x27,0x17,0x2F,0x27,0x17,
0x2F,0x27,0x17,0x2F,0x27,0x17,0x2F,0x27,
0x17,0x2F,0x27,0x17,0x2F,0x27,0x17,0x2F,
0x17,0x2F,0x2B,0x00,0x27,0x00,0x00,0x11,
0x15,0x00,0x11,0x11,0x27,0x27,0x15,0x17,
0x15,0x17,0x15,0x17,0x27,0x17,0x27,0x17,
0x27,0x17,0x27,0x17,0x27,0x17,0x27,0x17,
0x27,0x17,0x27,0x17,0x27,0x17,0x27,0x17,
0x27,0x15,0x27,0x27,0x15,0x27,
};
```

```
static unsigned long ari_hash_m[742] = {
0x00000104UL,0x0000030AUL,0x00000510UL,0x00000716UL,0x00000A1FUL,0x00000F2E
UL,0x00011100UL,0x00111103UL,
0x00111306UL,0x00111436UL,0x00111623UL,0x00111929UL,0x00111F2EUL,0x0011221BU
L,0x00112435UL,0x00112621UL,
0x00112D12UL,0x00113130UL,0x0011331DUL,0x00113535UL,0x00113938UL,0x0011411B
UL,0x00114433UL,0x00114635UL,
0x00114F29UL,0x00116635UL,0x00116F24UL,0x00117433UL,0x0011FF0FUL,0x00121102U
L,0x0012132DUL,0x00121436UL,
0x00121623UL,0x00121912UL,0x0012213FUL,0x0012232DUL,0x00122436UL,0x00122638U
L,0x00122A29UL,0x00122F2BUL,
0x0012322DUL,0x00123436UL,0x00123738UL,0x00123B29UL,0x0012411DUL,0x00124536
UL,0x00124938UL,0x00124F12UL,
0x00125535UL,0x00125F29UL,0x00126535UL,0x0012B837UL,0x0013112AUL,0x0013131E
UL,0x0013163BUL,0x0013212DUL,
0x0013233CUL,0x00132623UL,0x00132F2EUL,0x0013321EUL,0x00133521UL,0x00133824
UL,0x0013411EUL,0x00134336UL,
0x00134838UL,0x00135135UL,0x00135537UL,0x00135F12UL,0x00137637UL,0x0013FF29U
L,0x00140024UL,0x00142321UL,
0x00143136UL,0x00143321UL,0x00143F25UL,0x00144321UL,0x00148638UL,0x0014FF29U
L,0x00154323UL,0x0015FF12UL,
0x0016F20CUL,0x0018A529UL,0x00210031UL,0x0021122CUL,0x00211408UL,0x00211713
UL,0x00211F2EUL,0x0021222AUL,
0x00212408UL,0x00212710UL,0x00212F2EUL,0x0021331EUL,0x00213436UL,0x00213824U
L,0x0021412DUL,0x0021431EUL,
0x00214536UL,0x00214F1FUL,0x00216637UL,0x00220004UL,0x0022122AUL,0x00221420U
L,0x00221829UL,0x00221F2EUL,
0x0022222DUL,0x00222408UL,0x00222623UL,0x00222929UL,0x00222F2BUL,0x0022321E
UL,0x00223408UL,0x00223724UL,
0x00223A29UL,0x0022411EUL,0x00224436UL,0x00224823UL,0x00225134UL,0x00225621U
L,0x00225F12UL,0x00226336UL,
0x00227637UL,0x0022FF29UL,0x0023112DUL,0x0023133CUL,0x00231420UL,0x00231916
UL,0x0023212DUL,0x0023233CUL,
0x00232509UL,0x00232929UL,0x0023312DUL,0x00233308UL,0x00233509UL,0x00233724U
L,0x0023413CUL,0x00234421UL,
0x00234A13UL,0x0023513CUL,0x00235421UL,0x00235F1FUL,0x00236421UL,0x0023FF29
UL,0x00240024UL,0x0024153BUL,
0x00242108UL,0x00242409UL,0x00242726UL,0x00243108UL,0x00243409UL,0x00243610U
L,0x00244136UL,0x00244321UL,
0x00244523UL,0x00244F1FUL,0x00245423UL,0x0024610AUL,0x00246423UL,0x0024FF29
UL,0x00252510UL,0x00253121UL,
0x0025343BUL,0x00254121UL,0x00254510UL,0x00254F25UL,0x00255221UL,0x0025FF12U
L,0x00266513UL,0x0027F529UL,
0x0029F101UL,0x002CF224UL,0x00310030UL,0x0031122AUL,0x00311420UL,0x00311816
UL,0x0031212CUL,0x0031231EUL,
0x00312408UL,0x00312710UL,0x0031312AUL,0x0031321EUL,0x00313408UL,0x00313623U
L,0x0031411EUL,0x0031433CUL,
```

FIG 42(1)

0x00320007UL,0x0032122DUL,0x00321420UL,0x00321816UL,0x0032212DUL,0x0032233C
UL,0x00322509UL,0x00322916UL,
0x0032312DUL,0x00323420UL,0x00323710UL,0x00323F2BUL,0x00324308UL,0x00324623
UL,0x00324F25UL,0x00325421UL,
0x00325F1FUL,0x00326421UL,0x0032FF29UL,0x00331107UL,0x00331308UL,0x0033150D
UL,0x0033211EUL,0x00332308UL,
0x00332420UL,0x00332610UL,0x00332929UL,0x0033311EUL,0x00333308UL,0x0033363BU
L,0x00333A29UL,0x0033413CUL,
0x00334320UL,0x0033463BUL,0x00334A29UL,0x0033510AUL,0x00335320UL,0x00335824
UL,0x0033610AUL,0x00336321UL,
0x00336F12UL,0x00337623UL,0x00341139UL,0x0034153BUL,0x00342108UL,0x00342409U
L,0x00342610UL,0x00343108UL,
0x00343409UL,0x00343610UL,0x00344108UL,0x0034440DUL,0x00344610UL,0x0034510A
UL,0x00345309UL,0x0034553BUL,
0x0034610AUL,0x00346309UL,0x0034F824UL,0x00350029UL,0x00352510UL,0x00353120U
L,0x0035330DUL,0x00353510UL,
0x00354120UL,0x0035430DUL,0x00354510UL,0x00354F28UL,0x0035530DUL,0x00355510
UL,0x00355F1FUL,0x00356410UL,
0x00359626UL,0x0035FF12UL,0x00366426UL,0x0036FF12UL,0x0037F426UL,0x0039D712
UL,0x003BF612UL,0x003DF81FUL,
0x00410004UL,0x00411207UL,0x0041150DUL,0x0041212AUL,0x00412420UL,0x0041311E
UL,0x00413308UL,0x00413509UL,
0x00413F2BUL,0x00414208UL,0x00420007UL,0x0042123CUL,0x00421409UL,0x00422107
UL,0x0042223CUL,0x00422409UL,
0x00422610UL,0x0042313CUL,0x00423409UL,0x0042363BUL,0x0042413CUL,0x00424320
UL,0x0042463BUL,0x00425108UL,
0x00425409UL,0x0042FF29UL,0x00431107UL,0x00431320UL,0x0043153BUL,0x0043213C
UL,0x00432320UL,0x00432610UL,
0x0043313CUL,0x00433320UL,0x0043353BUL,0x00433813UL,0x00434108UL,0x00434409U
L,0x00434610UL,0x00435108UL,
0x0043553BUL,0x00435F25UL,0x00436309UL,0x0043753BUL,0x0043FF29UL,0x00441239
UL,0x0044143BUL,0x00442139UL,
0x00442309UL,0x0044253BUL,0x00443108UL,0x00443220UL,0x0044353BUL,0x0044410A
UL,0x00444309UL,0x0044453BUL,
0x00444813UL,0x0044510AUL,0x00445309UL,0x00445510UL,0x00445F25UL,0x0044630D
UL,0x00450026UL,0x00452713UL,
0x00453120UL,0x0045330DUL,0x00453510UL,0x00454120UL,0x0045430DUL,0x00454510
UL,0x00455120UL,0x0045530DUL,
0x00456209UL,0x00456410UL,0x0045FF12UL,0x00466513UL,0x0047FF22UL,0x0048FF25U
L,0x0049F43DUL,0x004BFB25UL,
0x004EF825UL,0x004FFF18UL,0x00511339UL,0x00512107UL,0x00513409UL,0x00520007U
L,0x00521107UL,0x00521320UL,
0x00522107UL,0x00522409UL,0x0052313CUL,0x00523320UL,0x0052353BUL,0x00524108U
L,0x00524320UL,0x00531139UL,
0x00531309UL,0x00532139UL,0x00532309UL,0x0053253BUL,0x00533108UL,0x0053340D
UL,0x00533713UL,0x00534108UL,
0x0053453BUL,0x00534F2BUL,0x00535309UL,0x00535610UL,0x00535F25UL,0x0053643B
UL,0x00541139UL,0x00542139UL,

FIG 42(2)

0x00542309UL,0x00542613UL,0x00543139UL,0x00543309UL,0x00543510UL,0x00543F2BU
L,0x00544309UL,0x00544510UL,
0x00544F28UL,0x0054530DUL,0x0054FF12UL,0x00553613UL,0x00553F2BUL,0x00554410
UL,0x0055510AUL,0x0055543BUL,
0x00555F25UL,0x0055633BUL,0x0055FF12UL,0x00566513UL,0x00577413UL,0x0059FF28
UL,0x005CC33DUL,0x005EFB28UL,
0x005FFF18UL,0x00611339UL,0x00612107UL,0x00613320UL,0x0061A724UL,0x00621107
UL,0x0062140BUL,0x00622107UL,
0x00622320UL,0x00623139UL,0x00623320UL,0x00631139UL,0x0063130CUL,0x00632139U
L,0x00632309UL,0x00633139UL,
0x00633309UL,0x00633626UL,0x00633F2BUL,0x00634309UL,0x00634F2BUL,0x0063543B
UL,0x0063FF12UL,0x0064343BUL,
0x00643F2BUL,0x0064443BUL,0x00645209UL,0x00665513UL,0x0066610AUL,0x00666526
UL,0x0067A616UL,0x0069843DUL,
0x006CF612UL,0x006EF326UL,0x006FFF18UL,0x0071130CUL,0x00721107UL,0x00722239
UL,0x0072291CUL,0x0072340BUL,
0x00731139UL,0x00732239UL,0x0073630BUL,0x0073FF12UL,0x0074430BUL,0x00755426
UL,0x00776F28UL,0x00777410UL,
0x0078843DUL,0x007CF416UL,0x007EF326UL,0x007FFF18UL,0x00822239UL,0x00831139
UL,0x0083430BUL,0x0084530BUL,
0x0087561CUL,0x00887F25UL,0x00888426UL,0x008AF61CUL,0x008F0018UL,0x008FFF18
UL,0x00911107UL,0x0093230BUL,
0x0094530BUL,0x0097743DUL,0x00998C25UL,0x00999616UL,0x009EF825UL,0x009FFF18
UL,0x00A3430BUL,0x00A4530BUL,
0x00A7743DUL,0x00AA9F2BUL,0x00AAA616UL,0x00ABD61FUL,0x00AFFF18UL,0x00B3
330BUL,0x00B44426UL,0x00B7643DUL,
0x00BB971FUL,0x00BBB53DUL,0x00BEF512UL,0x00BFFF18UL,0x00C22139UL,0x00C53
30EUL,0x00C7633DUL,0x00CCAF2EUL,
0x00CCC616UL,0x00CFFF18UL,0x00D4440EUL,0x00D6420EUL,0x00DDCF2EUL,0x00DD
D516UL,0x00DFFF18UL,0x00E4330EUL,
0x00E6841CUL,0x00EEE61CUL,0x00EFFF18UL,0x00F3320EUL,0x00F55319UL,0x00F8F41
CUL,0x00FAFF2EUL,0x00FF002EUL,
0x00FFF10CUL,0x00FFF33DUL,0x00FFF722UL,0x00FFFF18UL,0x01000232UL,0x0111113
EUL,0x01112103UL,0x0111311AUL,
0x0112111AUL,0x01122130UL,0x01123130UL,0x0112411DUL,0x01131102UL,0x01132102
UL,0x01133102UL,0x01141108UL,
0x01142136UL,0x01143136UL,0x01144135UL,0x0115223BUL,0x01211103UL,0x0121211A
UL,0x01213130UL,0x01221130UL,
0x01222130UL,0x01223102UL,0x01231104UL,0x01232104UL,0x01233104UL,0x01241139U
L,0x01241220UL,0x01242220UL,
0x01251109UL,0x0125223BUL,0x0125810AUL,0x01283212UL,0x0131111AUL,0x01312130
UL,0x0131222CUL,0x0131322AUL,
0x0132122AUL,0x0132222DUL,0x0132322DUL,0x01331207UL,0x01332234UL,0x01333234
UL,0x01341139UL,0x01343134UL,
0x01344134UL,0x01348134UL,0x0135220BUL,0x0136110BUL,0x01365224UL,0x01411102U
L,0x01412104UL,0x01431239UL,
0x01432239UL,0x0143320AUL,0x01435134UL,0x01443107UL,0x01444134UL,0x01446134U
L,0x0145220EUL,0x01455134UL,

FIG 42(3)

```
0x0147110EUL,0x01511102UL,0x01521239UL,0x01531239UL,0x01532239UL,0x01533107U
L,0x0155220EUL,0x01555134UL,
0x0157110EUL,0x01611107UL,0x01621239UL,0x01631239UL,0x01661139UL,0x01666134U
L,0x01711107UL,0x01721239UL,
0x01745107UL,0x0177110CUL,0x01811107UL,0x01821107UL,0x0185110CUL,0x0188210C
UL,0x01911107UL,0x01933139UL,
0x01A11107UL,0x01A31139UL,0x01F5220EUL,0x02000001UL,0x02000127UL,0x02000427
UL,0x02000727UL,0x02000E2FUL,
0x02110000UL,0x02111200UL,0x02111411UL,0x02111827UL,0x02111F2FUL,0x02112411U
L,0x02112715UL,0x02113200UL,
0x02113411UL,0x02113715UL,0x02114200UL,0x02121200UL,0x02121301UL,0x02121F2FU
L,0x02122200UL,0x02122615UL,
0x02122F2FUL,0x02123311UL,0x02123F2FUL,0x02124411UL,0x02131211UL,0x02132311U
L,0x02133211UL,0x02184415UL,
0x02211200UL,0x02211311UL,0x02211F2FUL,0x02212311UL,0x02212F2FUL,0x02213211U
L,0x02221201UL,0x02221311UL,
0x02221F2FUL,0x02222311UL,0x02222F2FUL,0x02223211UL,0x02223F2FUL,0x02231211U
L,0x02232211UL,0x02232F2FUL,
0x02233211UL,0x02233F2FUL,0x02287515UL,0x022DAB17UL,0x02311211UL,0x02311527
UL,0x02312211UL,0x02321211UL,
0x02322211UL,0x02322F2FUL,0x02323311UL,0x02323F2FUL,0x02331211UL,0x02332211U
L,0x02332F2FUL,0x02333F2FUL,
0x0237FF17UL,0x02385615UL,0x023D9517UL,0x02410027UL,0x02487827UL,0x024E3117
UL,0x024FFF2FUL,0x02598627UL,
0x025DFF2FUL,0x025FFF2FUL,0x02687827UL,0x026DFA17UL,0x026FFF2FUL,0x0279642
7UL,0x027E4217UL,0x027FFF2FUL,
0x02888727UL,0x028EFF2FUL,0x028FFF2FUL,0x02984327UL,0x029F112FUL,0x029FFF2F
UL,0x02A76527UL,0x02AEF717UL,
0x02AFFF2FUL,0x02B7C827UL,0x02BEF917UL,0x02BFFF2FUL,0x02C66527UL,0x02CD55
17UL,0x02CFFF2FUL,0x02D63227UL,
0x02DDD527UL,0x02DFFF2BUL,0x02E84717UL,0x02EEE327UL,0x02EFFF2FUL,0x02F545
27UL,0x02FCF817UL,0x02FFEF2BUL,
0x02FFFA2FUL,0x02FFFE2FUL,0x03000127UL,0x03000201UL,0x03111200UL,0x03122115
UL,0x03123200UL,0x03133211UL,
0x03211200UL,0x03213127UL,0x03221200UL,0x03345215UL,0x04000F17UL,0x04122F17U
L,0x043F6515UL,0x043FFF17UL,
0x044F5527UL,0x044FFF17UL,0x045F0017UL,0x045FFF17UL,0x046F6517UL,0x04710027
UL,0x047F4427UL,0x04810027UL,
0x048EFA15UL,0x048FFF2FUL,0x049F4427UL,0x049FFF2FUL,0x04AEA727UL,0x04AFFF
2FUL,0x04BE9C15UL,0x04BFFF2FUL,
0x04CE5427UL,0x04CFFF2FUL,0x04DE3527UL,0x04DFFF17UL,0x04EE4627UL,0x04EFFF
17UL,0x04FEF327UL,0x04FFFF2FUL,
0x06000F27UL,0x069FFF17UL,0x06FFFF17UL,0x08110017UL,0x08EFFF15UL,0x7FFFFFF
F00UL,
};
```

FIG 42(4)

```
unsigned short ari_cf_m[96][17] = {
{ 708, 706, 579, 569, 568, 567, 479, 469, 297, 138, 97, 91, 72, 52, 38, 34,
0
},
{ 7619, 6917, 6519, 6412, 5514, 5003, 4683, 4563, 3907, 3297, 3125, 3060, 2904, 2718, 2631,
2590,
0
},
{ 7263, 4888, 4810, 4803, 1889, 415, 335, 327, 195, 72, 52, 49, 36, 20, 15, 14,
0
},
{ 3626, 2197, 2188, 2187, 582, 57, 47, 46, 30, 12, 9, 8, 6, 4, 3, 2,
0
},
{ 7806, 5541, 5451, 5441, 2720, 834, 691, 674, 487, 243, 179, 167, 139, 98, 77, 70,
0
},
{ 6684, 4101, 4058, 4055, 1748, 426, 368, 364, 322, 257, 235, 232, 228, 222, 217, 215,
0
},
{ 9162, 5964, 5831, 5819, 3269, 866, 658, 638, 535, 348, 258, 244, 234, 214, 195, 186,
0
},
{ 10638, 8491, 8365, 8351, 4418, 2067, 1859, 1834, 1190, 601, 495, 478, 356, 217, 174,
164,
0
},
{ 13389,10514,10032, 9961, 7166, 3488, 2655, 2524, 2015, 1140, 760, 672, 585, 426, 325,
283,
0
},
{ 14861,12788,12115,11952, 9987, 6657, 5323, 4984, 4324, 3001, 2205, 1943, 1764, 1394,
1115, 978,
0
},
{ 12876,10004, 9661, 9610, 7107, 3435, 2711, 2595, 2257, 1508, 1059, 952, 893, 753, 609,
538,
0
},
{ 15125,13591,13049,12874,11192, 8543, 7406, 7023, 6291, 4922, 4104, 3769, 3465, 2890,
2486, 2275,
0
},
{ 14574,13106,12731,12638,10453, 7947, 7233, 7037, 6031, 4618, 4081, 3906, 3465, 2802,
2476, 2349,
0
```

FIG 43(1)

},
{ 15070,13179,12517,12351,10742, 7657, 6200, 5825, 5264, 3998, 3014, 2662, 2510, 2153,
1799, 1564,
0
},
{ 15542,14466,14007,13844,12489,10409, 9481, 9132, 8305, 6940, 6193, 5867, 5458, 4743,
4291, 4047,
0
},
{ 15165,14384,14084,13934,12911,11485,10844,10513,10002, 8993, 8380, 8051, 7711, 7036,
6514, 6233,
0
},
{ 15642,14279,13625,13393,12348, 9971, 8405, 7858, 7335, 6119, 4918, 4376, 4185, 3719,
3231, 2860,
0
},
{ 13408,13407,11471,11218,11217,11216, 9473, 9216, 6480, 3689, 2857, 2690, 2256, 1732,
1405, 1302,
0
},
{ 16098,15584,15191,14931,14514,13578,12703,12103,11830,11172,10475, 9867, 9695, 9281,
8825, 8389,
0
},
{ 15844,14873,14277,13996,13230,11535,10205, 9543, 9107, 8086, 7085, 6419, 6214, 5713,
5195, 4731,
0
},
{
16131,15720,15443,15276,14848,13971,13314,12910,12591,11874,11225,10788,10573,10077,
9585, 9209,
0
},
{ 16331,16330,12283,11435,11434,11433, 8725, 8049, 6065, 4138, 3187, 2842, 2529, 2171,
1907, 1745,
0
},
{ 16011,15292,14782,14528,14008,12767,11556,10921,10591, 9759, 8813, 8043, 7855, 7383,
6863, 6282,
0
},
{ 16380,16379,15159,14610,14609,14608,12859,12111,11046, 9536, 8348, 7713, 7216, 6533,
5964, 5546,
0
},

FIG 43(2)

{
16367,16333,16294,16253,16222,16143,16048,15947,15915,15832,15731,15619,15589,15512,
15416,15310,
0
},
{ 15967,15319,14937,14753,14010,12638,11787,11360,10805, 9706, 8934, 8515, 8166, 7456,
6911, 6575,
0
},
{ 4906, 3005, 2985, 2984, 875, 102, 83, 81, 47, 17, 12, 11, 8, 5, 4, 3,
0
},
{ 7217, 4346, 4269, 4264, 1924, 428, 340, 332, 280, 203, 179, 175, 171, 164, 159, 157,
0
},
{ 16010,15415,15032,14805,14228,13043,12168,11634,11265,10419, 9645, 9110, 8892, 8378,
7850, 7437,
0
},
{ 8573, 5218, 5046, 5032, 2787, 771, 555, 533, 443, 286, 218, 205, 197, 181, 168, 162,
0
},
{ 11474, 8095, 7822, 7796, 4632, 1443, 1046, 1004, 748, 351, 218, 194, 167, 121, 93, 83,
0
},
{
16152,15764,15463,15264,14925,14189,13536,13070,12846,12314,11763,11277,11131,10777,
10383,10011,
0
},
{ 14187,11654,11043,10919, 8498, 4885, 3778, 3552, 2947, 1835, 1283, 1134, 998, 749, 585,
514,
0
},
{ 14162,11527,10759,10557, 8601, 5417, 4105, 3753, 3286, 2353, 1708, 1473, 1370, 1148,
959, 840,
0
},
{
16205,15902,15669,15498,15213,14601,14068,13674,13463,12970,12471,12061,11916,11564,
11183,10841,
0
},
{ 15043,12972,12092,11792,10265, 7446, 5934, 5379, 4883, 3825, 3036, 2647, 2507, 2185,
1901, 1699,
0

FIG 43(3)

},
{ 15320,13694,12782,12352,11191, 8936, 7433, 6671, 6255, 5366, 4622, 4158, 4020, 3712,
3420, 3198,
0
},
{
16255,16020,15768,15600,15416,14963,14440,14006,13875,13534,13137,12697,12602,12364,
12084,11781,
0
},
{ 15627,14503,13906,13622,12557,10527, 9269, 8661, 8117, 6933, 5994, 5474, 5222, 4664,
4166, 3841,
0
},
{ 16366,16365,14547,14160,14159,14158,11969,11473, 8735, 6147, 4911, 4530, 3865, 3180,
2710, 2473,
0
},
{
16257,16038,15871,15754,15536,15071,14673,14390,14230,13842,13452,13136,13021,12745,
12434,12154,
0
},
{ 15855,14971,14338,13939,13239,11782,10585, 9805, 9444, 8623, 7846, 7254, 7079, 6673,
6262, 5923,
0
},
{ 9492, 6318, 6197, 6189, 3004, 652, 489, 477, 333, 143, 96, 90, 78, 60, 50, 47,
0
},
{
16313,16191,16063,15968,15851,15590,15303,15082,14968,14704,14427,14177,14095,13899,
13674,13457,
0
},
{ 8485, 5473, 5389, 5383, 2411, 494, 386, 377, 278, 150, 117, 112, 103, 89, 81, 78,
0
},
{ 10497, 7154, 6959, 6943, 3788, 1004, 734, 709, 517, 238, 152, 138, 120, 90, 72, 66,
0
},
{
16317,16226,16127,16040,15955,15762,15547,15345,15277,15111,14922,14723,14671,14546,
14396,14239,
0
},

FIG 43(4)

{
16382,16381,15858,15540,15539,15538,14704,14168,13768,13092,12452,11925,11683,11268,
10841,10460,
0
},
{ 5974, 3798, 3758, 3755, 1275, 205, 166, 162, 95, 35, 26, 24, 18, 11, 8, 7,
0
},
{ 3532, 2258, 2246, 2244, 731, 135, 118, 115, 87, 45, 36, 34, 29, 21, 17, 16,
0
},
{ 7466, 4882, 4821, 4811, 2476, 886, 788, 771, 688, 531, 469, 457, 437, 400, 369, 361,
0
},
{ 9580, 5772, 5291, 5216, 3444, 1496, 1025, 928, 806, 578, 433, 384, 366, 331, 296, 273,
0
},
{ 10692, 7730, 7543, 7521, 4679, 1746, 1391, 1346, 1128, 692, 495, 458, 424, 353, 291,
268,
0
},
{ 11040, 7132, 6549, 6452, 4377, 1875, 1253, 1130, 958, 631, 431, 370, 346, 296, 253,
227,
0
},
{ 12687, 9332, 8701, 8585, 6266, 3093, 2182, 2004, 1683, 1072, 712, 608, 559, 458, 373,
323,
0
},
{ 13429, 9853, 8860, 8584, 6806, 4039, 2862, 2478, 2239, 1764, 1409, 1224, 1178, 1077, 979,
903,
0
},
{ 14685,12163,11061,10668, 9101, 6345, 4871, 4263, 3908, 3200, 2668, 2368, 2285, 2106,
1942, 1819,
0
},
{ 13295,11302,10999,10945, 7947, 5036, 4490, 4385, 3391, 2185, 1836, 1757, 1424, 998, 833,
785,
0
},
{ 4992, 2993, 2972, 2970, 1269, 575, 552, 549, 530, 505, 497, 495, 493, 489, 486, 485,
0
},
{ 15419,13862,13104,12819,11429, 8753, 7220, 6651, 6020, 4667, 3663, 3220, 2995, 2511,
2107, 1871,

FIG 43(5)

```
0
},
{ 12468, 9263, 8912, 8873, 5758, 2193, 1625, 1556, 1187, 589, 371, 330, 283, 200, 149,
131,
0
},
{ 15870,15076,14615,14369,13586,12034,10990,10423, 9953, 8908, 8031, 7488, 7233, 6648,
6101, 5712,
0
},
{ 1693, 978, 976, 975, 194, 18, 16, 15, 11, 7, 6, 5, 4, 3, 2, 1,
0
},
{ 7992, 5218, 5147, 5143, 2152, 366, 282, 276, 173, 59, 38, 35, 27, 16, 11, 10,
0
}
};
```

FIG 43(6)

```
unsigned short ari_cf_r [4] ={ (3<<14)/4,(2<<14)/4,(1<<14)/4, 0};
```

FIG 44

AUDIO ENCODER, AUDIO DECODER, METHOD FOR ENCODING AND AUDIO INFORMATION, METHOD FOR DECODING AN AUDIO INFORMATION AND COMPUTER PROGRAM USING AN OPTIMIZED HASH TABLE

CROSS-REFERENCE TO RELATED APPLICATIONS

This application is a continuation of copending International Application No. PCT/EP2011/062478, filed Jul. 20, 2011, which is incorporated herein by reference in its entirety, and additionally claims priority from U.S. Patent Application No. 61/365,936, filed Jul. 20, 2010, which is also incorporated herein by reference in its entirety.

Embodiments according to the invention are related to an audio decoder for providing a decoded audio information on the basis of an encoded audio information, an audio encoder for providing an encoded audio information on the basis of an input audio information, a method for providing a decoded audio information on the basis of an encoded audio information, a method for providing an encoded audio information on the basis of an input audio information and a computer program.

Embodiments according to the invention are related to an improved spectral noiseless coding, which can be used in an audio encoder or decoder, like, for example, a so-called unified-speech-and-audio coder (USAC).

Embodiment according to the invention are related to an update of spectral coding tables for application in a current USAC specification.

BACKGROUND OF THE INVENTION

In the following, the background of the invention will be briefly explained in order to facilitate the understanding of the invention and the advantages thereof. During the past decade, big efforts have been put on creating the possibility to digitally store and distribute audio contents with good bitrate efficiency. One important achievement on this way is the definition of the International Standard ISO/IEC 14496-3. Part 3 of this Standard is related to an encoding and decoding of audio contents, and subpart 4 of part 3 is related to general audio coding. ISO/IEC 14496 part 3, subpart 4 defines a concept for encoding and decoding of general audio content. In addition, further improvements have been proposed in order to improve the quality and/or to reduce the bit rate that may be used.

According to the concept described in said Standard, a time-domain audio signal is converted into a time-frequency representation. The transform from the time-domain to the time-frequency-domain is typically performed using transform blocks, which are also designated as "frames", of time-domain samples. It has been found that it is advantageous to use overlapping frames, which are shifted, for example, by half a frame, because the overlap allows to efficiently avoid (or at least reduce) artifacts. In addition, it has been found that a windowing should be performed in order to avoid the artifacts originating from this processing of temporally limited frames.

By transforming a windowed portion of the input audio signal from the time-domain to the time-frequency domain, an energy compaction is obtained in many cases, such that some of the spectral values comprise a significantly larger magnitude than a plurality of other spectral values. Accordingly, there are, in many cases, a comparatively small number of spectral values having a magnitude, which is significantly above an average magnitude of the spectral values. A typical example of a time-domain to time-frequency domain transform resulting in an energy compaction is the so-called modified-discrete-cosine-transform (MDCT).

The spectral values are often scaled and quantized in accordance with a psychoacoustic mode1, such that quantization errors are comparatively smaller for psychoacoustically more important spectral values, and are comparatively larger for psychoacoustically less-important spectral values. The scaled and quantized spectral values are encoded in order to provide a bitrate-efficient representation thereof.

For example, the usage of a so-called Huffman coding of quantized spectral coefficients is described in the International Standard ISO/IEC 14496-3:2005(E), part 3, subpart 4.

However, it has been found that the quality of the coding of the spectral values has a significant impact on the bit rate that may be used. Also, it has been found that the complexity of an audio decoder, which is often implemented in a portable consumer device, and which should therefore be cheap and of low power consumption, is dependent on the coding used for encoding the spectral values.

In view of this situation, there is a need for a concept for an encoding and decoding of an audio content, which provides for an improved trade-off between bitrate-efficiency and resource efficiency.

SUMMARY

In accordance with one embodiment, an audio decoder for providing a decoded audio information on the basis of an encoded audio information may have: an arithmetic decoder for providing a plurality of decoded spectral values on the basis of an arithmetically encoded representation of the spectral values included in the encoded audio information; and a frequency-domain-to-time-domain converter for providing a time-domain audio representation using the decoded spectral values, in order to obtain the decoded audio information; wherein the arithmetic decoder is configured to select a mapping rule describing a mapping of a code value of the arithmetically encoded representation of spectral values representing one or more of the spectral values, or a most significant bit-plane of one or more of the spectral values, in an encoded form, onto a symbol code representing one or more of the spectral values, or a most significant bitplane of one or more of the spectral values, in a decoded form, in dependence on a context state described by a numeric current context value; wherein the arithmetic decoder is configured to determine the numeric current context value in dependence on a plurality of previously decoded spectral values; wherein the arithmetic decoder is configured to evaluate a hash table, entries of which define both significant state values amongst the numeric context values and boundaries of intervals of non-significant state values amongst the numeric context values, in order to select the mapping rule, wherein the arithmetic decoder is configured to evaluate the hash table for finding a hash table index value for which the value ari_hash_m[i]>>8 is equal or greater than c, while, if the found hash table index value i is greater than 0, the value ari_hash_m[i−1]>>8 is lower than c; wherein the arithmetic decoder is configured to select the mapping rule which is determined by a probability model index which equals to ari_hash_m[i]& 0xFF when ari_hash_m[i]>>8 is equal to c, or equals to ari_lookup_m[i] otherwise; wherein the hash table ari_hash_m is defined as given in FIGS. 22(1), 22(2), 22(3) and 22(4); and wherein the mapping table ari_lookup_m is defined as given in FIG. 21; wherein a mapping rule index value is individually associated to a numeric context value being a significant state value; and wherein ari_hash_m[i] designates an entry of the hash table ari_hash_m including hash table index value i.

In accordance with another embodiment, an audio decoder for providing a decoded audio information on the basis of an encoded audio information may have: an arithmetic decoder for providing a plurality of decoded spectral values on the basis of an arithmetically encoded representation of the spectral values included in the encoded audio information; and a frequency-domain-to-time-domain converter for providing a time-domain audio representation using the decoded spectral values, in order to acquire the decoded audio information; wherein the arithmetic decoder is configured to select a mapping rule describing a mapping of a code value of the arithmetically encoded representation of spectral values representing one or more of the spectral values, or a most significant bit-plane of one or more of the spectral values, in an encoded form, onto a symbol code representing one or more of the spectral values, or a most significant bit-plane of one or more of the spectral values, in a decoded form, in dependence on a context state described by a numeric current context value; wherein the arithmetic decoder is configured to determine the numeric current context value in dependence on a plurality of previously decoded spectral values; wherein the arithmetic decoder is configured to evaluate a hash table, entries of which define both significant state values amongst the numeric context values and boundaries of intervals of non-significant state values amongst the numeric context values, in order to select the mapping rule, wherein the hash table ari_hash_m is defined as given in FIGS. 22(1), 22(2), 22(3) and 22(4); wherein the arithmetic decoder is configured to evaluate the hash table, to determine whether the numeric current context value is identical to a table context value described by an entry of the hash table or to determine an interval described by entries of the hash table within which the numeric current context value lies, and to derive a mapping rule index value describing a selected mapping rule in dependence on a result of the evaluation, wherein a mapping rule index value is individually associated to a numeric context value being a significant state value.

In accordance with another embodiment, a method for providing a decoded audio information on the basis of an encoded audio information may have the steps of: providing a plurality of decoded spectral values on the basis of an arithmetically encoded representation of the spectral values included in the encoded audio information; and providing a time-domain audio representation using the decoded spectral values, in order to acquire the decoded audio information; wherein providing the plurality of decoded spectral values includes selecting a mapping rule describing a mapping of a code value of the arithmetically encoded representation of spectral values representing one or more of the spectral values, or a most-significant bit-plane of one or more of the spectral values, in an encoded form, onto a symbol code representing one or more of the spectral values, or a most significant bit-plane of one or more of the spectral values, in a decoded form, in dependence on a context state described by a numeric current context value; wherein the numeric current context value is determined in dependence on a plurality of previously decoded spectral values; wherein a hash table, entries of which define both significant state values amongst the numeric context values and boundaries of intervals of non-significant state values amongst the numeric context values, is evaluated in order to select the mapping rule, wherein the hash table is evaluated using the algorithm

```
i = i_min;
while ((i_max−i_min)>1)
{
i = i_min+((i_max−i_min)/2);
j = ari_hash_m[i];
if (c<(j>>8))
      i_max = i;
else if (c>(j>>8))
      i_min=i;
else
      return(j&0xFF);
}
return ari_lookup_m[i_max];
```

wherein c designates a variable representing the numeric current context value or a scaled version thereof; wherein i is a variable describing a current hash table index value; wherein i_min is a variable initialized to designate a hash table index value of a first entry of the hash table and selectively updated in dependence on a comparison between c and; wherein the condition "c<(j>>8)" defines that a state value described by the variable c is smaller than a state value described by the table entry ari_hash_m[i]; wherein "j&0xFF" describes a mapping rule index value described by the table entry ari_hash_m[i]; wherein i_max is a variable initialized to designate a hash table index value of a last entry of the hash table and selectively updated in dependence on a comparison between c and; wherein the condition "c>(j>>8)" defines that a state value described by the variable c is larger than a state value described by the table entry ari_hash_m[i]; wherein j is a variable; wherein the return value designates an index pki of a probability model, and is a mapping rule index value; wherein ari_hash_m designates the hash table; wherein ari_hash_m[i] designates an entry of the hash table ari_hash_m having hash table index value i; wherein ari_lookup_m designates a mapping table; wherein ari_lookup_m[i_max] designates an entry of the mapping table ari_lookup_m having mapping table index value i_max; wherein the hash table ari_hash_m is defined as given in FIGS. 22(1), 22(2), 22(3), 22(4); and wherein the mapping table ari_lookup_m is defined as given in FIG. 21; and wherein a mapping rule index value is individually associated to a numeric context value being a significant state value.

In accordance with another embodiment, a method for providing a decoded audio information on the basis of an encoded audio information may have the steps of: providing a plurality of decoded spectral values on the basis of an arithmetically encoded representation of the spectral values included in the encoded audio information; and providing a time-domain audio representation using the decoded spectral values, in order to acquire the decoded audio information; wherein providing a plurality of decoded spectral values includes selecting a mapping rule describing a mapping of a code value of the arithmetically encoded representation of spectral values representing one or more of the spectral values, or a most significant bit-plane of one or more of the spectral values, in an encoded form onto a symbol code representing one or more of the spectral values, or a most significant bit-plane of one or more of the spectral values, in a decoded form, in dependence on a context state described by a numeric current context value; wherein the numeric current context value is determined in dependence on a plurality of previously decoded spectral values; wherein a hash table, entries of which define both significant state values amongst the numeric context values and boundaries of intervals of non-significant state values amongst the numeric context values, is evaluated in order to select the mapping rule, wherein the hash table ari_hash_m is defined as given in FIGS. 22(1), 22(2), 22(3) and 22(4); wherein the hash table is evaluated to determine whether the numeric current context value is identical to a table context value described by an entry of the hash table or to determine an interval described by entries of the hash table within which the numeric current context value lies, and wherein a mapping rule index value describing a selected mapping rule is derived in dependence on a result of the evaluation; wherein a mapping rule index value is individually associated to a numeric context value being a significant state value.

In accordance with another embodiment, an audio encoder for providing an encoded audio information on the basis of an input audio information may have: an energy-compacting time-domain-to-frequency-domain converter for providing a frequency-domain audio representation on the basis of a time-domain representation of the input audio information, such that the frequency-domain audio representation includes a set of spectral values; and an arithmetic encoder configured to encode one or more of the spectral values or a preprocessed version thereof using a variable length codeword, wherein the arithmetic encoder is configured to map one or more of the spectral values, or a value of a most significant bit-plane of one or more of the spectral values, onto a code value, wherein the arithmetic encoder is configured to select a mapping rule describing a mapping of the one or more spectral values, or of a most significant bit-plane of the one or more spectral values, onto the code value, in dependence on a context state described by a numeric current context value; and wherein the arithmetic encoder is configured to determine the numeric current context value in dependence on a plurality of previously-encoded spectral values; and wherein the arithmetic encoder is configured to evaluate a hash table, entries of which define both significant state values amongst the numeric context values and boundaries of intervals of non-significant state values amongst the numeric context values, in order to select the mapping rule, wherein the hash table ari_hash_m is defined as given in FIGS. 22(1), 22(2), 22(3) and 22(4); wherein the arithmetic encoder is configured to evaluate the hash table, to determine whether the numeric current context value is identical to a table context value described by an entry of the hash table or to determine an interval described by entries of the hash table within which the numeric current context value lies, and to derive a mapping rule index value describing a selected mapping rule in dependence on a result of the evaluation; wherein a mapping rule index value is individually associated to a numeric context value being a significant state value.

In accordance with another embodiment, a method for providing an encoded audio information on the basis of an input audio information may have the steps of: providing a frequency-domain audio representation on the basis of a time-domain representation of the input audio information using an energy-compacting time-domain-to-frequency-domain conversion, such that the frequency-domain audio representation includes a set of spectral values; and arithmetically encoding one or more of the spectral values or a preprocessed version thereof using a variable length codeword, wherein one or more of the spectral values, or a value of a most significant bit-plane of one or more of the spectral values, is mapped onto a code value, wherein a mapping rule describing a mapping of one or more of the spectral values, or of a most significant bit-plane of one or more of the spectral values, onto a code value, is selected in dependence on a context state described by a numeric current context value; and wherein the numeric current context value is determined in dependence on a plurality of previously-encoded spectral values; and wherein a hash table, entries of which define both significant state values amongst the numeric context values and boundaries of intervals of non-significant state values amongst the numeric context values, is evaluated in order to select the mapping rule, wherein the hash table ari_hash_m is defined as given in FIGS. 22(1), 22(2), 22(3) and 22(4); and wherein the hash table is evaluated, to determine whether the numeric current context value is identical to a table context value described by an entry of the hash table or to determine an interval described by entries of the hash table within which the numeric current context value lies, and wherein a mapping rule index value describing a selected mapping rule is derived in dependence on a result of the evaluation; wherein a mapping rule index value is individually associated to a numeric context value being a significant state value.

Another embodiment may have a computer program for performing the method for providing a decoded audio information on the basis of an encoded audio information, which method may have the steps of: providing a plurality of decoded spectral values on the basis of an arithmetically encoded representation of the spectral values included in the encoded audio information; and providing a time-domain audio representation using the decoded spectral values, in order to acquire the decoded audio information; wherein providing a plurality of decoded spectral values includes selecting a mapping rule describing a mapping of a code value of the arithmetically encoded representation of spectral values representing one or more of the spectral values, or a most significant bit-plane of one or more of the spectral values, in an encoded form onto a symbol code representing one or more of the spectral values, or a most significant bit-plane of one or more of the spectral values, in a decoded form, in dependence on a context state described by a numeric current context value; wherein the numeric current context value is determined in dependence on a plurality of previously decoded spectral values; wherein a hash table, entries of which define both significant state values amongst the numeric context values and boundaries of intervals of non-significant state values amongst the numeric context values, is evaluated in order to select the mapping rule, wherein the hash table ari_hash_m is defined as given in FIGS. 22(1), 22(2), 22(3) and 22(4); wherein the hash table is evaluated to determine whether the numeric current context value is identical to a table context value described by an entry of the hash table or to determine an interval described by entries of the hash table within which the numeric current context value lies, and wherein a mapping rule index value describing a selected mapping rule is derived in dependence on a result of the evaluation; wherein a mapping rule index value is individually associated to a numeric context value being a significant state value, when the computer program runs on a computer.

Another embodiment may have a computer program for performing the method for providing an encoded audio information on the basis of an input audio information, which method may have the steps of: providing a frequency-domain audio representation on the basis of a time-domain representation of the input audio information using an energy-compacting time-domain-to-frequency-domain conversion, such that the frequency-domain audio representation includes a set of spectral values; and arithmetically encoding one or more of the spectral values or a preprocessed version thereof using a variable length codeword, wherein one or more of the spectral values, or a value of a most significant bit-plane of one or more of the spectral values, is mapped onto a code value, wherein a mapping rule describing a mapping of one or more of the spectral values, or of a most significant bit-plane of one or more of the spectral values, onto a code value, is selected in dependence on a context state described by a numeric current context value; and wherein the numeric current context value is determined in dependence on a plurality of previously-encoded spectral values; and wherein a hash table, entries of which define both significant state values amongst the numeric context values and boundaries of intervals of non-significant state values amongst the numeric context values, is evaluated in order to select the mapping rule, wherein the hash table ari_hash_m is defined as given in FIGS. 22(1), 22(2), 22(3) and 22(4); and wherein the hash table is evaluated, to determine whether the numeric current context value is identical to a table context value described by an entry of the hash table or to determine an interval described by entries of the hash table within which the numeric current context value lies, and wherein a mapping rule index value describing a selected mapping rule is derived in dependence on a result of the evaluation; wherein a mapping rule index value is individually associated to a numeric context value being a significant state value, when the computer program runs on a computer.

It has been found that the combination of the above mentioned algorithm with the hash table of FIGS. 22(1) to 22(4) allows for a particularly efficient selection of a mapping rule, as the hash table in accordance with FIGS. 22(1) to 22(4) defines, in a particularly well-suited manner, both significant values of the numeric context value and state intervals. Moreover, the interaction between said algorithm and the hash table in accordance with FIGS. 22(1) to 22(4) has shown to bring along particularly good results while keeping computational complexity reasonable small. Moreover, the mapping table defined in FIG. 21 is also particularly well-adapted to said algorithm when taken in combination with the above mentioned hash table. To summarize, the usage of the hash table as given in FIGS. 22(1) to 22(4) and of the mapping table as defined in FIG. 22 in connection with the algorithm as described above brings along a good coding/decoding efficiency and a low computational complexity.

In an advantageous embodiment, the arithmetic decoder is configured to evaluate the hash table using the algorithm as defined in FIG. 5*e*, wherein c designates a variable representing the numeric current context value or a scaled version thereof, wherein i is a variable describing a current hash table index value, wherein in i_min is a variable initialed to designate a hash table index value of a first entry of the hash table and selectively updated in dependence on a comparison between c and (j>>8). In the above mentioned algorithm, the condition "c<(j>>8)" defines that a state value described by the variable c is smaller than a state value described by the table entry ari_hash_m[i]. Also, in the above mentioned algorithm, "j&0xFF" describes a mapping rule index value described by the table entry ari_hash_m[i]. Further i_max is a variable initialized to designate a hash table index value of a last entry of the hash table an selectively updated in dependence on a comparison between c and (j>>8). The condition "c>(j>>8)" defines that a state value described by the variable c is larger than a state value described by the table entry ari_hash_m[i]. The return value of said algorithm designates an index pki of a probability model and is a mapping rule index value. "ari_hash_m" designates the hash table, and "ari_hash_m[i]" designates an entry of the hash table ari_hash-m having hash table index value i. "ari_lookup_m" designates a mapping table, and "ari_lookup_m[i_max]" designates an entry of the mapping table ari_lookup_m having mapping index value i_max.

It has been found that the combination of the above mentioned algorithm, as shown in FIG. 5*e*, with the hash table of FIGS. 22(1) to 22(4) allows for a particularly efficient selection of a mapping rule, as the hash in accordance with FIGS. 22(1) to 22(4) defines, in a particularly well-suited manner, both significant values of the numeric context value and state intervals. Moreover, the interaction between said algorithm in accordance with FIG. 5*e* and the hash table in accordance with FIGS. 22(1) to 22(4) has shown to bring along particularly good results in combination with a fast algorithm for the table search. Moreover, the mapping table defined in FIG. 21 is also particularly well-adapted to said algorithm when taken in combination with the above mentioned hash table. To summarize, the usage of the hash table as given in FIGS. 22(1) to 22(4) and of the mapping table as defined in FIG. 22 in connection with the algorithm as defined in FIG. 5*e* brings along a good coding/decoding efficiency and a low computational complexity. In other words, it has been found that the bi-section algorithm of FIG. 5*e* is well suited to operate with the tables ari_hash_m and ari_lookup_m, as defined above.

However, it should be noted that slight changes (which are easily feasible) or even significant changes of the search algorithm may be made without changing the concept according to the present invention.

In other words, the search method is not constrained to the mentioned methods. Even though the usage of the bi-section method (for example, according to FIG. 5*e*) further improves the performance, it would also be possible to perform a simple exhaustive search, which, nevertheless brings along some increase of complexity.

In an advantageous embodiment, the arithmetic decoder is configured to select the mapping rule describing a mapping of a code value onto a symbol code on the basis of the mapping rule index value pki, which is, for example provided as a return value of the algorithm shown in FIG. 5*e*. The usage of said mapping rule index value pki is very efficient, because the interaction of the above mentioned tables and the above mentioned algorithm is optimized for providing a meaningful mapping rule index value.

In an advantageous embodiment, the arithmetic decoder is configured to use the mapping rule index value as a table index value to select the mapping rule describing a mapping of a code value onto a symbol code. The usage of the mapping rule index value as a table index value allows for a computationally efficient an memory efficient selection of the mapping rule.

In an advantageous embodiment, the arithmetic decoder is configured to select one of the sub-tables of the table ari_cf_m [64][17], as defined in FIG. 23(1), 23(2), 23(3), as the selected mapping rule. This concept is based on the fact that the mapping rules defined by sub tables of the table ari_cf_m [64][17], as defined in FIG. 23(1),(2), (3), are well-adapted to the results which can be achieved by the execution of the above mentioned algorithm according to FIG. 5*e* in combination with the tabled in accordance with FIGS. 21 and 22(1) to 22(4).

In an advantageous embodiment, the arithmetic decoder is configured to obtain the numeric context value on the basis of a numeric previous context value using an algorithm in accordance with FIG. 5*c*, wherein the algorithm receives, as input values, a value of a variable c representing a numeric previous context value, a value or a variable i representing an index of a two-tuple of spectral values to decode in a vector of spectral values. A value or a variable N represents a window length of a reconstruction window of the frequency-domain-to-time-domain-converter. The algorithm provides, as an output value, an updated value or variable c representing the numeric current context value. In the algorithm, an operation "c>>4" describes a shift to the right by 4 bits of the value or variable c. Moreover, q[0][i+1] designates a context sub region value associate with a previous audio frame and having associated a higher frequency index i+1, higher by 1, than a current frequency index of a two-total of spectral values to be currently decoded Similarly q[1][i−1] designates a context sub region value associated with a current audio frame and having associated a smaller frequency index i−1, smaller by 1, then a current frequency index of a two-tuple of spectral values to be currently decoded. q[1][i−2] designates a context sub region value associated with a current audio frame and having associated a smaller frequency index i−2, smaller by 2, than a current frequency index of a two-tuple of spectral values to be currently decoded. q[1][i−3] designates a context sub region value associated with the current audio frame and having associated a smaller frequency index i−3, smaller by 3, than a current frequency index of a two-tuple of spectral values to be currently decoded. It has been found that the algorithm according to FIG. 5*e* when taken in combination with the tables of FIGS. 21 and 22(1) to 22(4) is well-adapted to provide the mapping rule index value on the basis of a numeric current context value c obtained using the algorithm of FIG. 5*c*, wherein obtaining the numeric current context value using the algorithm of FIG. 5*c* is computationally particularly efficient, because the algorithm according to FIG. 5*c* may use only a very simple computation.

In an advantageous embodiment, the arithmetic decoder is configured to update a context sub region value q[1][i] associated with a current audio frame and having associated the current frequency index of the two-tuple of spectral values currently decoded using an algorithm according to FIG. 5*l*, wherein a designates an absolute value of a first spectral value of the two-tuple of the spectral values currently decoded, and wherein b designates a second spectral value of the two-tuple of spectral values currently decoded. It can be seen that the advantageous algorithm is very well-suited for a simple update of the context sub region values.

In an advantageous embodiment, the arithmetic decoder is configured to provide a decoded value m representing a two-tuple of decoded spectral values using the arithmetic decoding algorithm according to FIG. 5*g*. It has been found that said arithmetic decoding algorithm is very well-suited for the cooperation with the above described algorithms.

Another embodiment according to the invention creates a decoder for providing a decoded audio information on the basis of an encoded audio information. The audio decoder comprises an arithmetic decoder for providing a plurality of decoded spectral values on the basis of an arithmetically encoded representation of the spectral values. The audio decoder also comprises a frequency-domain-to-time-domain converter for providing a time-domain audio representation using the decoded spectral values, in order to obtain the decoded audio information. The arithmetic decoder is configured to select a mapping rule describing a mapping of a code value representing a spectral value, or a most-significant bit-plane of a spectral value, in a encoded form, onto a symbol code representing a spectral value, or a most-significant bit-plane of a spectral value, in a decoded form, in dependence on a context state described by a numeric current context value. The arithmetic decoder is configured to determine the numeric current context value in dependence on a plurality of previously decoded spectral values. The arithmetic decoder is configured to evaluate the hash table, entries of which define both significant state values amongst the numeric context values and boundaries of intervals of numeric context values, in order to select the mapping rule. The hash table ari_hash_m is defined as given in FIGS. 22(1), 22(2), 22(3) and 22(4). The arithmetic decoder is configured to evaluate the hash table to determine whether the numeric current context value is identical to a table context value described by an entry of the hash table or to determine an interval described by entries of the hash table within which the numeric current context value lies, and to derive a mapping rule index value describing a selected mapping rule in dependence on a result of a evaluation. It has been found that the hash table ari_hash_m ais given in FIGS. 22(1) to 22(4) is well-suited for a parsing for table context values described by entries of the hash table and intervals described by entries of the hash table, to thereby derive the mapping index value. It has been found that the definition of both table context values and intervals by the hash table in accordance with FIGS. 22(1) to 22(4) provides an efficient mechanism for the selection of the mapping rule when taken in combination with a simple concept for the evaluation of the hash table which uses entries of said hash table both to a check for table context values and to determine in which interval defined by entries of the hash table a non-table context values lies.

In an advantageous embodiment, the arithmetic decoder is configured to compare the numeric current context value, or a scaled version of the numeric current context value, with a series of the numerically ordered entries or sub-entries of the hash table, to iteratively obtain a hash table index value of a table entry, such that the numeric current context value lies within a interval defined by the obtained hash table entry designated by the obtained hash table index value and an adjacent hash table entry. In this case, the arithmetic decoder is configured to determine a next entry of the series of entries of the hash table in dependence on a result of a comparison between the numeric current context value, or a scaled version of the numeric current context value, and a current entry or sub-entry. It has been recognized that this mechanism allows for a particularly efficient evaluation of the hash table in accordance with FIGS. 22(1) to 22(4).

In an advantageous embodiment, the arithmetic decoder is configured to select a mapping rule defined by a second sub-entry of the hash table designated by the current hash table index value if it is found that the numeric current context value or a scaled version thereof is equal to the first sub-entry of the hash table designated by the current hash table index value. Accordingly, the entries of the hash-table, as defined in accordance with FIGS. 22(1) to 22(4) take over a double function. A first sub-entry (i.e., a first portion of an entry) of the hash table is used for identifying particularly significant states of the numeric (current) context value, while a second sub-entry of the hash table (i.e., a second part of such an entry) defines a mapping rule, for example, by defining a mapping rule index value. Thus, the entries of the hash table are used in a very efficient manner. Also, the mechanism is particularly efficient in providing mapping rule index values for the particularly important states of the numeric current context values, which are described by entries of the hash table, or, more precisely, by sub-entries of the hash table. Thus, a complete entry of the hash table, as defined in FIGS. 22(1) to 22(4), defines rules a mapping of a particularly important state of the numeric (current) context value to a mapping rule and interval boundaries of regions (or intervals) of less important states of the numeric current context value.

In an advantageous embodiment, the arithmetic decoder is configured to select a mapping rule defined by an entry or sub-entry of a mapping table ari_lookup_m if it is not found that the numeric current context value is equal to a sub-entry of the hash table. In this case, the arithmetic decoder is configured to choose the entry or sub-entry of the mapping table in dependence on the iteratively obtained hash table index value. Thus, a particularly efficient two-table mechanism is created, which allows to efficiently provide a mapping rule index value both for particularly important states of the numeric current context value and for less important states of the numeric current context value (wherein the less important states of the numeric current context value are not explicitly, i.e. individually, described by entries or sub-entries of the hash table).

In an advantageous embodiment, the arithmetic decoder is configured to selectively provide a mapping rule index value defined by the entry of the hash table designated by the obtained hash table index value if it is found that the numeric current context value equals the value defined by the entry of the hash table designated by the current hash table index value. Thus, there is an efficient mechanism which allows for the double-usage of the entries of the hash table.

Further embodiments of the invention create methods for providing a decoded audio information on the basis of an encoded audio information. Said methods fulfill the functionality of the audio decoders discussed before. Accordingly, the methods are based on the same ideas and findings as the audio decoders, such that a discussion is omitted here for the sake of brevity. It should be noted that the methods can be supplemented by any of the features and functionalities of the audio decoders.

Another embodiment according to the invention creates an audio decoder for providing an encoded audio information on the basis of an input audio information. The audio encoder comprises an energy-compacting time-domain-to-frequency-domain converter for providing a frequency-domain audio representation on the basis of a time-domain representation of the input audio information, such that the frequency-domain audio representation comprises a set of spectral values. The audio encoder also comprises an arithmetic encoder configured to encode a spectral value or a preprocessed version thereof using a variable length codeword.

The arithmetic encoder is configured to map a spectral value, or a value of a most significant bit-plane of a spectral value, onto a code value. The arithmetic encoder is also configured to select a mapping rule describing a mapping of a spectral value, or a most significant bit-plane of a spectral value, onto a code value, in dependence on a context state described by a numeric current context value. The arithmetic encoder is configured to determine the numeric current context value in dependence on a plurality of previously-encoded spectral values. The arithmetic encoder is also configured to evaluate a hash table, entries of which define both significant state values amongst the numeric context values and boundaries of intervals of numeric context values, in order to select the mapping rule. The hash table ari_hash_m is defined as given in FIGS. 22(1) to 22(4). The arithmetic encoder is configured to evaluate the hash table to determine whether the numeric current context value is identical to a table context value described by an entry of the hash table or to determine an interval described by entries of the hash table within which the numeric current context value lies, and to derive a mapping rule index value describing a selected mapping rule in dependence on a result of said evaluation. It should be noted that the functionality of the audio encoder is in parallel with the functionality of the audio decoder discussed above. Accordingly, reference is made to the above discussion of the key ideas of the audio decoder for the sake of brevity.

Moreover, it should be noted that the audio encoder can be supplemented by any of the features and functionalities of the audio decoder. In particular, any of the features regarding the selection of the mapping rule can be implemented in the audio encoder as well, wherein encoded spectral values take the place of decoded spectral values, and so on.

Another embodiment according to the invention creates a method for providing an encoded audio information on the basis for an input audio information. The method performs the functionality of the audio encoder described before in is based on the same ideas.

Another embodiment according to the invention creates a computer program for performing at least one of the methods described before.

BRIEF DESCRIPTION OF THE DRAWINGS

Embodiments according to the present invention will subsequently be described taking reference to the enclosed figures, in which:

FIG. 3 shows a pseudo-program-code representation of an algorithm "values_decode( )" for decoding spectral values;

FIG. 5*a* shows a pseudo-program-code representation of an algorithm "arith_map_context( )" for mapping a context;

FIG. 5*b* shows a pseudo-program-code representation of another algorithm "arith_map_context( )" for mapping a context;

FIG. 5*c* shows a pseudo-program-code representation of an algorithm "arith_get_context( )" for obtaining a context state value;

FIG. 5*d* shows a pseudo-program-code representation of another algorithm "arith_get_context( )" for obtaining a context state value;

FIG. 5*e* shows a pseudo-program-code representation of an algorithm "arith_get_pk( )" for deriving a cumulative-frequencies-table index value "pki" from a state value (or a state variable);

FIG. 5*f* shows a pseudo-program-code representation of another algorithm "arith_get_pk( )" for deriving a cumulative-frequencies-table index value "pki" from a state value (or a state variable);

FIG. 5*g* shows a pseudo-program-code representation of an algorithm "arith_decode( )" for arithmetically decoding a symbol from a variable length codeword;

FIG. 5*h* shows a first part of a pseudo-program-code representation of another algorithm "arith_decode( )" for arithmetically decoding a symbol from a variable length codeword;

FIG. 5*i* shows a second part of a pseudo-program-code representation of the other algorithm "arith_decode( )" for arithmetically decoding a symbol from a variable length codeword;

FIG. 5*j* shows a pseudo-program-code representation of an algorithm for deriving absolute values a,b of spectral values from a common value m;

FIG. 5*k* shows a pseudo-program-code representation of an algorithm for entering the decoded values a,b into an array of decoded spectral values;

FIG. 5*l* shows a pseudo-program-code representation of an algorithm "arith_update_context( )" for obtaining a context subregion value on the basis of absolute values a,b of decoded spectral values;

FIG. 5*m* shows a pseudo-program-code representation of an algorithm "arith_finish( )" for filling entries of an array of decoded spectral values and an array of context subregion values;

FIG. 5*n* shows a pseudo-program-code representation of another algorithm for deriving absolute values a,b of decoded spectral values from a common value m;

FIG. 5*o* shows a pseudo-program-code representation of an algorithm "arith_update_context( )" for updating an array of decoded spectral values and an array of context subregion values;

FIG. 5*p* shows a pseudo-program-code representation of an algorithm "arith_save_context( )" for filling entries of an array of decoded spectral values and entries of an array of context subregion values;

FIG. 5*q* shows a legend of definitions;

FIG. 5*r* shows another legend of definitions;

FIG. 6*a* shows a syntax representation of a unified-speech-and-audio-coding (USAC) raw data block;

FIG. 6*b* shows a syntax representation of a single channel element;

FIG. 6*c* shows a syntax representation of a channel pair element;

FIG. 6*d* shows a syntax representation of an "ICS" control information;

FIG. 6*e* shows a syntax representation of a frequency-domain channel stream;

FIG. 6*f* shows a syntax representation of arithmetically coded spectral data;

FIG. 6*g* shows a syntax representation for decoding a set of spectral values;

FIG. 6*h* shows another syntax representation for decoding a set of spectral values;

FIG. 6*i* shows a legend of data elements and variables;

FIG. 6*j* shows another legend of data elements and variables;

FIG. 6*k* shows a syntax representation of a USAC single channel element "UsacSingleChannelElement( )";

FIG. 6*l* shows a syntax representation of a USAC channel pair element "UsacChannelPairElement( )";

FIG. 6*m* shows a syntax representation of an "ICS" control information;

FIG. 6*n* shows a syntax representation of USAC core coder data "UsacCoreCoderData";

FIG. 6*o* shows a syntax representation of a frequency domain channel stream "fd_channel_stream( )";

FIG. 6*p* shows a syntax representation of arithmetically coded spectral data "ac_spectral_data( )";

FIG. 14*b* shows an overview of the tables as used in the arithmetic coding scheme according to working draft 4 of the USAC Draft Standard;

FIG. 15*b* shows an overview of the tables as used in the arithmetic coding scheme according to a comparison example;

FIG. 18 shows a table representation of average bit rates produced by a USAC arithmetic coder according to working draft 3 of the USAC Draft Standard and according to a comparison example;

FIG. 19 shows a table representation of minimum and maximum bit reservoir levels for an arithmetic decoder according to working draft 3 of the USAC Draft Standard and for an arithmetic decoder according to a comparison example;

FIG. 20 shows a table representation of average complexity numbers for decoding a 32-kbits bitstream according to working draft 3 of the USAC Draft Standard for different versions of the arithmetic coder;

FIG. 21 shows a table representation of a content of a table "ari_lookup_m[742]", according to an embodiment of the invention;

FIGS. 22(1) to 22(4) show a table representation of a content of a table "ari_hash_m[742]", according to an embodiment of the invention;

FIGS. 23(1) to 23(3) show a table representation of a content of a table "ari_cf_m[64][17]", according to an embodiment of the invention; and FIG. 24 shows a table representation of a content of a table "ari_cf_41";

FIG. 29 shows a table representation of characteristics of tables as used in an embodiment according to the invention ("Re-trained coding scheme");

FIG. 30 shows a table representation of average complexity numbers for decoding the 32 kbit/s WD6 reference quality bitstreams for the different arithmetic coder versions;

FIG. 31 shows a table representation of average complexity numbers for decoding the 12 kbit/s WD6 reference quality bitstreams for the different arithmetic coder versions;

FIG. 32 shows a table representation of average bitrates produced by the arithmetic coder in an embodiment according to the invention and in the WD6;

FIG. 33 shows a table representation of minimum, maximum and average bitrates of USAC on a frame basis using the proposed scheme;

FIG. 34 shows a table representation of average bitrates produced by a USAC coder using WD6 arithmetic coder and a coder according to an embodiment according to the invention ("new proposal");

FIG. 35 shows a table representation of best and worst cases for an embodiment according to the invention;

FIG. 36 shows a table representation of bitreservoir limit for an embodiment according to the invention;

FIG. 37 shows a syntax representation of arithmetically coded data "arith_data", according to an embodiment of the invention;

FIG. 38 shows a legend of definitions an help elements;

FIG. 39 shows another legend of definitions;

FIG. 40*a* shows a pseudo-program-code representation of a function or algorithm "arith_map_context", according to an embodiment of the invention;

FIG. 40*b* shows a pseudo-program-code representation of a function or algorithm "arith_get_context", according to an embodiment of the invention;

FIG. 40*c* shows a pseudo-program-code representation of a function or algorithm "arith_map_pk", according to an embodiment of the invention;

FIG. 40*d* shows a pseudo-program-code representation of a first portion of a function or algorithm "arith_decode", according to an embodiment of the invention;

FIG. 40*e* shows a pseudo-program-code representation of a second portion of a function or algorithm "arith_decode", according to an embodiment of the invention;

FIG. 40*f* shows a pseudo-program-code representation of a function or algorithm for decoding one or more least significant bits, according to an embodiment of the invention;

FIG. 40*g* shows a pseudo-program-code representation of a function or algorithm "arith_update_context", according to an embodiment of the invention;

FIG. 40*h* shows a pseudo-program-code representation of a function or algorithm "arith_save_context", according to an embodiment of the invention;

FIGS. 41(1) and 41(2) show a table representation of a content of a table "ari_lookup_m[742]", according to an embodiment of the invention;

FIGS. 42 (1),(2),(3),(4) show a table representation of a content of a table "ari_hash_m[742]", according to an embodiment of the invention;

FIGS. 43 (1),(2),(3),(4),(5),(6) show a table representation of a content of a table "ari_cf_m[96][17]", according to an embodiment of the invention; and FIG. 44 shows a table representation of a table "ari_cf_r[4]", according to an embodiment of the invention.

DETAILED DESCRIPTION OF THE INVENTION

1. Audio Encoder according to FIG. 7

Figure 7:
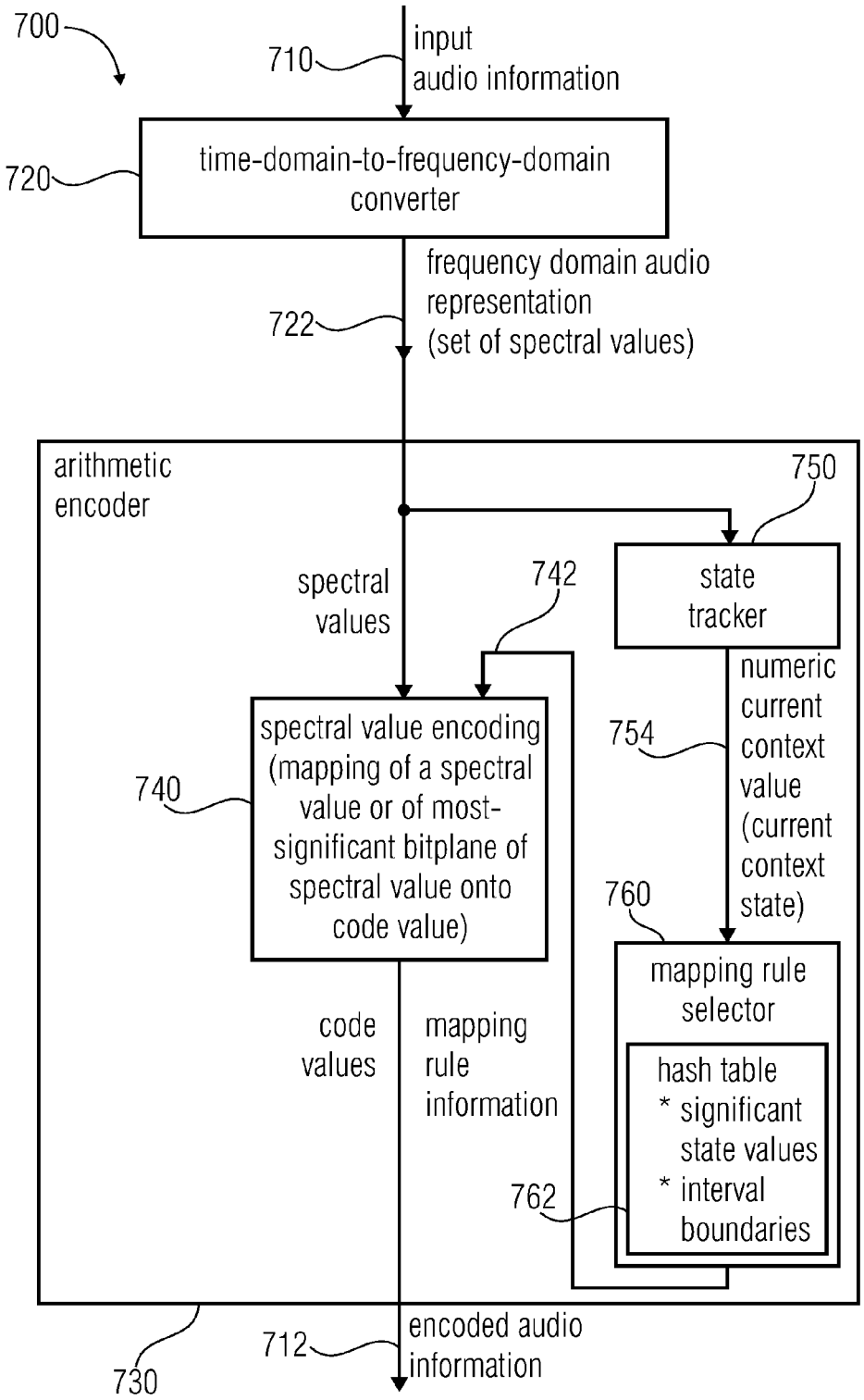
FIG. 7 shows a block schematic diagram of an audio encoder, according to the first aspect of the invention.

FIG. 7 shows a block schematic diagram of an audio encoder, according to an embodiment of the invention. The audio encoder 700 is configured to receive an input audio information 710 and to provide, on the basis thereof, an encoded audio information 712.

The audio encoder comprises an energy-compacting time-domain-to-frequency-domain converter 720 which is configured to provide a frequency-domain audio representation 722 on the basis of a time-domain representation of the input audio information 710, such that the frequency-domain audio representation 722 comprises a set of spectral values.

The audio encoder 700 also comprises an arithmetic encoder 730 configured to encode a spectral value (out of the set of spectral values forming the frequency-domain audio representation 722), or a pre-processed version thereof, using a variable-length codeword in order to obtain the encoded audio information 712 (which may comprise, for example, a plurality of variable-length codewords).

The arithmetic encoder 730 is configured to map a spectral value, or a value of a most-significant bit-plane of a spectral value, onto a code value (i.e. onto a variable-length codeword) in dependence on a context state.

The arithmetic encoder is configured to select a mapping rule describing a mapping of a spectral value, or of a most-significant bit-plane of a spectral value, onto a code value, in dependence on a (current) context state. The arithmetic encoder is configured to determine the current context state, or a numeric current context value describing the current context state, in dependence on a plurality of previously-encoded (advantageously, but not necessarily, adjacent) spectral values.

For this purpose, the arithmetic encoder is configured to evaluate a hash-table, entries of which define both significant state values amongst the numeric context values and boundaries of intervals of numeric context values.

The hash_table (also designated as "ari_hash_m" in the following) is advantageously defined as given in the table representation of FIGS. 22(1), 22(2), 22(3) and 22(4).

Moreover, the arithmetic encoder is advantageously configured to evaluate the hash table(ari_hash_m), to determine whether the numeric current context value is identical to a table context value described by entries of the hash table (ari_hash_m) and/or to determine an interval described by entries of the hash table (ari_hash_m) within which the numeric current context value lies, and to derive a mapping rule index value (for example, designated with "pki" herein) describing a selected mapping rule in dependence on a result of the evaluation.

In some cases, a mapping rule index value may be individually associated to a numeric (current) context value being a significant state value. Also, a common mapping rule index value may be associated to different numeric (current) context values lying within an interval bounded by interval boundaries (wherein the interval boundaries are advantageously defined by the entries of the hash table).

As can be seen, the mapping of a spectral value (of the frequency-domain audio representation 722), or of a most-significant bit-plane of a spectral value, onto a code value (of the encoded audio information 712), may be performed by a spectral value encoding 740 using a mapping rule 742. A state tracker 750 may be configured to track the context state. The state tracker 750 provides an information 754 describing the current context state. The information 754 describing the current context state may advantageously take the form of a numeric current context value. A mapping rule selector 760 is configured to select a mapping rule, for example, a cumulative-frequencies-table, describing a mapping of a spectral value, or of a most-significant bit-plane of a spectral value, onto a code value. Accordingly, the mapping rule selector 760 provides the mapping rule information 742 to the spectral value encoding 740. The mapping rule information 742 may take the form of a mapping rule index value or of a cumulative-frequencies-table selected in dependence on a mapping rule index value. The mapping rule selector 760 comprises (or at least evaluates) a hash-table 752, entries of which define both significant state values amongst the numeric context values and boundaries and intervals of numeric context values. Advantageously, the entries of the hash table 762 (ari_hash_m[742]) are defined as given in the table representation of FIGS. 22(1) to 22(4). The hash-table 762 is evaluated in order to select the mapping rule, i.e. in order to provide the mapping rule information 742.

Advantageously, but not necessarily, a mapping rule index value may be individually associated to a numeric context value being a significant state value, and a common mapping rule index value may be associated to different numeric context values lying within an interval bounded by interval boundaries.

To summarize the above, the audio encoder 700 performs an arithmetic encoding of a frequency-domain audio representation provided by the time-domain-to-frequency-domain converter. The arithmetic encoding is context-dependent, such that a mapping rule (e.g. a cumulative-frequencies-table) is selected in dependence on previously encoded spectral values. Accordingly, spectral values adjacent in time and/or frequency (or, at least, within a predetermined environment) to each other and/or to the currently-encoded spectral value (i.e. spectral values within a predetermined environment of the currently encoded spectral value) are considered in the arithmetic encoding to adjust the probability distribution evaluated by the arithmetic encoding. When selecting an appropriate mapping rule, numeric context current values 754 provided by a state tracker 750 are evaluated. As typically the number of different mapping rules is significantly smaller than the number of possible values of the numeric current context values 754, the mapping rule selector 760 allocates the same mapping rules (described, for example, by a mapping rule index value) to a comparatively large number of different numeric context values. Nevertheless, there are typically specific spectral configurations (represented by specific numeric context values) to which a particular mapping rule should be associated in order to obtain a good coding efficiency.

It has been found that the selection of a mapping rule in dependence on a numeric current context value can be performed with particularly high computational efficiency if entries of a single hash-table define both significant state values and boundaries of intervals of numeric (current) context values. Moreover, it has been found that the usage of the hash table as defined in FIGS. 22(1), 22(2), 22(3), 22(4) brings along a particularly high coding efficiency. It has been found that this mechanism, in combination with said hash table, is well-adapted to the requirements of the mapping rule selection, because there are many cases in which a single significant state value (or significant numeric context value) is embedded between a left-sided interval of a plurality of non-significant state values (to which a common mapping rule is associated) and a right-sided interval of a plurality of non-significant state values (to which a common mapping rule is associated). Also, the mechanism of using a single hash-table, entries of which are defined in the tables of FIGS. 22(1), 22(2), 22(3), 22(4) and define both significant state values and boundaries of intervals of numeric (current) context values can efficiently handle different cases, in which, for example, there are two adjacent intervals of non-significant state values (also designated as non-significant numeric context values) without a significant state value in between. A particularly high computational efficiency is achieved due to a number of table accesses being kept small. For example, a single iterative table search is sufficient in most embodiments in order to find out whether the numeric current context value is equal to any of the significant state values defined by the entries of said hash table, or in which of the intervals of non-significant state values the numeric current context value lays. Consequently, the number of table accesses which are both, time-consuming and energy-consuming, can be kept small. Thus, the mapping rule selector 760, which uses the hash-table 762, may be considered as a particularly efficient mapping rule selector in terms of computational complexity, while still allowing to obtain a good encoding efficiency (in terms of bitrate).

Further details regarding the derivation of the mapping rule information 742 from the numeric current context value 754 will be described below.

2. Audio Decoder According to FIG. 8

Figure 8:
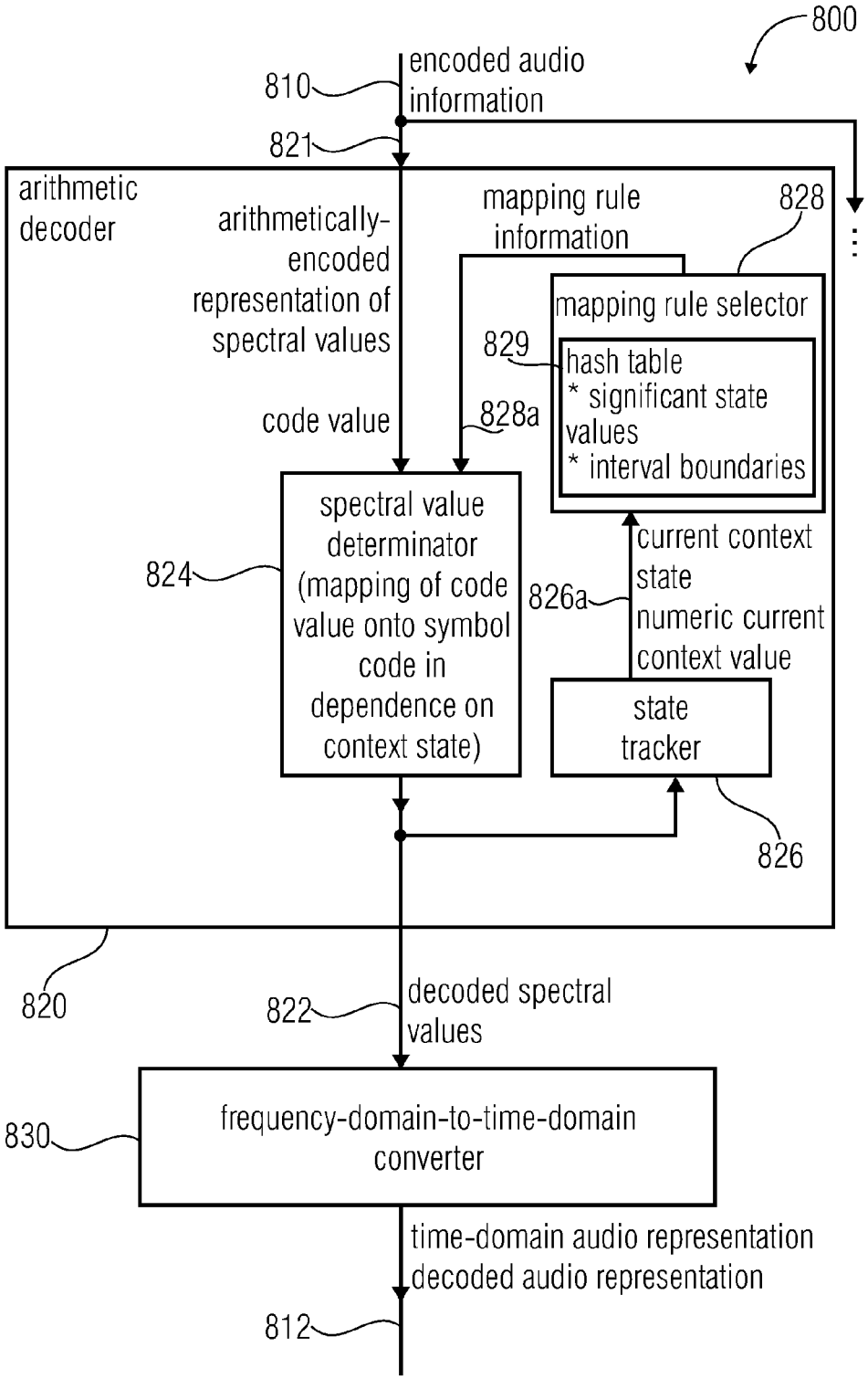
FIG. 8 shows a block schematic diagram of an audio decoder, according to the first aspect of the invention.

FIG. 8 shows a block schematic diagram of an audio decoder 800. The audio decoder 800 is configured to receive an encoded audio information 810 and to provide, on the basis thereof, a decoded audio information 812.

The audio decoder 800 comprises an arithmetic decoder 820 which is configured to provide a plurality of spectral values 822 on the basis of an arithmetically encoded representation 821 of the spectral values.

The audio decoder 800 also comprises a frequency-domain-to-time-domain converter 830 which is configured to receive the decoded spectral values 822 and to provide the time-domain audio representation 812, which may constitute the decoded audio information, using the decoded spectral values 822, in order to obtain a decoded audio information 812.

The arithmetic decoder 820 comprises a spectral value determinator 824, which is configured to map a code value of the arithmetically-encoded representation 821 of spectral values onto a symbol code representing one or more of the decoded spectral values, or at least a portion (for example, a most-significant bit-plane) of one or more of the decoded spectral values. The spectral value determinator 824 may be configured to perform a mapping in dependence on a mapping rule, which may be described by a mapping rule information 828*a*. The mapping rule information 828*a* may, for example, take the form of a mapping rule index value, or of a selected cumulative-frequencies-table (selected, for example, in dependence on a mapping rule index value).

The arithmetic decoder 820 is configured to select a mapping rule (e.g. a cumulative-frequencies-table) describing a mapping of code values (described by the arithmetically-encoded representation 821 of spectral values) onto a symbol code (describing one or more spectral values, or a most-significant bit-plane thereof, in a decoded form) in dependence on a context state (which may be described by the context state information 826*a*).

The arithmetic decoder 820 is configured to determine the current context state (described by the numeric current context value) in dependence on a plurality of previously-decoded spectral values. For this purpose, a state tracker 826 may be used, which receives an information describing the previously-decoded spectral values and which provides, on the basis thereof, a numeric current context value 826*a* describing the current context state.

The arithmetic decoder is also configured to evaluate a hash-table 829, entries of which define both significant state values amongst the numeric context values and boundaries of intervals of numeric context values, in order to select the mapping rule. Advantageously, the entries of the hash table 829 (ari_hash_m[742]) are defined as given in the table representation of FIGS. 22(1) to 22(4). The hash-table 829 is evaluated in order to select the mapping rule, i.e. in order to provide the mapping rule information 829.

Advantageously, a mapping rule index value is individually associated to a numeric context value being a significant state value, and a common mapping rule index value is associated to different numeric context values lying within an interval bounded by interval boundaries. The evaluation of the hash-table 829 may, for example, be performed using a hash-table evaluator which may be part of the mapping rule selector 828. Accordingly, a mapping rule information 828*a*, for example, in the form of a mapping rule index value, is obtained on the basis of the numeric current context value 826*a* describing the current context state. The mapping rule selector 828 may, for example, determine the mapping rule index value 828*a* in dependence on a result of the evaluation of the hash-table 829. Alternatively, the evaluation of the hash-table 829 may directly provide the mapping rule index value.

Regarding the functionality of the audio signal decoder 800, it should be noted that the arithmetic decoder 820 is configured to select a mapping rule (e.g. a cumulative-frequencies-table) which is, on average, well adapted to the spectral values to be decoded, as the mapping rule is selected in dependence on the current context state (described, for example, by the numeric current context value), which in turn is determined in dependence on a plurality of previously-decoded spectral values. Accordingly, statistical dependencies between adjacent spectral values to be decoded can be exploited. Moreover, the arithmetic decoder 820 can be implemented efficiently, with a good trade-off between computational complexity, table size, and coding efficiency, using the mapping rule selector 828. By evaluating a (single) hash-table 829, entries of which describe both significant state values and interval boundaries of intervals of non-significant state values, a single iterative table search may be sufficient in order to derive the mapping rule information 828*a* from the numeric current context value 826*a*. Moreover, it has been found that the usage of the hash table as defined in FIGS. 22(1), 22(2), 22(3), 22(4) brings along a particularly high coding efficiency. Accordingly, it is possible to map a comparatively large number of different possible numeric (current) context values onto a comparatively smaller number of different mapping rule index values. By using the hash-table 829, as described above, and as defined in the table representation of FIGS. 22(1) to 22(4), it is possible to exploit the finding that, in many cases, a single isolated significant state value (significant context value) is embedded between a left-sided interval of non-significant state values (non-significant context values) and a right-sided interval of non-significant state values (non-significant context values), wherein a different mapping rule index value is associated with the significant state value (significant context value), when compared to the state values (context values) of the left-sided interval and the state values (context values) of the right-sided interval. However, usage of the hash-table 829 is also well-suited for situations in which two intervals of numeric state values are immediately adjacent, without a significant state value in between.

To conclude, the mapping rule selector 828, which evaluates the hash-table 829 "ari_hash_m[742], brings along a particularly good efficiency when selecting a mapping rule (or when providing a mapping rule index value) in dependence on the current context state (or in dependence on the numeric current context value describing the current context state), because the hashing mechanism is well-adapted to the typical context scenarios in an audio decoder.

Further details will be described below.

3. Context Value Hashing Mechanism According to FIG. 9

In the following, a context hashing mechanism will be disclosed, which may be implemented in the mapping rule selector 760 and/or the mapping rule selector 828. The hash-table 762 and/or the hash-table 829, as defined in the table representation of FIGS. 22(1) to 22(4), may be used in order to implement said context value hashing mechanism.

Taking reference now to FIG. 9, which shows a numeric current context value hashing scenario, further details will be described. In the graphic representation of FIG. 9, an abscissa 910 describes values of the numeric current context value (i.e. numeric context values). An ordinate 912 describes mapping rule index values. Markings 914 describe mapping rule index values for non-significant numeric context values (describing non-significant states). Markings 916 describe mapping rule index values for "individual" (true) significant numeric context values describing individual (true) significant states. Markings 916 describe mapping rule index values for "improper" numeric context values describing "improper" significant states, wherein an "improper" significant state is a significant state to which the same mapping rule index value is associated as to one of the adjacent intervals of non-significant numeric context values.

As can be seen, a hash-table entry "ari_hash_m[i1]" describes an individual (true) significant state having a numeric context value of c1. As can be seen, the mapping rule index value mriv1 is associated to the individual (true) significant state having the numeric context value c1. Accordingly, both the numeric context value c1 and the mapping rule index value mriv1 may be described by the hash-table entry "ari_hash_m[i1]". An interval 932 of numeric context values is bounded by the numeric context value c1, wherein the numeric context value c1 does not belong to the interval 932, such that the largest numeric context value of interval 932 is equal to c1−1. A mapping rule index value of mriv4 (which is different from mriv1) is associated with the numeric context values of the interval 932. The mapping rule index value mriv4 may, for example, be described by the table entry "ari_lookup_m[i1−1]" of an additional table "ari_lookup_m".

Moreover, a mapping rule index value mriv2 may be associated with numeric context values lying within an interval 934. A lower bound of interval 934 is determined by the numeric context value c1, which is a significant numeric context value, wherein the numeric context value c1 does not belong to the interval 932. Accordingly, the smallest value of the interval 934 is equal to c1+1 (assuming integer numeric context values). Another boundary of the interval 934 is determined by the numeric context value c2, wherein the numeric context value c2 does not belong to the interval 934, such that the largest value of the interval 934 is equal to c2−1. The numeric context value c2 is a so-called "improper" numeric context value, which is described by a hash-table entry "ari_hash_m[i2]". For example, the mapping rule index value mriv2 may be associated with the numeric context value c2, such that the numeric context value associated with the "improper" significant numeric context value c2 is equal to the mapping rule index value associated with the interval 934 bounded by the numeric context value c2. Moreover, an interval 936 of numeric context value is also bounded by the numeric context value c2, wherein the numeric context value c2 does not belong to the interval 936, such that the smallest numeric context value of the interval 936 is equal to c2+1. A mapping rule index value mriv3, which is typically different from the mapping rule index value mriv2, is associated with the numeric context values of the interval 936.

As can be seen, the mapping rule index value mriv4, which is associated to the interval 932 of numeric context values, may be described by an entry "ari_lookup_m[i1−1]" of a table "ari_lookup_m", the mapping rule index mriv2, which is associated with the numeric context values of the interval 934, may be described by a table entry "ari_lookup_m[i1]" of the table "ari_lookup_m", and the mapping rule index value mriv3 may be described by a table entry "ari_lookup_m[i2]" of the table "ari_lookup_m". In the example given here, the hash-table index value i2, may be larger, by 1, than the hash-table index value i1.

Figure 9:
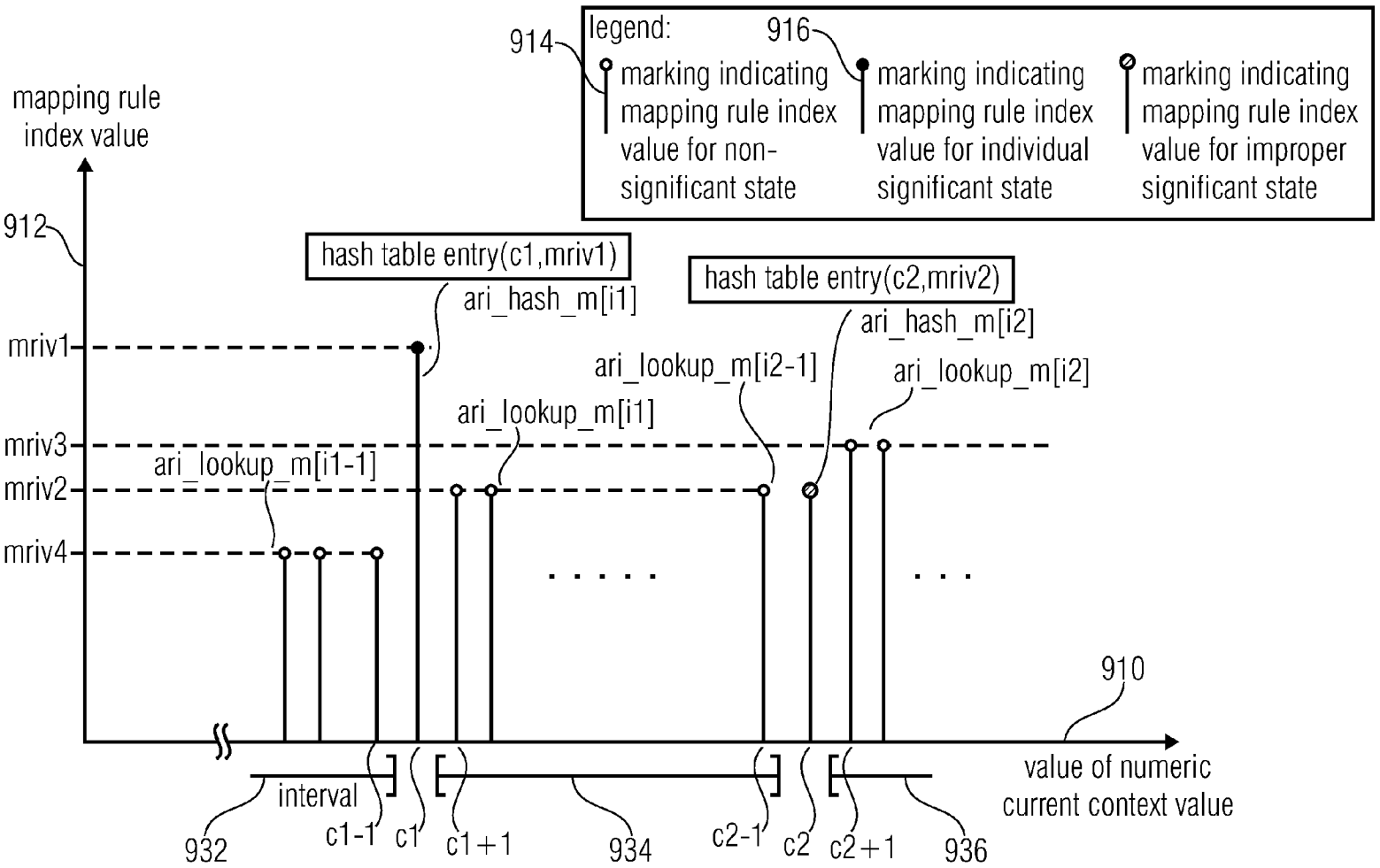
FIG. 9 shows a graphical representation of a mapping of a numeric current context value onto a mapping rule index value, according to the first aspect of the invention.

As can be seen from FIG. 9, the mapping rule selector 760 or the mapping rule selector 828 may receive a numeric current context value 764, 826*a*, and decide, by evaluating the entries of the table "ari_hash_m", whether the numeric current context value is a significant state value (irrespective of whether it is an "individual" significant state value or an "improper" significant state value), or whether the numeric current context value lies within one of the intervals 932, 934, 936, which are bounded by the ("individual" or "improper") significant state values c1, c2. Both the check whether the numeric current context value is equal to a significant state value c1, c2 and the evaluation in which of the intervals 932, 934, 936 the numeric current context value lies (in the case that the numeric current context value is not equal to a significant state value) may be performed using a single, common hash table search.

Moreover, the evaluation of the hash-table "ari_hash_m" may be used to obtain a hash-table index value (for example, i1−1, i1 or i2). Thus, the mapping rule selector 760, 828 may be configured to obtain, by evaluating a single hash-table 762, 829 (for example, the hash-table "ari_hash_m"), a hash-table index value (for example, i1−1, i1 or i2) designating a significant state value (e.g., c1 or c2) and/or an interval (e.g., 932,934,936) and an information as to whether the numeric current context value is a significant context value (also designated as significant state value) or not.

Moreover, if it is found in the evaluation of the hash-table 762, 829, "ari_hash_m", that the numeric current context value is not a "significant" context value (or "significant" state value), the hash-table index value (for example, i1−1, i1 or i2) obtained from the evaluation of the hash-table ("ari_hash_m") may be used to obtain a mapping rule index value associated with an interval 932, 934, 936 of numeric context values. For example, the hash-table index value (e.g., i1−1, i1 or i2) may be used to designate an entry of an additional mapping table (for example, "ari_lookup_m"), which describes the mapping rule index values associated with the interval 932, 934, 936 within which the numeric current context value lies.

For further details, reference is made to the detailed discussion below of the algorithm "arith_get_pk" (wherein there are different options for this algorithm "arith_get_pk( )", examples of which are shown in FIGS. 5*e* and 5*f*).

Moreover, it should be noted that the size of the intervals may differ from one case to another. In some cases, an interval of numeric context values comprises a single numeric context value. However, in many cases, an interval may comprise a plurality of numeric context values.

4. Audio Encoder According to FIG. 10

Figure 10:
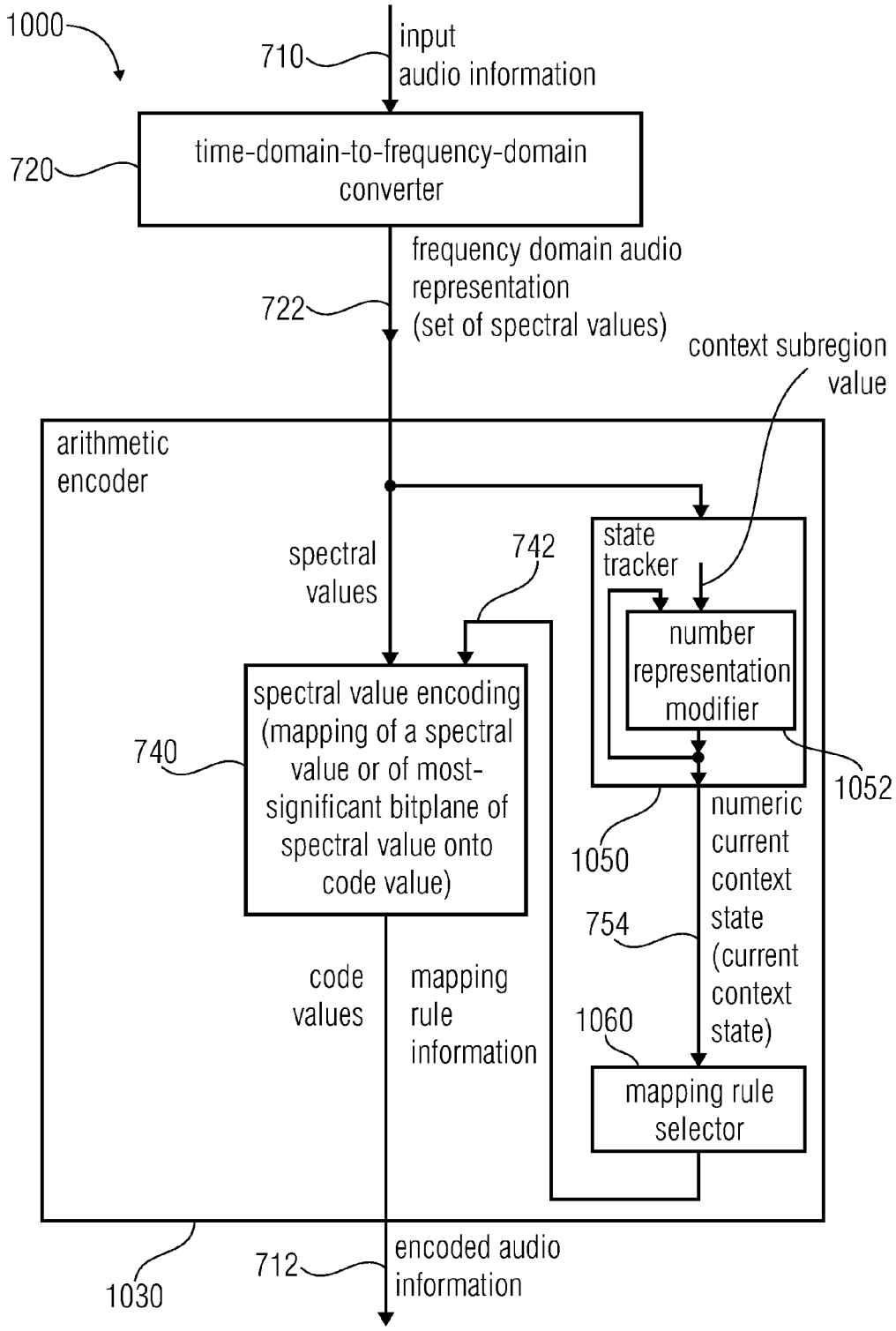
FIG. 10 shows a block schematic diagram of an audio encoder, according to a second aspect of the invention.

FIG. 10 shows a block schematic diagram of an audio encoder 1000 according to an embodiment of the invention. The audio encoder 1000 according to FIG. 10 is similar to the audio encoder 700 according to FIG. 7, such that identical signals and means are designated with identical reference numerals in FIGS. 7 and 10.

The audio encoder 1000 is configured to receive an input audio information 710 and to provide, on the basis thereof, an encoded audio information 712. The audio encoder 1000 comprises an energy-compacting time-domain-to-frequency-domain converter 720, which is configured to provide a frequency-domain representation 722 on the basis of a time-domain representation of the input audio information 710, such that the frequency-domain audio representation 722 comprises a set of spectral values. The audio encoder 1000 also comprises an arithmetic encoder 1030 configured to encode a spectral value (out of the set of spectral values forming the frequency-domain audio representation 722), or a pre-processed version thereof, using a variable-length codeword to obtain the encoded audio information 712 (which may comprise, for example, a plurality of variable-length codewords).

The arithmetic encoder 1030 is configured to map a spectral value, or a plurality of spectral values, or a value of a most-significant bit-plane of a spectral value or of a plurality of spectral values, onto a code value (i.e. onto a variable-length codeword) in dependence on a context state. The arithmetic encoder 1030 is configured to select a mapping rule describing a mapping of a spectral value, or of a plurality of spectral values, or of a most-significant bit-plane of a spectral value or of a plurality of spectral values, onto a code value in dependence on a context state. The arithmetic encoder is configured to determine the current context state in dependence on a plurality of previously-encoded (advantageously, but not necessarily adjacent) spectral values. For this purpose, the arithmetic encoder is configured to modify a number representation of a numeric previous context value, describing a context state associated with one or more previously-encoded spectral values (for example, to select a corresponding mapping rule), in dependence on a context sub-region value, to obtain a number representation of a numeric current context value describing a context state associated with one or more spectral values to be encoded (for example, to select a corresponding mapping rule).

As can be seen, the mapping of a spectral value, or of a plurality of spectral values, or of a most-significant bit-plane of a spectral value or of a plurality of spectral values, onto a code value may be performed by a spectral value encoding 740 using a mapping rule described by a mapping rule information 742. A state tracker 750 may be configured to track the context state. The state tracker 750 may be configured to modify a number representation of a numeric previous context value, describing a context state associated with an encoding of one or more previously-encoded spectral values, in dependence on a context sub-region value, to obtain a number representation of a numeric current context value describing a context state associated with an encoding of one or more spectral values to be encoded. The modification of the number representation of the numeric previous context value may, for example, be performed by a number representation modifier 1052, which receives the numeric previous context value and one or more context sub-region values and provides the numeric current context value. Accordingly, the state tracker 1050 provides an information 754 describing the current context state, for example, in the form of a numeric current context value. A mapping rule selector 1060 may select a mapping rule, for example, a cumulative-frequencies-table, describing a mapping of a spectral value, or of a plurality of spectral values, or of a most-significant bit-plane of a spectral value or of a plurality of spectral values, onto a code value. Accordingly, the mapping rule selector 1060 provides the mapping rule information 742 to the spectral encoding 740.

It should be noted that, in some embodiments, the state tracker 1050 may be identical to the state tracker 750 or the state tracker 826. It should also be noted that the mapping rule selector 1060 may, in some embodiments, be identical to the mapping rule selector 760, or the mapping rule selector 828. Advantageously, the mapping rule selector 828 may be configured to use a hash table "ari_hash_m[742]", as defined in the table representation of FIGS. 22(1) to 22(4), for the selection of the mapping rule. For example, the mapping rule selector may perform the functionality as described above with reference to FIGS. 7 and 8.

To summarize the above, the audio encoder 1000 performs an arithmetic encoding of a frequency-domain audio representation provided by the time-domain-to-frequency-domain converter. The arithmetic encoding is context dependent, such that a mapping rule (e.g. a cumulative-frequencies-table) is selected in dependence on previously-encoded spectral values. Accordingly, spectral values adjacent in time and/or frequency (or at least within a predetermined environment) to each other and/or to the currently-encoded spectral value (i.e. spectral values within a predetermined environment of the currently-encoded spectral value) are considered in the arithmetic encoding to adjust the probability distribution evaluated by the arithmetic encoding.

When determining the numeric current context value, a number representation of a numeric previous context value, describing a context state associated with one or more previously-encoded spectral values, is modified in dependence on a context sub-region value, to obtain a number representation of a numeric current context value describing a context state associated with one or more spectral values to be encoded. This approach allows avoiding a complete re-computation of the numeric current context value, which complete re-computation consumes a significant amount of resources in conventional approaches. A large variety of possibilities exist for the modification of the number representation of the numeric previous context value, including a combination of a re-scaling of a number representation of the numeric previous context value, an addition of a context sub-region value or a value derived therefrom to the number representation of the numeric previous context value or to a processed number representation of the numeric previous context value, a replacement of a portion of the number representation (rather than the entire number representation) of the numeric previous context value in dependence on the context sub-region value, and so on. Thus, typically the numeric representation of the numeric current context value is obtained on the basis of the number representation of the numeric previous context value and also on the basis of at least one context sub-region value, wherein typically a combination of operations are performed to combine the numeric previous context value with a context sub-region value, such as for example, two or more operations out of an addition operation, a subtraction operation, a multiplication operation, a division operation, a Boolean-AND operation, a Boolean-OR operation, a Boolean-NAND operation, a Boolean NOR operation, a Boolean-negation operation, a complement operation or a shift operation. Accordingly, at least a portion of the number representation of the numeric previous context value is typically maintained unchanged (except for an optional shift to a different position) when deriving the numeric current context value from the numeric previous context value. In contrast, other portions of the number representation of the numeric previous context value are changed in dependence on one or more context sub-region values. Thus, the numeric current context value can be obtained with a comparatively small computational effort, while avoiding a complete re-computation of the numeric current context value.

Thus, a meaningful numeric current context value can be obtained, which is well-suited for the use by the mapping rule selector 1060, and which is particularly well suited for use in combination with the hash table ari_hash_m as defined in the table representation of FIGS. 22(1),22(2),22(3),22(4).

Consequently, an efficient encoding can be achieved by keeping the context calculation sufficiently simple.

5. Audio Decoder According to FIG. 11

Figure 11:
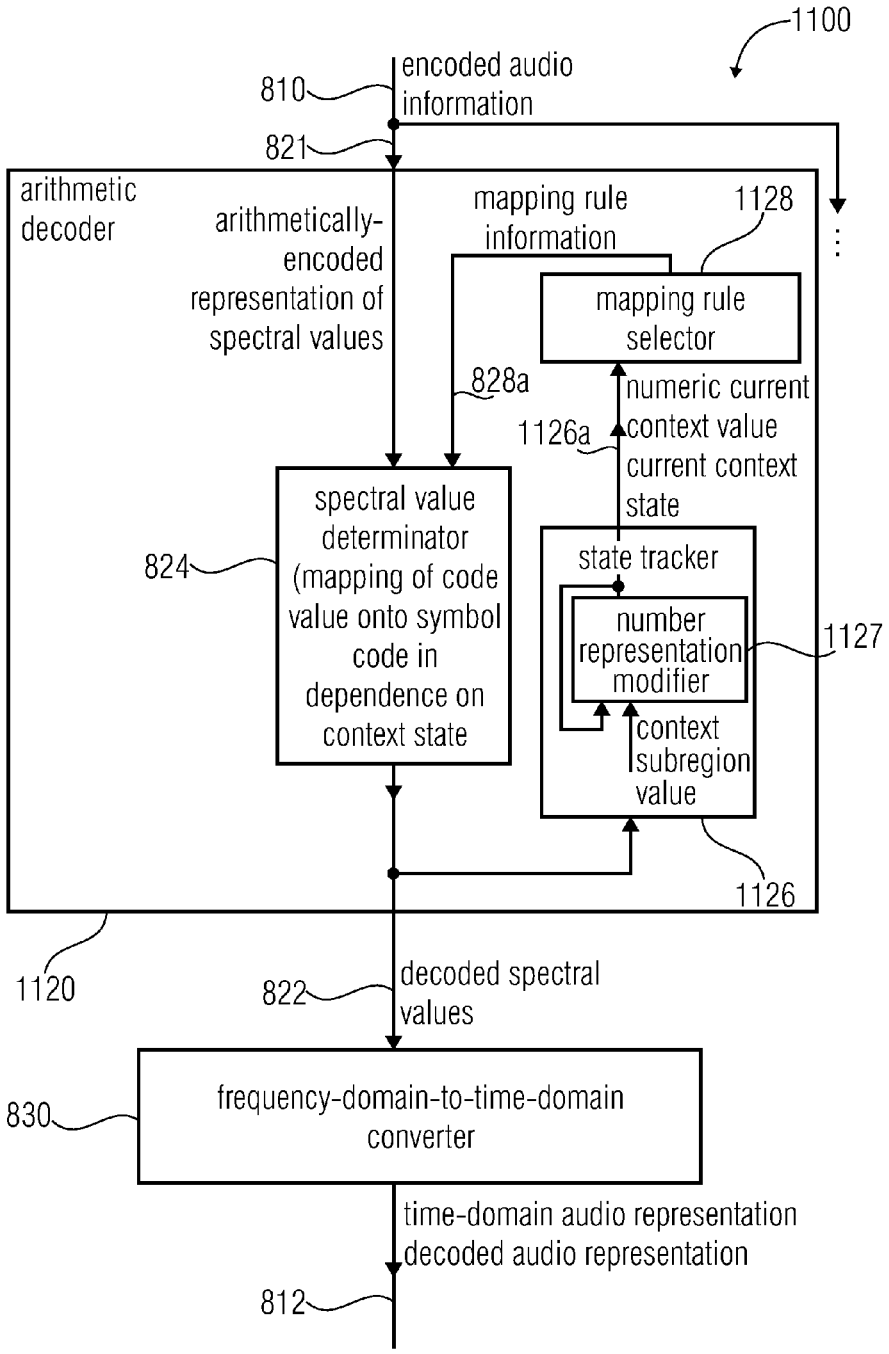
FIG. 11 shows a block schematic diagram of an audio decoder, according to the second aspect of the invention.

FIG. 11 shows a block schematic diagram of an audio decoder 1100. The audio decoder 1100 is similar to the audio decoder 800 according to FIG. 8, such that identical signals, means and functionalities are designated with identical reference numerals.

The audio decoder 1100 is configured to receive an encoded audio information 810 and to provide, on the basis thereof, a decoded audio information 812. The audio decoder 1100 comprises an arithmetic decoder 1120 that is configured to provide a plurality of decoded spectral values 822 on the basis of an arithmetically-encoded representation 821 of the spectral values. The audio decoder 1100 also comprises a frequency-domain-to-time-domain converter 830 which is configured to receive the decoded spectral values 822 and to provide the time-domain audio representation 812, which may constitute the decoded audio information, using the decoded spectral values 822, in order to obtain a decoded audio information 812.

The arithmetic decoder 1120 comprises a spectral value determinator 824, which is configured to map a code value of the arithmetically-encoded representation 821 of spectral values onto a symbol code representing one or more of the decoded spectral values, or at least a portion (for example, a most-significant bit-plane) of one or more of the decoded spectral values. The spectral value determinator 824 may be configured to perform the mapping in dependence on a mapping rule, which may be described by a mapping rule information 828*a*. The mapping rule information 828*a* may, for example, comprise a mapping rule index value, or may comprise a selected set of entries of a cumulative-frequencies-table.

The arithmetic decoder 1120 is configured to select a mapping rule (e.g., a cumulative-frequencies-table) describing a mapping of a code value (described by the arithmetically-encoded representation 821 of spectral values) onto a symbol code (describing one or more spectral values) in dependence on a context state, which context state may be described by the context state information 1126*a*. The context state information 1126*a* may take the form of a numeric current context value. The arithmetic decoder 1120 is configured to determine the current context state in dependence on a plurality of previously-decoded spectral values 822. For this purpose, a state tracker 1126 may be used, which receives an information describing the previously-decoded spectral values. The arithmetic decoder is configured to modify a number representation of numeric previous context value, describing a context state associated with one or more previously decoded spectral values, in dependence on a context sub-region value, to obtain a number representation of a numeric current context value describing a context state associated with one or more spectral values to be decoded. A modification of the number representation of the numeric previous context value may, for example, be performed by a number representation modifier 1127, which is part of the state tracker 1126. Accordingly, the current context state information 1126*a* is obtained, for example, in the form of a numeric current context value. The selection of the mapping rule may be performed by a mapping rule selector 1128, which derives a mapping rule information 828*a* from the current context state information 1126*a*, and which provides the mapping rule information 828*a* to the spectral value determinator 824. Advantageously, the mapping rule selector 1128 may be configured to use a hash table "ari_hash_m[742]", as defined in the table representation of FIGS. 22(1) to 22(4), for the selection of the mapping rule. For example, the mapping rule selector may perform the functionality as described above with reference to FIGS. 7 and 8.

Regarding the functionality of the audio signal decoder 1100, it should be noted that the arithmetic decoder 1120 is configured to select a mapping rule (e.g., a cumulative-frequencies-table) which is, on average, well-adapted to the spectral value to be decoded, as the mapping rule is selected in dependence on the current context state, which, in turn, is determined in dependence on a plurality of previously-decoded spectral values. Accordingly, statistical dependencies between adjacent spectral values to be decoded can be exploited.

Moreover, by modifying a number representation of a numeric previous context value describing a context state associated with a decoding of one or more previously decoded spectral values, in dependence on a context sub-region value, to obtain a number representation of a numeric current context value describing a context state associated with a decoding of one or more spectral values to be decoded, it is possible to obtain a meaningful information about the current context state, which is well-suited for a mapping to a mapping rule index value, and which is particularly well suited for use in combination with the hash table ari_hash_m as defined in the table representation of FIGS. 22(1),22(2),22(3),22(4), with comparatively small computational effort. By maintaining at least a portion of a number representation of the numeric previous context value (possibly in a bit-shifted or a scaled version) while updating another portion of the number representation of the numeric previous context value in dependence on the context sub-region values which have not been considered in the numeric previous context value but which should be considered in the numeric current context value, a number of operations to derive the numeric current context value can be kept reasonably small. Also, it is possible to exploit the fact that contexts used for decoding adjacent spectral values are typically similar or correlated. For example, a context for a decoding of a first spectral value (or of a first plurality of spectral values) is dependent on a first set of previously-decoded spectral values. A context for decoding of a second spectral value (or a second set of spectral values), which is adjacent to the first spectral value (or the first set of spectral values) may comprise a second set of previously-decoded spectral values. As the first spectral value and the second spectral value are assumed to be adjacent (e.g., with respect to the associated frequencies), the first set of spectral values, which determine the context for the coding of the first spectral value, may comprise some overlap with the second set of spectral values, which determine the context for the decoding of the second spectral value. Accordingly, it can easily be understood that the context state for the decoding of the second spectral value comprises some correlation with the context state for the decoding of the first spectral value. A computational efficiency of the context derivation, i.e. of the derivation of the numeric current context value, can be achieved by exploiting such correlations. It has been found that the correlation between context states for a decoding of adjacent spectral values (e.g., between the context state described by the numeric previous context value and the context state described by the numeric current context value) can be exploited efficiently by modifying only those parts of the numeric previous context value which are dependent on context sub-region values not considered for the derivation of the numeric previous context state, and by deriving the numeric current context value from the numeric previous context value.

To conclude, the concepts described herein allow for a particularly good computational efficiency when deriving the numeric current context value.

Further details will be described below.

6. Audio Encoder According to FIG. 12

Figure 12:
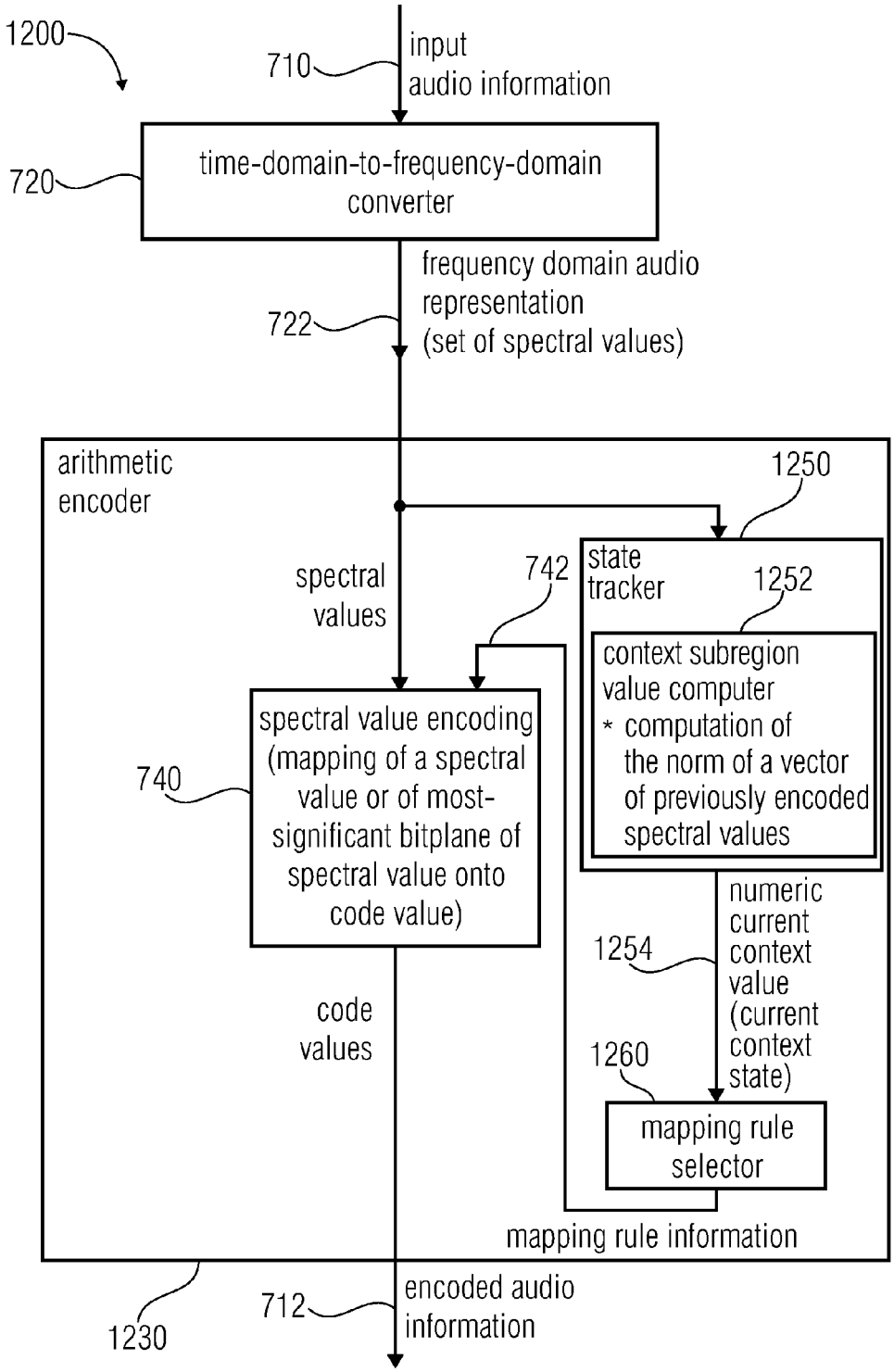
FIG. 12 shows a block schematic diagram of an audio encoder, according to a third aspect of the invention.

FIG. 12 shows a block schematic diagram of an audio encoder, according to an embodiment of the invention. The audio encoder 1200 according to FIG. 12 is similar to the audio encoder 700 according to FIG. 7, such that identical means, signals and functionalities are designated with identical reference numerals.

The audio encoder 1200 is configured to receive an input audio information 710 and to provide, on the basis thereof, an encoded audio information 712. The audio encoder 1200 comprises an energy-compacting time-domain-to-frequency-domain converter 720 which is configured to provide a frequency-domain audio representation 722 on the basis of a time-domain audio representation of the input audio information 710, such that the frequency-domain audio representation 722 comprises a set of spectral values. The audio encoder 1200 also comprises an arithmetic encoder 1230 configured to encode a spectral value (out of the set of spectral values forming the frequency-domain audio representation 722), or a plurality of spectral values, or a pre-processed version thereof, using a variable-length codeword to obtain the encoded audio information 712 (which may comprise, for example, a plurality of variable-length codewords.

The arithmetic encoder 1230 is configured to map a spectral value, or a plurality of spectral values, or a value of a most-significant bit-plane of a spectral value or of a plurality of spectral values, onto a code value (i.e. onto a variable-length codeword), in dependence on a context state. The arithmetic encoder 1230 is configured to select a mapping rule describing a mapping of a spectral value, or of a plurality of spectral values, or of a most-significant bit-plane of a spectral value or of a plurality of spectral values, onto a code value, in dependence on the context state. The arithmetic encoder is configured to determine the current context state in dependence on a plurality of previously-encoded (advantageously, but not necessarily, adjacent) spectral values. For this purpose, the arithmetic encoder is configured to obtain a plurality of context sub-region values on the basis of previously-encoded spectral values, to store said context sub-region values, and to derive a numeric current context value associated with one or more spectral values to be encoded in dependence on the stored context sub-region vales. Moreover, the arithmetic encoder is configured to compute the norm of a vector formed by a plurality of previously encoded spectral values, in order to obtain a common context sub-region value associated with the plurality of previously-encoded spectral values.

As can be seen, the mapping of a spectral value, or of a plurality of spectral values, or of a most-significant bit-plane of a spectral value or of a plurality of spectral values, onto a code value may be performed by a spectral value encoding 740 using a mapping rule described by a mapping rule information 742. A state tracker 1250 may be configured to track the context state and may comprise a context sub-region value computer 1252, to compute the norm of a vector formed by a plurality of previously encoded spectral values, in order to obtain a common context sub-region values associated with the plurality of previously-encoded spectral values. The state tracker 1250 is also advantageously configured to determine the current context state in dependence on a result of said computation of a context sub-region value performed by the context sub-region value computer 1252. Accordingly, the state tracker 1250 provides an information 1254, describing the current context state. A mapping rule selector 1260 may select a mapping rule, for example, a cumulative-frequencies-table, describing a mapping of a spectral value, or of a most-significant bit-plane of a spectral value, onto a code value. Accordingly, the mapping rule selector 1260 provides the mapping rule information 742 to the spectral encoding 740. Advantageously, the mapping rule selector 1260 may be configured to use a hash table "ari_hash_m[742]", as defined in the table representation of FIGS. 22(1) to 22(4), for the selection of the mapping rule. For example, the mapping rule selector may perform the functionality as described above with reference to FIGS. 7 and 8.

To summarize the above, the audio encoder 1200 performs an arithmetic encoding of a frequency-domain audio representation provided by the time-domain-to-frequency-domain converter 720. The arithmetic encoding is context-dependent, such that a mapping rule (e.g., a cumulative-frequencies-table) is selected in dependence on previously-encoded spectral values. Accordingly, spectral values adjacent in time and/or frequency (or, at least, within a predetermined environment) to each other and/or to the currently-encoded spectral value (i.e. spectral values within a predetermined environment of the currently encoded spectral value) are considered in the arithmetic encoding to adjust the probability distribution evaluated by the arithmetic encoding.

In order to provide a numeric current context value, a context sub-region value associated with a plurality of previously-encoded spectral values is obtained on the basis of a computation of a norm of a vector formed by a plurality of previously-encoded spectral values. The result of the determination of the numeric current context value is applied in the selection of the current context state, i.e. in the selection of a mapping rule.

By computing the norm of a vector formed by a plurality of previously-encoded spectral values, a meaningful information describing a portion of the context of the one or more spectral values to be encoded can be obtained, wherein the norm of a vector of previously encoded spectral values can typically be represented with a comparatively small number of bits. Thus, the amount of context information, which needs to be stored for later use in the derivation of a numeric current context value, can be kept sufficiently small by applying the above discussed approach for the computation of the context sub-region values. It has been found that the norm of a vector of previously encoded spectral values typically comprises the most significant information regarding the state of the context. In contrast, it has been found that the sign of said previously encoded spectral values typically comprises a subordinate impact on the state of the context, such that it makes sense to neglect the sign of the previously decoded spectral values in order to reduce the quantity of information to be stored for later use. Also, it has been found that the computation of a norm of a vector of previously-encoded spectral values is a reasonable approach for the derivation of a context sub-region value, as the averaging effect, which is typically obtained by the computation of the norm, leaves the most important information about the context state substantially unaffected. To summarize, the context sub-region value computation performed by the context sub-region value computer 1252 allows for providing a compact context sub-region information for storage and later re-use, wherein the most relevant information about the context state is preserved in spite of the reduction of the quantity of information.

Moreover, it has been found that a numeric current context value obtained as discussed above is very well suited for a selection of a mapping rule using the hash table "ari_hash_m[742]", as defined in the table representation of FIGS. 22(1) to 22(4). For example, the mapping rule selector may perform the functionality as described above with reference to FIGS. 7 and 8

Accordingly, an efficient encoding of the input audio information 710 can be achieved, while keeping the computational effort and the amount of data to be stored by the arithmetic encoder 1230 sufficiently small.

7. Audio Decoder According to FIG. 13

Figure 13:
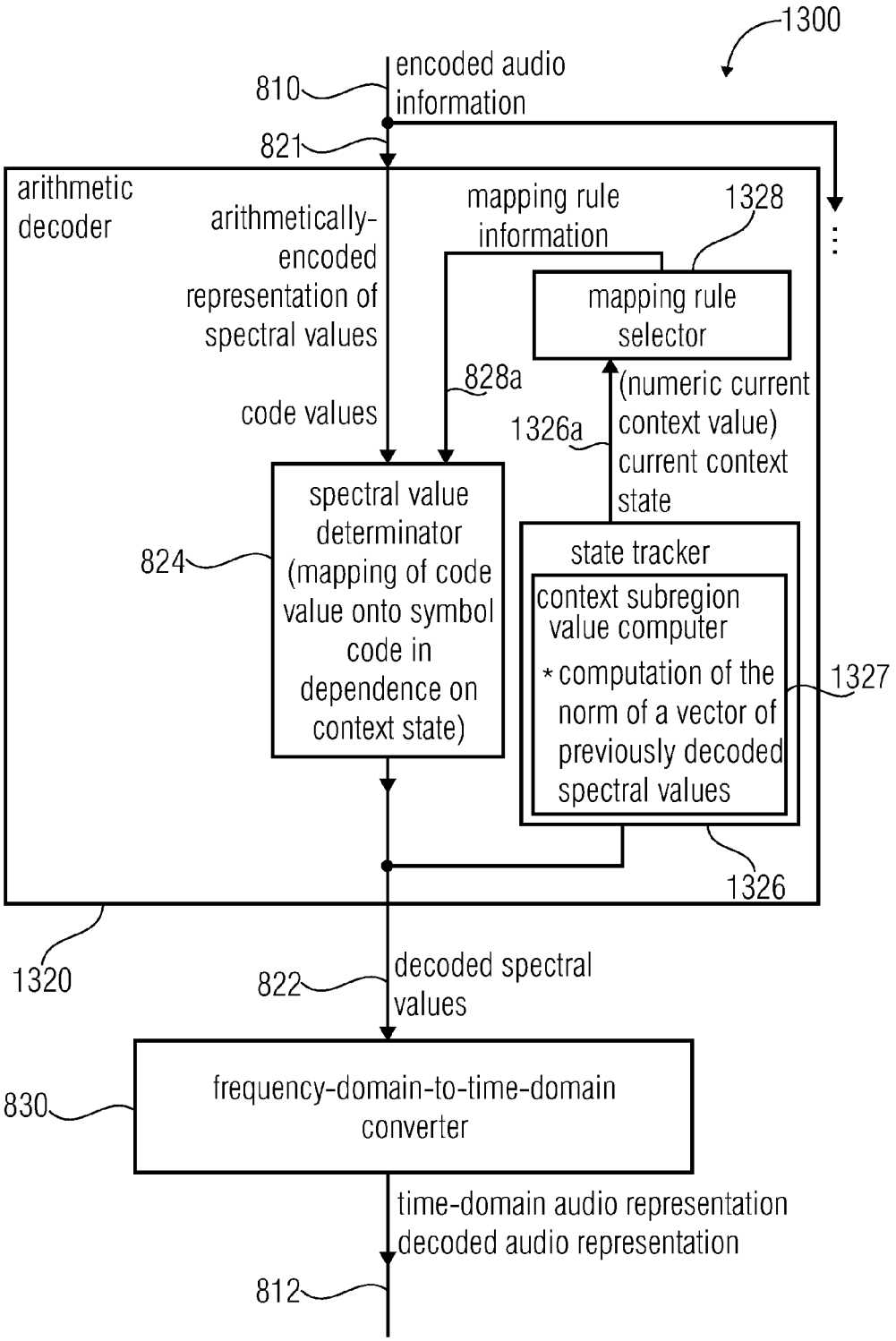
FIG. 13 shows a block schematic diagram of an audio decoder, according to the third aspect of the invention.
Figure 14A:
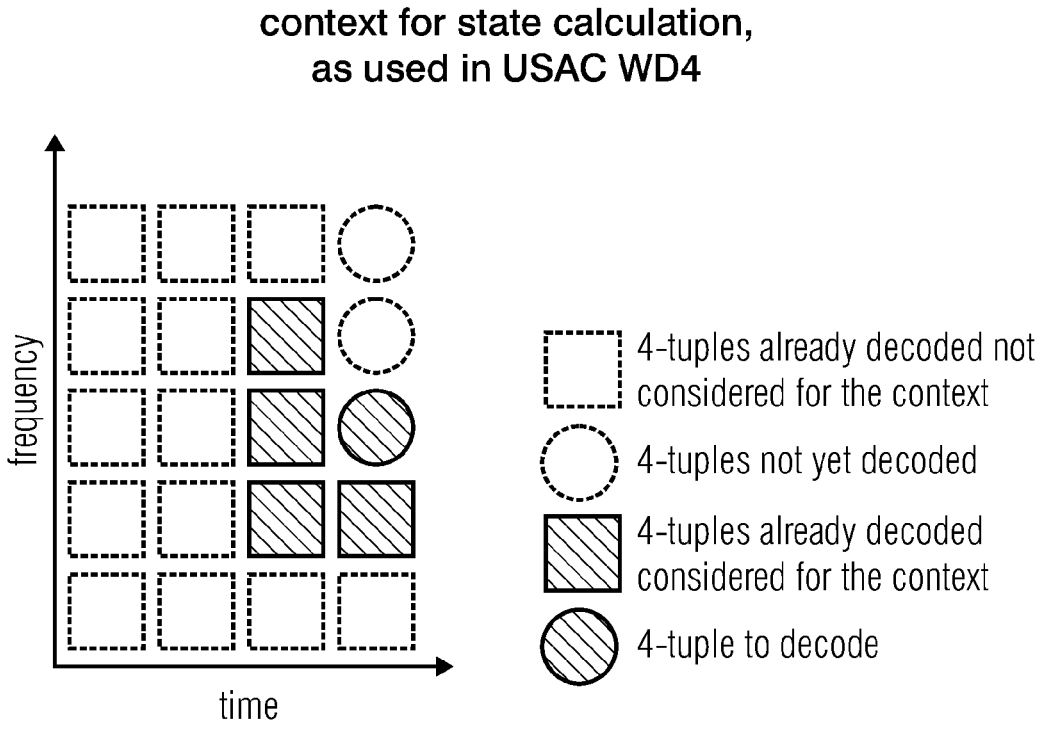
FIG. 14*a* shows a schematic representation of a context for a state calculation, as it is used in accordance with working draft 4 of the USAC Draft Standard.
Figure 15A:
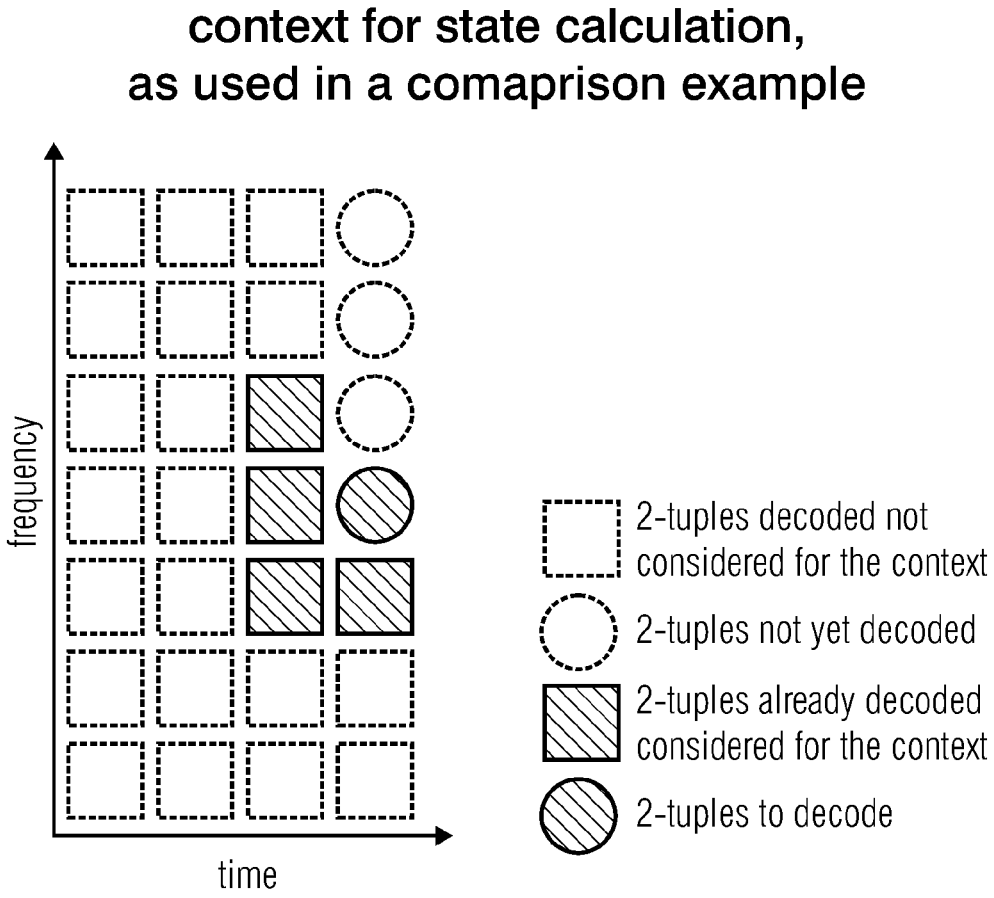
FIG. 15*a* shows a schematic representation of a context for a state calculation, as it is used in embodiments according to the invention.
Figure 16A:
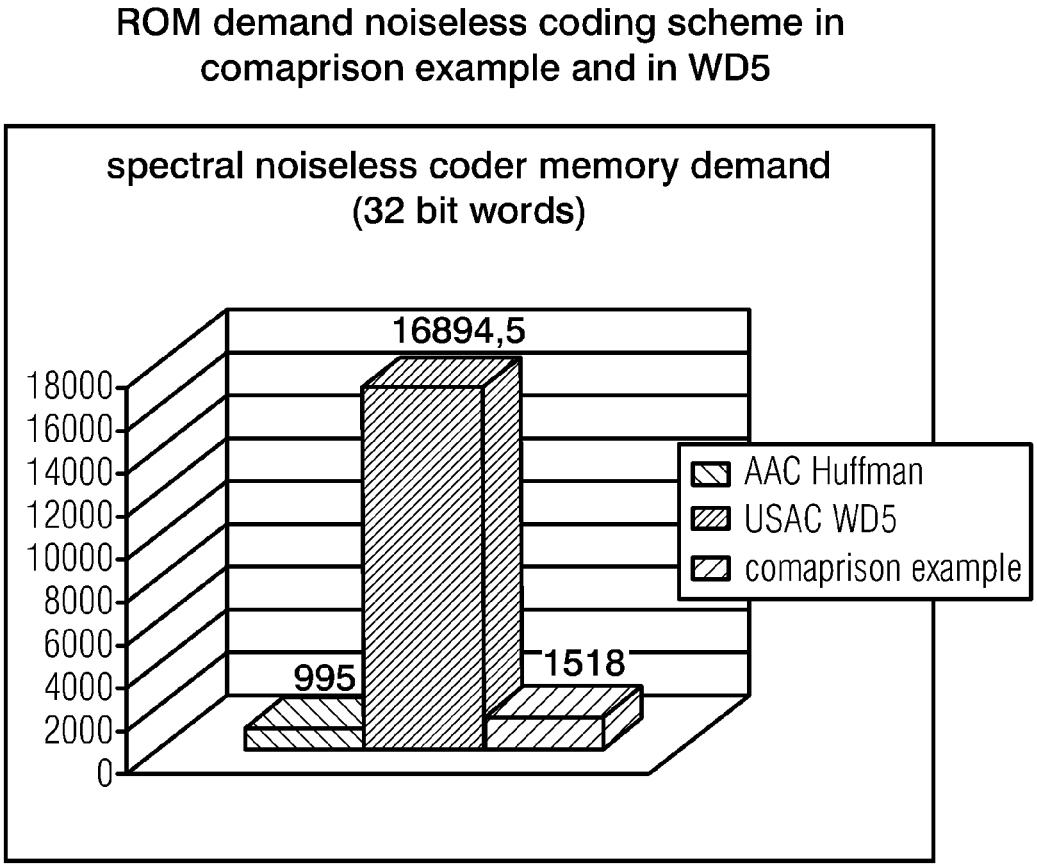
FIG. 16*a* shows a graphical representation of a read-only memory demand for the noiseless coding scheme according a comparison example, and according to working draft 5 of the USAC Draft Standard, and according to the AAC (advanced audio coding) Huffman Coding.
Figure 16B:
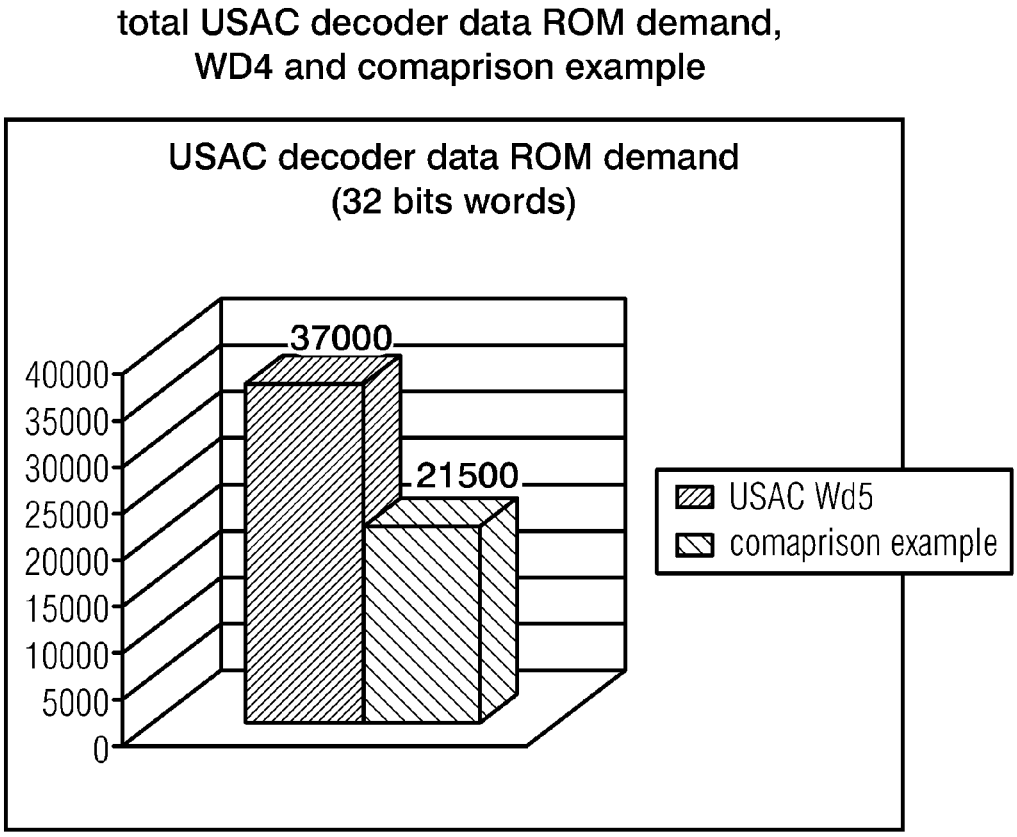
FIG. 16*b* shows a graphical representation of a total USAC decoder data read-only memory demand in accordance with a comparison example and in accordance with the concept according to working draft 5 of the USAC Draft Standard.
Figure 17:
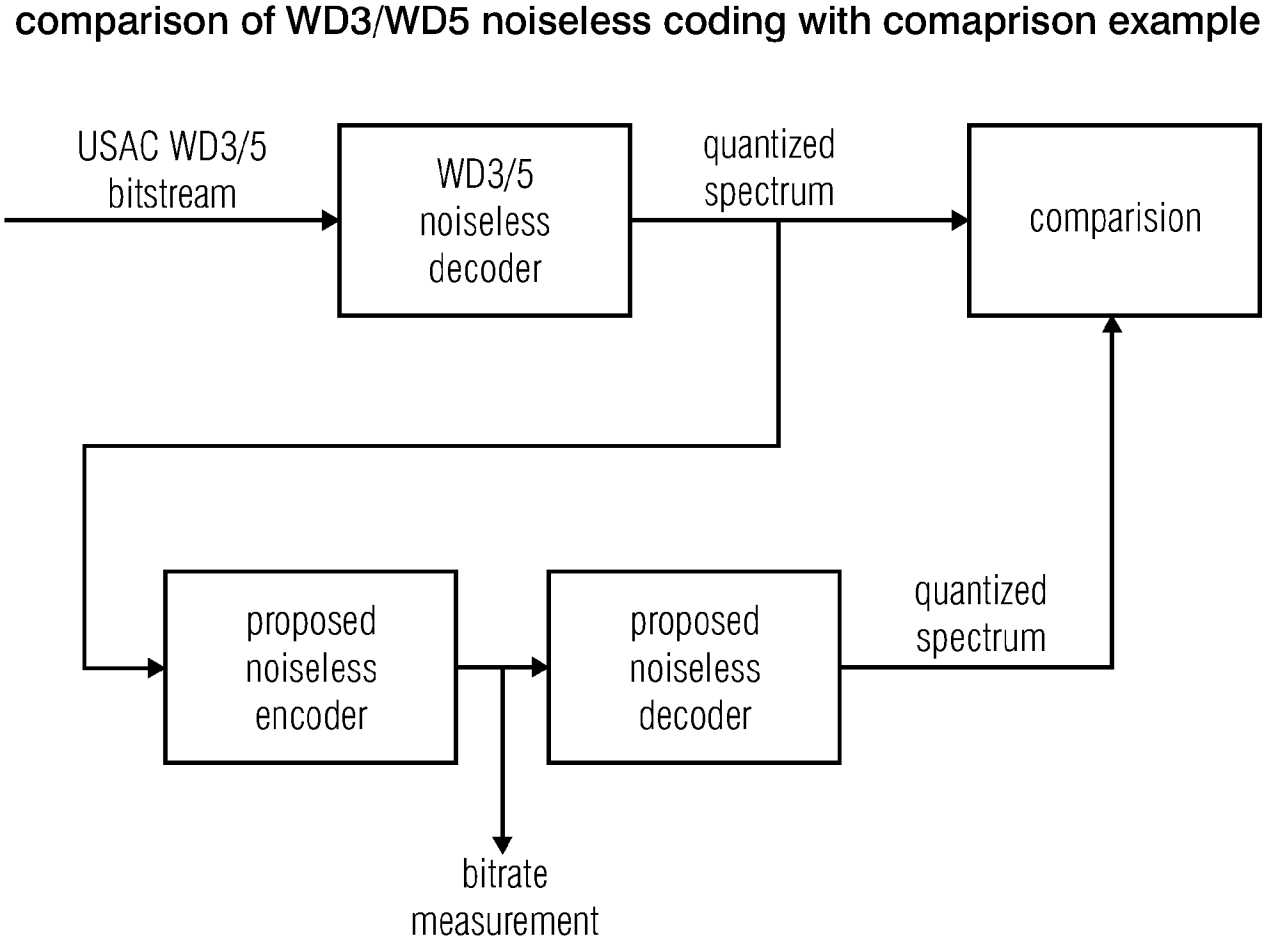
FIG. 17 shows a schematic representation of an arrangement for a comparison of a noiseless coding according to working draft 3 or working draft 5 of the USAC Draft Standard with a coding scheme according to the comparison example.

FIG. 13 shows a block schematic diagram of an audio decoder 1300. As the audio decoder 1300 is similar to the audio decoder 800 according to FIG. 8, and to the audio decoder 1100 according to FIG. 11, identical means, signals and functionalities are designated with identical numerals.

The audio decoder 1300 is configured to receive an encoded audio information 810 and to provide, on the basis thereof, a decoded audio information 812. The audio decoder 1300 comprises an arithmetic decoder 1320 that is configured to provide a plurality of decoded spectral values 822 on the basis of an arithmetically-encoded representation 821 of the spectral values. The audio decoder 1300 also comprises a frequency-domain-to-time-domain converter 830 which is configured to receive the decoded spectral values 822 and to provide the time-domain audio representation 812, which may constitute the decoded audio information, using the decoded spectral values 822, in order to obtain a decoded audio information 812.

The arithmetic decoder 1320 comprises a spectral value determinator 824 which is configured to map a code value of the arithmetically-encoded representation 821 of spectral values onto a symbol code representing one or more of the decoded spectral values, or at least a portion (e.g. a most-significant bit-plane) of one or more of the decoded spectral values. The spectral value determinator 824 may be configured to perform a mapping in dependence on a mapping rule, which is described by a mapping rule information 828*a*. The mapping rule information 828*a* may, for example, comprise a mapping rule index value, or a selected set of entries of a cumulative-frequencies-table.

The arithmetic decoder 1320 is configured to select a mapping rule (e.g., a cumulative-frequencies-table) describing a mapping of a code value (described by the arithmetically-encoded representation 821 of spectral values) onto a symbol code (describing one or more spectral values) in dependence on a context state (which may be described by the context state information 1326*a*). Advantageously, the arithmetic decoder 1320 may be configured to use a hash table "ari_hash_m[742]", as defined in the table representation of FIGS. 22(1) to 22(4), for the selection of the mapping rule. For example, the arithmetic decoder 1320 may perform the functionality as described above with reference to FIGS. 7 and 8. The arithmetic decoder 1320 is configured to determine the current context state in dependence on a plurality of previously-decoded spectral values 822. For this purpose, a state tracker 1326 may be used, which receives an information describing the previously-decoded spectral values. The arithmetic decoder is also configured to obtain a plurality of context sub-region values on the basis of previously-decoded spectral values and to store said context sub-region values. The arithmetic decoder is configured to derive a numeric current context value associated with one or more spectral values to be decoded in dependence on the stored context sub-region values. The arithmetic decoder 1320 is configured to compute the norm of a vector formed by a plurality of previously decoded spectral values, in order to obtain a common context sub-region value associated with the plurality of previously-decoded spectral values.

The computation of the norm of a vector formed by a plurality of previously-encoded spectral values, in order to obtain a common context sub-region value associated with the plurality of previously decoded spectral values, may, for example, be performed by the context sub-region value computer 1327, which is part of the state tracker 1326. Accordingly, a current context state information 1326*a* is obtained on the basis of the context sub-region values, wherein the state tracker 1326 advantageously provides a numeric current context value associated with one or more spectral values to be decoded in dependence on the stored context sub-region values. The selection of the mapping rules may be performed by a mapping rule selector 1328, which derives a mapping rule information 828*a* from the current context state information 1326*a*, and which provides the mapping rule information 828*a* to the spectral value determinator 824.

Regarding the functionality of the audio signal decoder 1300, it should be noted that the arithmetic decoder 1320 is configured to select a mapping rule (e.g., a cumulative-frequencies-table) which is, on average, well-adapted to the spectral value to be decoded, as the mapping rule is selected in dependence on the current context state, which, in turn, is determined in dependence on a plurality of previously-decoded spectral values. Accordingly, statistical dependencies between adjacent spectral values to be decoded can be exploited.

However, it has been found that it is efficient, in terms of memory usage, to store context sub-region values, which are based on the computation of a norm of a vector formed on a plurality of previously decoded spectral values, for later use in the determination of the numeric context value. It has also been found that such context sub-region values still comprise the most relevant context information. Accordingly, the concept used by the state tracker 1326 constitutes a good compromise between coding efficiency, computational efficiency and storage efficiency.

Further details will be described below.

8. Audio Encoder According to FIG. 1

Figure 1A:
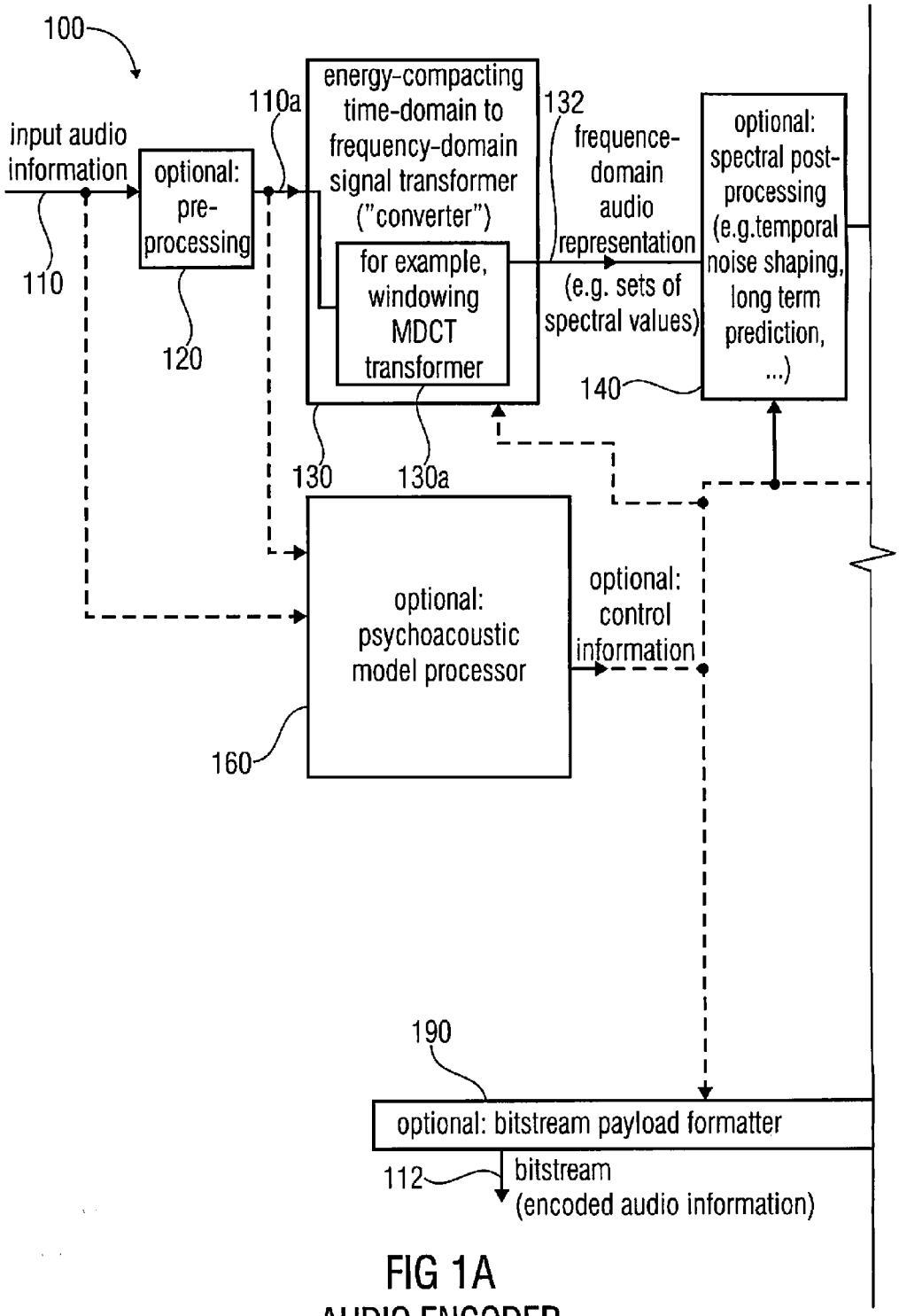
FIGS. 1A and 1B show a block schematic diagram of an audio encoder, according to an embodiment of the invention.
Figure 1B:
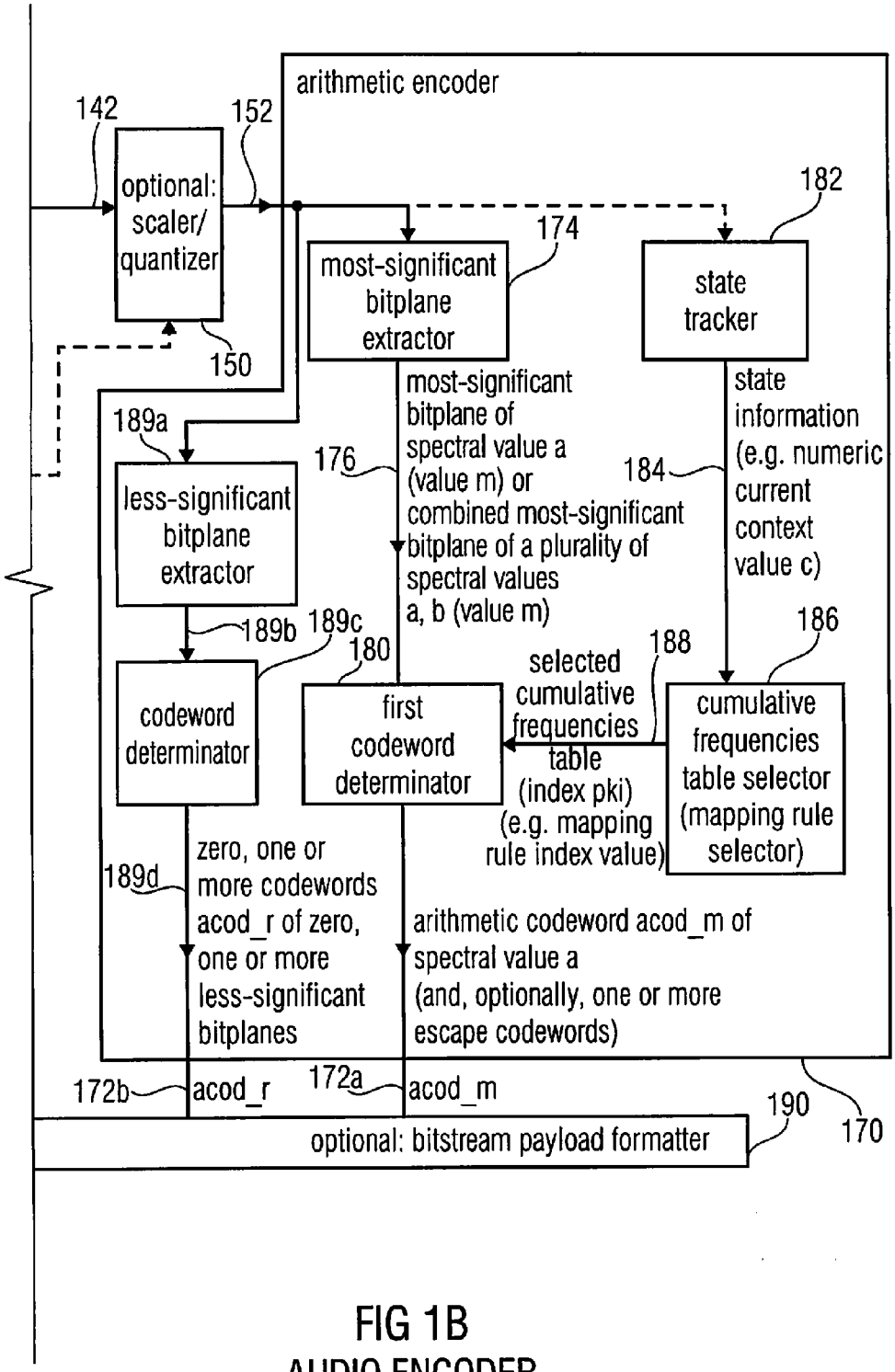

In the following, an audio encoder according to an embodiment of the present invention will be described. FIG. 1 shows a block schematic diagram of such an audio encoder 100.

The audio encoder 100 is configured to receive an input audio information 110 and to provide, on the basis thereof, a bitstream 112, which constitutes an encoded audio information. The audio encoder 100 optionally comprises a preprocessor 120, which is configured to receive the input audio information 110 and to provide, on the basis thereof, a preprocessed input audio information 110*a*. The audio encoder 100 also comprises an energy-compacting time-domain to frequency-domain signal transformer 130, which is also designated as signal converter. The signal converter 130 is configured to receive the input audio information 110, 110*a* and to provide, on the basis thereof, a frequency-domain audio information 132, which advantageously takes the form of a set of spectral values. For example, the signal transformer 130 may be configured to receive a frame of the input audio information 110, 110*a* (e.g. a block of time-domain samples) and to provide a set of spectral values representing the audio content of the respective audio frame. In addition, the signal transformer 130 may be configured to receive a plurality of subsequent, overlapping or non-overlapping, audio frames of the input audio information 110, 110*a* and to provide, on the basis thereof, a time-frequency-domain audio representation, which comprises a sequence of subsequent sets of spectral values, one set of spectral values associated with each frame.

The energy-compacting time-domain to frequency-domain signal transformer 130 may comprise an energy-compacting filterbank, which provides spectral values associated with different, overlapping or non-overlapping, frequency ranges. For example, the signal transformer 130 may comprise a windowing MDCT transformer 130*a*, which is configured to window the input audio information 110, 110*a* (or a frame thereof) using a transform window and to perform a modified-discrete-cosine-transform of the windowed input audio information 110, 110*a* (or of the windowed frame thereof). Accordingly, the frequency-domain audio representation 132 may comprise a set of, for example, 1024 spectral values in the form of MDCT coefficients associated with a frame of the input audio information.

The audio encoder 100 may further, optionally, comprise a spectral post-processor 140, which is configured to receive the frequency-domain audio representation 132 and to provide, on the basis thereof, a post-processed frequency-domain audio representation 142. The spectral post-processor 140 may, for example, be configured to perform a temporal noise shaping and/or a long term prediction and/or any other spectral post-processing known in the art. The audio encoder further comprises, optionally, a scaler/quantizer 150, which is configured to receive the frequency-domain audio representation 132 or the post-processed version 142 thereof and to provide a scaled and quantized frequency-domain audio representation 152.

The audio encoder 100 further comprises, optionally, a psycho-acoustic model processor 160, which is configured to receive the input audio information 110 (or the post-processed version 110*a* thereof) and to provide, on the basis thereof, an optional control information, which may be used for the control of the energy-compacting time-domain to frequency-domain signal transformer 130, for the control of the optional spectral post-processor 140 and/or for the control of the optional scaler/quantizer 150. For example, the psycho-acoustic model processor 160 may be configured to analyze the input audio information, to determine which components of the input audio information 110, 110*a* are particularly important for the human perception of the audio content and which components of the input audio information 110, 110*a* are less important for the perception of the audio content. Accordingly, the psycho-acoustic model processor 160 may provide control information, which is used by the audio encoder 100 in order to adjust the scaling of the frequency-domain audio representation 132, 142 by the scaler/quantizer 150 and/or the quantization resolution applied by the scaler/quantizer 150. Consequently, perceptually important scale factor bands (i.e. groups of adjacent spectral values which are particularly important for the human perception of the audio content) are scaled with a large scaling factor and quantized with comparatively high resolution, while perceptually less-important scale factor bands (i.e. groups of adjacent spectral values) are scaled with a comparatively smaller scaling factor and quantized with a comparatively lower quantization resolution. Accordingly, scaled spectral values of perceptually more important frequencies are typically significantly larger than spectral values of perceptually less important frequencies.

The audio encoder also comprises an arithmetic encoder 170, which is configured to receive the scaled and quantized version 152 of the frequency-domain audio representation 132 (or, alternatively, the post-processed version 142 of the frequency-domain audio representation 132, or even the frequency-domain audio representation 132 itself) and to provide arithmetic codeword information 172*a* on the basis thereof, such that the arithmetic codeword information represents the frequency-domain audio representation 152.

The audio encoder 100 also comprises a bitstream payload formatter 190, which is configured to receive the arithmetic codeword information 172*a*. The bitstream payload formatter 190 is also typically configured to receive additional information, like, for example, scale factor information describing which scale factors have been applied by the scaler/quantizer 150. In addition, the bitstream payload formatter 190 may be configured to receive other control information. The bitstream payload formatter 190 is configured to provide the bitstream 112 on the basis of the received information by assembling the bitstream in accordance with a desired bitstream syntax, which will be discussed below.

In the following, details regarding the arithmetic encoder 170 will be described. The arithmetic encoder 170 is configured to receive a plurality of post-processed and scaled and quantized spectral values of the frequency-domain audio representation 132. The arithmetic encoder comprises a most-significant-bit-plane-extractor 174, or even from two spectral values, which is configured to extract a most-significant bit-plane m from a spectral value. It should be noted here that the most-significant bit-plane may comprise one or even more bits (e.g. two or three bits), which are the most-significant bits of the spectral value. Thus, the most-significant bit-plane extractor 174 provides a most-significant bit-plane value 176 of a spectral value.

Alternatively, however, the most significant bit-plane extractor 174 may provide a combined most-significant bit-plane value m combining the most-significant bit-planes of a plurality of spectral values (e.g., of spectral values a and b). The most-significant bit-plane of the spectral value a is designated with m. Alternatively, the combined most-significant bit-plane value of a plurality of spectral values a,b is designated with m.

The arithmetic encoder 170 also comprises a first codeword determinator 180, which is configured to determine an arithmetic codeword acod_m [pki][m] representing the most-significant bit-plane value m. Optionally, the codeword determinator 180 may also provide one or more escape codewords (also designated herein with "ARITH_ESCAPE") indicating, for example, how many less-significant bit-planes are available (and, consequently, indicating the numeric weight of the most-significant bit-plane). The first codeword determinator 180 may be configured to provide the codeword associated with a most-significant bit-plane value m using a selected cumulative-frequencies-table having (or being referenced by) a cumulative-frequencies-table index pki.

In order to determine as to which cumulative-frequencies-table should be selected, the arithmetic encoder advantageously comprises a state tracker 182, which is configured to track the state of the arithmetic encoder, for example, by observing which spectral values have been encoded previously. The state tracker 182 consequently provides a state information 184, for example, a state value designated with "s" or "t" or "c". The arithmetic encoder 170 also comprises a cumulative-frequencies-table selector 186, which is configured to receive the state information 184 and to provide an information 188 describing the selected cumulative-frequencies-table to the codeword determinator 180. For example, the cumulative-frequencies-table selector 186 may provide a cumulative-frequencies-table index "pki" describing which cumulative-frequencies-table, out of a set of 64 cumulative-frequencies-tables, is selected for usage by the codeword determinator. Alternatively, the cumulative-frequencies-table selector 186 may provide the entire selected cumulative-frequencies-table or a sub-table to the codeword determinator. Thus, the codeword determinator 180 may use the selected cumulative-frequencies-table or sub-table for the provision of the codeword acod_m[pki][m] of the most-significant bit-plane value m, such that the actual codeword acod_m[pki][m] encoding the most-significant bit-plane value m is dependent on the value of m and the cumulative-frequencies-table index pki, and consequently on the current state information 184. Further details regarding the coding process and the obtained codeword format will be described below.

It should be noted, however, that in some embodiments, the state tracker 182 may be identical to, or take the functionality of, the state tracker 750, the state tracker 1050 or the state tracker 1250. It should also be noted that the cumulative-frequencies-table selector 186 may, in some embodiments, be identical to, or take the functionality of, the mapping rule selector 760, the mapping rule selector 1060, or the mapping rule selector 1260. Moreover, the first codeword determinator 180 may, in some embodiments, be identical to, or take the functionality of, the spectral value encoding 740.

The arithmetic encoder 170 further comprises a less-significant bit-plane extractor 189*a*, which is configured to extract one or more less-significant bit-planes from the scaled and quantized frequency-domain audio representation 152, if one or more of the spectral values to be encoded exceed the range of values encodeable using the most-significant bit-plane only. The less-significant bit-planes may comprise one or more bits, as desired. Accordingly, the less-significant bit-plane extractor 189*a* provides a less-significant bit-plane information 189*b*. The arithmetic encoder 170 also comprises a second codeword determinator 189*c*, which is configured to receive the less-significant bit-plane information 189*d* and to provide, on the basis thereof, 0, 1 or more codewords "acod_r" representing the content of 0, 1 or more less-significant bit-planes. The second codeword determinator 189*c* may be configured to apply an arithmetic encoding algorithm or any other encoding algorithm in order to derive the less-significant bit-plane codewords "acod_r" from the less-significant bit-plane information 189*b*.

It should be noted here that the number of less-significant bit-planes may vary in dependence on the value of the scaled and quantized spectral values 152, such that there may be no less-significant bit-plane at all, if the scaled and quantized spectral value to be encoded is comparatively small, such that there may be one less-significant bit-plane if the current scaled and quantized spectral value to be encoded is of a medium range and such that there may be more than one less-significant bit-plane if the scaled and quantized spectral value to be encoded takes a comparatively large value.

To summarize the above, the arithmetic encoder 170 is configured to encode scaled and quantized spectral values, which are described by the information 152, using a hierarchical encoding process. The most-significant bit-plane (comprising, for example, one, two or three bits per spectral value) of one or more spectral values, is encoded to obtain an arithmetic codeword "acod_m[pki][m]" of a most-significant bit-plane value m. One or more less-significant bit-planes (each of the less-significant bit-planes comprising, for example, one, two or three bits) of the one or more spectral values are encoded to obtain one or more codewords "acod_r". When encoding the most-significant bit-plane, the value m of the most-significant bit-plane is mapped to a codeword acod_m[pki][m]. For this purpose, 64 different cumulative-frequencies-tables are available for the encoding of the value m in dependence on a state of the arithmetic encoder 170, i.e. in dependence on previously-encoded spectral values. Accordingly, the codeword "acod_m[pki][m]" is obtained. In addition, one or more codewords "acod_r" are provided and included into the bitstream if one or more less-significant bit-planes are present.

Reset Description

The audio encoder 100 may optionally be configured to decide whether an improvement in bitrate can be obtained by resetting the context, for example by setting the state index to a default value. Accordingly, the audio encoder 100 may be configured to provide a reset information (e.g. named "arith_reset_flag") indicating whether the context for the arithmetic encoding is reset, and also indicating whether the context for the arithmetic decoding in a corresponding decoder should be reset.

Details regarding the bitstream format and the applied cumulative-frequency tables will be discussed below.

9. Audio Decoder According to FIG. 2

Figure 2A:
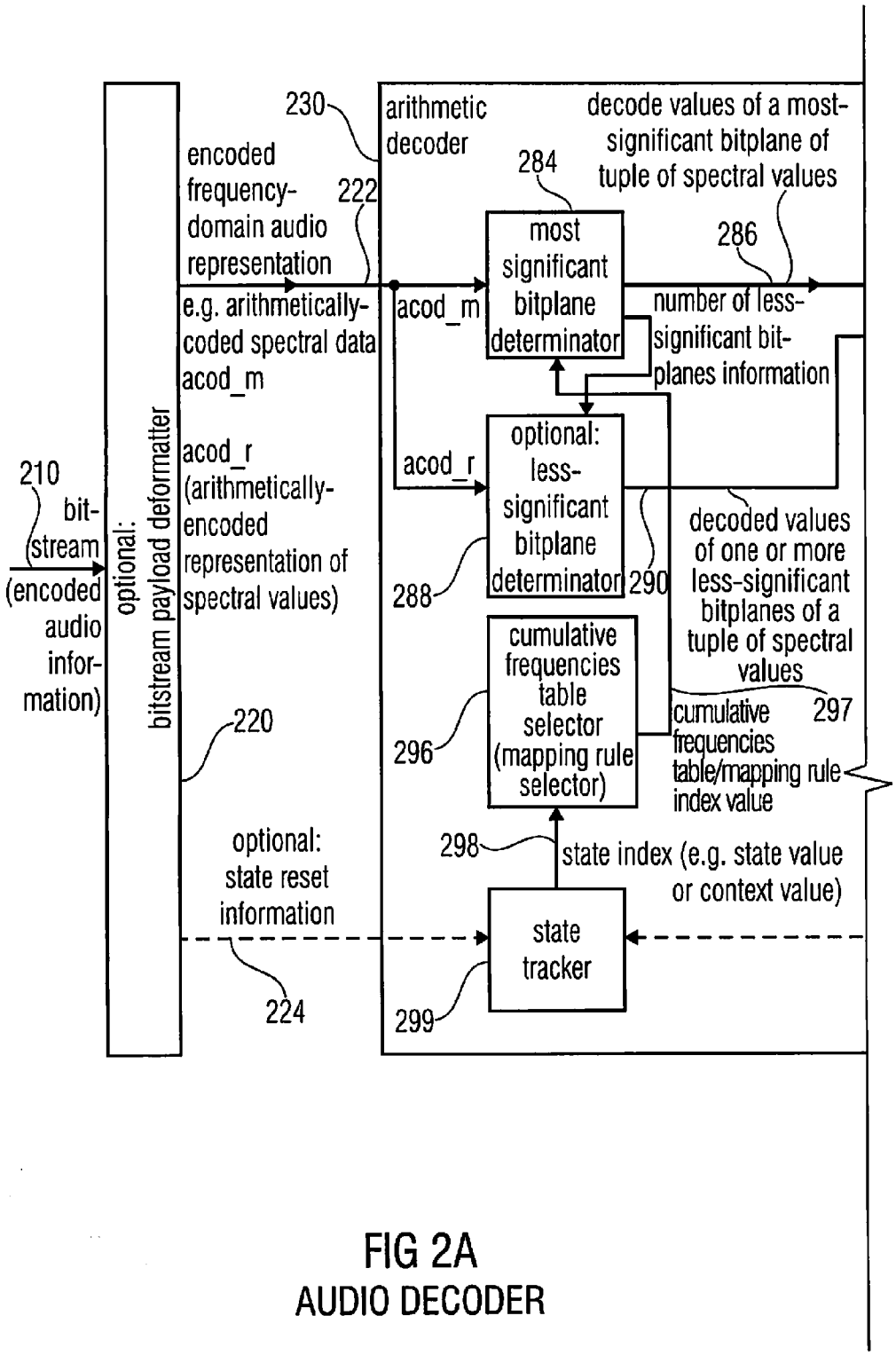
FIGS. 2A and 2B show a block schematic diagram of an audio decoder, according to an embodiment of the invention.
Figure 2B:
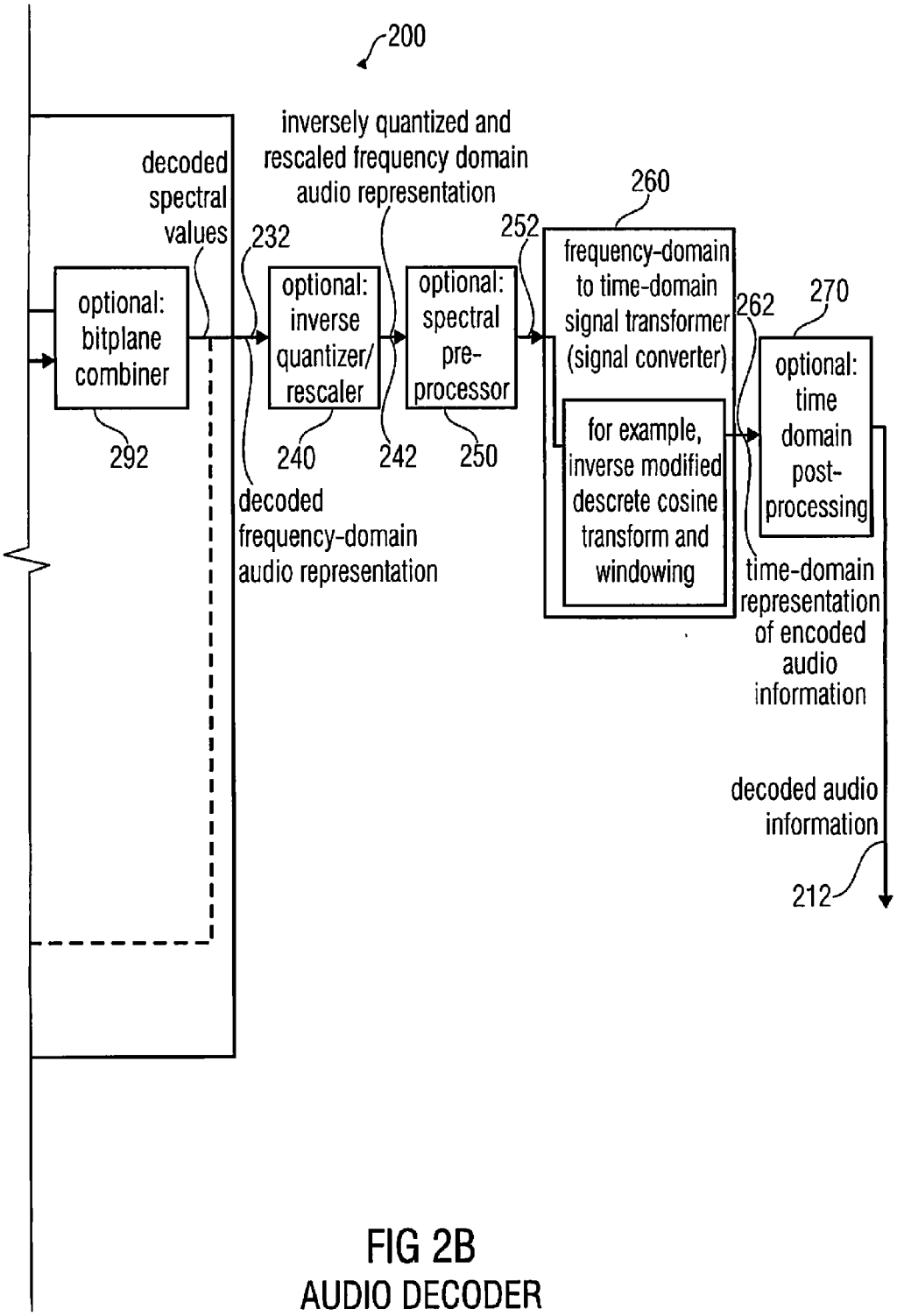

In the following, an audio decoder according to an embodiment of the invention will be described. FIG. 2 shows a block schematic diagram of such an audio decoder 200.

The audio decoder 200 is configured to receive a bitstream 210, which represents an encoded audio information and which may be identical to the bitstream 112 provided by the audio encoder 100. The audio decoder 200 provides a decoded audio information 212 on the basis of the bitstream 210.

The audio decoder 200 comprises an optional bitstream payload de-formatter 220, which is configured to receive the bitstream 210 and to extract from the bitstream 210 an encoded frequency-domain audio representation 222. For example, the bitstream payload de-formatter 220 may be configured to extract from the bitstream 210 arithmetically-coded spectral data like, for example, an arithmetic codeword "acod_m[pki][m]" representing the most-significant bit-plane value m of a spectral value a, or of a plurality of spectral values a, b, and a codeword "acod_r" representing a content of a less-significant bit-plane of the spectral value a, or of a plurality of spectral values a, b, of the frequency-domain audio representation. Thus, the encoded frequency-domain audio representation 222 constitutes (or comprises) an arithmetically-encoded representation of spectral values. The bitstream payload deformatter 220 is further configured to extract from the bitstream additional control information, which is not shown in FIG. 2. In addition, the bitstream payload deformatter is optionally configured to extract from the bitstream 210, a state reset information 224, which is also designated as arithmetic reset flag or "arith_reset_flag".

The audio decoder 200 comprises an arithmetic decoder 230, which is also designated as "spectral noiseless decoder". The arithmetic decoder 230 is configured to receive the encoded frequency-domain audio representation 220 and, optionally, the state reset information 224. The arithmetic decoder 230 is also configured to provide a decoded frequency-domain audio representation 232, which may comprise a decoded representation of spectral values. For example, the decoded frequency-domain audio representation 232 may comprise a decoded representation of spectral values, which are described by the encoded frequency-domain audio representation 220.

The audio decoder 200 also comprises an optional inverse quantizer/rescaler 240, which is configured to receive the decoded frequency-domain audio representation 232 and to provide, on the basis thereof, an inversely-quantized and resealed frequency-domain audio representation 242.

The audio decoder 200 further comprises an optional spectral pre-processor 250, which is configured to receive the inversely-quantized and resealed frequency-domain audio representation 242 and to provide, on the basis thereof, a pre-processed version 252 of the inversely-quantized and resealed frequency-domain audio representation 242. The audio decoder 200 also comprises a frequency-domain to time-domain signal transformer 260, which is also designated as a "signal converter". The signal transformer 260 is configured to receive the pre-processed version 252 of the inversely-quantized and resealed frequency-domain audio representation 242 (or, alternatively, the inversely-quantized and resealed frequency-domain audio representation 242 or the decoded frequency-domain audio representation 232) and to provide, on the basis thereof, a time-domain representation 262 of the audio information. The frequency-domain to time-domain signal transformer 260 may, for example, comprise a transformer for performing an inverse-modified-discrete-cosine transform (IMDCT) and an appropriate windowing (as well as other auxiliary functionalities, like, for example, an overlap-and-add).

The audio decoder 200 may further comprise an optional time-domain post-processor 270, which is configured to receive the time-domain representation 262 of the audio information and to obtain the decoded audio information 212 using a time-domain post-processing. However, if the post-processing is omitted, the time-domain representation 262 may be identical to the decoded audio information 212.

It should be noted here that the inverse quantizer/rescaler 240, the spectral pre-processor 250, the frequency-domain to time-domain signal transformer 260 and the time-domain post-processor 270 may be controlled in dependence on control information, which is extracted from the bitstream 210 by the bitstream payload deformatter 220.

To summarize the overall functionality of the audio decoder 200, a decoded frequency-domain audio representation 232, for example, a set of spectral values associated with an audio frame of the encoded audio information, may be obtained on the basis of the encoded frequency-domain representation 222 using the arithmetic decoder 230. Subsequently, the set of, for example, 1024 spectral values, which may be MDCT coefficients, are inversely quantized, resealed and pre-processed. Accordingly, an inversely-quantized, resealed and spectrally pre-processed set of spectral values (e.g., 1024 MDCT coefficients) is obtained. Afterwards, a time-domain representation of an audio frame is derived from the inversely-quantized, resealed and spectrally pre-processed set of frequency-domain values (e.g. MDCT coefficients). Accordingly, a time-domain representation of an audio frame is obtained. The time-domain representation of a given audio frame may be combined with time-domain representations of previous and/or subsequent audio frames. For example, an overlap-and-add between time-domain representations of subsequent audio frames may be performed in order to smoothen the transitions between the time-domain representations of the adjacent audio frames and in order to obtain an aliasing cancellation. For details regarding the reconstruction of the decoded audio information 212 on the basis of the decoded time-frequency domain audio representation 232, reference is made, for example, to the International Standard ISO/IEC 14496-3, part 3, sub-part 4 where a detailed discussion is given. However, other more elaborate overlapping and aliasing-cancellation schemes may be used.

In the following, some details regarding the arithmetic decoder 230 will be described. The arithmetic decoder 230 comprises a most-significant bit-plane determinator 284, which is configured to receive the arithmetic codeword acod_m[pki][m] describing the most-significant bit-plane value m. The most-significant bit-plane determinator 284 may be configured to use a cumulative-frequencies table out of a set comprising a plurality of 64 cumulative-frequencies-tables for deriving the most-significant bit-plane value m from the arithmetic codeword "acod_m[pki][m]".

The most-significant bit-plane determinator 284 is configured to derive values 286 of a most-significant bit-plane of one of more spectral values on the basis of the codeword acod_m. The arithmetic decoder 230 further comprises a less-significant bit-plane determinator 288, which is configured to receive one or more codewords "acod_r" representing one or more less-significant bit-planes of a spectral value. Accordingly, the less-significant bit-plane determinator 288 is configured to provide decoded values 290 of one or more less-significant bit-planes. The audio decoder 200 also comprises a bit-plane combiner 292, which is configured to receive the decoded values 286 of the most-significant bit-plane of one or more spectral values and the decoded values 290 of one or more less-significant bit-planes of the spectral values if such less-significant bit-planes are available for the current spectral values. Accordingly, the bit-plane combiner 292 provides decoded spectral values, which are part of the decoded frequency-domain audio representation 232. Naturally, the arithmetic decoder 230 is typically configured to provide a plurality of spectral values in order to obtain a full set of decoded spectral values associated with a current frame of the audio content.

The arithmetic decoder 230 further comprises a cumulative-frequencies-table selector 296, which is configured to select one of the 64 cumulative-frequencies tables ari_cf_m[64][17] (each table ari_cf_m[pki][17], with 0≤pki≤63, having 17 entries) in dependence on a state index 298 describing a state of the arithmetic decoder. For selecting one of the cumulative-frequencies-tables, the cumulative-frequencies-table selector advantageously evaluates the hash table ari_hash_m[742] as defined by the table representation of FIGS. 22(1), 22(2), 22(3), 22(4). Details regarding this evaluation of the hash table ari_hash_m[742] will be described below. The arithmetic decoder 230 further comprises a state tracker 299, which is configured to track a state of the arithmetic decoder in dependence on the previously-decoded spectral values. The state information may optionally be reset to a default state information in response to the state reset information 224. Accordingly, the cumulative-frequencies-table selector 296 is configured to provide an index (e.g. pki) of a selected cumulative-frequencies-table, or a selected cumulative-frequencies-table or sub-table itself, for application in the decoding of the most-significant bit-plane value m in dependence on the codeword "acod_m".

To summarize the functionality of the audio decoder 200, the audio decoder 200 is configured to receive a bitrate-efficiently-encoded frequency-domain audio representation 222 and to obtain a decoded frequency-domain audio representation on the basis thereof. In the arithmetic decoder 230, which is used for obtaining the decoded frequency-domain audio representation 232 on the basis of the encoded frequency-domain audio representation 222, a probability of different combinations of values of the most-significant bit-plane of adjacent spectral values is exploited by using an arithmetic decoder 280, which is configured to apply a cumulative-frequencies-table. In other words, statistic dependencies between spectral values are exploited by selecting different cumulative-frequencies-tables out of a set comprising 64 different cumulative-frequencies-tables in dependence on a state index 298, which is obtained by observing the previously-computed decoded spectral values.

It should be noted that the state tracker 299 may be identical to, or may take the functionality of, the state tracker 826, the state tracker 1126, or the state tracker 1326. The cumulative-frequencies-table selector 296 may be identical to, or may take the functionality of, the mapping rule selector 828, the mapping rule selector 1128, or the mapping rule selector 1328. The most significant bit-plane determinator 284 may be identical to, or may take the functionality of, the spectral value determinator 824.

10. Overview of the Tool of Spectral Noiseless Coding

In the following, details regarding the encoding and decoding algorithm, which is performed, for example, by the arithmetic encoder 170 and the arithmetic decoder 230, will be explained.

Focus is placed on the description of the decoding algorithm. It should be noted, however, that a corresponding encoding algorithm can be performed in accordance with the teachings of the decoding algorithm, wherein mappings between encoded and decoded spectral values are inversed, and wherein the computation of the mapping rule index value is substantially identical. In an encoder, the encoded spectral values take over the place of the decoded spectral values. Also, the spectral values to be encoded take over the place of the spectral values to be decoded.

It should be noted that the decoding, which will be discussed in the following, is used in order to allow for a so-called "spectral noiseless coding" of typically post-processed, scaled and quantized spectral values. The spectral noiseless coding is used in an audio encoding/decoding concept (or in any other encoding/decoding concept) to further reduce the redundancy of the quantized spectrum, which is obtained, for example, by an energy compacting time-domain-to-frequency-domain transformer. The spectral noiseless coding scheme, which is used in embodiments of the invention, is based on an arithmetic coding in conjunction with a dynamically adapted context.

Figure 4:
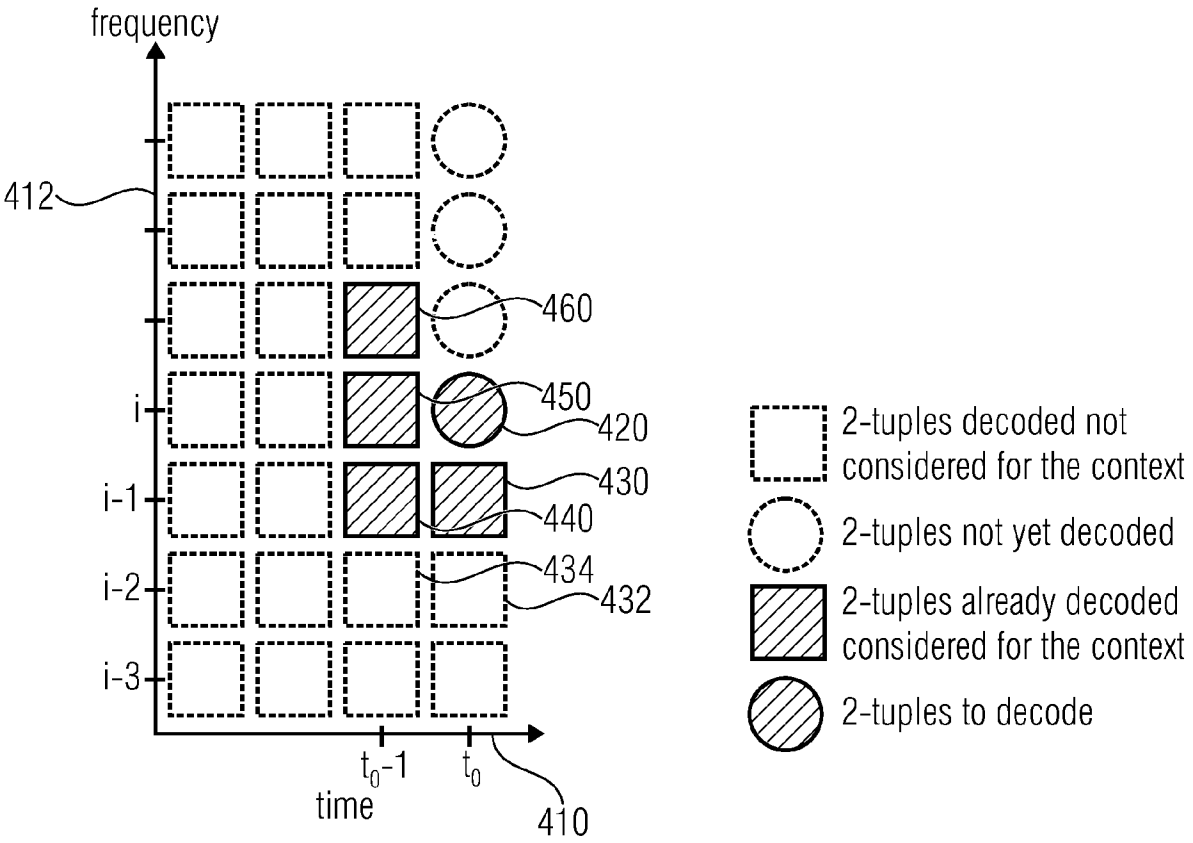
FIG. 4 shows a schematic representation of a context for a state calculation.

In some embodiments according to the invention, the spectral noiseless coding scheme is based on 2-tuples, that is, two neighbored spectral coefficients are combined. Each 2-tuple is split into the sign, the most-significant 2-bits-wise-plane, and the remaining less-significant bit-planes. The noiseless coding for the most-significant 2-bits-wise-plane m uses context dependent cumulative-frequencies-tables derived from four previously decoded 2-tuples. The noiseless coding is fed, for example, by the quantized spectral values and uses context dependent cumulative-frequencies-tables derived from four previously decoded neighboring 2-tuples. Here, neighborhood in both time and frequency is advantageously taken into account, as illustrated in FIG. 4. The cumulative-frequencies-tables (which will be explained below) are then used by the arithmetic coder to generate a variable-length binary code (and by the arithmetic decoder to derive decoded values from a variable-length binary code).

For example, the arithmetic coder 170 produces a binary code for a given set of symbols and their respective probabilities (i.e. in dependence on the respective probabilities). The binary code is generated by mapping a probability interval, where the set of symbols lies, to a codeword.

The noiseless coding for the remaining less-significant bit-plane or bit planes r uses, for example, a single cumulative-frequencies-table. The cumulative frequencies correspond, for example, to a uniform distribution of the symbols occurring in the less-significant bit-planes, i.e. it is expected there is the same probability that a 0 or a 1 occurs in the less-significant bit-planes. However, other solutions for the coding of the remaining less-significant bit-plane or bit-planes may be used.

In the following, another short overview of the tool of spectral noiseless coding will be given. Spectral noiseless coding is used to further reduce the redundancy of the quantized spectrum. The spectral noiseless coding scheme is based on an arithmetic coding, in conjunction with a dynamically adapted context. The noiseless coding is fed by the quantized spectral values and uses context dependent cumulative-frequencies-tables derived from, for example, four previously decoded neighboring 2-tuples of spectral values. Here, neighborhood, in both time and frequency, is taken into account as illustrated in FIG. 4. The cumulative-frequencies-tables are then used by the arithmetic coder to generate a variable length binary code.

The arithmetic coder produces a binary code for a given set of symbols and their respective probabilities. The binary code is generated by mapping a probability interval, where the set of symbols lies, to a codeword.

11. Decoding Process 11.1 Decoding Process Overview

In the following, an overview of the process of the coding of a spectral value will be given taking reference to FIG. 3, which shows a pseudo-program code representation of the process of decoding a plurality of spectral values.

The process of decoding a plurality of spectral values comprises an initialization 310 of a context. Initialization 310 of the context comprises a derivation of the current context from a previous context, using the function "arith_map_context(N, arith_reset_flag)". The derivation of the current context from a previous context may selectively comprise a reset of the context. Both the reset of the context and the derivation of the current context from a previous context will be discussed below. Advantageously, the function "arith_map_context(N, arith_reset_flag)" according to FIG. 5*a* may be used, but alternatively the function according to FIG. 5*b* may be used.

The decoding of a plurality of spectral values also comprises an iteration of a spectral value decoding 312 and a context update 313, which context update 313 is performed by a function "arith_update_context(i, a,b)" which is described below. The spectral value decoding 312 and the context update 312 are repeated lg/2 times, wherein lg/2 indicates the number of 2-tuples of spectral values to be decoded (e.g., for an audio frame), unless a so-called "ARITH_STOP" symbol is detected. Moreover, the decoding of a set of lg spectral values also comprises a signs decoding 314 and a finishing step 315.

The decoding 312 of a tuple of spectral values comprises a context-value calculation 312*a*, a most-significant bit-plane decoding 312*b*, an arithmetic stop symbol detection 312*c*, a less-significant bit-plane addition 312*d*, and an array update 312*e*.

The state value computation 312*a* comprises a call of the function "arith_get_context(c,i,N)" as shown, for example, in FIG. 5*c* or 5*d*. Advantageously, the function "arith_get_context(c,i,N)" according to FIG. 5*c* is used. Accordingly, a numeric current context (state) value c is provided as a return value of the function call of the function "arith_get_context (c,i,N)". As can be seen, the numeric previous context value (also designated with "c"), which serves as an input variable to the function "arith_get_context(c,i,N)", is updated to obtain, as a return value, the numeric current context value c.

The most-significant bit-plane decoding 312*b* comprises an iterative execution of a decoding algorithm 312*ba*, and a derivation 312*bb* of values a,b from the result value m of the algorithm 312*ba*. In preparation of the algorithm 312*ba*, the variable lev is initialized to zero. The algorithm 312*ba* is repeated, until a "break" instruction (or condition) is reached. The algorithm 312*ba* comprises a computation of a state index "pki" (which also serves as a cumulative-frequencies-table index) in dependence on the numeric current context value c, and also in dependence on the level value "esc_nb" using a function "arith_get_pk( )", which is discussed below (and embodiments of which are shown, for example, in FIGS. 5*e* and 5*f*). Advantageously, the function "arith_get_pk(c)" according to FIG. 5*e* is used. The algorithm 312*ba* also comprises the selection of a cumulative-frequencies-table in dependence on the state index "pki", which is retuned by the call of the function "arith_get_pk", wherein a variable "cum_freq" may be set to a starting address of one out of 64 cumulative-frequencies-tables (or sub-tables) in dependence on the state index "pki". A variable "cfl" may also be initialized to a length of the selected cumulative-frequencies-table (or a sub-table), which is, for example, equal to a number of symbols in the alphabet, i.e. the number of different values which can be decoded. The length of all the cumulative-frequencies-tables (or sub-tables) from "ari_cf_m[pki=0][17]" to "ari_cf_m [pki=63][17]" available for the decoding of the most-significant bit-plane value m is 17, as 16 different most-significant bit-plane values and an escape symbol ("ARITH_ESCAPE") can be decoded. Advantageously, the cumulative frequencies table ari_cf_m[64][17], as defined in the table representation according to FIGS. 23(1), 23(2), 23(3), which defines the cumulative-frequencies-tables (or sub-tables) "ari_cf_m [pki=0][17]" to "ari_cf_m[pki=63][17]", is evaluated, to obtain the selected cumulative-frequencies-table (or sub-table).

Subsequently, a most-significant bit-plane value m may be obtained by executing a function "arith_decode( )", taking into consideration the selected cumulative-frequencies-table (described by the variable "cum_freq" and the variable "cfl"). When deriving the most-significant bit-plane value m, bits named "acod_m" of the bitstream 210 may be evaluated (see, for example, FIG. 6*g* or FIG. 6*h*). Advantageously, the function "arith_decode(cum_freq,cfl)" according to FIG. 5*g* is used, but alternatively the function "arith_decode(cum_freq, cfl)" according to FIGS. 5*h* and Si may be used.

The algorithm 312*ba* also comprises checking whether the most-significant bit-plane value m is equal to an escape symbol "ARITH_ESCAPE", or not. If the most-significant bit-plane value m is not equal to the arithmetic escape symbol, the algorithm 312*ba* is aborted ("break" condition) and the remaining instructions of the algorithm 312*ba* are then skipped. Accordingly, execution of the process is continued with the setting of the value b and of the value a at step 312*bb*. In contrast, if the decoded most-significant bit-plane value m is identical to the arithmetic escape symbol, or "ARITH_ESCAPE", the level value "lev" is increased by one. The level value "esc_nb" is set to be equal to the level value "lev", unless the variable "lev" is larger than seven, in which case, the variable "esc_nb" is set to be equal to seven. As mentioned, the algorithm 312*ba* is then repeated until the decoded most-significant bit-plane value m is different from the arithmetic escape symbol, wherein a modified context is used (because the input parameter of the function "arith_get_pk( )" is adapted in dependence on the value of the variable "esc_nb").

As soon as the most-significant bit-plane is decoded using the one time execution or iterative execution of the algorithm 312*ba*, i.e. a most-significant bit-plane value m different from the arithmetic escape symbol has been decoded, the spectral value variable "b" is set to be equal to a plurality of (e.g. 2) more significant bits of the most-significant bit-plane value m, and the spectral value variable "a" is set to the (e.g. 2) lowermost bits of the most-significant bit-plane value m. Details regarding this functionality can be seen, for example, at reference numeral 312*bb*.

Subsequently, it is checked in step 312*c*, whether an arithmetic stop symbol is present. This is the case if the most-significant bit-plane value m is equal to zero and the variable "lev" is larger than zero. Accordingly, an arithmetic stop condition is signaled by an "unusual" condition, in which the most-significant bit-plane value m is equal to zero, while the variable "lev" indicates that an increased numeric weight is associated to the most-significant bit-plane value m. In other words, an arithmetic stop condition is detected if the bitstream indicates that an increased numeric weight, higher than a minimum numeric weight, should be given to a most-significant bit-plane value which is equal to zero, which is a condition that does not occur in a normal encoding situation. In other words, an arithmetic stop condition is signaled if an encoded arithmetic escape symbol is followed by an encoded most significant bit-plane value of 0.

After the evaluation whether there is an arithmetic stop condition, which is performed in the step 212*c*, the less-significant bit planes are obtained, for example, as shown at reference numeral 212*d* in FIG. 3. For each less-significant bit plane, two binary values are decoded. One of the binary values is associated with the variable a (or the first spectral value of a tuple of spectral values) and one of the binary values is associated with the variable b (or a second spectral value of a tuple of spectral values). A number of less-significant bit planes is designated by the variable lev.

In the decoding of the one or more least-significant bit planes (if any) an algorithm 212*da* is iteratively performed, wherein a number of executions of the algorithm 212*da* is determined by the variable "lev". It should be noted here that the first iteration of the algorithm 212*da* is performed on the basis of the values of the variables a, b as set in the step 212*bb*. Further iterations of the algorithm 212*da* are be performed on the basis of updated variable values of the variable a, b.

At the beginning of an iteration, a cumulative-frequencies table is selected. Subsequently, an arithmetic decoding is performed to obtain a value of a variable r, wherein the value of the variable r describes a plurality of less-significant bits, for example one less-significant bit associated with the variable a and one less-significant bit associated with the variable b. The function "ARITH_DECODE" (for example, as defined in FIG. 5*g*) is used to obtain the value r, wherein the cumulative frequencies table "arith_cf_r" is used for the arithmetic decoding.

Subsequently, the values of the variables a and b are updated. For this purpose, the variable a is shifted to the left by one bit, and the least-significant bit of the shifted variable a is set the value defined by the least-significant bit of the value r. The variable b is shifted to the left by one bit, and the least-significant bit of the shifted variable b is set the value defined by bit 1 of the variable r, wherein bit 1 of the variable r has a numeric weight of 2 in the binary representation of the variable r. The algorithm 412*ba* is then repeated until all least-significant bits are decoded.

After the decoding of the less-significant bit-planes, an array "x_ac_dec" is updated in that the values of the variables a,b are stored in entries of said array having array indices 2*i and 2*i+1.

Subsequently, the context state is updated by calling the function "arith_update_context(i,a,b)", details of which will be explained below taking reference to FIG. 5*g*. Advantageously, the function "arith_update_context(i,a,b)", as defined in FIG. 5*l*, may be used.

Subsequent to the update of the context state, which is performed in step 313, algorithms 312 and 313 are repeated, until running variable i reaches the value of lg/2 or an arithmetic stop condition is detected.

Subsequently, a finish algorithm "arith_finish( )" is performed, as can be seen at reference number 315. Details of the finishing algorithm "arith_finish( )" will be described below taking reference to FIG. 5*m*.

Subsequent to the finish algorithm 315, the signs of the spectral values are decoded using the algorithm 314. As can be seen, the signs of the spectral values which are different from zero are individually coded. In the algorithm 314, signs are read for all of the spectral values having indices i between i=0 and i=lg−1 which are non-zero. For each non-zero spectral value having a spectral value index i between i=0 and i=lg−1, a value (typically a single bit) s is read from the bitstream. If the value of s, which is read from the bit stream is equal to 1, the sign of said spectral value is inverted. For this purpose, access is made to the array "x_ac_dec", both to determine whether the spectral value having the index i is equal to zero and for updating the sign of the decoded spectral values. However, it should be noted that the signs of the variables a, b are left unchanged in the sign decoding 314.

By performing the finish algorithm 315 before the signs decoding 314, it is possible to reset all useful bins after an ARITH_STOP symbol.

It should be noted here that the concept for obtaining the values of the less-significant bit-planes is not of particular relevance in some embodiments according to the present invention.

In some embodiments, the decoding of any less-significant bit-planes may even be omitted. Alternatively, different decoding algorithms may be used for this purpose.

11.2 Decoding Order According to FIG. 4

In the following, the decoding order of the spectral values will be described.

The quantized spectral coefficients "x_ac_dec[ ]" are noiselessly encoded and transmitted (e.g. in the bitstream) starting from the lowest-frequency coefficient and progressing to the highest-frequency coefficient.

Consequently, the quantized spectral coefficients "x_ac_dec[ ]" are noiselessly decoded starting from the lowest-frequency coefficient and progressing to the highest-frequency coefficient. The quantized spectral coefficients are decoded by groups of two successive (e.g. adjacent in frequency) coefficients a and b gathering in a so-called 2-tuple (a,b) (also designated with {a,b}). It should be noted here that the quantized spectral coefficients are sometimes also designated with "qdec".

The decoded coefficients "x_ac_dec[ ]" for a frequency-domain mode (e.g., decoded coefficients for an advanced audio coding, for example, obtained using a modified-discrete-cosine transform, as discussed in ISO/IEC 14496, part 3, sub-part 4) are then stored in an array "x_ac_quant[g][win][sfb][bin]". The order of transmission of the noiseless coding codewords is such that when they are decoded in the order received and stored in the array, "bin" is the most rapidly incrementing index, and "g" is the most slowly incrementing index. Within a codeword, the order of decoding is a,b (i.e., a, and then b).

The decoded coefficients "x_ac_dec[ ]" for the transform coded-excitation (TCX) are stored, for example, directly in an array "x_tcx_invquant[win][bin]", and the order of the transmission of the noiseless coding codeword is such that when they are decoded in the order received and stored in the array, "bin" is the most rapidly incrementing index, and "win" is the most slowly incrementing index. Within a codeword, the order of the decoding is a, b (i.e., a, and then b). In other words, if the spectral values describe a transform-coded-excitation of the linear-prediction filter of a speech coder, the spectral values a, b are associated to adjacent and increasing frequencies of the transform-coded-excitation. Spectral coefficients associated to a lower frequency are typically encoded and decoded before a spectral coefficient associated with a higher frequency.

Notably, the audio decoder 200 may be configured to apply the decoded frequency-domain representation 232, which is provided by the arithmetic decoder 230, both for a "direct" generation of a time-domain audio signal representation using a frequency-domain-to-time-domain signal transform and for an "indirect" provision of a time-domain audio signal representation using both a frequency-domain-to-time-domain decoder and a linear-prediction-filter excited by the output of the frequency-domain-to-time-domain signal transformer.

In other words, the arithmetic decoder, the functionality of which is discussed here in detail, is well-suited for decoding spectral values of a time-frequency-domain representation of an audio content encoded in the frequency-domain, and for the provision of a time-frequency-domain representation of a stimulus signal for a linear-prediction-filter adapted to decode (or synthesize) a speech signal encoded in the linear-prediction-domain. Thus, the arithmetic decoder is well-suited for use in an audio decoder which is capable of handling both frequency-domain encoded audio content and linear-predictive-frequency-domain encoded audio content (transform-coded-excitation-linear-prediction-domain mode).

11.3 Context Initialization According to FIGS. 5*a* and 5*b*

In the following, the context initialization (also designated as a "context mapping"), which is performed in a step 310, will be described.

The context initialization comprises a mapping between a past context and a current context in accordance with the algorithm "arith_map_context( )", a first example of which is shown in FIG. 5*a* and a second example of which is shown in FIG. 5*b*.

As can be seen, the current context is stored in a global variable "q[2][n_context]" which takes the form of an array having a first dimension of 2 and a second dimension of "n_context". A past context may optionally (but not necessarily) be stored in a variable "qs[n_context]" which takes the form of a table having a dimension of "n_context" (if it is used).

Taking reference to the example algorithm "arith_map_context" in FIG. 5*a*, the input variable N describes a length of a current window and the input variable "arith_reset_flag" indicates whether the context should be reset. Moreover, the global variable "previous_N" describes a length of a previous window. It should be noted here that typically a number of spectral values associated with a window is, at least approximately, equal to half a length of the said window in terms of time-domain samples. Moreover, it should be noted that a number of 2-tuples of spectral values is, consequently, at least approximately equal to a quarter of a length of said window in terms of time-domain samples.

First, it should be noted that the flag "arith_reset_flag" determines if the context is reset.

Taking reference to the example of FIG. 5*a*, mapping of the context may be performed in accordance with the algorithm "arith_map_context( )". It should be noted here that the function "arith_map_context( )" sets the entries "q[0][j]" of the current context array q to zero for j=0 to j=N/4-1, if the flag "arith_reset_flag" is active and consequently indicates that the context should be reset. Otherwise, i.e. if the flag "arith_reset_flag" is inactive, the entries "q[0][j]" of the current context array q are derived from the entries "q[1][k]" of the current context array q. It should be noted that the function "arith_map_context( )" according to FIG. 5*a* sets the entries "q[0][j]" of the current context array q to the values "q[1][k]" of the current context array q, if the number of spectral values associated with the current (e.g., frequency-domain-encoded) audio frame is identical to the number of spectral values associated with the previous audio frame for j=k=0 to j=k=N/4-1.

A more complicated mapping is performed if the number of spectral values associated to the current audio frame is different from the number of spectral values associated to the previous audio frame. However, details regarding the mapping in this case are not particularly relevant for the key idea of the present invention, such that reference is made to the pseudo program code of FIG. 5*a* for details.

Moreover, an initialization value for the numeric current context value c is returned by the function "arith_map_context( )". This initialization value is, for example, equal to the value of the entry "q[0][0]" shifted to the left by 12-bits. Accordingly, the numeric (current) context value c is properly initialized for an iterative update.

Moreover, FIG. 5*b* shows another example of an algorithm "arith_map_context( )" which may alternatively be used. For details, reference is made to the pseudo program code in FIG. 5*b*.

To summarize the above, the flag "arith_reset_flag" determines if the context is reset. If the flag is true, a reset sub-algorithm 500*a* of the algorithm "arith_map_context( )" is called. Alternatively, however, if the flag "arith_reset_flag" is inactive (which indicates that no reset of the context should be performed), the decoding process starts with an initialization phase where the context element vector (or array) q is updated by copying and mapping the context elements of the previous frame stored in q[1][ ] into q[0][ ]. The context elements within q are stored on 4-bits per 2-tuple. The copying and/or mapping of the context element are performed, for example, in a sub-algorithm 500*b*.

Moreover, it should be noted that if the context cannot be reliably determined, e.g., if the data of the previous frame is not available, and if the "arith_reset_flag" is not set, then the decoding of spectral data cannot be continued and the reading of the current "arith_data( )" element should be skipped.

In the example of FIG. 5*b*, the decoding process starts with an initialization phase where a mapping is done between the saved past context stored in qs and the context of the current frame q. The past context qs is stored on 2-bits per frequency line.

11.4 State Value Computation According to FIGS. 5*c* and 5*d*

In the following, the state value computation 312*a* will be described in more detail.

A first advantageous algorithm will be described taking reference to FIG. 5*c* and a second alternative example algorithm will be described taking reference to FIG. 5*d*.

It should be noted that the numeric current context value c (as shown in FIG. 3) can be obtained as a return value of the function "arith_get_context(c,i,N)", a pseudo program code representation of which is shown in FIG. 5*c*. Alternatively, however, the numeric current context value c can be obtained as a return value of the function "arith_get_context(c,i)", a pseudo program code representation of which is shown in FIG. 5*d*.

Regarding the computation of the state value, reference is also made to FIG. 4, which shows the context used for a state evaluation, i.e. for the computation of a numeric current context value c. FIG. 4 shows a 2-dimensional representation of spectral values, both over time and frequency. An abscissa 410 describes the time, and an ordinate 412 describes the frequency.

As can be seen in FIG. 4, a tuple 420 of spectral values to decode (advantageously using the numeric current context value), is associated with a time-index t0 and a frequency index i. As can be seen, for the time index t0, the tuples having frequency indices i−1, i−2, and i−3 are already decoded at the time at which the spectral values of the tuple 120, having the frequency index i, is to be decoded. As can be seen from FIG. 4, a spectral value 430 having a time index t0 and a frequency index i−1 is already decoded before the tuple 420 of spectral values is decoded, and the tuple 430 of spectral values is considered for the context which is used for the decoding of the tuple 420 of spectral values. Similarly, a tuple 440 of spectral values having a time index t0-1 and a frequency index of i−1, a tuple 450 of spectral values having a time index t0-1 and a frequency index of i, and a tuple 460 of spectral values having a time index t0-1 and a frequency index of i+1, are already decoded before the tuple 420 of spectral values is decoded, and are considered for the determination of the context, which is used for decoding the tuple 420 of spectral values. The spectral values (coefficients) already decoded at the time when the spectral values of the tuple 420 are decoded and considered for the context are shown by a shaded square. In contrast, some other spectral values already decoded (at the time when the spectral values of the tuple 420 are decoded) but not considered for the context (for the decoding of the spectral values of the tuple 420) are represented by squares having dashed lines, and other spectral values (which are not yet decoded at the time when the spectral values of the tuple 420 are decoded) are shown by circles having dashed lines. The tuples represented by squares having dashed lines and the tuples represented by circles having dashed lines are not used for determining the context for decoding the spectral values of the tuple 420.

However, it should be noted that some of these spectral values, which are not used for the "regular" or "normal" computation of the context for decoding the spectral values of the tuple 420 may, nevertheless, be evaluated for the detection of a plurality of previously-decoded adjacent spectral values which fulfill, individually or taken together, a predetermined condition regarding their magnitudes. Details regarding this issue will be discussed below.

Taking reference now to FIG. 5*c*, details of the algorithm "arith_get_context(c,i,N)" will be described. FIG. 5*c* shows the functionality of said function "arith_get_context(c,i,N)" in the form of a pseudo program code, which uses the conventions of the well-known C-language and/or C++ language. Thus, some more details regarding the calculation of the numeric current context value "c" which is performed by the function "arith_get_context(c,i,N)" will be described.

It should be noted that the function "arith_get_context(c,i,N)" receives, as input variables, an "old state context", which may be described by a numeric previous context value c. The function "arith_get_context(c,i,N)" also receives, as an input variable, an index i of a 2-tuple of spectral values to decode. The index i is typically a frequency index. An input variable N describes a window length of a window, for which the spectral values are decoded.

The function "arith_get_context(c,i,N)" provides, as an output value, an updated version of the input variable c, which describes an updated state context, and which may be considered as a numeric current context value. To summarize, the function "arith_get_context(c,i,N)" receives a numeric previous context value c as an input variable and provides an updated version thereof, which is considered as a numeric current context value. In addition, the function "arith_get_context" considers the variables i, N, and also accesses the "global" array q[ ][ ].

Regarding the details of the function "arith_get_context(c,i,N)", it should be noted that the variable c, which initially represents the numeric previous context value in a binary form, is shifted to the right by 4-bits in a step 504*a*. Accordingly, the four least significant bits of the numeric previous context value (represented by the input variable c) are discarded. Also, the numeric weights of the other bits of the numeric previous context values are reduced, for example, a factor of 16.

Moreover, if the index i of the 2-tuple is smaller than N/4-1, i.e. does not take a maximum value, the numeric current context value is modified in that the value of the entry q[0][i+1] is added to bits 12 to 15 (i.e. to bits having a numeric weight of $2^{12}$, $2^{13}$, $2^{14}$ and $2^{15}$) of the shifted context value which is obtained in step 504*a*. For this purpose, the entry q[0][i+1] of the array q[ ][ ] (or, more precisely, a binary representation of the value represented by said entry) is shifted to the left by 12-bits. The shifted version of the value represented by the entry q[0][i+1] is then added to the context value c, which is derived in the step 504*a*, i.e. to a bit-shifted (shifted to the right by 4-bits) number representation of the numeric previous context value. It should be noted here that the entry q[0][i+1] of the array q[ ][ ] represents a sub-region value associated with a previous portion of the audio content (e.g., a portion of the audio content having time index t0-1, as defined with reference to FIG. 4), and with a higher frequency (e.g. a frequency having a frequency index i+1, as defined with reference to FIG. 4) than the tuple of spectral values to be currently decoded (using the numeric current context value c output by the function "arith_get_context(c,i,N)"). In other words, if the tuple 420 of spectral values is to be decoded using the numeric current context value, the entry q[0][i+1] may be based on the tuple 460 of previously-decoded spectral values.

A selective addition of the entry q[0][i+1] of the array q[ ][ ] (shifted to the left by 12-bits) is shown at reference numeral 504*b*. As can be seen, the addition of the value represented by the entry q[0][i+1] is naturally only performed if the frequency index i does not designate a tuple of spectral values having the highest frequency index i=N/4-1.

Subsequently, in a step 504*c*, a Boolean AND-operation is performed, in which the value of the variable c is AND-combined with a hexadecimal value of 0xFFF0 to obtain an updated value of the variable c. By performing such an AND-operation, the four least-significant bits of the variable c are effectively set to zero.

In a step 504*d*, the value of the entry q[0][i−1] is added to the value of the variable c, which is obtained by step 504*c*, to thereby update the value of the variable c. However, said update of the variable c in step 504*d* is only performed if the frequency index i of the 2-tuple to decode is larger than zero. It should be noted that the entry q[0][i−1] is a context sub-region value based on a tuple of previously-decoded spectral values of the current portion of the audio content for frequencies smaller than the frequencies of the spectral values to be decoded using the numeric current context value. For example, the entry q[0][i−1] of the array q[ ][ ] may be associated with the tuple 430 having time index t0 and frequency index i−1, if it is assumed that the tuple 420 of spectral values is to be decoded using the numeric current context value returned by the present execution of the function "arith_get_context(c,i,N)".

To summarize, bits 0, 1, 2, and 3 (i.e. a portion of four least-significant bits) of the numeric previous context value are discarded in step 504*a* by shifting them out of the binary number representation of the numeric previous context value. Moreover, bits 12, 13, 14, and 15 of the shifted variable c (i.e.

of the shifted numeric previous context value) are set to take values defined by the context sub-region value q[0][i+1] in the step 504*b*. Bits 0, 1, 2, and 3 of the shifted numeric previous context value (i.e. bits 4, 5, 6, and 7 of the original numeric previous context value) are overwritten by the context sub-region value q[1][i−1] in steps 504*c* and 504*d*.

Consequently, it can be said that bits 0 to 3 of the numeric previous context value represent the context sub-region value associated with the tuple 432 of spectral values, bits 4 to 7 of the numeric previous context value represent the context sub-region value associated with a tuple 434 of previously decoded spectral values, bits 8 to 11 of the numeric previous context value represent the context sub-region value associated with the tuple 440 of previously-decoded spectral values and bits 12 to 15 of the numeric previous context value represent a context sub-region value associated with the tuple 450 of previously-decoded spectral values. The numeric previous context value, which is input into the function "arith_get_context(c,i,N)", is associated with a decoding of the tuple 430 of spectral values.

The numeric current context value, which is obtained as an output variable of the function "arith_get_context(c,i,N)", is associated with a decoding of the tuple 420 of spectral values. Accordingly, bits 0 to 3 of the numeric current context values describe the context sub-region value associated with the tuple 430 of the spectral values, bits 4 to 7 of the numeric current context value describe the context sub-region value associated with the tuple 440 of spectral values, bits 8 to 11 of the numeric current context value describe the numeric sub-region value associated with the tuple 450 of spectral value and bits 12 to 15 of the numeric current context value described the context sub-region value associated with the tuple 460 of spectral values. Thus, it can be seen that a portion of the numeric previous context value, namely bits 8 to 15 of the numeric previous context value, are also included in the numeric current context value, as bits 4 to 11 of the numeric current context value. In contrast, bits 0 to 7 of the current numeric previous context value are discarded when deriving the number representation of the numeric current context value from the number representation of the numeric previous context value.

In a step 504*e*, the variable c which represents the numeric current context value is selectively updated if the frequency index i of the 2-tuple to decode is larger than a predetermined number of, for example, 3. In this case, i.e. if i is larger than 3, it is determined whether the sum of the context sub-region values q[1][i−3], q[1][i−2], and q[1][i−1] is smaller than (or equal to) a predetermined value of, for example, 5. If it is found that the sum of said context sub-region values is smaller than said predetermined value, a hexadecimal value of, for example, 0x10000, is added to the variable c. Accordingly, the variable c is set such that the variable c indicates if there is a condition in which the context sub-region values q[1][i−3], q[1][i−2], and q[1][i−1] comprise a particularly small sum value. For example, bit 16 of the numeric current context value may act as a flag to indicate such a condition.

To conclude, the return value of the function "arith_get_context(c,i,N)" is determined by the steps 504*a*, 504*b*, 504*c*, 504*d*, and 504*e*, where the numeric current context value is derived from the numeric previous context value in steps 504*a*, 504*b*, 504*c*, and 504*d*, and wherein a flag indicating an environment of previously decoded spectral values having, on average, particularly small absolute values, is derived in step 504*e* and added to the variable c. Accordingly, the value of the variable c obtained steps 504*a*, 504*b*, 504*c*, 504*d* is returned, in a step 504*f*, as a return value of the function "arith_get_context(c,i,N)", if the condition evaluated in step 504*e* is not fulfilled. In contrast, the value of the variable c, which is derived in steps 504*a*, 504*b*, 504*c*, and 504*d*, is incremented by the hexadecimal value of 0x10000 and the result of this increment operation is returned, in the step 504*e*, if the condition evaluated in step 540*e* is fulfilled.

To summarize the above, it should be noted that the noiseless decoder outputs 2-tuples of unsigned quantized spectral coefficients (as will be described in more detail below). At first the state c of the context is calculated based on the previously decoded spectral coefficients "surrounding" the 2-tuple to decode. In an advantageous embodiment, the state (which is, for example, represented by a numeric context value c) is incrementally updated using the context state of the last decoded 2-tuple (which is designated as a numeric previous context value), considering only two new 2-tuples (for example, 2-tuples 430 and 460). The state is coded on 17-bits (e.g., using a number representation of a numeric current context value) and is returned by the function "arith_get_context( )". For details, reference is made to the program code representation of FIG. 5*c*.

Moreover, it should be noted that a pseudo program code of an alternative embodiment of a function "arith_get_context( )" is shown in FIG. 5*d*. The function "arith_get_context(c,i)" according to FIG. 5*d* is similar to the function "arith_get_context(c,i,N)" according to FIG. 5*c*. However, the function "arith_get_context(c,i)" according to FIG. 5*d* does not comprise a special handling or decoding of tuples of spectral values comprising a minimum frequency index of i=0 or a maximum frequency index of i=N/4-1.

11.5 Mapping Rule Selection

In the following, the selection of a mapping rule, for example, a cumulative-frequencies-table which describes a mapping of a codeword value onto a symbol code, will be described. The selection of the mapping rule is made in dependence on a context state, which is described by the numeric current context value c.

11.5.1 Mapping Rule Selection Using the Algorithm According to FIG. 5*e*

In the following, the selection of a mapping rule using the function "arith_get_pk(c)" will be described. It should be noted that the function "arith_get_pk( )" is called at the beginning of the sub-algorithm 312*ba* when decoding a code value "acod_m" for providing a tuple of spectral values. It should be noted that the function "arith_get_pk(c)" is called with different arguments in different iterations of the algorithm 312*b*. For example, in a first iteration of the algorithm 312*b*, the function "arith_get_pk(c)" is called with an argument which is equal to the numeric current context value c, provided by the previous execution of the function "arith_get_context(c,i,N)" at step 312*a*. In contrast, in further iterations of the sub-algorithm 312*ba*, the function "arith_get_pk(c)" is called with an argument which is the sum of the numeric current context value c provided by the function "arith_get_context(c,i,N)" in step 312*a*, and a bit-shifted version of the value of the variable "esc_nb", wherein the value of the variable "esc_nb" is shifted to the left by 17-bits. Thus, the numeric current context value c provided by the function "arith_get_context(c,i,N)" is used as an input value of the function "arith_ get_pk( )" in the first iteration of the algorithm 312*ba*, i.e. in the decoding of comparatively small spectral values. In contrast, when decoding comparatively larger spectral values, the input variable of the function "arith_get_pk( )" is modified in that the value of the variable "esc_nb", is taken into consideration, as is shown in FIG. 3.

Taking reference now to FIG. 5*e*, which shows a pseudo program code representation of a first, advantageous embodiment of the function "arith_get_pk(c)", it should be noted that the function "arith_get_pk( )" receives the variable c as an input value, wherein the variable c describes the state of the context, and wherein the input variable c of the function "arith_get_pk( )" is equal to the numeric current context value provided as a return variable by the function "arith_get_context( )" at least in some situations. Moreover, it should be noted that the function "arith_get_pk( )" provides, as an output variable, the variable "pki", which describes an index of a probability model and which may be considered as a mapping rule index value.

Taking reference to FIG. 5*e*, it can be seen that the function "arith_get_pk( )" comprises a variable initialization 506*a*, wherein the variable "i_min" is initialized to take the value of −1. Similarly, the variable i is set to be equal to the variable "i_min", such that the variable i is also initialized to a value of −1. The variable "i_max" is initialized to take a value which is smaller, by 1, than the number of entries of the table "ari_lookup_m[ ]" (details of which will be described taking reference to FIG. 21). Accordingly, the variables "i_min" and "i_max" define an interval. For example, i_max may be initialized to the value 741.

Subsequently, a search 506*b* is performed to identify an index value which designates an entry of the table "ari_hash_m", which is chosen as defined in the table representation of FIGS. 22(1),22(2), 22(3), 22(4), such that the value of the input variable c of the function "arith_get_pk( )" lies within an interval defined by said entry and an adjacent entry.

In the search 506*b*, a sub-algorithm 506*ba* is repeated, while a difference between the variables "i_max" and "i_min" is larger than 1. In the sub-algorithm 506*ba*, the variable i is set to be equal to an arithmetic mean of the values of the variables "i_min" and "i_max". Consequently, the variable i designates an entry of the table "ari_hash_m[ ]" (as defined in the table representations of FIGS. 22(1), 22(2), 22(3) and 22(4)) in a middle of a table interval defined by the values of the variables "i_min" and "i_max". Subsequently, the variable j is set to be equal to the value of the entry "ari_hash_m[i]" of the table "ari_hash_m[ ]". Thus, the variable j takes a value defined by an entry of the table "ari_hash_m[ ]", which entry lies in the middle of a table interval defined by the variables "i_min" and "i_max". Subsequently, the interval defined by the variables "i_min" and "i_max" is updated if the value of the input variable c of the function "arith_get_pk( )" is different from a state value defined by the uppermost bits of the table entry "j=ari_hash_m[i]" of the table "ari_hash_m[ ]". For example, the "upper bits" (bits 8 and upward) of the entries of the table "ari_hash_m[ ]" describe significant state values. Accordingly, the value "j>>8" describes a significant state value represented by the entry "j=ari_hash_m[i]" of the table "ari_hash_m[ ]" designated by the hash-table-index value i. Accordingly, if the value of the variable c is smaller than the value "j>>8", this means that the state value described by the variable c is smaller than a significant state value described by the entry "ari_hash_m[i]" of the table "ari_hash_m[ ]". In this case, the value of the variable "i_max" is set to be equal to the value of the variable i, which in turn has the effect that a size of the interval defined by "i_min" and "i_max" is reduced, wherein the new interval is approximately equal to the lower half of the previous interval. If it found that the input variable c of the function "arith_get_pk( )" is larger than the value "j>>8", which means that the context value described by the variable c is larger than a significant state value described by the entry "ari_hash_m[i]" of the array "ari_hash_m[ ]", the value of the variable "i_min" is set to be equal to the value of the variable i. Accordingly, the size of the interval defined by the values of the variables "i_min" and "i_max" is reduced to approximately a half of the size of the previous interval, defined by the previous values of the variables "i_min" and "i_max". To be more precise, the interval defined by the updated value of the variable "i_min" and by the previous (unchanged) value of the variable "i_max" is approximately equal to the upper half of the previous interval in the case that the value of the variable c is larger than the significant state value defined by the entry "ari_hash_m[i]".

If, however, it is found that the context value described by the input variable c of the algorithm "arith_get_pk( )" is equal to the significant state value defined by the entry "ari_hash_m[i]" (i.e. c==(j>>8)), a mapping rule index value defined by the lower most 8-bits of the entry "ari_hash_m[i]" is returned as the return value of the function "arith_get_pk( )" (instruction "return (j&0xFF)").

To summarize the above, an entry "ari_hash_m[i]", the uppermost bits (bits 8 and upward) of which describe a significant state value, is evaluated in each iteration 506*ba*, and the context value (or numeric current context value) described by the input variable c of the function "arith_get_pk( )" is compared with the significant state value described by said table entry "ari_hash_m[i]". If the context value represented by the input variable c is smaller than the significant state value represented by the table entry "ari_hash_m[i]", the upper boundary (described by the value "i_max") of the table interval is reduced, and if the context value described by the input variable c is larger than the significant state value described by the table entry "ari_hash_m[i]", the lower boundary (which is described by the value of the variable "i_min") of the table interval is increased. In both of said cases, the sub-algorithm 506*ba* is repeated, unless the size of the interval (defined by the difference between "i_max" and "i_min") is smaller than, or equal to, 1. If, in contrast, the context value described by the variable c is equal to the significant state value described by the table entry "ari_hash_m[i]", the function "arith_get_pk( )" is aborted, wherein the return value is defined by the lower most 8-bits of the table entry "ari_hash_m[i]".

If, however, the search 506*b* is terminated because the interval size reaches its minimum value ("i_max−"i_min" is smaller than, or equal to, 1), the return value of the function "arith_get_pk( )" is determined by an entry "ari_lookup_m[i_max]" of a table "ari_lookup_m[ ]", which can be seen at reference numeral 506*c*. The table ari_lookup_m[ ] is advantageously chosen as defined in the table representation of FIG. 21, and may therefore be equal to the table ari_lookup_m[742]. Accordingly, the entries of the table "ari_hash_m[ ]" (which is advantageously equal to the table ari_hash_m[742] as defined in FIGS. 22(1), 22(2), 22(3), 22(4)) define both significant state values and boundaries of intervals. In the sub-algorithm 506*ba*, the search interval boundaries "i_min" and "i_max" are iteratively adapted such that the entry "ari_hash_m[i]" of the table "ari_hash_m[ ]", a hash table index i of which lies, at least approximately, in the center of the search interval defined by the interval boundary values "i_min" and "i_max", at least approximates a context value described by the input variable c. It is thus achieved that the context value described by the input variable c lies within an interval defined by "ari_hash_m[i_min]" and "ari_hash_m[i_max]" after the completion of the iterations of the sub-algorithm 506*ba*, unless the context value described by the input variable c is equal to a significant state value described by an entry of the table "ari_hash_m[ ]".

If, however, the iterative repetition of the sub-algorithm 506*ba* is terminated because the size of the interval (defined by "i_max−i_min") reaches or exceeds its minimum value, it is assumed that the context value described by the input variable c is not a significant state value. In this case, the index "i_max", which designates an upper boundary of the interval, is nevertheless used. The upper value "i_max" of the interval, which is reached in the last iteration of the sub-algorithm 506*ba*, is re-used as a table index value for an access to the table "ari_lookup_m" (which may be equal to the table ari_lookup_m[742] of FIG. 21). The table "ari_lookup_m[ ]" describes mapping rule index values associated with intervals of a plurality of adjacent numeric context values. The intervals, to which the mapping rule index values described by the entries of the table "ari_lookup_m[ ]" are associated, are defined by the significant state values described by the entries of the table "ari_hash_mll". The entries of the table "ari_hash_m" define both significant state values and interval boundaries of intervals of adjacent numeric context values. In the execution of the algorithm 506*b*, it is determined whether the numeric context value described by the input variable c is equal to a significant state value, and if this is not the case, in which interval of numeric context values (out of a plurality of intervals, boundaries of which are defined by the significant state values) the context value described by the input variable c is lying. Thus, the algorithm 506*b* fulfills a double functionality to determine whether the input variable c describes a significant state value and, if it is not the case, to identify an interval, bounded by significant state values, in which the context value represented by the input variable c lies. Accordingly, the algorithm 506*e* is particularly efficient and may use only a comparatively small number of table accesses.

To summarize the above, the context state c determines the cumulative-frequencies-table used for decoding the most-significant 2-bits-wise plane m. The mapping from c to the corresponding cumulative-frequencies-table index "pki" as performed by the function "arith_get_pk( )". A pseudo program code representation of said function "arith_get_pk( )" has been explained taking reference to FIG. 5*e*.

To further summarize the above, the value m is decoded using the function "arith_decode( )" (which is described in more detail below) called with the cumulative-frequencies-table "arith_cf_m[pki][ ]", where "pki" corresponds to the index (also designated as mapping rule index value) returned by the function "arith_get_pk( )", which is described with reference to fig Se in the form of a pseudo-C code.

11.5.2 Mapping Rule Selection Using the Algorithm According to FIG. 5*f*

In the following, another embodiment of a mapping rule selection algorithm "arith_get_pk( )" will be described with reference to FIG. 5*f* which shows a pseudo program code representation of such an algorithm, which may be used in the decoding of a tuple of spectral values. The algorithm according to FIG. 5*f* may be considered as an optimized version (e.g., speed optimized version) of the algorithm, "get_pk( )" or of the algorithm "arith_get_pk( )".

The algorithm "arith_get_pk( )" according to FIG. 5*f* receives, as an input variable, a variable c which describes the state of the context. The input variable c may, for example, represent a numeric current context value.

The algorithm "arith_get_pk( )" provides, as an output variable, a variable "pki", which describes and index of a probability distribution (or probability model) associated to a state of the context described by the input variable c. The variable "pki" may, for example, be a mapping rule index value.

The algorithm according to FIG. 5*f* comprises a definition of the contents of the array "i_diff[ ]". As can be seen, a first entry of the array "i_diff[ ]" (having an array index 0) is equal to 299 and the further array entries (having array indices 1 to 8) take the values of 149, 74, 37, 18, 9, 4, 2, and 1. Accordingly, the step size for the selection of a hash-table index value "i_min" is reduced with each iteration, as the entries of the arrays "i_diffll" define said step sizes. For details, reference is made to the below discussion.

However, different step sizes, e.g. different contents of the array "i_diff[ ]" may actually be chosen, wherein the contents of the array "i_diff[ ]" may naturally be adapted to a size of the hash-table "ari_hash_m[i]".

It should be noted that the variable "i_min" is initialized to take a value of 0 right at the beginning of the algorithm "arith_get_pk( )".

In an initialization step 508*a*, a variable s is initialized in dependence on the input variable c, wherein a number representation of the variable c is shifted to the left by 8 bits in order to obtain the number representation of the variable s.

Subsequently, a table search 508*b* is performed, in order to identify a hash-table-index-value "i_min" of an entry of the hash-table "ari_hash_m[ ]", such that the context value described by the context value c lies within an interval which is bounded by the context value described by the hash-table entry "ari_hash_m[i_min]" and a context value described by another hash-table entry "ari_hash_m" which other entry "ari_hash_m" is adjacent (in terms of its hash-table index value) to the hash-table entry "ari_hash_m[i_min]" Thus, the algorithm 508*b* allows for the determining of a hash-table-index-value "i_min" designating an entry "j=ari_hash_m [i_min]" of the hash-table "ari_hash_m[ ]", such that the hash-table entry "ari_hash_m[i_min]" at least approximates the context value described by the input variable c.

The table search 508*b* comprises an iterative execution of a sub-algorithm 508*ba*, wherein the sub-algorithm 508*ba* is executed for a predetermined number of, for example, nine iterations. In the first step of the sub-algorithm 508*ba*, the variable i is set to a value which is equal to a sum of a value of a variable "i_min" and a value of a table entry "i_diff[k]". It should be noted here that k is a running variable, which is incremented, starting from an initial value of k=0, with each iteration of the sub-algorithm 508*ba*. The array "i_diff[ ]" defines predetermine increment values, wherein the increment values decrease with increasing table index k, i.e. with increasing numbers of iterations.

In a second step of the sub-algorithm 508*ba*, a value of a table entry "ari_hash_m[ ]" is copied into a variable j. Advantageously, the uppermost bits of the table-entries of the table "ari_hash_m[ ]" describe a significant state values of a numeric context value, and the lowermost bits (bits 0 to 7) of the entries of the table "ari_hash_m[ ]" describe mapping rule index values associated with the respective significant state values.

In a third step of the sub-algorithm 508*ba*, the value of the variable S is compared with the value of the variable j, and the variable "i_min" is selectively set to the value "i+1" if the value of the variable s is larger than the value of the variable j. Subsequently, the first step, the second step, and the third step of the sub-algorithm 508*ba* are repeated for a predetermined number of times, for example, nine times. Thus, in each execution of the sub-algorithm 508*ba*, the value of the variable "i_min" is incremented by i_diff[ ]+1, if, and only if, the context value described by the currently valid hash-table-index i_min+i_diff[ ] is smaller than the context value described by the input variable c. Accordingly, the hash-table-index-value "i_min" is (iteratively) increased in each execution of the sub-algorithm 508*ba* if (and only if) the context value described by the input variable c and, consequently, by the variable s, is larger than the context value described by the entry "ari_hash_m[i=i_min+diff[k]]".

Moreover, it should be noted that only a single comparison, namely the comparison as to whether the value of the variable s is larger than the value of the variable j, is performed in each execution of the sub-algorithm 508*ba*. Accordingly, the algorithm 508*ba* is computationally particularly efficient. Moreover, it should be noted that there are different possible outcomes with respect to the final value of the variable "i_min" For example, it is possible that the value of the variable "i_min" after the last execution of the sub-algorithm 512*ba* is such that the context value described by the table entry "ari_hash_m[i_min]" is smaller than the context value described by the input variable c, and that the context value described by the table entry "ari_hash_m[i_min+1]" is larger than the context value described by the input variable c. Alternatively, it may happen that after the last execution of the sub-algorithm 508*ba*, the context value described by the hash-table-entry "ari_hash_m[i_min−1]" is smaller than the context value described by the input variable c, and that the context value described by the entry "ari_hash_m[i_min]" is larger than the context value described by the input variable c. Alternatively, however, it may happen that the context value described by the hash-table-entry "ari_hash_m[i_min]" is identical to the context value described by the input variable c.

For this reason, a decision-based return value provision 508*c* is performed. The variable j is set to take the value of the hash-table-entry "ari_hash_m[i_min]" Subsequently, it is determined whether the context value described by the input variable c (and also by the variable s) is larger than the context value described by the entry "ari_hash_m[i_min]" (first case defined by the condition "s>j"), or whether the context value described by the input variable c is smaller than the context value described by the hash-table-entry "ari_hash_m[i_min]" (second case defined by the condition "c<(j>>8)"), or whether the context value described by the input variable c is equal to the context value described by the entry "ari_hash_m[i_min]" (third case).

In the first case, (s>j), an entry "ari_lookup_m[i_min+1]" of the table "ari_lookup_m[ ]" designated by the table index value "i_min+1" is returned as the output value of the function "arith_get_pk( )". In the second case (c<(j>>8)), an entry "ari_lookup_m[i_min]" of the table "ari_lookup_m[ ]" designated by the table index value "i_min" is returned as the return value of the function "arith_get_pk( )". In the third case (i.e. if the context value described by the input variable c is equal to the significant state value described by the table entry "ari_hash_m[i_min]"), a mapping rule index value described by the lowermost 8-bits of the hash-table entry "ari_hash_m[i_min]" is returned as the return value of the function "arith_get_pk( )".

To summarize the above, a particularly simple table search is performed in step 508*b*, wherein the table search provides a variable value of a variable "i_min" without distinguishing whether the context value described by the input variable c is equal to a significant state value defined by one of the state entries of the table "ari_hash_m[ ]" or not. In the step 508*c*, which is performed subsequent to the table search 508*b*, a magnitude relationship between the context value described by the input variable c and a significant state value described by the hash-table-entry "ari_hash_m[i_min]" is evaluated, and the return value of the function "arith_get_pk( )" is selected in dependence on a result of said evaluation, wherein the value of the variable "i_min", which is determined in the table evaluation 508*b*, is considered to select a mapping rule index value even if the context value described by the input variable c is different from the significant state value described by the hash-table-entry "ari_hash_m[i_min]".

It should further be noted that the comparison in the algorithm should advantageously (or alternatively) be done between the context index (numeric context value) c and j=ari_hash_m[i]>>8. Indeed, each entry of the table "ari_hash_m[ ]" represents a context index, coded beyond the 8th bits, and its corresponding probability model coded on the 8 first bits (least significant bits). In the current implementation, we are mainly interested in knowing whether the present context c is greater than ari_hash_m[i]>>8, which is equivalent to detecting if s=c<<8 is also greater than ari_hash_m[i].

To summarize the above, once the context state is calculated (which may, for example, be achieved using the algorithm "arith_get_context(c,i,N)" according to FIG. 5*c*, or the algorithm "arith_get_context(c,i)" according to FIG. 5*d*, the most significant 2-bit-wise-plane is decoded using the algorithm "arith_decode" (which will be described below) called with the appropriate cumulative-frequencies-table corresponding to the probability model corresponding to the context state. The correspondence is made by the function "arith_get_pk( )", for example, the function "arith_get_pk( )" which has been discussed with reference to FIG. 5*f*.

11.6 Arithmetic Decoding 11.6.1 Arithmetic Decoding Using the Algorithm According to FIG. 5*g*

In the following, the functionality an advantageous implementation of the function "arith_decode( )" will be discussed in detail with reference to FIG. 5*g*. FIG. 5*g* shows a pseudo C-code describing the used algorithm.

It should be noted that the function "arith_decode( )" uses the helper function "arith_first_symbol (void)", which returns TRUE, if it is the first symbol of the sequence and FALSE otherwise. The function "arith_decode( )" also uses the helper function "arith_get_next_bit(void)", which gets and provides the next bit of the bitstream.

In addition, the function "arith_decode( )" uses the global variables "low", "high" and "value". Further, the function "arith_decode( )" receives, as an input variable, the variable "cum_freq[ ]", which points towards a first entry or element (having element index or entry index 0) of the selected cumulative-frequencies-table or cumulative-frequencies sub-table (advantageously, one of the sub-tables ari_cf_m[pki=0][17] to ari_cf_m[pki=63][17] of the table ari_cf_m[64][17], as defined by the table representation of FIGS. 23(1), 23(2), 23(3)). Also, the function "arith_decode( )" uses the input variable "cfl", which indicates the length of the selected cumulative-frequencies-table or cumulative-frequencies sub-table designated by the variable "cum_freq[ ]".

The function "arith_decode( )" comprises, as a first step, a variable initialization 570*a*, which is performed if the helper function "arith_first_symbol( )" indicates that the first symbol of a sequence of symbols is being decoded. The value initialization 550*a* initializes the variable "value" in dependence on a plurality of, for example, 16 bits, which are obtained from the bitstream using the helper function "arith_get_next_bit", such that the variable "value" takes the value represented by said bits. Also, the variable "low" is initialized to take the value of 0, and the variable "high" is initialized to take the value of 65535.

In a second step 570*b*, the variable "range" is set to a value, which is larger, by 1, than the difference between the values of the variables "high" and "low". The variable "cum" is set to a value which represents a relative position of the value of the variable "value" between the value of the variable "low" and the value of the variable "high". Accordingly, the variable "cum" takes, for example, a value between 0 and $2^{16}$ in dependence on the value of the variable "value".

The pointer p is initialized to a value which is smaller, by 1, than the starting address of the selected cumulative-frequencies-table or sub-table.

The algorithm "arith_decode( )" also comprises an iterative cumulative-frequencies-table-search 570*c*. The iterative cumulative-frequencies-table-search is repeated until the variable cfl is smaller than or equal to 1. In the iterative cumulative-frequencies-table-search 570*c*, the pointer variable q is set to a value, which is equal to the sum of the current value of the pointer variable p and half the value of the variable "cfl". If the value of the entry *q of the selected cumulative-frequencies-table, which entry is addressed by the pointer variable q, is larger than the value of the variable "cum", the pointer variable p is set to the value of the pointer variable q, and the variable "cfl" is incremented. Finally, the variable "cfl" is shifted to the right by one bit, thereby effectively dividing the value of the variable "cfl" by 2 and neglecting the modulo portion.

Accordingly, the iterative cumulative-frequencies-table-search 570*c* effectively compares the value of the variable "cum" with a plurality of entries of the selected cumulative-frequencies-table, in order to identify an interval within the selected cumulative-frequencies-table, which is bounded by entries of the cumulative-frequencies-table, such that the value cum lies within the identified interval. Accordingly, the entries of the selected cumulative-frequencies-table define intervals, wherein a respective symbol value is associated to each of the intervals of the selected cumulative-frequencies-table. Also, the widths of the intervals between two adjacent values of the cumulative-frequencies-table define probabilities of the symbols associated with said intervals, such that the selected cumulative-frequencies-table in its entirety defines a probability distribution of the different symbols (or symbol values). Details regarding the available cumulative-frequencies-tables or cumulative-frequencies-sub-tables will be discussed below taking reference to FIG. 23.

Taking reference again to FIG. 5*g*, the symbol value is derived from the value of the pointer variable p, wherein the symbol value is derived as shown at reference numeral 570*d*. Thus, the difference between the value of the pointer variable p and the starting address "cum_freq" is evaluated in order to obtain the symbol value, which is represented by the variable "symbol".

The algorithm "arith_decode" also comprises an adaptation 570*e* of the variables "high" and "low". If the symbol value represented by the variable "symbol" is different from 0, the variable "high" is updated, as shown at reference numeral 570*e*. Also, the value of the variable "low" is updated, as shown at reference numeral 570*e*. The variable "high" is set to a value which is determined by the value of the variable "low", the variable "range" and the entry having the index "symbol −1" of the selected cumulative-frequencies-table or cumulative-frequencies sub-table. The variable "low" is increased, wherein the magnitude of the increase is determined by the variable "range" and the entry of the selected cumulative-frequencies-table having the index "symbol". Accordingly, the difference between the values of the variables "low" and "high" is adjusted in dependence on the numeric difference between two adjacent entries of the selected cumulative-frequencies-table.

Accordingly, if a symbol value having a low probability is detected, the interval between the values of the variables "low" and "high" is reduced to a narrow width. In contrast, if the detected symbol value comprises a relatively large probability, the width of the interval between the values of the variables "low" and "high" is set to a comparatively large value. Again, the width of the interval between the values of the variable "low" and "high" is dependent on the detected symbol and the corresponding entries of the cumulative-frequencies-table.

The algorithm "arith_decode( )" also comprises an interval renormalization 570*f*, in which the interval determined in the step 570*e* is iteratively shifted and scaled until the "break"-condition is reached. In the interval renormalization 570*f*, a selective shift-downward operation 570*fa* is performed. If the variable "high" is smaller than 32768, nothing is done, and the interval renormalization continues with an interval-size-increase operation 570*fb*. If, however, the variable "high" is not smaller than 32768 and the variable "low" is greater than or equal to 32768, the variables "values", "low" and "high" are all reduced by 32768, such that an interval defined by the variables "low" and "high" is shifted downwards, and such that the value of the variable "value" is also shifted downwards. If, however, it is found that the value of the variable "high" is not smaller than 32768, and that the variable "low" is not greater than or equal to 32768, and that the variable "low" is greater than or equal to 16384 and that the variable "high" is smaller than 49152, the variables "value", "low" and "high" are all reduced by 16384, thereby shifting down the interval between the values of the variables "high" and "low" and also the value of the variable "value". If, however, neither of the above conditions is fulfilled, the interval renormalization is aborted.

If, however, any of the above-mentioned conditions, which are evaluated in the step 570*fa*, is fulfilled, the interval-increase-operation 570*fb* is executed. In the interval-increase-operation 570*fb*, the value of the variable "low" is doubled. Also, the value of the variable "high" is doubled, and the result of the doubling is increased by 1. Also, the value of the variable "value" is doubled (shifted to the left by one bit), and a bit of the bitstream, which is obtained by the helper function "arith_get_next_bit" is used as the least-significant bit. Accordingly, the size of the interval between the values of the variables "low" and "high" is approximately doubled, and the precision of the variable "value" is increased by using a new bit of the bitstream. As mentioned above, the steps 570*fa* and 570*fb* are repeated until the "break" condition is reached, i.e. until the interval between the values of the variables "low" and "high" is large enough.

Regarding the functionality of the algorithm "arith_decode( )", it should be noted that the interval between the values of the variables "low" and "high" is reduced in the step 570*e* in dependence on two adjacent entries of the cumulative-frequencies-table referenced by the variable "cum_freq". If an interval between two adjacent values of the selected cumulative-frequencies-table is small, i.e. if the adjacent values are comparatively close together, the interval between the values of the variables "low" and "high", which is obtained in the step 570*e*, will be comparatively small. In contrast, if two adjacent entries of the cumulative-frequencies-table are spaced further, the interval between the values of the variables "low" and "high", which is obtained in the step 570*e*, will be comparatively large.

Consequently, if the interval between the values of the variables "low" and "high", which is obtained in the step 570*e*, is comparatively small, a large number of interval renormalization steps will be executed to re-scale the interval to a "sufficient" size (such that neither of the conditions of the condition evaluation 570*fa* is fulfilled). Accordingly, a comparatively large number of bits from the bitstream will be used in order to increase the precision of the variable "value". If, in contrast, the interval size obtained in the step 570*e* is comparatively large, only a smaller number of repetitions of the interval normalization steps 570*fa* and 570*fb* may be used in order to renormalize the interval between the values of the variables "low" and "high" to a "sufficient" size. Accordingly, only a comparatively small number of bits from the bitstream will be used to increase the precision of the variable "value" and to prepare a decoding of a next symbol.

To summarize the above, if a symbol is decoded, which comprises a comparatively high probability, and to which a large interval is associated by the entries of the selected cumulative-frequencies-table, only a comparatively small number of bits will be read from the bitstream in order to allow for the decoding of a subsequent symbol. In contrast, if a symbol is decoded, which comprises a comparatively small probability and to which a small interval is associated by the entries of the selected cumulative-frequencies-table, a comparatively large number of bits will be taken from the bitstream in order to prepare a decoding of the next symbol.

Accordingly, the entries of the cumulative-frequencies-tables reflect the probabilities of the different symbols and also reflect a number of bits that may be used for decoding a sequence of symbols. By varying the cumulative-frequencies-table in dependence on a context, i.e. in dependence on previously-decoded symbols (or spectral values), for example, by selecting different cumulative-frequencies-tables in dependence on the context, stochastic dependencies between the different symbols can be exploited, which allows for a particular bitrate-efficient encoding of the subsequent (or adjacent) symbols.

To summarize the above, the function "arith_decode( )", which has been described with reference to FIG. 5*g*, is called with the cumulative-frequencies-table "arith_cf_m[pki][ ]", corresponding to the index "pki" returned by the function "arith_get_pk( )" to determine the most-significant bit-plane value m (which may be set to the symbol value represented by the return variable "symbol").

To summarize the above, the arithmetic decoder is an integer implementation using the method of tag generation with scaling. For details, reference is made to the book "Introduction to Data Compression" of K. Sayood, Third Edition, 2006, Elsevier Inc.

The computer program code according to FIG. 5*g* describes the used algorithm according to an embodiment of the invention.

11.6.2 Arithmetic Decoding Using the Algorithm According to FIGS. 5*h* and 5*i*

FIGS. 5*h* and 5*i* show a pseudo program code representation of another embodiment of the algorithm "arith_decode( )", which can be used as an alternative to the algorithm "arith_decode" described with reference to FIG. 5*g*.

It should be noted that both the algorithms according to FIG. 5*g* and FIGS. 5*h* and 5*i* may be used in the algorithm "values_decode( )" according to FIG. 3.

To summarize, the value m is decoded using the function "arith_decode( )" called with the cumulative-frequencies-table "arith_cf_m[pki][ ]" (which is, advantageously, a subtable of the table ari_cf_m[67][17] defined in the table representations of FIGS. 23(1), 23(2), 23(3)) wherein "pki" corresponds to the index returned by the function "arith_get_pk( )". The arithmetic coder (or decoder) is an integer implementation using the method of tag generation with scaling. For details, reference is made to the Book "Introduction to Data Compression" of K. Sayood, Third Edition, 2006, Elsevier Inc. The computer program code according to FIGS. 5*h* and 5*i* describes the used algorithm.

11.7 Escape Mechanism

In the following, the escape mechanism, which is used in the decoding algorithm "values_decode( )" according to FIG. 3, will briefly be discussed.

When the decoded value m (which is provided as a return value of the function "arith_decode( )") is the escape symbol "ARITH_ESCAPE", the variables "lev" and "esc_nb" are incremented by 1, and another value m is decoded. In this case, the function "arith_get_pk( )" (or "get_pk( )") is called once again with the value "c+esc_nb<<17 as input argument, where the variable "esc_nb" describes the number of escape symbols previously decoded for the same 2-tuple and bounded to 7.

To summarize, if an escape symbol is identified, it is assumed that the most-significant bit-plane value m comprises an increased numeric weight. Moreover, current numeric decoding is repeated, wherein a modified numeric current context value "c+esc_nb<<17" is used as an input variable to the function "arith_get_pk( )". Accordingly, a different mapping rule index value "pki" is typically obtained in different iterations of the sub-algorithm 312*ba*.

11.8 Arithmetic Stop Mechanism

In the following, the arithmetic stop mechanism will be described. The arithmetic stop mechanism allows for the reduction of the number of bits that may be used in the case that the upper frequency portion is entirely quantized to 0 in an audio encoder.

In an embodiment, an arithmetic stop mechanism may be implemented as follows: Once the value m is not the escape symbol, "ARITH_ESCAPE", the decoder checks if the successive m forms an "ARITH_STOP" symbol. If the condition "(esc_nb>0&&m==0)" is true, the "ARITH_STOP" symbol is detected and the decoding process is ended. In this case, the decoder jumps directly to the sign decoding described below or to the "arith_finish( )" function which will be described below. The condition means that the rest of the frame is composed of zero values.

11.9 Less-Significant Bit-Plane Decoding

In the following, the decoding of the one or more less-significant bit-planes will be described. The decoding of the less-significant bit-plane, is performed, for example, in the step 312*d* shown in FIG. 3. Alternatively, however, the algorithms as shown in FIGS. 5*j* and 5*n* may be used, wherein the algorithm of FIG. 5*j* is an advantageous algorithm.

11.9.1 Less-Significant Bit-Plane Decoding According to FIG. 5*j*

Taking reference now to FIG. 5*j*, it can be seen that the values of the variables a and b are derived from the value m. For example, the number representation of the value m is shifted to the right by 2-bits to obtain the number representation of the variable b. Moreover, the value of the variable a is obtained by subtracting a bit-shifted version of the value of variable b, bit-shifted to the left by 2-bits, from the value of the variable m.

Subsequently, an arithmetic decoding of the least-significant bit-plane values r is repeated, wherein the number of repetitions is determined by the value of the variable "lev". A least-significant bit-plane value r is obtained using the function "arith_decode", wherein a cumulative-frequencies-table adapted to the least-significant bit-plane decoding is used (cumulative-frequencies-table "arith_cf_r"). A least-significant bit (having a numeric weight of 1) of the variable r describes a less-significant bit-plane of the spectral value represented by the variable a, and a bit having a numeric weight of 2 of the variable r describes a less-significant bit of the spectral value represented by the variable b. Accordingly, the variable a is updated by shifting the variable a to the left by 1 bit and adding the bit having the numeric weight of 1 of the variable r as the least significant bit. Similarly, the variable b is updated by shifting the variable b to the left by one bit and adding the bit having the numeric weight of 2 of the variable r.

Accordingly, the two most-significant information carrying bits of the variables a,b are determined by the most-significant bit-plane value m, and the one or more least-significant bits (if any) of the values a and b are determined by one or more less-significant bit-plane values r.

To summarize the above, if the "ARITH_STOP" symbol is not met, the remaining bit planes are then decoded, if any exist, for the present 2-tuple. The remaining bit-planes are decoded from the most-significant to the least-significant level by calling the function "arith_decode( )" lev number of times with the cumulative frequencies table "arith_cf_r[ ]". The decoded bit-planes r permit to refine the previously-decoded value m in accordance with the algorithm, a pseudo program code of which is shown in FIG. 5*j*.

11.9.2 Less-Significant Bit Band Decoding According to FIG. 5*n*

Alternatively, however, the algorithm a pseudo program code representation of which is shown in FIG. 5*n* can also be used for the less-significant bit-plane decoding. In this case, if the "ARITH_STOP" symbol is not met, the remaining bit-planes are then decoded, if any exist, for the present 2-tuple. The remaining bit-planes are decoded from the most-significant to the least-significant level by calling "lev" times "arith_decode( )" with the cumulative-frequencies-table "arith_cf_r( )". The decoded bit-planes r permits for the refining of the previously-decoded value m in accordance with the algorithm shown in FIG. 5*n*.

11.10 Context Update 11.10.1 Context Update According to FIGS. 5*k*, 5*l*, and 5*m*

In the following, operations used to complete the decoding of the tuple of spectral values will be described, taking reference to FIGS. 5*k* and 5*l*. Moreover, an operation will be described which is used to complete a decoding of a set of tuples of spectral values associated with a current portion (for example, a current frame) of an audio content.

It should be noted that the algorithms according to FIGS. 5*k*, 5*l* and 5*m* are advantageous, even though alternative algorithms may be used.

Taking reference now to FIG. 5*k*, it can be seen that the entry having entry index 2*i of the array "x_ac_dec[ ]" is set to be equal to a, and that the entry having entry index "2*i+1" of the array "x_ac_dec[ ]" is set to be equal to b after the less significant bit decoding 312*d*. In other words, at the point after the less-significant bit decoding 312*d*, the unsigned value of the 2-tuple {a,b}, is completely decoded. It is saved into the array (for example the array "x_ac_dec[ ]") holding the spectral coefficients in accordance with the algorithm shown in FIG. 5*k*.

Subsequently, the context "q" is also updated for the next 2-tuple. It should be noted that this context update also has to be performed for the last 2-tuple. This context update is performed by the function "arith_update_context( )", a pseudo program code representation of which is shown in FIG. 5*l*.

Taking reference now to FIG. 5*l*, it can be seen that the function "arith_update_context(i,a,b)" receives, as input variables, decoded unsigned quantized spectral coefficients (or spectral values) a, b of the 2-tuple. In addition, the function "arith_update_context" also receives, as an input variable, an index i (for example, a frequency index) of the quantized spectral coefficient to decode. In other words, the input variable i may, for example, be an index of the tuple of spectral values, absolute values of which are defined by the input variables a, b. As can be seen, the entry "q[1][i]" of the array "q[ ][ ]" may be set to a value which is equal to a+b+1. In addition, the value of the entry "q[1][i]" of the array "q[ ][ ]" may be limited to a hexadecimal value of "0xF". Thus, the entry "q[1][i]" of the array "q[ ][ ]" is obtained by computing a sum of absolute values of the currently decoded tuple {a,b} of spectral values having frequency index i, and adding 1 to the result of said sum.

It should be noted here that the entry "q[1][i]" of the array "q[ ][ ]" may be considered as a context sub-region value, because it describes a sub-region of the context which is used for a subsequent decoding of additional spectral values (or tuples of spectral values).

It should be noted here that the summation of the absolute values a and b of the two currently decoded spectral values (signed versions of which are stored in the entries "x_ac_dec[2*i]" and "x_ac_dec[2*i+1]" of the array "x_ac_dec[ ]"), may be considered as the computation of a norm (e.g. a L1 norm) of the decoded spectral values.

It has been found that context sub-region values (i.e. entries of the array "q[ ][ ]"), which describe a norm of a vector formed by a plurality of previously decoded spectral values are particularly meaningful and memory efficient. It has been found that such a norm, which is computed on the basis of a plurality of previously decoded spectral values, comprises meaningful context information in a compact form. It has been found that the sign of the spectral values is typically not particularly relevant for the choice of the context. It has also been found that the formation of a norm across a plurality of previously decoded spectral values typically maintains the most important information, even though some details are discarded. Moreover, it has been found that a limitation of the numeric current context value to a maximum value typically does not result in a severe loss of information. Rather, it has been found that it is more efficient to use the same context state for significant spectral values which are larger than a predetermined threshold value. Thus, the limitation of the context sub-region values brings along a further improvement of the memory efficiency. Furthermore, it has been found that the limitation of the context sub-region values to a certain maximum value allows for a particularly simple and computationally efficient update of the numeric current context value, which has been described, for example, with reference to FIGS. 5*c* and 5*d*. By limiting the context sub-region values to a comparatively small value (e.g. to a value of 15), a context state which is based on a plurality of context sub-region values can be represented in the efficient form, which has been discussed taking reference to FIGS. 5*c* and 5*d*.

Moreover, it has been found that a limitation of the context sub-region values to values between 1 and 15, brings along a particularly good compromise between accuracy and memory efficiency, because 4 bits are sufficient in order to store such a context sub-region value.

However, it should be noted that in some other embodiments, a context sub-region value may be based on a single decoded spectral value only. In this case, the formation of a norm may optionally be omitted.

The next 2-tuple of the frame is decoded after the completion of the function "arith_update_context" by incrementing i by 1 and by redoing the same process as described above, starting from the function "arith_get_context( )".

When lg/2 2-tuples are decoded within the frame, or with the stop symbol "ARITH_STOP" occurs, the decoding process of the spectral amplitude terminates and the decoding of the signs begins.

Details regarding the decoding of the signs have been discussed with reference to FIG. 3, wherein the decoding of the signs is shown in reference numeral 314.

Once all unsigned quantized spectral coefficients are decoded, the according sign is added. For each non-null quantized value of "x_ac_dec" a bit is read. If the read bit value is equal to 1, the quantized value is positive, nothing is done and the signed value is equal to the previously-decoded unsigned value. Otherwise (i.e. if the read bit value is equal to 0), the decoded coefficient (or spectral value) is negative and the two's complement is taken from the unsigned value. The sign bits are read from the low to the higher frequencies. For details, reference is made to FIG. 3 and to the explanations regarding the signs decoding 314.

The decoding is finished by calling the function "arith_finish( )". The remaining spectral coefficients are set to 0. The respective context states are updated correspondingly.

For details, reference is made to FIG. 5*m*, which shows a pseudo program code representation of the function "arith_finish( )". As can be seen, the function "arith_finish( )" receives an input variable lg which describes the decoded quantized spectral coefficients. Advantageously, the input variable lg of the function "arith_finish" describes a number of actually-decoded spectral coefficients, leaving spectral coefficients unconsidered, to which a O-value has been allocated in response to the detection of an "ARITH_STOP" symbol. An input variable N of the function "arith_finish" describes a window length of a current window (i.e. a window associated with the current portion of the audio content). Typically, a number of spectral values associated with a window of length N is equal to N/2 and a number of 2-tuples of spectral values associated with a window of window length N is equal to N/4.

The function "arith_finish" also receives, as an input value, a vector "x_ac_dec" of decoded spectral values, or at least a reference to such a vector of decoded spectral coefficients.

The function "arith_finish" is configured to set the entries of the array (or vector) "x_ac_dec", for which no spectral values have been decoded due to the presence of an arithmetic stop condition, to 0. Moreover, the function "arith_finish" sets context sub-region values "q[1][i]", which are associated with spectral values for which no value has been decoded due to the presence of an arithmetic stop condition, to a predetermined value of 1. The predetermined value of 1 corresponds to a tuple of the spectral values wherein both spectral values are equal to 0.

Accordingly, the function "arith_finish( )" allows to update the entire array (or vector) "x_ac_dec[ ]" of spectral values and also the entire array of context sub-region values "q[1][i]", even in the presence of an arithmetic stop condition.

11.10.2 Context Update According to FIGS. 5*o* and 5*p*

In the following, another embodiment of the context update will be described taking reference to FIGS. 5*o* and 5*p*. At the point at which the unsigned value of the 2-tuple (a,b) is completely decoded, the context q is then updated for the next 2-tuple. The update is also performed if the present 2-tuple is the last 2-tuple. Both updates are made by the function "arith_update_context( )", a pseudo program code representation of which is shown in FIG. 5*o*. The next 2-tuple of the frame is then decoded by incrementing i by 1 and calling the function arith_decode( ). If the lg/2 2-tuples were already decoded with the frame, or if the stop symbol "ARITH_STOP" occurred, the function "arith_finish( )" is called. The context is saved and stored in the array (or vector) "qs" for the next frame. A pseudo program code of the function "arith_save_context( )" is shown in FIG. 5*p*.

Once all unsigned quantized spectral coefficients are decoded, the sign is then added. For each non-quantized value of "qdec", a bit is read. If the read bit value is equal to 0, the quantized value is positive, nothing is done and the signed value is equal to the previously-decoded unsigned value. Otherwise, the decoded coefficient is negative and the two's complement is taken from the unsigned vale. The signed bits are read from the low to the high frequencies.

11.11 Summary of Decoding Process

In the following, the decoding process will briefly be summarized. For details, reference is made to the above discussion and also to FIGS. 3, 4, 5*a*, 5*c*, 5*e*, 5*g*, 5*j*, 5*k*, 5*l*, and 5*m*. The quantized spectral coefficients "x_ac_dec[ ]" are noiselessly decoded starting from the lowest-frequency coefficient and progressing to the highest-frequency coefficient. They are decoded by groups of two successive coefficients a,b gathering in a so-called 2-tuple (a,b) (also designated with{a, b}).

The decoded coefficients "x_ac_dec[ ]" for the frequency-domain (i.e. for a frequency-domain mode) are then stored in the array "x_ac_quant[g][win][sfb][bin]". The order of transmission of the noiseless coding codewords is such that when they are decoded in the order received and stored in the array, "bin" is the most rapidly incrementing index and "g" is the most slowly incrementing index. Within a codeword, the order of decoding is a, then b. The decoded coefficients "x_ac_dec[ ]" for the "TCX" (i.e. for an audio decoding using a transform-coded excitation) are stored (for example, directly) in the array "x_tcx_invquant[win][bin]" and the order of the transmission of the noiseless coding codewords is such that when they are decoded in the order received and stored in the array, "bin" is the most rapidly incrementing index and "win" is the most slowly incrementing index. Within a codeword, the order of decoding is a, then b.

First, the flag "arith_reset_flag" determines if the context is reset. If the flag is true, this is considered in the function "arith_map_context".

The decoding process starts with an initialization phase where the context element vector "q" is updated by copying and mapping the context elements of the previous frame stored in "q[1][ ]" into "q[0][ ]". The context elements within "q" are stored on a 4-bits per 2-tuple. For details, reference is made to the pseudo program code of FIG. 5*a*.

The noiseless decoder outputs 2-tuples of unsigned quantized spectral coefficients. At first, the state c of the context is calculated based on the previously-decoded spectral coefficients surrounding the 2-tuple to decode. Therefore, the state is incrementally updated using the context state of the last decoded 2-tuple considering only two new 2-tuples. The state is decoded on 17-bits and is returned by the function "arith_get_context". A pseudo program code representation of the set function "arith_get_context" is shown in FIG. 5*c*.

The context state c determines the cumulative-frequencies-table used for decoding the most significant 2-bit-wise-plane m. The mapping from c to the corresponding cumulative-frequencies-table index "pki" is performed by the function "arith_get_pk( )". A pseudo program code representation of the function "arith_get_pk( )" is shown in FIG. 5*e*.

The value m is decoded using the function "arith_decode( )" called with the cumulative-frequencies-table, "arith_cf_m[pki][ ]", where "pki" corresponds to the index returned by "arith_get_pk( )". The arithmetic coder (and decoder) is an integer implementation using a method of tag generation with scaling. The pseudo program code according to FIG. 5*g* describes the used algorithm.

When the decoded value m is the escape symbol "ARITH_ESCAPE", the variables "led" and "esc_nb" are incremented by 1 and another value m is decoded. In this case, the function "get_pk( )" is called once again with the value "c+esc_nb<<17" as input argument, where "esc_nb" is the number of escape symbols previously decoded for the same 2-tuple and bounded to 7.

Once the value m is not the escape symbol "ARITH_ESCAPE", the decoder checks if the successive m forms an "ARITH_STOP" symbol. If the condition "(esc_nb>0&&m==0)" is true, the "ARITH_STOP" symbol is detected and the decoding process is ended. The decoder jumps directly to the sign decoding described afterwards. The condition means that the rest of the frame is composed of 0 values.

If the "ARITH_STOP" symbol is not met, the remaining bit-planes are then decoded, if any exist, for the present 2-tuple. The remaining bit-planes are decoded from the most-significant to the least-significant level, by calling "arith_decode( )" lev number of times with the cumulative-frequencies-table "arith_cf_r[ ]". The decoded bit-planes r permit the refining of the previously-decoded value m, in accordance with the algorithm a pseudo program code of which is shown in FIG. 5*j*. At this point, the unsigned value of the 2-tuple (a,b) is completely decoded. It is saved into the element holding the spectral coefficients in accordance with the algorithm, a pseudo program code representation of which is shown in FIG. 5*k*.

The context "q" is also updated for the next 2-tuple. It should be noted that this context update has to also be performed for the last 2-tuple. This context update is performed by the function "arith_update_context( )", a pseudo program code representation of which is shown in FIG. 5*l*.

The next 2-tuple of the frame is then decoded by incrementing i by 1 and by redoing the same process as described as above, starting from the function "arith_get_context( )". When lg/2 2-tuples are decoded within the frame, or when the stop symbol "ARITH_STOP" occurs, the decoding process of the spectral amplitude terminates and the decoding of the signs begins.

The decoding is finished by calling the function "arith_finish( )". The remaining spectral coefficients are set to 0. The respective context states are updated correspondingly. A pseudo program code representation of the function "arith_finish" is shown in FIG. 5*m*.

Once all unsigned quantized spectral coefficients are decoded, the according sign is added. For each non-null quantized value of "x_ac_dec", a bit is read. If the read bit value is equal to 1, the quantized value is positive, and nothing is done, and the signed value is equal to the previously decoded unsigned value. Otherwise, the decoded coefficient is negative and the two's complement is taken from the unsigned value. The signed bits are read from the low to the high frequencies.

11.12 Legends

FIG. 5*q* shows a legend of the definitions which is related to the algorithms according to FIGS. 5*a*, 5*c*, 5*e*, 5*f*, 5*g*, 5*j*, 5*k*, 5*l*, and 5*m*.

FIG. 5*r* shows a legend of the definitions which is related to the algorithms according to FIGS. 5*b*, 5*d*, 5*f*, 5*h*, 5*i*, 5*n*, 5*o*, and 5*p*.

12. Mapping Tables

In an embodiment according to the invention, particularly advantageous tables "ari_lookup_m", "ari_hash_m", and "ari_cf_m" are used for the execution of the function "arith_get_pk( )" according to FIG. 5*e* or FIG. 5*f*, and for the execution of the function "arith_decode( )" which was discussed with reference to FIGS. 5*g*, 5*h* and 5*i*. However, it should be noted that different tables may be used in some alternative embodiments.

12.1 Table "ari_hash_m[742]" According to FIGS. 22(1), 22(2), 22(3) and 22(4)

A content of a particularly advantageous implementation of the table "ari_hash_m", which is used by the function "arith_get_pk", a first advantageous embodiment of which was described with reference to FIG. 5*e*, and a second embodiment of which was described with reference to FIG. 5*f*, is shown in the table of FIGS. 22(1) to 22(4). It should be noted that the table of FIGS. 22(1) to 22(4) lists the 742 entries of the table (or array) "ari_hash_m[742]". It should also be noted that the table representation of FIGS. 22(1) to 22(4) shows the elements in the order of the element indices, such that the first value "0x00000104UL" corresponds to a table entry "ari_hash_m[0]" having an element index (or table index) 0, and such that the last value "0xFFFFFF00UL" corresponds to a table entry "ari_hash_m[741]" having element index or table index 741. It should further be noted here that "0x" indicates that the table entries of the table "ari_hash_m[ ]" are represented in a hexadecimal format. Moreover, it should be noted here that the suffix "UL" indicates that the table entries of the table "ari_hash_m[ ]" are represented as unsigned "long" integer values (having a precision of 32-bits).

Furthermore, it should be noted that the table entries of the table "ari_hash_m[ ]" according to FIGS. 22(1) to 22(4) are arranged in a numeric order, in order to allow for the execution of the table search 506*b*, 508*b*, 510*b* of the function "arith_get_pk( )".

It should further be noted that the most-significant 24-bits of the table entries of the table "ari_hash_m" represent certain significant state values (and may be considered as a first sub-entry), while the least-significant 8-bits represent mapping rule index values "pki" (and may be considered as a second sub-entry). Thus, the entries of the table "ari_hash_m[ ]" describe a "direct hit" mapping of a context value onto a mapping rule index value "pki".

However, the uppermost 24-bits of the entries of the table "ari_hash_m[ ]" represent, at the same time, interval boundaries of intervals of numeric context values, to which the same mapping rule index value is associated. Details regarding this concept have already been discussed above.

12.2 Table "ari_lookup_m" According to FIG. 21

A content of a particularly advantageous embodiment of the table "ari_lookup_m" is shown in the table of FIG. 21. It should be noted here that the table of FIG. 21 lists the entries of the table "ari_lookup_m". The entries are referenced by a 1-dimensional integer-type entry index (also designated as "element index" or "array index" or "table index") which is, for example, designated with "i_max" or "i_min" or "i". It should be noted that the table "ari_lookup_m", which comprises a total of 742 entries, is well-suited for the use by the function "arith_get_pk" according to FIG. 5*e* or FIG. 5*f*. It should also be noted that the table "ari_lookup_m" according to FIG. 21 is adapted to cooperate with the table "ari_hash_m" according to FIG. 22.

It should be noted that the entries of the table "ari_lookup_m[742]" are listed in an ascending order of the table index "i" (e.g. "i_min" or "i_max" or "i") between 0 and 741. The term "0x" indicates that the table entries are described in a hexadecimal format. Accordingly, the first table entry "0x01" corresponds to the table entry "ari_lookup_m[0]" having table index 0 and the last table entry "0x27" corresponds to the table entry "ari_lookup_m[741]" having table index 741.

It should also be noted that the entries of the table "ari_lookup_m[ ]" are associated with intervals defined by adjacent entries of the table "arith_hash_m[ ]". Thus, the entries of the table "ari_lookup_m" describe mapping rule index values associated with intervals of numeric context values, wherein the intervals are defined by the entries of the table "arith_hash_m".

12.3. Table "ari_cf_m[64][17]" According to FIGS. 23(1), 23(2) and 23(3)

FIG. 23 shows a set of 64 cumulative-frequencies-tables (or sub-tables) "ari_cf_m[pki][17]", one of which is selected by and audio encoder 100, 700 or an audio decoder 200, 800, for example, for the execution of the function "arith_decode( )", i.e. for the decoding of the most-significant bit-plane value. The selected one of the 64 cumulative-frequencies-tables (or sub-tables) shown in FIGS. 23(1) to 23(3) takes the function of the table "cum_freq[ ]" in the execution of the function "arith_decode( )".

As can be seen from FIGS. 23(1) to 23(3), each sub-block or line represents a cumulative-frequencies-table having 17 entries. For example, a first sub-block or line 2310 represents the 17 entries of a cumulative-frequencies-table for "pki=0". A second sub-block or line 2312 represents the 17 entries of a cumulative-frequencies-table for "pki=1". Finally, a 64th sub-block or line 2364 represents the 17 entries of a cumulative-frequencies-table for "pki=63". Thus, FIGS. 23(1) to 23(3) effectively represent 64 different cumulative-frequencies-tables (or sub-tables) for "pki=0" to "pki=95", wherein each of the 64 cumulative-frequencies-tables is represented by a sub-block (enclosed by curled brackets) or line, and wherein each of said cumulative-frequencies-tables comprises 17 entries.

Within a sub-block or line (e.g. a sub-block or line 2310 or 2312, or a sub-block or line 2396), a first value (for example, a first value 708 of the first sub-block 2310) describes a first entry of the cumulative-frequencies-table (having an array index or table index of 0) represented by the sub-block or line, and a last value (for example, a last value 0 of the first sub-block or line 2310) describes a last entry of the cumulative-frequencies-table (having an array index or table index of 16) represented by the sub-block or line.

Accordingly, each sub-block or line 2310, 2312, 2364 of the table representation of FIG. 23 represents the entries of a cumulative-frequencies-table for use by the function "arith_decode" according to FIG. 5*g*, or according to FIGS. 5*h* and 5*i*. The input variable "cum_freq[ ]" of the function "arith_decode" describes which of the 64 cumulative-frequencies-tables (represented by individual sub-blocks of 17 entries of the table "arith_cf_m") should be used for the decoding of the current spectral coefficients.

12.4 Table "ari_cf_r[ ]" According to FIG. 24

FIG. 24 shows a content of the table "ari_cf_r[ ]".

The four entries of said table are shown in FIG. 24. However, it should be noted that the table "ari_cf_r" may eventually be different in other embodiments.

13. Overview, Performance Evaluation and Advantages

The embodiments according to the invention use updated functions (or algorithms) and an updated set of tables, as discussed above, in order to obtain an improved tradeoff between computational complexity, memory requirement, and coding efficiency.

Generally speaking, the embodiments according to the invention create an improved spectral noiseless coding. Embodiments according to the present invention describe an enhancement of the spectral noiseless coding in USAC (unified speech and audio encoding).

Embodiments according to the invention create an updated proposal for the CE on improved spectral noiseless coding of spectral coefficients, based on the schemes as presented in the MPEG input papers m16912 and m17002. Both proposals were evaluated, potential short-comings eliminated and the strengths combined. In addition embodiments of the invention comprise an update of noiseless spectral coding tables for application in a current USAC specification.

13.1. Overview

In the following, a short overview will be given. In the course of the ongoing standardization of USAC (Unified Speech and Audio Coding), an enhanced spectral noiseless coding scheme (aka entropy coding scheme) in USAC was proposed. This enhanced spectral noiseless coding scheme helps to more efficiently code quantized spectral coefficients in a lossless manner. Therefore, spectral coefficients are mapped to corresponding code-words of variable length. This entropy coding scheme is based on a context based arithmetic coding scheme: The context (i.e. neighboring spectral coefficients) of a spectral coefficient determines a probability distribution (cumulative frequency table), which is used for arithmetic coding of the spectral coefficient.

Embodiments according to the present invention use an updated set of tables for the spectral coding scheme, as previously proposed in the context of USAC. To give the background, it should be noted that the conventional spectral noiseless coding technology consists firstly of an algorithm and secondly of a set of trained tables (or, at least, comprises an algorithm and a set of trained tables). This conventional set of trained tables is based upon USAC WD4 bitstreams. Since USAC has now progressed to WD7, and significant changes have been applied to the USAC specification in the meantime, a new set of re-trained tables is used in embodiments according to the invention, which is based on the most recent USAC version WD7. The algorithm itself remains unchanged. As a side effect, the retrained tables provide compression performance better than any of the previously presented schemes.

According to the present invention, it is proposed to replace the conventional trained tables by the re-trained tables as presented here, which results in an increased coding performance.

13.2. Introduction

In the following, an introduction will be provided.

For the USAC work item, several proposals on updating the noiseless coding scheme were brought forward during the last meetings in a collaborative fashion. However, this work was basically initiated at the 89th meeting. Since then it has been common practice for all proposals on spectral coefficient coding to show performance results based on USAC WD 4 reference quality bitstreams and training upon a WD 4 training database.

In the meantime, great improvements to other fields of USAC, in particular to stereo processing and windowing, have been incorporated into the USAC specification as of today. It was found that these improvements also slightly affect the statistics for the spectral noiseless coding. The results shown for the noiseless coding CEs can therefore be regarded as suboptimal, since they do not correspond to the latest WD revision.

Accordingly, spectral noiseless coding tables are suggested which are better adapted to the updated algorithms and to the statistics of the spectral values to be encoded and decoded.

13.3. Short Description of Algorithm

In the following, a short description of the algorithm will be provided.

To overcome the issue of memory footprint and the computational complexity, an improved noiseless coding scheme was proposed to replace the scheme as in working draft 6/7 (WD6/7). The main focus in the development was put on reducing memory demand while maintaining the compression efficiency and not increasing the computational complexity. More specifically the target was to reach the best tradeoff in the multi-dimension complexity space of compression performance, complexity and memory requirements.

The proposed coding scheme proposal borrows the main feature of the WD6/7 noiseless coder, namely the context adaptation. The context is derived using previously decoded spectral coefficients, which come as in WD6/7 from both the past and the present frame. However, the spectral coefficients are now coded by combining 2 coefficients together for forming a 2-tuple. Another difference lays in the fact that the spectral coefficients are now split in three parts, the sign, the MSBs and the LSBs. The sign is coded independently from the magnitude which is further divided in two parts, the two most significant bits and the rest of bits if they exist. The 2-tuples for which the magnitude of the two elements is lower or equal to 3 are coded directly by the MSBs coding. Otherwise, an escape codeword is transmitted first for signaling any additional bit plane. In the base version, the missing information, the LSBs and the sign are both coded using uniform probability distribution.

The table size reduction is still possible since:

Only probabilities for 17 symbols need to be stored: {[0;+3], [0;+3]}+ESC symbol;

There is no need to store a grouping table (egroups, dgroups, dgvectors); and

The size of the hash-table could be reduced with an appropriate training 13.3.1 MSBs coding In the following, a MSBs coding will be described.

Figures 25, 26:
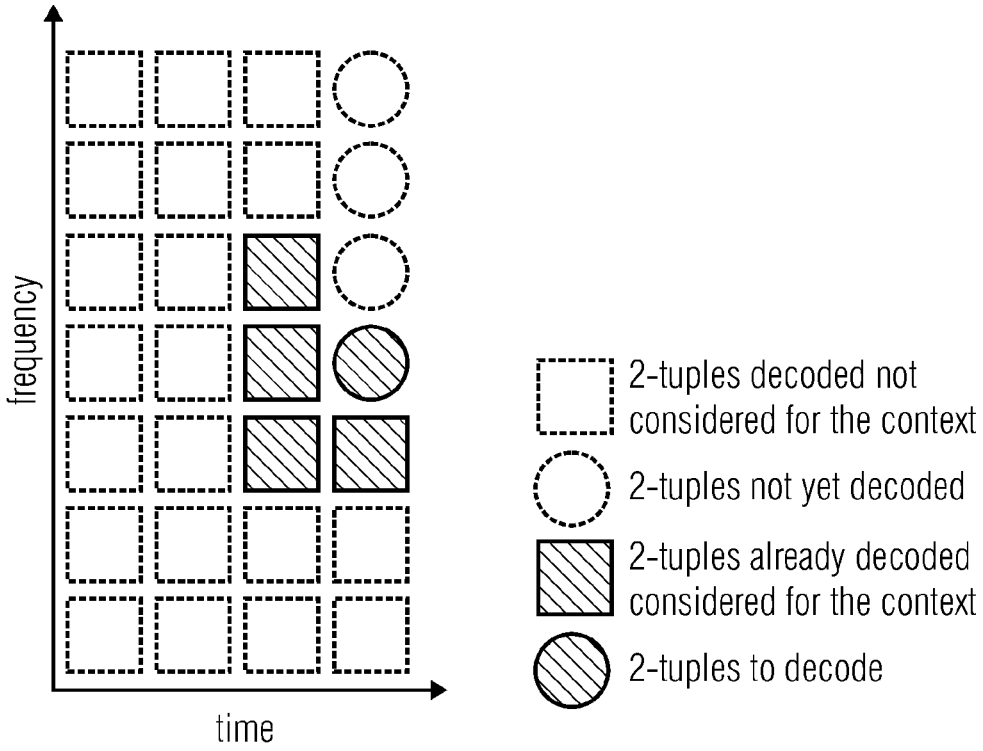
FIG. 25 shows a schematic representation of a context for a state calculation.
FIG. 26 shows a table representation of an averaged coding performance for transcoding of WD6 reference quality bitstreams for a comparison example ("M17558") and for an embodiment according to the invention ("New Proposal")

As already mentioned, the main difference between WD6/7, previous proposals and the current proposal, is the dimension of the symbols. In WD6/7 4-tuples were considered for the context generation and the noiseless coding. In previous submissions, 1-tuples were used instead for reducing the ROM requirements. In the course of our development, the 2-tuples were found to be the best compromise for reducing the ROM requirements without increasing the computational complexity. Instead of considering four 4-tuples for the context derivation, now four 2-tuples are considered. As shown in FIG. 25, three 2-tuples come from the past frame and one from the present frame.

The table size reduction is due to three main factors. First, only probabilities for 17 symbols need to be stored (i.e. {[0;+3], [0;+3]}+ESC symbol). Grouping tables (i.e. egroups, dgroups, dgvectors) are not needed anymore. Moreover, the size of the hash-table was reduced by performing an appropriate training.

Although the dimension was reduced from 4 to 2, the complexity was maintained to the range as in the WD6/7. It was achieved by simplifying both the context generation and the hash table access.

The different simplifications and optimizations were done in a way that the coding performance was not affected and even slightly improved.

13.3.2 LSBs Coding

The LSBs are coded with a uniform probability distribution. Compared to WD6/7, the LSBs are now considered within 2-tuples instead of 4 t-tuples. However, different coding of the least significant bits is possible.

13.3.3 Sign Coding

The sign is coded without using the arithmetic core-coder for the sake of complexity reduction. The sign is transmitted on 1 bit only when the corresponding magnitude is non-null. 0 means a positive value and 1*a* negative value.

13.4. Proposed Update of Tables

This contribution provides an updated set of tables for the USAC spectral noiseless coding scheme. The tables were re-trained based on the current USAC WD6/7 bitstreams. Apart from the actual tables, which result from a training process, the algorithm remains unchanged.

To investigate the effect of the re-training, coding efficiency and memory requirement of the new tables is compared against the previous proposal (M17558) and the WD6. WD6 is selected as a reference point since a) results at the 92nd meeting were given with respect to this reference and b) the differences between WD6 and WD7 are only very minor (bugfixes only, with no effect on entropy coding or distribution of spectral coefficients).

13.4.1 Coding Efficiency

Firstly, the coding efficiency of the proposed new set of tables is compared against USAC WD6 and the CE as proposed in M17558. As can be seen in the table representation of FIG. 26, by a pure retraining the averaged increase in coding efficiency (compared to WD6) could be increased from 1.74% (M17558) to 2.45% (new propsal, according to an embodiment of the invention). Compared to M17558, the compression gain could thus be increased by roughly 0.7% in embodiments according to the invention.

Figures 27, 28:
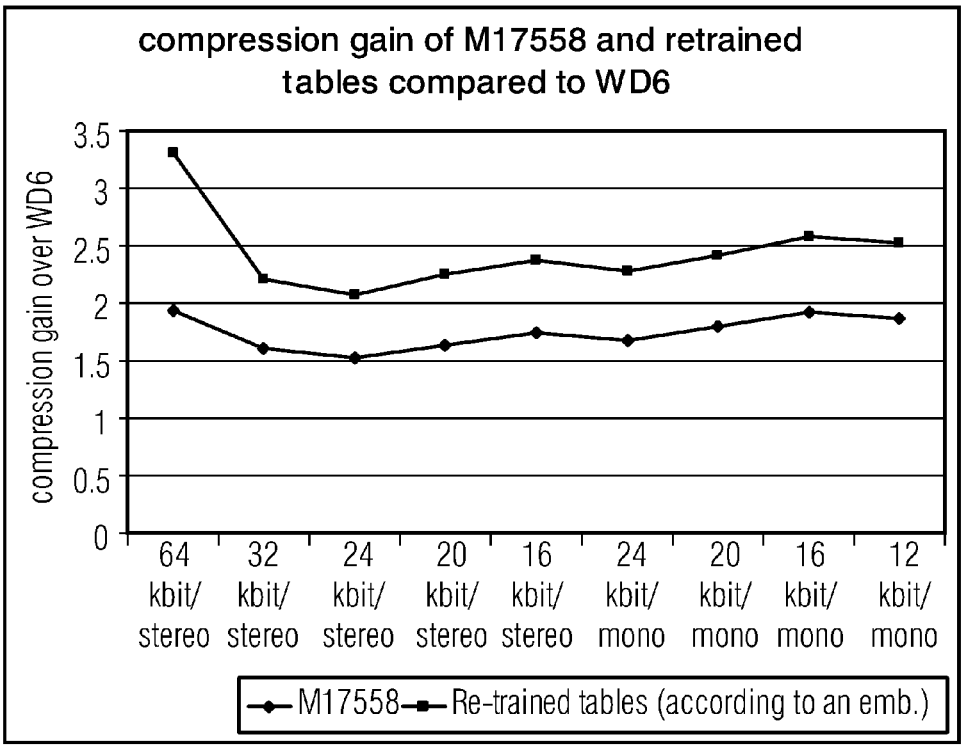
FIG. 27 shows a table representation of a coding performance for transcoding of WD6 reference quality bitstreams per operating point for a comparison example ("M17558") and for an embodiment according to the invention ("Re-trained tables")
FIG. 28 shows a table representation of a comparison of Noiseless Coder Memory Demand for WD6, for a comparison example ("M17588") and for an embodiment according to the invention ("New Proposal")

FIG. 27 visualizes the compression gain for all operating points. As can be seen, a minimum compression gain of at least 2% can be reached using embodiments according to the invention compared to WD6. For low rates, such as 12 kbit/s and 16 kbit/s, the compression gain is even slightly increased. The good performance is also retained at higher bitrates such as 64 kbit/s, where a significant increase in coding efficiency of more than 3% can be observed.

It should be noted that a lossless transcoding of all WD6 reference quality bitstreams was proven to be possible without violating the bit reservoir constraints. More detailed results will be given in section 13.6.

13.4.2 Memory Demand and Complexity

Secondly, memory demand and complexity are compared against USAC WD6 and the CE as proposed in M17558. The table of FIG. 28 compares the memory demand for the noiseless coder as in WD6, proposed in M17558 and the new proposal according to an embodiment of the invention. As can be clearly seen, the memory demand is significantly reduced by adopting the new algorithm, as proposed in M17558. Further on it can be seen that for the new proposal the total table size could even be slightly reduced by nearly 80 words (32 bit), resulting in a total ROM demand of 1441 words, and a total RAM demand of 64 words (32 bit) per audio channel. The small saving in ROM demand is the result of a better trade-off between number of probability models and hash-table size, found by the automatic training algorithm based on the new set of WD6 training bitstreams. For more details reference is made to the table of FIG. 29.

In term of complexity, the newly proposed schemes' computational complexity was compared against an optimized version of the current noiseless in USAC. It was found by a "pen and paper" method and by instructing the code that the new coding scheme has the same order of complexity as the current scheme. As reported in the table of FIG. 30 for the 32 kbps stereo and the table of FIG. 31 for the 12 kbps mono operating points, the estimated complexity shows an increase of 0.006 weighted MOPS and 0.024 weighted MOPS respectively over an optimized implementation of the WD6 noiseless decoder. Compared to an overall complexity of about 11.7 PCU [2], these differences can be considered negligible.

13.5. Conclusion

In the following, some conclusions will be provided.

A new set of tables for the USAC spectral noiseless coding scheme was presented. In contrast to the previous proposal, which is the result of a training based upon older bitstreams, the proposed new tables are now trained on current USAC WD bitstreams, wherein an advanced training concept has been used. By this re-training, the coding efficiency on current USAC bitstreams could be improved, without sacrificing the low memory demand or increasing the complexity compared to previous proposals. Compared to the USAC WD6, the memory demand could be significantly reduced.

13.6. Detailed Information on the Transcoding of WD6 Bitstreams

Detailed information on the transcoding of Working draft 6 (WD6) bitstreams can be seen in the table representations of FIGS. 32, 33, 34, 35 and 36.

FIG. 32 shows a table representation of average bitrates produced by the arithmetic coder in an embodiment according to the invention and in the WD6.

FIG. 33 shows a table representation of minimum, maximum and average bitrates of USAC on a frame basis using the proposed scheme.

FIG. 34 shows a table representation of average bitrates produced by a USAC coder using WD6 arithmetic coder and a coder according to an embodiment according to the invention ("new proposal").

FIG. 35 shows a table representation of best and worst cases for an embodiment according to the invention.

FIG. 36 shows a table representation of bitreservoir limit for an embodiment according to the invention.

14. Changes when Compared to the Working Draft 6 or Working Draft 7

In the following, changes of the noiseless coding when compared to a conventional noiseless coding will be described. Accordingly, an embodiment is defined in terms of modifications when compared to the working draft 6 or working draft 7 of the USAC draft standard.

In particular, Changes to WD text will be described. In other words, this section lists the complete set of changes against the USAC specification WD7.

14.1. Changes to the Technical Description

The proposed new noiseless coding engenders the modifications in the MPEG USAC WD which will be described in the following. The main differences are marked.

14.1.1. Changes of the Syntax and the Payload

FIG. 7 shows a representation of a syntax of the arithmetically coded data "arith_data( )". The main differences are marked.

In the following, changes with respect to the Payloads of the spectral noiseless coder will be described.

Spectral coefficients from both the "linear prediction-domain" coded signal and the "frequency-domain" coded signal are scalar quantized and then noiselessly coded by an adaptively context dependent arithmetic coding. The quantized coefficients are gathered together in 2-tuples before being transmitted from the lowest-frequency to the highest-frequency. It should be noted that the usage of 2-tuples constitutes a change when compared to previous versions of the spectral noiseless coding.

However, it is a further change that each 2-tuple is split into the sign s, the most significant 2 bits-wise plane, m, and the remaining less significant bit-planes, r. Also, it is a change that the value m is coded according to the coefficient's neighborhood, and that the remaining less significant bit-planes, r, are entropy coded without considering the context. Also, it is a change with respect to some of the previous versions that the values m and r form the symbols of the arithmetic coder. Finally, it is a change with respect to some of the previous versions that the signs s are coded outside the arithmetic coder using 1 bit per non-null quantized coefficient.

A detailed arithmetic decoding procedure is described below in section 14.2.3.

14.1.2 Changes of the Definitions and Help Elements

Changes to the definitions and help elements are shown in the representation of definitions and help elements in FIG. 38.

14.2 Spectral Noiseless Coding

In the following, the spectral noiseless coding according to an embodiment will be summarized.

14.2.1 Tool Description

Spectral noiseless coding is used to further reduce the redundancy of the quantized spectrum.

The spectral noiseless coding scheme is based on an arithmetic coding in conjunction with a dynamically adapted context. The noiseless coding is fed by the quantized spectral values and uses context dependent cumulative frequencies tables derived from four previously decoded neighboring. Here, neighborhood in both, time and frequency is taken into account, as illustrated in FIG. 25. The cumulative frequencies tables are then used by the arithmetic coder to generate a variable length binary code.

The arithmetic coder produces a binary code for a given set of symbols and their respective probabilities. The binary code is generated by mapping a probability interval, where the set of symbols lies, to a codeword.

14.2.2 Definitions

Definitions and help elements are described in FIG. 39. Changes when compared to previous versions of the arithmetic coding are marked.

14.2.3 Decoding Process

The quantized spectral coefficients qdec are noiselessly decoded starting from the lowest-frequency coefficient and progressing to the highest-frequency coefficient. They are decoded by groups of two successive coefficients a and b gathering in a so-called 2-tuple {a,b}.

The decoded coefficients for AAC are then stored in the array x_ac_quant[g][win][sfb][bin]. The order of transmission of the noiseless coding codewords is such that when they are decoded in the order received and stored in the array, bin is the most rapidly incrementing index and g is the most slowly incrementing index. Within a codeword the order of decoding is a and then b.

The decoded coefficients for the TCX are stored in the array x_tcx_invquant[win][bin], and the order of the transmission of the noiseless coding codewords is such that when they are decoded in the order received and stored in the array, bin is the most rapidly incrementing index and win is the most slowly incrementing index. Within a codeword the order of decoding is a and then b.

The decoding process starts with an initialization phase where a mapping is done between the saved past context stored in qs and the context of the current frame q. The past context qs is stored on 2 bits per frequency line.

For details, reference is mad to the pseudo program code representation of the algorithm "arith_map_context" in FIG. 40*a*.

The noiseless decoder outputs 2-tuples of unsigned quantized spectral coefficients. At first, the state c of the context is calculated based on the previously decoded spectral coefficients surrounding the 2-tuple to decode. The state is incrementally updated using the context state of the last decoded 2-tuple considering only two new 2-tuples. The state is coded on 17 bits and is returned by the function arithget_context( )

A pseudo program code representation of the function "arith_get_contextO" is shown in FIG. 40*b*.

Once the context state c is calculated, the most significant 2-bits wise plane m is decoded using the arith_decode( ) fed with the appropriated cumulative frequencies table corresponding to the probability model corresponding to the context state. The correspondence is made by the function arith_getpk( )

A pseudo program code representation of the function arith_get_pk( ) is shown in FIG. 40*c*.

The value m is decoded using the function arith_decode( ) called with the cumulative frequencies table, arith_cf_m [pki][ ], where pki corresponds to the index returned by arith_get_pk( ) The arithmetic coder is an integer implementation using the method of tag generation with scaling. The pseudo C-code shown in FIGS. 40*d* and 40*e* describes the used algorithm.

When the decoded value m is the escape symbol, ARITH_ESCAPE, the variable lev and esc_nb are incremented by one and another value m is decoded. In this case, the function get_pk( ) is called once again with the value c&esc_nb<<17 as input argument, where esc_nb is the number of escape symbols previously decoded for the same 2-tuple and bounded to 7.

Once the value m is not the escape symbol, ARITH_ESCAPE, the decoder checks if the successive m form a ARITH_ STOP symbol. If the condition (esc_nb>0 && m==0) is true, the ARITH_STOP symbol is detected and the decoding process is ended. The decoder jumps directly to the arith_save_context( ) function. The condition means that the rest of the frame is composed of zero values.

If the ARITH_STOP symbol is not met, the remaining bit planes are then decoded if any exists for the present 2-tuple. The remaining bit planes are decoded from the most significant to the lowest significant level by calling lev times arith_decode( ) with the cumulative frequencies table arith_cf_r[ ]. The decoded bit planes r permit to refine the previously decoded value m by the function or algorithm a pseudo program code representation of which is shown in FIG. 40*f*.

At this point, the unsigned value of the 2-tuple [a, b] is completely decoded. The context q is then updated for the next 2-tuple. If it is the last 2-tuple, as well. The both updates are made by the function arith_update_context( ), a pseudo program code representation of which is shown in FIG. 40*g*.

The next 2-tuple of the frame is then decoded by incrementing i by one and calling the function. If the lg/2 2-tuple were already decoded with the frame or if the stop symbol ARITH_STOP occurred, the function arith_save_context( ) is called. The context is saved and stored in qs for the next frame. A pseudo program code representation of the function or algorithm arith_save_context( ) is shown in FIG. 40*h*.

Once all unsigned quantized spectral coefficients are decoded, the sign is then added. For each non-null quantized value of qdec a bit is read. If the read bit value is equal to zero, the quantized value is positive, nothing is done and the signed value is equal to the previously decoded unsigned value. Otherwise, the decoded coefficient is negative and the two's complement is taken from the unsigned value. The sign bits are read from the low to the high frequencies.

14.2.4 Updated Tables

A set of re-trained tables for use with the algorithms described above is shown in FIGS. 41(1), 41(2), 42(1), 42(2), 42(3), 42(4), 43(1), 43(2), 43(3), 43(4), 43(5), 43(6) and 44.

FIGS. 41(1) and 41(2) show a table representation of a content of a table "ari_lookup_m[742]", according to an embodiment of the invention;

FIGS. 42 (1),(2),(3),(4) show a table representation of a content of a table "ari_hash_m[742]", according to an embodiment of the invention;

FIGS. 43 (1),(2),(3),(4),(5),(6) show a table representation of a content of a table "ari_cf_m[96][17]", according to an embodiment of the invention; and FIG. 44 shows a table representation of a table "ari_cf_r [4]", according to an embodiment of the invention.

To summarize the above, it can be seen that embodiments according to the present invention provide a particularly good trade-off between computational complexity, memory requirements and coding efficiency.

15. Bitstream Syntax 15.1 Payloads of the Spectral Noiseless Coder

In the following, some details regarding the payloads of the spectral noiseless coder will be described. In some embodiments, there is a plurality of different coding modes, such as, for example, a so-called "linear-prediction-domain" coding mode and a "frequency-domain" coding mode. In the linear-prediction-domain coding mode, a noise shaping is performed on the basis of a linear-prediction analysis of the audio signal, and a noise-shaped signal is encoded in the frequency-domain. In the frequency-domain coding mode a noise shaping is performed on the basis of a psychoacoustic analysis and a noise shaped version of the audio content is encoded in the frequency-domain.

Spectral coefficients from both the "linear-prediction-domain" coded signal and the "frequency-domain" coded signal are scalar quantized and then noiselessly coded by an adaptively context dependent arithmetic coding. The quantized coefficients are gathered together into 2-tuples before being transmitted from the lowest frequency to the highest frequency. Each 2-tuple is split into a sign s, the most significant 2-bits-wise-plane m, and the remaining one or more less-significant bit-planes r (if any). The value m is coded according to a context defined by the neighboring spectral coefficients. In other words, m is coded according to the coefficients neighborhood. The remaining less-significant bit-planes r are entropy coded without considering the context. By means of m and r, the amplitude of these spectral coefficients can be reconstructed on the decoder side. For all non-null symbols, the signs s is coded outside the arithmetic coder using 1-bit. In other words, the values m and r form the symbols of the arithmetic coder. Finally, the signs s, are coded outside of the arithmetic coder using 1-bit per non-null quantized coefficient.

A detailed arithmetic coding procedure is described herein.

15.2 Syntax Elements According to FIGS. 6*a* to 6*j*

In the following, the bitstream syntax of a bitstream carrying the arithmetically-encoded spectral information will be described taking reference to FIGS. 6*a* to 6*j*.

FIG. 6*a* shows a syntax representation of so-called USAC raw data block ("usac_raw_data_block( )").

The USAC raw data block comprises one or more single channel elements ("single_channel_element( )") and/or one or more channel pair elements ("channel_pair_element( )").

Taking reference now to FIG. 6*b*, the syntax of a single channel element is described. The single channel element comprises a linear-prediction-domain channel stream ("lpd_channel_stream( )") or a frequency-domain channel stream ("fd_channel_stream( )") in dependence on the core mode.

FIG. 6*c* shows a syntax representation of a channel pair element. A channel pair element comprises core mode information ("core_mode0", "core_mode1"). In addition, the channel pair element may comprise a configuration information "ics_info( )". Additionally, depending on the core mode information, the channel pair element comprises a linear-prediction-domain channel stream or a frequency-domain channel stream associated with a first of the channels, and the channel pair element also comprises a linear-prediction-domain channel stream or a frequency-domain channel stream associated with a second of the channels.

The configuration information "ics_info( )", a syntax representation of which is shown in FIG. 6*d*, comprises a plurality of different configuration information items, which are not of particular relevance for the present invention.

A frequency-domain channel stream ("fd_channel_stream( )"), a syntax representation of which is shown in FIG. 6*e*, comprises a gain information ("global_gain") and a configuration information ("ics_info( )"). In addition, the frequency-domain channel stream comprises scale factor data ("scale_factor_data( )"), which describes scale factors used for the scaling of spectral values of different scale factor bands, and which is applied, for example, by the scaler 150 and the rescaler 240. The frequency-domain channel stream also comprises arithmetically-coded spectral data ("ac_spectral_data( )"), which represents arithmetically-encoded spectral values.

The arithmetically-coded spectral data ("ac_spectral_data( )"), a syntax representation of which is shown in FIG. 6*f*, comprises an optional arithmetic reset flag ("arith_reset_flag"), which is used for selectively resetting the context, as described above. In addition, the arithmetically-coded spectral data comprise a plurality of arithmetic-data blocks ("arith_data"), which carry the arithmetically-coded spectral values. The structure of the arithmetically-coded data blocks depends on the number of frequency bands (represented by the variable "num_bands") and also on the state of the arithmetic reset flag, as will be discussed in the following.

In the following, the structure of the arithmetically encoded data-block will be described taking reference to FIG. 6*g*, which shows a syntax representation of said arithmetically-coded data-blocks. The data representation within the arithmetically-coded data-block depends on the number lg of spectral values to be encoded, the status of the arithmetic reset flag and also on the context, i.e. the previously-encoded spectral values.

The context for the encoding of the current set (e.g., 2-tuple) of spectral values is determined in accordance with the context determination algorithm shown at reference numeral 660. Details with respect to the context determination algorithm have been explained above, taking reference to FIGS. 5*a* and 5*b*. The arithmetically-encoded data-block comprises lg/2 sets of codewords, each set of codewords representing a plurality (e.g., a 2-tuple) of spectral values. A set of codewords comprises an arithmetic codeword "acod_m[pki][m]" representing a most-significant bit-plane value m of the tuple of spectral values using between 1 and 20 bits. In addition, the set of codewords comprises one or more codewords "acod_r[r]" if the tuple of spectral values uses more bit-planes than the most-significant bit-plane for a correct representation. The codeword "acod_r[r]" represents a less-significant bit-plane using between 1 and 14 bits.

If, however, one or more less-significant bit-planes may be used (in addition to the most-significant bit-plane) for a proper representation of the spectral values, this is signaled by using one or more arithmetic escape codewords ("ARITH_ESCAPE"). Thus, it can be generally said that for a spectral value, it is determined how many bit-planes (the most-significant bit-plane and, possibly, one or more additional less-significant bit-planes) may be used. If one or more less-significant bit-planes may be used, this is signaled by one or more arithmetic escape codewords "acod_m[pki][ARITH_ESCAPE]", which are encoded in accordance with a currently selected cumulative-frequencies-table, a cumulative-frequencies-table-index of which is given by the variable "pki". In addition, the context is adapted, as can be seen at reference numerals 664, 662, if one or more arithmetic escape codewords are included in the bitstream. Following the one or more arithmetic escape codewords, an arithmetic codeword "acod_m[pki][m]" is included in the bitstream, as shown at reference numeral 663, wherein "pki" designates the currently valid probability model index (taking the context adaptation caused by the inclusion of the arithmetic escape codewords into consideration) and wherein m designates the most-significant bit-plane value of the spectral value to be encoded or decoded (wherein m is different from the "ARITH_ESCAPE" codeword).

As discussed above, the presence of any less-significant bit-plane results in the presence of one or more codewords "acod_r[r]", each of which represents 1 bit of a least-significant bit-plane of a first spectral value and each of which also represents 1 bit of a least-significant bit-plane of a second spectral value. The one or more codewords "acod_r[r]" are encoded in accordance with a corresponding cumulative-frequencies-table, which may, for example, be constant and context-independent. However, different mechanisms for the selection of the cumulative-frequencies-table for the decoding of the one or more codewords "acod_r_r[r]" are possible.

In addition, it should be noted that the context is updated after the encoding of each tuple of spectral values, as shown at reference numeral 668, such that the context is typically different for encoding and decoding two subsequent tuples of spectral values.

FIG. 6*i* shows a legend of definitions and help elements defining the syntax of the arithmetically encoded data-block.

Moreover, an alternative syntax of the arithmetic data "arith_data( )" is shown in FIG. 6*h*, with a corresponding legend of definitions and help elements shown in FIG. 6*j*.

To summarize the above, a bitstream format has been described, which may be provided by the audio encoder 100 and which may be evaluated by the audio decoder 200. The bitstream of the arithmetically encoded spectral values is encoded such that it fits the decoding algorithm discussed above.

In addition, it should be generally noted that the encoding is the inverse operation of the decoding, such that it can generally be assumed that the encoder performs a table lookup using the above-discussed tables, which is approximately inverse to the table lookup performed by the decoder. Generally, it can be said that a man skilled in the art who knows the decoding algorithm and/or the desired bitstream syntax will easily be able to design an arithmetic encoder, which provides the data that is defined in the bitstream syntax and may be used by an arithmetic decoder.

Moreover, it should be noted that the mechanisms for determining the numeric current context value and for deriving a mapping rule index value may be identical in an audio encoder and an audio decoder, because it is typically desired that the audio decoder uses the same context as the audio encoder, such that the decoding is adapted to the encoding.

15.3. Syntax Elements according to FIGS. 6*k*, 6*l*, 6*m*, 6*n*, 6*o* and 6*p*

In the following, an extract from an alternative bitstream syntax will be described taking reference to FIGS. 6*k*, 6*l*, 6*m*, 6*n*, 6*o* and 6*p*.

FIG. 6*k* shows a syntax representation of a bitstream element "UsacSingleChannelElement(indepFlag)". Said syntax element "UsacSingleChannelElement(indepFlag)" comprises a syntax element "UsacCoreCoderData" describing one core coder channel.

FIG. 6*l* shows a syntax representation of a bitstream element "UsacChannelPairElement(indepFlag)". Said syntax element "UsacChannelPairElement(indepFlag)" comprises a syntax element "UsacCoreCoderData" describing one or two core coder channels, depending on a stereo configuration.

FIG. 6*m* shows a syntax representation of a bitstream element "ics_info( )", which comprises definitions of a number of parameters, as can be seen in FIG. 6*m*.

FIG. 6*n* shows a syntax representation of a bitstream element "UsacCoreCoderData( )". The bitstream element "UsacCoreCoderData( )" comprises one or more linear-prediction-domain channel streams "lpd_channel_stream( )" and/or one or more frequency domain channel streams "fd_channel_stream( )". Some other control information may optionally also be included in the bitstream element "UsacCoreCoderData( )", as can be seen in FIG. 6*n*.

FIG. 6*o* shows a syntax representation of a bitstream element "fd_channel_stream( )". The bitstream element "fd_channel_stream( )" comprises, among other optional bitstream elements, a bitstream element "scale_factor_data( )" and a bitstream element "ac_spectral_data( )".

FIG. 6*p* shows a syntax representation of a bitstream element "ac_spectral_data( )". The bitstream element "ac_spectral_data( )" optionally comprises a bitstream element "arith_reset_flag". Moreover, the bitstream element also comprises a number of arithmetically encoded data "arith_data( )". The arithmetically encoded data may, for example, follow the bitstream syntax described with reference to FIG. 6*g*.

16. Implementation Alternatives

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a Blue-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

17. Conclusions

To conclude, embodiments according to the invention comprise one or more of the following aspects, wherein the aspects may be used individually or in combination.

a) Context state hashing mechanism

According to an aspect of the invention, the states in the hash table are considered as significant states and group boundaries. This permits to significantly reduce the size of the tables that may be used.

b). Incremental Context Update

According to an aspect, some embodiments according to the invention comprise a computationally efficient manner for updating the context. Some embodiments use an incremental context update in which a numeric current context value is derived from a numeric previous context value.

c). Context Derivation

According to an aspect of the invention, using the sum of two spectral absolute values is association of a truncation. It is a kind of gain vector quantization of the spectral coefficients (as opposition to the conventional shape-gain vector quantization). It aims to limit the context order, while conveying the most meaningful information from the neighborhood.

d) Updated Tables

According to an aspect of the invention, optimized tables ari_hash_m[742], ari_lookup_m[742] and ari_cf_m [64][17], which provide for a particularly good compromise between coding efficiency and computational complexity are applied.

Some other technologies, which are applied in embodiments according to the invention, are described in patent applications PCT EP2010/065725, PCT EP2010/065726, and PCT EP 2010/065727. Moreover, in some embodiments according to the invention, a stop symbol is used. Moreover, in some embodiments, only the unsigned values are considered for the context.

However, the above-mentioned International patent applications disclose aspects which are still in use in some embodiments according to the invention.

For example, an identification of a zero-region is used in some embodiments of the invention. Accordingly, a so-called "small-value-flag" is set (e.g., bit 16 of the numeric current context value c).

In some embodiments, the region-dependent context computation may be used. However, in other embodiments, a region-dependent context computation may be omitted in order to keep the complexity and the size of the tables reasonably small.

Moreover, the context hashing using a hash function is an important aspect of the invention. The context hashing may be based on the two-table concept which is described in the above-referenced non-pre-published International patent applications. However, specific adaptations of the context hashing may be used in some embodiments in order to increase the computational efficiency. Nevertheless, in some other embodiments according to the invention, the context hashing which is described in the above-referenced International patent applications may be used.

Moreover, it should be noted that the incremental context hashing is rather simple and computationally efficient. Also, the context-independence from the sign of the values, which is used in some embodiments of the invention, helps to simplify the context, thereby keeping the memory requirements reasonably low.

In some embodiments of the invention, a context derivation using the sum of two spectral values and a context limitation is used. These two aspects can be combined. Both aim to limit the context order by conveying the most meaningful information from the neighborhood.

In some embodiments, a small-value-flag is used which may be similar to an identification of a group of a plurality of zero values.

In some embodiments according to the invention, an arithmetic stop mechanism is used. The concept is similar to the usage of a symbol "end-of-block" in JPEG, which has a comparable function. However, in some embodiments of the invention, the symbol ("ARITH_STOP") is not included explicitly in the entropy coder. Instead, a combination of already existing symbols, which could not occur previously, is used, i.e. "ESC+0". In other words, the audio decoder is configured to detect a combination of existing symbols, which are not normally used for representing a numeric value, and to interpret the occurrence of such a combination of already existing symbols as an arithmetic stop condition.

An embodiment according to the invention uses a two-table context hashing mechanism.

To further summarize, some embodiments according to the invention may comprise one or more of the following five main aspects.

improved tables;

extended context for detecting either zero-regions or small amplitude regions in the neighborhood;

context hashing;

context state generation: incremental update of the context state; and context derivation: specific quantization of the context values including summation of the amplitudes and limitation.

To further conclude, one aspect of embodiments according to the present invention lies in an incremental context update. Embodiments according to the invention comprise an efficient concept for the update of the context, which avoids the extensive calculations of the working draft (for example, of the working draft 5). Rather, simple shift operations and logic operations are used in some embodiments. The simple context update facilitates the computation of the context significantly.

In some embodiments, the context is independent from the sign of the values (e.g., the decoded spectral values). This independence of the context from the sign of the values brings along a reduced complexity of the context variable. This concept is based on the finding that a neglect of the sign in the context does not bring along a severe degradation of the coding efficiency.

According to an aspect of the invention, the context is derived using the sum of two spectral values. Accordingly, the memory requirements for storage of the context are significantly reduced. Accordingly, the usage of a context value, which represents the sum of two spectral values, may be considered as advantageous in some cases.

Also, the context limitation brings along a significant improvement in some cases. In addition to the derivation of the context using the sum of two spectral values, the entries of the context array "q" are limited to a maximum value of "0xF" in some embodiments, which in turn results in a limitation of the memory requirements. This limitation of the values of the context array "q" brings along some advantages.

In some embodiments, a so-called "small value flag" is used. In obtaining the context variable c (which is also designated as a numeric current context value), a flag is set if the values of some entries "q[1][i−3]" to "q[1][i−1]" are very small. Accordingly, the computation of the context can be performed with high efficiency. A particularly meaningful context value (e.g. numeric current context value) can be obtained.

In some embodiments, an arithmetic stop mechanism is used. The "ARITH_STOP" mechanism allows for an efficient stop of the arithmetic encoding or decoding if there are only zero values left. Accordingly, the coding efficiency can be improved at moderate costs in terms of complexity.

According to an aspect of the invention, a two-table context hashing mechanism is used. The mapping of the context is performed using an interval-division algorithm evaluating the table "ari_hash_m" in combination with a subsequent lookup table evaluation of the table "ari_lookup_m". This algorithm is more efficient than the WD3 algorithm.

In the following, some additional details will be discussed.

It should be noted here that the tables "arith_hash_m[742]" and "arith_lookup_m[742]" are two distinct tables. The first is used to map a single context index (e.g. numeric context value) to a probability model index (e.g., mapping rule index value) and the second is used for mapping a group of consecutive contexts, delimited by the context indices in "arith_hash_m[ ]", into a single probability model.

It should further be noted that table "arith_cf_m sb[64][16]" may be used as an alternative to the table "ari_cf_m[64][17]", even though the dimensions are slightly different. "ari_cf_m[ ][ ]" and "ari_cf_msb[ ][ ]" may refer to the same table, as the $17^{th}$ coefficients of the probability models are invariably zero. It is sometimes not taken into account when counting the space that may be used for storing the tables.

To summarize the above, some embodiments according to the invention provide a proposed new noiseless coding (encoding or decoding), which engenders modifications in the MPEG USAC working draft (for example, in the MPEG USAC working draft 5). Said modifications can be seen in the enclosed figures and also in the related description.

As a concluding remark, it should be noted that the prefix "ari" and the prefix "arith" in names of variables, arrays, functions, and so on, are used interchangeably.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. An audio decoder for providing a decoded audio information on the basis of an encoded audio information, the audio decoder comprising:

an arithmetic decoder for providing a plurality of decoded spectral values on the basis of an arithmetically encoded representation of the spectral values comprised in the encoded audio information; and a frequency-domain-to-time-domain converter for providing a time-domain audio representation using the decoded spectral values, in order to obtain the decoded audio information;

wherein the arithmetic decoder is configured to select a mapping rule describing a mapping of a code value of the arithmetically encoded representation of spectral values representing one or more of the spectral values, or a most significant bit-plane of one or more of the spectral values, in an encoded form, onto a symbol code representing one or more of the spectral values, or a most significant bitplane of one or more of the spectral values, in a decoded form, in dependence on a context state described by a numeric current context value;

wherein the arithmetic decoder is configured to determine the numeric current context value in dependence on a plurality of previously decoded spectral values;

wherein the arithmetic decoder is configured to evaluate a hash table, entries of which define both significant state values amongst the numeric context values and boundaries of intervals of non-significant state values amongst the numeric context values, in order to select the mapping rule, wherein the arithmetic decoder is configured to evaluate the hash table for finding a hash table index value i for which the value ari_hash_m[i]>>8 is equal or greater than c, while, if the found hash table index value i is greater than 0, the value ari_hash_m[i−1]>>8 is lower than c;

wherein the arithmetic decoder is configured to select the mapping rule which is determined by a probability model index which equals to ari_hash_m[i]&0xFF when ari_hash_m[i]>>8 is equal to c, or equals to ari_lookup_m[i] otherwise;

wherein the hash table ari_hash_m is defined as given in FIGS. 22(1), 22(2), 22(3) and 22(4); and wherein the mapping table ari_lookup_m is defined as given in FIG. 21;

wherein a mapping rule index value is individually associated to a numeric context value being a significant state value; and wherein ari_hash_m[i] designates an entry of the hash table ari_hash_m comprising hash table index value i;

wherein the audio decoder is implemented as a hardware apparatus, or a computer, or a combination of a hardware apparatus and a computer.

2. The audio decoder according to claim 1, wherein the arithmetic decoder is configured to evaluate the hash table using the algorithm

```
i = i_min;
while ((i_max−i_min)>1)
{
i = i_min+((i_max−i_min)/2);
j = ari_hash_m[i];
if (c<(j>>8))
      i_max = i;
else if (c>(j>>8))
      i_min=i;
else
      return(j&0xFF);
}
return ari_lookup_m[i_max];
```

wherein c designates a variable representing the numeric current context value or a scaled version thereof;

wherein i is a variable describing a current hash table index value;

wherein i_min is a variable initialized to designate a hash table index value of a first entry of the hash table and selectively updated in dependence on a comparison between c and (j>>8);

wherein the condition "c<(j>>8)" defines that a state value described by the variable c is smaller than a state value described by the table entry ari_hash_m[i];

wherein "j&0xFF" describes a mapping rule index value described by the table entry ari_hash_m[i];

wherein i_max is a variable initialized to designate a hash table index value of a last entry of the hash table and selectively updated in dependence on a comparison between c and (j>>8);

wherein the condition "c>(j>>8)" defines that a state value described by the variable c is larger than a state value described by the table entry ari_hash_m[i];

wherein j is a variable;

wherein the return value designates an index pki of a probability model, and is a mapping rule index value;

wherein ari_hash_m designates the hash table;

wherein ari_hash_m[i] designates an entry of the hash table ari_hash_m comprising hash table index value i;

wherein ari_lookup_m designates a mapping table; and wherein ari_lookup_m[i_max] designates an entry of the mapping table ari_lookup_m comprising mapping table index value i_max.

3. The audio decoder according to claim 1, wherein the arithmetic decoder is configured to select the mapping rule describing a mapping of a code value onto a symbol code on the basis of the mapping rule index value pki.

4. The audio decoder according to claim 3, wherein the arithmetic decoder is configured to use the mapping rule index value as a table index value to select the mapping rule describing a mapping of a code value onto a symbol code.

5. The audio decoder according to claim 1, wherein the arithmetic decoder is configured to select one of the sub-tables of the table ari_cf_m[64][17] as given in FIGS. 23(1), 23(2), 23(3) as the selected mapping rule.

6. The audio decoder according to claim 1, wherein the arithmetic decoder is configured to obtain the numeric current context value on the basis of a numeric previous context value using the algorithm

```
c = c>>4;
if (i<N/4−1)
    c = c + (q[0][i+1]<<12);
c = (c&0xFFF0);
if (i>0)
    c = c + (q[1][i−1]);
if (i > 3) {
    if ((q[1][i−3] + q[1][i−2] + q[1][i−1]) < 5)
        return(c+0x10000);
}
return (c);
```

wherein the algorithm receives, as input values, a value or variable c representing the numeric previous context value, and a value or variable i representing an index of a 2-tuple of spectral values to decode in a vector of spectral values;

wherein a value or variable N represents a window length of a reconstruction window of the frequency-domain-to-time-domain converter; and wherein the algorithm provides, as an output value, an updated value or variable c representing the numeric current context value;

wherein an operation "c>>4" describes a shift to the right by 4 bits of the value or variable c, wherein q[0][i+1] designates a context subregion value associated with a previous audio frame and having associated a higher frequency index i+1, higher by one, than a current frequency index of a 2-tuple of spectral values to be currently decoded; and wherein q[1][i−1] designates a context subregion value associated with a current audio frame and having associated a smaller frequency index i−1, smaller by one, than a current frequency index of a 2-tuple of spectral values to be currently decoded;

wherein q[1][i−2] designates a context subregion value associated with a current audio frame and having associated a smaller frequency index i−2, smaller by two, than a current frequency index of a 2-tuple of spectral values to be currently decoded;

wherein q[1][i−3] designates a context subregion value associated with a current audio frame and having associated a smaller frequency index i−3, smaller by three, than a current frequency index of a 2-tuple of spectral values to be currently decoded.

7. The audio decoder according to claim 6, wherein the arithmetic decoder is configured to update a context subregion value q[1][i] associated with a current audio frame and having associated the current frequency index of the 2-tuple of spectral values currently decoded, using a combination of a plurality of spectral values currently decoded.

8. The audio decoder according to claim 6, wherein the arithmetic decoder is configured to update a context subregion value q[1][i] associated with a current audio frame and having associated the frequency index of a 2-tuple of spectral values currently decoded using an algorithm

```
{
    q[1][i] = a+b+1;
    if (q[1][i]>0xF)
        q[1][i] = 0xF;
}
```

wherein a and b are decoded unsigned quantized spectral coefficients of the 2-tuple currently decoded; and wherein i is the frequency index of the 2-tuple of spectral values currently decoded.

9. The audio decoder according to claim 1, wherein the arithmetic decoder is configured to provide a decoded value m representing a 2-tuple of decoded spectral values using the arithmetic decoding algorithm

```
{
    if (arith_first_symbol( )) {
        value = 0;
        for (i=1; i<=16; i++) {
            value = (value<<1) | arith_get_next_bit( );
        }
        low = 0;
        high = 65535;
    }
    range = high−low+1;
    cum =((((int) (value−low+1))<<14)−((int) 1))/range;
    p = cum_freq−1;
    do {
        q = p + (cfl>>1);
        if ( *q > cum ) { p=q; cfl++; }
        cfl>>=1;
    }
    while ( cfl>1 );
    symbol = p−cum_freq+1;
    if (symbol)
        high = low + (range*cum_freq[symbol−1])>>14 − 1;
    low += (range * cum_freq[symbol])>>14;
    for (;;) {
        if (high<32768) { }
        else if (low>=32768) {
            value −= 32768;
            low −=32768;
            high −= 32768;
        }
        else if (low>=16384 && high<49152) {
            value −= 16384;
            low −= 16384;
            high −= 16384;
        }
        else break;
        low += low;
        high += high+1;
        value = (value<<1) | arith_get_next_bit( );
    }
    return symbol;
}
```

wherein "cum_freq" is a variable describing a start of a selected table or sub-table describing a mapping of a code value onto a symbol code;

wherein "cfl" is a value or variable describing a length of the selected table or sub-table describing a mapping of a code value onto a symbol code;

wherein a helper function arith_first_symbol( ) returns true if a symbol to be decoded is a first symbol of a sequence of symbols, and returns false otherwise;

wherein a helper function get_next_bit( ) provides a next bit of the bitstream;

wherein a variable "low" is a global variable;

wherein a variable "high" is a global variable;

wherein a variable "value" is a global variable;

wherein "range" is a variable;

wherein "cum" is a variable;

wherein "p" is a variable pointing to an element of the selected table or sub-table describing a mapping of a code value onto a symbol code;

wherein "q" is a variable pointing to an element of the selected table or sub-table describing a mapping of a code value onto a symbol code;

wherein "*q" is a table element or sub-table element of the selected table or sub-table describing a mapping of a code value onto a symbol code to which the variable q points;

wherein a variable "symbol" is returned by the arithmetic decoding algorithm; and wherein the arithmetic decoder is configured to derive most-significant-bitplane-values of a currently decoded 2-tuple of spectral values from a return value of the arithmetic decoding algorithm.

10. An audio decoder for providing a decoded audio information on the basis of an encoded audio information, the audio decoder comprising:

an arithmetic decoder for providing a plurality of decoded spectral values on the basis of an arithmetically encoded representation of the spectral values comprised in the encoded audio information; and a frequency-domain-to-time-domain converter for providing a time-domain audio representation using the decoded spectral values, in order to acquire the decoded audio information;

wherein the arithmetic decoder is configured to select a mapping rule describing a mapping of a code value of the arithmetically encoded representation of spectral values representing one or more of the spectral values, or a most significant bit-plane of one or more of the spectral values, in an encoded form, onto a symbol code representing one or more of the spectral values, or a most significant bit-plane of one or more of the spectral values, in a decoded form, in dependence on a context state described by a numeric current context value;

wherein the arithmetic decoder is configured to determine the numeric current context value in dependence on a plurality of previously decoded spectral values;

wherein the arithmetic decoder is configured to evaluate a hash table, entries of which define both significant state values amongst the numeric context values and boundaries of intervals of non-significant state values amongst the numeric context values, in order to select the mapping rule, wherein the hash table ari_hash_m is defined as given in FIGS. 22(1), 22(2), 22(3) and 22(4);

wherein the arithmetic decoder is configured to evaluate the hash table, to determine whether the numeric current context value is identical to a table context value described by an entry of the hash table or to determine an interval described by entries of the hash table within which the numeric current context value lies, and to derive a mapping rule index value describing a selected mapping rule in dependence on a result of the evaluation, wherein a mapping rule index value is individually associated to a numeric context value being a significant state value;

wheren the audio decoder is implemented as a hardware apparatus, or a computer, or a combination of a hardware apparatus and a computer.

11. The audio decoder according to claim 10, wherein the arithmetic decoder is configured to compare the numeric current context value, or a scaled version of the numeric current context value, with a series of the numerically ordered entries or sub-entries of the hash table, to iteratively acquire a hash table index value of a table entry, such that the numeric current context value lies within an interval defined by the acquired hash table entry designated by the acquired hash table index value and an adjacent hash table entry, and wherein the arithmetic decoder is configured to determine a next entry of the series of entries of the hash table in dependence on a result of a comparison between the numeric current context value, or a scaled version of the numeric current context value, and a current entry or sub-entry of the hash table.

12. The audio decoder according to claim 11, wherein the arithmetic decoder is configured to select a mapping rule defined by a second sub-entry of the hash table designated by the current hash table index value if it is found that the numeric current context value or a scaled version thereof is equal to the first sub-entry of the hash table designated by the current hast table index value.

13. The audio decoder according to claim 11, wherein the arithmetic decoder is configured to select a mapping rule defined by an entry or subentry of a mapping table ari_lookup_m if it is not found that the numeric current context value is equal to a sub-entry of the hash table, wherein the arithmetic decoder is configured to choose the entry or sub-entry of the mapping table in dependence on the iteratively acquired hash table index value.

14. The audio decoder according to claim 10, wherein the arithmetic decoder is configured to selectively provide a mapping rule index value defined by the entry of the hash table designated by the current hash table index value if it is found that the numeric current context value equals to a value defined by the entry of the hash table designated by the current hash table index value.

15. A method for providing a decoded audio information on the basis of an encoded audio information, the method comprising:

providing a plurality of decoded spectral values on the basis of an arithmetically encoded representation of the spectral values comprised in the encoded audio information; and providing a time-domain audio representation using the decoded spectral values, in order to acquire the decoded audio information;

wherein providing the plurality of decoded spectral values comprises selecting a mapping rule describing a mapping of a code value of the arithmetically encoded representation of spectral values representing one or more of the spectral values, or a most-significant bit-plan of one or more of the spectral values, in an encoded form, onto a symbol code representing one or more of the spectral values, or a most significant bit-plane of one or more of the spectral values, in a decoded form, in dependence on a context state described by a numeric current context value;

wherein the numeric current context value is determined in dependence on a plurality of previously decoded spectral values;

wherein a hash table, entries of which define both significant state values amongst the numeric context values and boundaries of intervals of non-significant state values amongst the numeric context values, is evaluated in order to select the mapping rule, wherein the hash table is evaluated using the algorithm

```
i = i_min;
while ((i_max−i_min)>1)
{
i = i_min+((i_max−i_min)/2);
j = ari_hash_m[i];
if (c<(j>>8))
    i_max = i;
else if (c>(j>>8))
    i_min=i;
else
    return(j&0xFF);
}
return ari_lookup_m[i_max];
```

wherein c designates a variable representing the numeric current context value or a scaled version thereof;

wherein i is a variable describing a current hash table index value;

wherein i_min is a variable initialized to designate a hash table index value of a first entry of the hash table and selectively updated in dependence on a comparison between c and (j>>8);

wherein the condition "c<(j>>8)" defines that a state value described by the variable c is smaller than a state value described by the table entry ari_hash_m[i];

wherein "j&0xFF" describes a mapping rule index value described by the table entry ari_hash_m[i];

wherein i_max is a variable initialized to designate a hash table index value of a last entry of the hash table and selectively updated in dependence on a comparison between c and (j>>8);

wherein the condition "c>(j>>8)" defines that a state value described by the variable c is larger than a state value described by the table entry ari_hash_m[i];

wherein j is a variable;

wherein the return value designates an index pki of a probability model, and is a mapping rule index value;

wherein ari_hash_m designates the hash table;

wherein ari_hash_m[i] designates an entry of the hash table ari_hash_m comprising hash table index value i;

wherein ari_lookup_m designates a mapping table;

wherein ari_lookup_m[i_max] designates an entry of the mapping table ari_lookup_m comprising mapping table index value i_max;

wherein the hash table ari_hash_m is defined as given in FIGS. 22(1), 22(2), 22(3), 22(4); and wherein the mapping table ari_lookup_m is defined as given in FIG. 21; and wherein a mapping rule index value is individually associated to a numeric context value being a significant state value.

16. A method for providing a decoded audio information on the basis of an encoded audio information, the method comprising:

providing a plurality of decoded spectral values on the basis of an arithmetically encoded representation of the spectral values comprised in the encoded audio information; and providing a time-domain audio representation using the decoded spectral values, in order to acquire the decoded audio information;

wherein providing a plurality of decoded spectral values comprises selecting a mapping rule describing a mapping of a code value of the arithmetically encoded representation of spectral values representing one or more of the spectral values, or a most significant bit-plane of one or more of the spectral values, in an encoded form onto a symbol code representing one or more of the spectral values, or a most significant bit-plane of one or more of the spectral values, in a decoded form, in dependence on a context state described by a numeric current context value;

wherein the numeric current context value is determined in dependence on a plurality of previously decoded spectral values;

wherein a hash table, entries of which define both significant state values amongst the numeric context values and boundaries of intervals of non-significant state values amongst the numeric context values, is evaluated in order to select the mapping rule, wherein the hash table ari_hash_m is defined as given in FIGS. 22(1), 22(2), 22(3) and 22(4);

wherein the hash table is evaluated to determine whether the numeric current context value is identical to a table context value described by an entry of the hash table or to determine an interval described by entries of the hash table within which the numeric current context value lies, and wherein a mapping rule index value describing a selected mapping rule is derived in dependence on a result of the evaluation;

wherein a mapping rule index value is individually associated to a numeric context value being a significant state value.

17. An audio encoder for providing an encoded audio information on the basis of an input audio information, the audio encoder comprising:

an energy-compacting time-domain-to-frequency-domain converter for providing a frequency-domain audio representation on the basis of a time-domain representation of the input audio information, such that the frequency-domain audio representation comprises a set of spectral values; and an arithmetic encoder configured to encode one or more of the spectral values or a preprocessed version thereof using a variable length codeword, wherein the arithmetic encoder is configured to map one or more of the spectral values, or a value of a most significant bit-plane of one or more of the spectral values, onto a code value, wherein the arithmetic encoder is configured to select a mapping rule describing a mapping of the one or more spectral values, or of a most significant bit-plane of the one or more spectral values, onto the code value, in dependence on a context state described by a numeric current context value; and wherein the arithmetic encoder is configured to determine the numeric current context value in dependence on a plurality of previously-encoded spectral values; and wherein the arithmetic encoder is configured to evaluate a hash table, entries of which define both significant state values amongst the numeric context values and boundaries of intervals of non-significant state values amongst the numeric context values, in order to select the mapping rule, wherein the hash table ari_hash_m is defined as given in FIGS. 22(1), 22(2), 22(3) and 22(4);

wherein the arithmetic encoder is configured to evaluate the hash table, to determine whether the numeric current context value is identical to a table context value described by an entry of the hash table or to determine an interval described by entries of the hash table within which the numeric current context value lies, and to derive a mapping rule index value describing a selected mapping rule in dependence on a result of the evaluation;

wherein a mapping rule index value is individually associated to a numeric context value being a significant state value;

wherein the audio encoder is implemented as a hardware apparatus, or a computer, or a combination of a hardware apparatus and a computer.

18. A method for providing an encoded audio information on the basis of an input audio information, the method comprising:

providing a frequency-domain audio representation on the basis of a time-domain representation of the input audio information using an energy-compacting time-domain-to-frequency-domain conversion, such that the frequency-domain audio representation comprises a set of spectral values; and arithmetically encoding one or more of the spectral values or a preprocessed version thereof using a variable length codeword, wherein one or more of the spectral values, or a value of a most significant bit-plane of one or more of the spectral values, is mapped onto a code value, wherein a mapping rule describing a mapping of one or more of the spectral values, or of a most significant bit-plane of one or more of the spectral values, onto a code value, is selected in dependence on a context state described by a numeric current context value; and wherein the numeric current context value is determined in dependence on a plurality of previously-encoded spectral values; and wherein a hash table, entries of which define both significant state values amongst the numeric context values and boundaries of intervals of non-significant state values amongst the numeric context values, is evaluated in order to select the mapping rule, wherein the hash table ari_hash_m is defined as given in FIGS. 22(1), 22(2), 22(3) and 22(4); and wherein the hash table is evaluated, to determine whether the numeric current context value is identical to a table context value described by an entry of the hash table or to determine an interval described by entries of the hash table within which the numeric current context value lies, and wherein a mapping rule index value describing a selected mapping rule is derived in dependence on a result of the evaluation;

wherein a mapping rule index value is individually associated to a numeric context value being a significant state value.

19. A non-transitory computer-readable medium having stored thereon a computer program for performing the method for providing a decoded audio information on the basis of an encoded audio information, the method comprising:

providing a plurality of decoded spectral values on the basis of an arithmetically encoded representation of the spectral values comprised in the encoded audio information; and providing a time-domain audio representation using the decoded spectral values, in order to acquire the decoded audio information;

wherein providing a plurality of decoded spectral values comprises selecting a mapping rule describing a mapping of a code value of the arithmetically encoded representation of spectral values representing one or more of the spectral values, or a most significant bit-plane of one or more of the spectral values, in an encoded form onto a symbol code representing one or more of the spectral values, or a most significant bit-plane of one or more of the spectral values, in a decoded form, in dependence on a context state described by a numeric current context value;

wherein the numeric current context value is determined in dependence on a plurality of previously decoded spectral values;

wherein a hash table, entries of which define both significant state values amongst the numeric context values and boundaries of intervals of non-significant state values amongst the numeric context values, is evaluated in order to select the mapping rule, wherein the hash table ari_hash_m is defined as given in FIGS. 22(1), 22(2), 22(3) and 22(4);

wherein the hash table is evaluated to determine whether the numeric current context value is identical to a table context value described by an entry of the hash table or to determine an interval described by entries of the hash table within which the numeric current context value lies, and wherein a mapping rule index value describing a selected mapping rule is derived in dependence on a result of the evaluation;

wherein a mapping rule index value is individually associated to a numeric context value being a significant state value, when the computer program runs on a computer.

20. A non-transitory computer-readable medium having stored thereon a computer program for performing the method for providing an encoded audio information on the basis of an input audio information, the method comprising:

providing a frequency-domain audio representation on the basis of a time-domain representation of the input audio information using an energy-compacting time-domain-to-frequency-domain conversion, such that the frequency-domain audio representation comprises a set of spectral values; and arithmetically encoding one or more of the spectral values or a preprocessed version thereof using a variable length codeword, wherein one or more of the spectral values, or a value of a most significant bit-plane of one or more of the spectral values, is mapped onto a code value, wherein a mapping rule describing a mapping of one or more of the spectral values, or of a most significant bit-plane of one or more of the spectral values, onto a code value, is selected in dependence on a context state described by a numeric current context value; and wherein the numeric current context value is determined in dependence on a plurality of previously-encoded spectral values; and wherein a hash table, entries of which define both significant state values amongst the numeric context values and boundaries of intervals of non-significant state values amongst the numeric context values, is evaluated in order to select the mapping rule, wherein the hash table ari_hash_m is defined as given in FIGS. 22(1), 22(2), 22(3) and 22(4); and wherein the hash table is evaluated, to determine whether the numeric current context value is identical to a table context value described by an entry of the hash table or to determine an interval described by entries of the hash table within which the numeric current context value lies, and wherein a mapping rule index value describing a selected mapping rule is derived in dependence on a result of the evaluation;

wherein a mapping rule index value is individually associated to a numeric context value being a significant state value, when the computer program runs on a computer.

* * * * *